US007758351B2

(12) United States Patent
Brown et al.

(10) Patent No.: US 7,758,351 B2
(45) Date of Patent: Jul. 20, 2010

(54) METHOD AND SYSTEM FOR BATCH MANUFACTURING OF SPRING ELEMENTS

(75) Inventors: Dirk Dewar Brown, Mountain View, CA (US); John David Williams, Sunnyvale, CA (US); William B. Long, Sunnyvale, CA (US); Tingbao Chen, Cupertino, CA (US)

(73) Assignee: Neoconix, Inc., Sunnyvale, CA (US)

( * ) Notice: Subject to any disclaimer, the term of this patent is extended or adjusted under 35 U.S.C. 154(b) by 0 days.

(21) Appl. No.: 11/787,976

(22) Filed: Apr. 18, 2007

(65) Prior Publication Data

US 2007/0259539 A1 Nov. 8, 2007

Related U.S. Application Data

(63) Continuation-in-part of application No. 11/083,031, filed on Mar. 18, 2005, now Pat. No. 7,597,561, which is a continuation-in-part of application No. 10/412,729, filed on Apr. 11, 2003, now Pat. No. 7,056,131, application No. 11/787,976, which is a continuation-in-part of application No. 11/445,272, filed on Jun. 2, 2006, which is a continuation-in-part of application No. 10/412,729, and a continuation-in-part of application No. 10/731,213, filed on Dec. 8, 2003, now abandoned, application No. 11/787,976, which is a continuation-in-part of application No. 11/649,052, filed on Jan. 3, 2007, now Pat. No. 7,371,073, which is a continuation of application No. 11/445,285, filed on Jun. 2, 2006, now abandoned, which is a continuation-in-part of application No. 10/412,729, filed on Apr. 11, 2003, now Pat. No. 7,056,131, and a continuation-in-part of application No. 10/731,213, filed on Dec. 8, 2003, now abandoned.

(51) Int. Cl.
*H01R 12/00* (2006.01)

(52) U.S. Cl. ..... 439/66

(58) Field of Classification Search ..... 439/66, 439/67, 70–71, 591, 91; 324/755–757; 361/767
See application file for complete search history.

(56) References Cited

U.S. PATENT DOCUMENTS 1,668,011 A 5/1928 Friedmann (Continued)

FOREIGN PATENT DOCUMENTS

EP 0692823 A1 1/1996

(Continued)

OTHER PUBLICATIONS

Kromann, Gary B., et al., "Motorola's PowerPC 603 and PowerPC 604 RISC Microprocessor: the C4/Cermanic-ball-grid Array Interconnect Technology", *Motorola Advanced Packaging Technology*, Motorola Inc.,(1996),1-10 Pgs.

(Continued)

*Primary Examiner*—Jean F Duverne

(57) ABSTRACT

A system for batch forming a sheet of spring elements in three dimensions is described. A spring element sheet containing spring elements defined in two dimensions is arranged between two mating die press plates. A force is applied to the mating die press plates to form the two-dimensional spring contact elements into three dimensions. Alternatively, configurable die press plates are used to selectively form a two-dimensional spring element sheet into three-dimensional spring contacts.

26 Claims, 149 Drawing Sheets

U.S. PATENT DOCUMENTS

| | | | | |
|---|---|---|---|---|
| 3,543,587 | A | 12/1970 | Kawada | |
| 3,670,409 | A | 6/1972 | Reimer | |
| 3,634,807 | A | 12/1972 | Grobe et al. | |
| 3,850,500 | A | 11/1974 | Cobaugh et al. | |
| 4,087,146 | A | 5/1978 | Hudson, Jr. | |
| 4,175,810 | A | 11/1979 | Holt et al. | |
| 4,548,451 | A | 10/1985 | Benarr et al. | |
| 4,592,617 | A | 6/1986 | Seidler | |
| 4,657,336 | A | 4/1987 | Johnson et al. | |
| 4,734,053 | A | 3/1988 | Imai | |
| 4,790,777 | A | 12/1988 | Iimori et al. | |
| 4,893,172 | A | 1/1990 | Matsumoto et al. | |
| 4,998,885 | A | 3/1991 | Beaman | |
| 5,053,083 | A | 10/1991 | Sinton | |
| 5,135,403 | A | 8/1992 | Rinaldi | |
| 5,148,266 | A | 9/1992 | Khandros et al. | |
| 5,152,695 | A | 10/1992 | Grabbe et al. | |
| 5,161,983 | A | 11/1992 | Ohno et al. | |
| 5,173,055 | A * | 12/1992 | Grabbe | 439/66 |
| 5,199,879 | A * | 4/1993 | Kohn et al. | 439/63 |
| 5,228,861 | A | 7/1993 | Grabbe | |
| 5,257,950 | A | 11/1993 | Lenker et al. | |
| 5,292,558 | A | 3/1994 | Heller et al. | |
| 5,299,939 | A | 4/1994 | Walker et al. | |
| 5,316,496 | A | 5/1994 | Imai | |
| 5,338,209 | A | 8/1994 | Brooks et al. | |
| 5,358,411 | A | 10/1994 | Mroczkowski et al. | |
| 5,366,380 | A | 11/1994 | Reymond | |
| 5,380,210 | A | 1/1995 | Grabbe et al. | |
| 5,409,200 | A | 4/1995 | Zingher et al. | |
| 5,423,687 | A | 6/1995 | Laub | |
| 5,468,655 | A | 11/1995 | Greer | |
| 5,483,741 | A | 1/1996 | Akram et al. | |
| 5,509,814 | A | 4/1996 | Mosquera | |
| 5,528,456 | A | 6/1996 | Takahashi | |
| 5,530,288 | A | 6/1996 | Stone | |
| 5,532,612 | A | 7/1996 | Liang | |
| 5,562,487 | A | 10/1996 | Ii et al. | |
| 5,575,662 | A | 11/1996 | Yamamoto et al. | |
| 5,590,460 | A | 1/1997 | DiStefano et al. | |
| 5,593,903 | A | 1/1997 | Beckenbaugh et al. | |
| 5,629,837 | A | 5/1997 | Barabi et al. | |
| 5,632,631 | A | 5/1997 | Fjelstad et al. | |
| 5,634,821 | A | 6/1997 | Crane | |
| 5,691,913 | A | 11/1997 | Tsuchida et al. | |
| 5,751,556 | A | 5/1998 | Butler et al. | |
| 5,772,451 | A | 6/1998 | Dozier, II et al. | |
| 5,791,911 | A | 8/1998 | Fasano et al. | |
| 5,802,699 | A | 9/1998 | Fjelstad et al. | |
| 5,812,378 | A | 9/1998 | Fjelstad et al. | |
| 5,842,273 | A | 12/1998 | Schar | |
| 5,860,585 | A | 1/1999 | Rutledge et al. | |
| 5,896,038 | A | 4/1999 | Budnaitis et al. | |
| 5,903,059 | A | 5/1999 | Bertin et al. | |
| 5,906,498 | A | 5/1999 | Nagafuji | |
| 5,911,597 | A | 6/1999 | Oshitani | |
| 5,934,914 | A | 8/1999 | Fjelstad et al. | |
| 5,938,453 | A | 8/1999 | Ichimura | |
| 5,956,575 | A | 9/1999 | Bertin et al. | |
| 5,967,797 | A | 10/1999 | Maldonado | |
| 5,967,850 | A | 10/1999 | Crane | |
| 5,980,335 | A | 11/1999 | Barbieri et al. | |
| 5,981,870 | A | 11/1999 | Barcley et al. | |
| 5,984,704 | A | 11/1999 | Hashiguchi | |
| 5,989,994 | A | 11/1999 | Khoury et al. | |
| 5,993,247 | A | 11/1999 | Kidd | |
| 6,000,280 | A | 12/1999 | Miller et al. | |
| 6,019,611 | A | 2/2000 | McHugh et al. | |
| 6,027,366 | A | 2/2000 | Mori et al. | |
| 6,029,344 | A | 2/2000 | Khandros et al. | |
| 6,031,282 | A | 2/2000 | Jones et al. | |
| 6,032,356 | A | 3/2000 | Eldridge et al. | |
| 6,042,387 | A | 3/2000 | Jonaidi | |
| 6,044,548 | A | 4/2000 | Distefano et al. | |
| 6,056,572 | A | 5/2000 | Matsumoto et al. | |
| 6,063,640 | A | 5/2000 | Mizukoshi et al. | |
| 6,072,323 | A | 6/2000 | Hembree et al. | |
| 6,083,837 | A | 7/2000 | Millet | |
| 6,084,312 | A | 7/2000 | Lee | |
| 6,089,904 | A | 7/2000 | Wu | |
| 6,133,534 | A | 10/2000 | Fukutomi et al. | |
| 6,142,789 | A | 11/2000 | Nolan et al. | |
| 6,146,151 | A | 11/2000 | Li | |
| 6,156,484 | A | 12/2000 | Bassous et al. | |
| 6,170,808 | B1 | 1/2001 | Kutschi | |
| 6,181,144 | B1 | 1/2001 | Hembree et al. | |
| 6,184,699 | B1 | 2/2001 | Smith et al. | |
| 6,191,368 | B1 | 2/2001 | Di Stefano et al. | |
| 6,196,852 | B1 | 3/2001 | Neumann et al. | |
| 6,200,143 | B1 | 3/2001 | Haba et al. | |
| 6,203,347 | B1 | 3/2001 | Crane, Jr. | |
| 6,204,065 | B1 | 3/2001 | Ochiai | |
| 6,205,660 | B1 | 3/2001 | Fjelstad et al. | |
| 6,208,157 | B1 | 3/2001 | Akram et al. | |
| 6,218,848 | B1 | 4/2001 | Hembree et al. | |
| 6,220,869 | B1 | 4/2001 | Grant et al. | |
| 6,221,750 | B1 | 4/2001 | Fjelstad | |
| 6,224,392 | B1 | 5/2001 | Fasano et al. | |
| 6,250,933 | B1 | 6/2001 | Khoury et al. | |
| 6,255,727 | B1 | 7/2001 | Khoury | |
| 6,255,736 | B1 | 7/2001 | Kaneko | |
| 6,263,566 | B1 | 7/2001 | Hembree et al. | |
| 6,264,477 | B1 | 7/2001 | Smith et al. | |
| 6,293,806 | B1 * | 9/2001 | Yu | 439/66 |
| 6,293,808 | B1 | 9/2001 | Ochiai | |
| 6,297,164 | B1 | 10/2001 | Khoury et al. | |
| 6,298,552 | B1 | 10/2001 | Li | |
| 6,300,782 | B1 | 10/2001 | Hembree et al. | |
| 6,306,752 | B1 | 10/2001 | DiStefano et al. | |
| 6,315,616 | B1 | 11/2001 | Hayashi | |
| 6,332,801 | B1 | 12/2001 | Watanbe | |
| 6,335,210 | B1 | 1/2002 | Farooq et al. | |
| 6,336,269 | B1 | 1/2002 | Eldridge et al. | |
| 6,337,575 | B1 | 1/2002 | Akram | |
| 6,345,987 | B1 | 2/2002 | Mori et al. | |
| 6,352,436 | B1 | 3/2002 | Howard | |
| 6,361,328 | B1 | 3/2002 | Gosselin | |
| 6,373,267 | B1 | 4/2002 | Hiroi | |
| 6,374,487 | B1 | 4/2002 | Haba et al. | |
| 6,375,474 | B1 | 4/2002 | Harper, Jr. et al. | |
| 6,384,475 | B1 | 5/2002 | Beroz et al. | |
| 6,386,905 | B1 | 5/2002 | Ito | |
| 6,392,524 | B1 | 5/2002 | Biegelsen et al. | |
| 6,392,534 | B1 | 5/2002 | Flick | |
| 6,397,460 | B1 | 6/2002 | Hembree et al. | |
| 6,399,900 | B1 | 6/2002 | Khoury et al. | |
| 6,402,526 | B1 | 6/2002 | Schreiber et al. | |
| 6,409,521 | B1 | 6/2002 | Rathburn | |
| 6,420,661 | B1 | 7/2002 | Di Stefano et al. | |
| 6,420,789 | B1 | 7/2002 | Tay et al. | |
| 6,420,884 | B1 | 7/2002 | Khoury et al. | |
| 6,428,328 | B2 | 8/2002 | Haba et al. | |
| 6,431,881 | B1 | 8/2002 | Engbring et al. | |
| 6,436,802 | B1 | 8/2002 | Khoury | |
| 6,437,591 | B1 | 8/2002 | Farnworth et al. | |
| 6,442,039 | B1 | 8/2002 | Schreiber | |
| 6,447,305 | B1 | 9/2002 | Roberts | |
| 6,452,407 | B2 | 9/2002 | Khoury et al. | |
| 6,454,573 | B2 | 9/2002 | Hayashi et al. | |
| 6,461,892 | B2 | 10/2002 | Beroz | |
| 6,465,748 | B2 | 10/2002 | Yamanashi et al. | |
| 6,472,890 | B2 | 10/2002 | Khoury et al. | |
| 6,474,997 | B1 | 11/2002 | Ochiai | |
| 6,492,251 | B1 | 12/2002 | Haba et al. | |

6,497,581 B2 12/2002 Slocum et al.
6,517,362 B2 2/2003 Hirai et al.
6,520,778 B1 2/2003 Eldridge et al.
6,524,115 B1 2/2003 Gates et al.
6,551,112 B1 4/2003 Li et al.
6,558,187 B2 5/2003 Aoki
6,576,485 B2 6/2003 Zhou et al.
6,577,003 B1 6/2003 Crane et al.
6,604,950 B2 8/2003 Maldonado et al.
6,612,861 B2 9/2003 Khoury et al.
6,616,966 B2 9/2003 Mathieu et al.
6,622,380 B1 9/2003 Grigg
6,627,092 B2 9/2003 Clements et al.
6,640,432 B1 11/2003 Mathieu et al.
6,661,247 B2 12/2003 Maruyama et al.
6,663,399 B2 12/2003 Ali et al.
6,664,131 B2 12/2003 Jackson
6,669,489 B1 12/2003 Dozier, II et al.
6,671,947 B2 1/2004 Bohr
6,672,879 B2 1/2004 Neidich et al.
6,677,245 B2 1/2004 Zhou et al.
6,692,263 B2 2/2004 Villain et al.
6,692,265 B2 2/2004 Kung et al.
6,700,072 B2 3/2004 Distefano et al.
6,701,612 B2 3/2004 Khandros et al.
6,719,569 B2 4/2004 Ochiai
6,730,134 B2 5/2004 Neidich
6,733,326 B2 5/2004 Lee
6,736,664 B2 5/2004 Ueda et al.
6,736,665 B2 5/2004 Zhou et al.
6,749,459 B2 6/2004 Urbaniak et al.
6,750,136 B2 6/2004 Zhou et al.
6,750,551 B1 6/2004 Frutschy et al.
6,763,581 B2 7/2004 Hirai et al.
6,791,171 B2 9/2004 Mok et al.
6,814,584 B2 11/2004 Zaderej
6,814,587 B2 11/2004 Ma
6,815,961 B2 11/2004 Mok et al.
6,821,129 B2 11/2004 Tsuchiya
6,843,659 B2 1/2005 Liao et al.
6,847,101 B2 1/2005 Fjelstad et al.
6,848,173 B2 2/2005 Fjelstad et al.
6,848,929 B2 2/2005 Ma
6,853,210 B1 2/2005 Farnworth et al.
6,855,002 B2 2/2005 Chiu
6,857,880 B2 2/2005 Ohtsuki et al.
6,869,290 B2 3/2005 Brown et al.
6,869,307 B2 3/2005 Endo
6,881,070 B2 4/2005 Chiang
6,887,085 B2 5/2005 Hirai
6,898,580 B1 5/2005 Curran et al.
6,898,773 B1 5/2005 Teig et al.
6,902,425 B2 6/2005 Huang
6,916,181 B2 7/2005 Brown et al.
6,920,689 B2 7/2005 Khandros et al.
6,923,656 B2 8/2005 Novotny et al.
6,926,536 B2 8/2005 Ochiai
6,939,143 B2 9/2005 Rathburn
6,957,963 B2 10/2005 Rathburn
6,960,924 B2 11/2005 Akram
6,976,888 B2 12/2005 Shirai
6,980,017 B1 12/2005 Farnworth et al.
6,995,557 B2 2/2006 Goldfine et al.
6,995,577 B2 2/2006 Farnworth et al.
7,001,208 B2 2/2006 Huang
7,002,362 B2 2/2006 Farnworth et al.
7,004,775 B1 2/2006 Sakurai et al.
7,009,413 B1 3/2006 Alghouli
7,021,941 B1 4/2006 Chuang et al.
7,021,970 B2 4/2006 Ozai
7,025,601 B2 4/2006 Dittmann
D521,455 S 5/2006 Radza
D521,940 S 5/2006 Radza
7,048,548 B2 5/2006 Mathieu et al.
7,053,482 B2 5/2006 Cho
D522,461 S 6/2006 Radza
D522,972 S 6/2006 Long et al.
7,056,131 B1 6/2006 Williams
7,063,560 B2 6/2006 Asao
D524,756 S 7/2006 Radza
7,070,419 B2 7/2006 Brown et al.
7,074,074 B2 7/2006 Zhang et al.
7,083,425 B2 8/2006 Chong et al.
7,086,869 B1 8/2006 Dangler et al.
7,090,503 B2 8/2006 Dittmann
7,097,496 B2 8/2006 Zhang et al.
7,112,089 B1 9/2006 Liu et al.
7,113,408 B2 9/2006 Brown et al.
7,114,961 B2 10/2006 Williams
7,140,883 B2 11/2006 Khandros et al.
7,189,090 B2 3/2007 Aizawa et al.
7,210,942 B2 5/2007 Uchida et al.
7,238,044 B2 7/2007 Uchida et al.
7,244,125 B2 7/2007 Brown et al.
7,245,137 B2 * 7/2007 Eldridge et al. ..... 324/755
7,252,540 B2 8/2007 Tanaka
7,261,569 B2 8/2007 Uchida et al.
7,261,595 B2 8/2007 Shino
7,263,771 B2 9/2007 Ochiai
7,285,015 B2 10/2007 Helbok et al.
7,371,073 B2 * 5/2008 Williams ..... 439/66
7,597,561 B2 10/2009 Radza et al.
2001/0001080 A1 5/2001 Eldridge et al.
2001/0024890 A1 9/2001 Maruyama et al.
2002/0006744 A1 1/2002 Tashiro
2002/0008966 A1 1/2002 Fjelstad et al.
2002/0011859 A1 1/2002 Smith et al.
2002/0055282 A1 5/2002 Eldridge et al.
2002/0055289 A1 5/2002 Murakami et al.
2002/0058356 A1 5/2002 Oya
2002/0079120 A1 6/2002 Eskildsen et al.
2002/0117330 A1 8/2002 Eldridge et al.
2002/0129866 A1 9/2002 Czebatul et al.
2002/0129894 A1 9/2002 Liu et al.
2002/0133941 A1 9/2002 Akram et al.
2002/0146919 A1 10/2002 Cohn
2002/0178331 A1 11/2002 Beardsley et al.
2003/0000739 A1 1/2003 Frutschy et al.
2003/0003779 A1 1/2003 Rathburn
2003/0022503 A1 1/2003 Clements et al.
2003/0035277 A1 2/2003 Saputro et al.
2003/0049951 A1 3/2003 Eldridge et al.
2003/0064635 A1 4/2003 Ochiai
2003/0089936 A1 5/2003 McCormack et al.
2003/0092293 A1 5/2003 Ohtsuki et al.
2003/0096512 A1 5/2003 Cornell
2003/0099097 A1 5/2003 Mok et al.
2003/0129866 A1 7/2003 Romano et al.
2003/0147197 A1 8/2003 Uriu et al.
2003/0194832 A1 10/2003 Lopata et al.
2004/0029411 A1 2/2004 Rathburn
2004/0033717 A1 2/2004 Peng
2004/0072467 A1 4/2004 Jordan et al.
2004/0118603 A1 6/2004 Chambers
2004/0127073 A1 7/2004 Ochiai
2005/0088193 A1 4/2005 Haga
2005/0099193 A1 5/2005 Burgess
2005/0142900 A1 6/2005 Boggs et al.
2005/0167816 A1 8/2005 Khandros et al.
2005/0208788 A1 9/2005 Dittmann
2005/0287828 A1 12/2005 Stone et al.
2006/0028222 A1 2/2006 Farnworth et al.
2006/0281361 A1 12/2006 Uchida et al.
2007/0054544 A1 3/2007 Hirata
2007/0054545 A1 3/2007 Takahira
2007/0105433 A1 5/2007 Shioda et al.

| | | | | |
|---|---|---|---|---|
| 2007/0123074 | A1 | 5/2007 | Nishimura | |
| 2007/0134949 | A1 | 6/2007 | Dittmann | |
| 2007/0178751 | A1 | 8/2007 | Yamamoto | |
| 2007/0269997 | A1* | 11/2007 | Eldridge et al. | 439/66 |
| 2007/0275579 | A1 | 11/2007 | Si et al. | |
| 2008/0045076 | A1 | 2/2008 | Dittmann et al. | |
| 2008/0050958 | A1 | 2/2008 | Hashiguchi et al. | |
| 2008/0076282 | A1 | 3/2008 | Yamaji et al. | |

FOREIGN PATENT DOCUMENTS

| | | | |
|---|---|---|---|
| EP | 1005086 | A2 | 5/2000 |
| EP | 1280241 | A1 | 1/2003 |
| EP | 0692823 | B1 | 2/2003 |
| EP | 10050861 | B1 | 9/2003 |
| EP | 0839321 | B1 | 1/2006 |
| JP | 2000-114433 | | 4/2000 |
| JP | 2001-203435 | | 7/2001 |
| WO | WO-9602068 | A1 | 1/1996 |
| WO | WO-9743653 | A1 | 11/1997 |
| WO | WO-9744859 | A1 | 11/1997 |
| WO | WO-0213253 | A1 | 2/2002 |
| WO | WO-2005034296 | A1 | 4/2005 |
| WO | WO-2005036940 | A1 | 4/2005 |
| WO | WO-2005067361 | A1 | 7/2005 |
| WO | WO 20080131097 | A2 | 10/2008 |
| WO | WO 20080131097 | A3 | 10/2008 |

OTHER PUBLICATIONS

Mahajan, Ravi , et al., "Emerging Directions for packaging Technologies", *Intel Technology Journal*, V. 6, Issue 02, (May 16, 2002),62-75 Pgs.

Williams, John D., "Contact Grid Array System", *Patented Socketing System for the BGA/CSP Technology*, E-tec Interconnect Ltd.,(Jun. 2006),1-4 Pgs.

* cited by examiner

SUBSTRATE WITH CIRCUITRY $$\delta_{max} = \frac{P L^3}{3 E \frac{b h^3}{12}}$$

LOAD-DISPLACEMENT-RESISTANCE PLOT

LOAD-DISPLACEMENT PLOT

Fig. 66

DISTRIBUTIONS

FR0111 PARTIAL ETCH-FULL ETCH

FRFEF

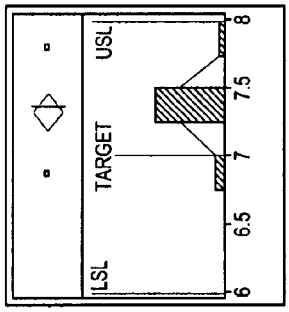

NORMAL (7.3555, 0.19

MOMENTS

| | |
|---|---|
| MEAN | 7.3555 |
| STD DEV | 0.1930769 |
| STD ERR MEAN | 0.0431733 |
| UPPER 95% MEAN | 7.4458628 |
| LOWER 95% MEAN | 7.2651372 |
| N | 20 |

CAPABILITY ANALYSIS

| SPECIFICATION | VALUE | PORTION | % ACTUAL |
|---|---|---|---|
| LOWER SPEC LIMIT | 6 | BELOW LSL | 0.0000 |
| UPPER SPEC LIMIT | 8 | ABOVE USL | 0.0000 |
| SPEC TARGET | 7 | TOTAL OUTSIDE | 0.0000 |

OVERALL, SIGMA=0.19308

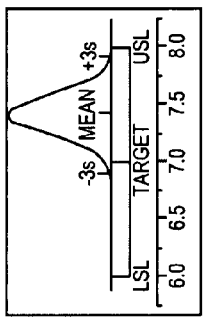

| CAPABILITY | INDEX | LOWER CI | UPPER CI |
|---|---|---|---|
| CP | 1.726 | 1.182 | 2.270 |
| CPK | 1.113 | 0.691 | 1.534 |
| CPM | 0.824 | 0.612 | 1.036 |
| CPL | 2.340 | | |
| CPU | 1.113 | | |

| PORTION | PERCENT | PPM |
|---|---|---|
| BELOW LSL | 0.0000 | 0.0000 |
| ABOVE USL | 0.0422 | 421.8452 |
| TOTAL OUTSIDE | 0.0422 | 421.8452 |

DISTRIBUTIONS

FRPEF

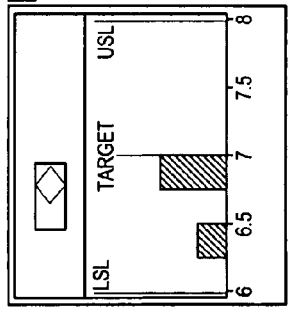

QUANTILES

| | | |
|---|---|---|
| 100.0% | MAXIMUM | 6.8900 |
| 99.5% | | 6.8900 |
| 97.5% | | 6.8900 |
| 90.0% | | 6.8900 |
| 75.0% | QUARTILE | 6.8900 |
| 50.0% | MEDIAN | 6.8900 |
| 25.0% | QUARTILE | 6.4000 |
| 10.0% | | 6.4000 |
| 2.5% | | 6.4000 |
| 0.5% | | 6.4000 |
| 0.0% | MINIMUM | 6.4000 |

MOMENTS

| | |
|---|---|
| MEAN | 6.473 |
| STD DEV | 0.2303795 |
| STD ERR MEAN | 0.0515144 |
| UPPER 95% MEAN | 6.8508209 |
| LOWER 95% MEAN | 6.6351791 |
| N | 20 |

CAPABILITY ANALYSIS

| SPECIFICATION | VALUE | PORTION | % ACTUAL |
|---|---|---|---|
| LOWER SPEC LIMIT | 6 | BELOW LSL | 0.0000 |
| UPPER SPEC LIMIT | 8 | ABOVE USL | 0.0000 |
| SPEC TARGET | 7 | TOTAL OUTSIDE | 0.0000 |

OVERALL, SIGMA=0.23038

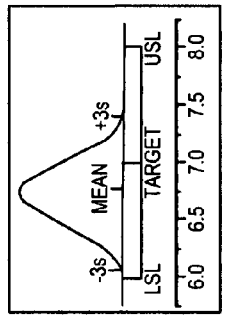

| CAPABILITY | INDEX | LOWER CI | UPPER CI |
|---|---|---|---|
| CP | 1.447 | 0.991 | 1.903 |
| CPK | 1.075 | 0.666 | 1.484 |
| CPM | 0.966 | 0.710 | 1.221 |
| CPL | 1.075 | | |
| CPU | 1.819 | | |

| PORTION | PERCENT | PPM |
|---|---|---|
| BELOW LSL | 0.0630 | 629.6155 |
| ABOVE USL | 0.0000 | 0.0243 |
| TOTAL OUTSIDE | 0.0630 | 629.6399 |

Fig. 67

DISTRIBUTIONS

LF0111 PARTIAL ETCH-FULL ETCH

LFFEF

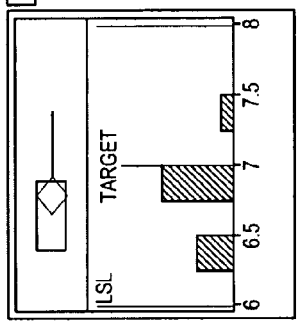

QUANTILES

| | | |
|---|---|---|
| 100.0% | MAXIMUM | 7.3800 |
| 99.5% | | 7.3800 |
| 97.5% | | 7.3800 |
| 90.0% | | 7.3310 |
| 75.0% | QUARTILE | 6.8900 |
| 50.0% | MEDIAN | 6.8900 |
| 25.0% | QUARTILE | 6.4000 |
| 10.0% | | 6.4000 |
| 2.5% | | 6.4000 |
| 0.5% | | 6.4000 |
| 0.0% | MINIMUM | 6.4000 |

MOMENTS

| | |
|---|---|
| MEAN | 6.792 |
| STD DEV | 0.3016376 |
| STD ERR MEAN | 0.0674482 |
| UPPER 95% MEAN | 6.9331708 |
| LOWER 95% MEAN | 6.6508292 |
| N | 20 |

CAPABILITY ANALYSIS

| SPECIFICATION | VALUE | PORTION | % ACTUAL |
|---|---|---|---|
| LOWER SPEC LIMIT | 6 | BELOW LSL | 0.0000 |
| UPPER SPEC LIMIT | 8 | ABOVE USL | 0.0000 |
| SPEC TARGET | 7 | TOTAL OUTSIDE | 0.0000 |

OVERALL, SIGMA=0.30164

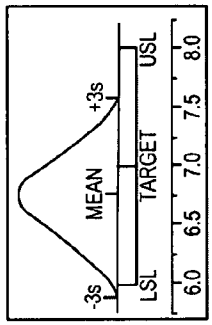

| CAPABILITY | INDEX | LOWER CI | UPPER CI |
|---|---|---|---|
| CP | 1.105 | 0.757 | 1.453 |
| CPK | 0.875 | 0.530 | 1.220 |
| CPM | 0.910 | 0.658 | 1.161 |
| CPL | 0.875 | | |
| CPU | 1.335 | | |

| PORTION | PERCENT | PPM |
|---|---|---|
| BELOW LSL | 0.4324 | 4323.9682 |
| ABOVE USL | 0.0031 | 31.0343 |
| TOTAL OUTSIDE | 0.4355 | 4355.0024 |

DISTRIBUTIONS

LFPEF

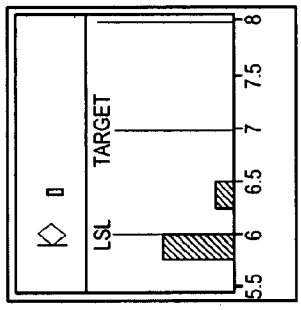

QUANTILES

| | | |
|---|---|---|
| 100.0% | MAXIMUM | 6.4000 |
| 99.5% | | 6.4000 |
| 97.5% | | 6.4000 |
| 90.0% | | 6.4000 |
| 75.0% | QUARTILE | 5.9100 |
| 50.0% | MEDIAN | 5.9100 |
| 25.0% | QUARTILE | 5.9100 |
| 10.0% | | 5.9100 |
| 2.5% | | 5.9100 |
| 0.5% | | 5.9100 |
| 0.0% | MINIMUM | 5.9100 |

MOMENTS

| | |
|---|---|
| MEAN | 6.008 |
| STD DEV | 0.2010918 |
| STD ERR MEAN | 0.0449655 |
| UPPER 95% MEAN | 6.1021138 |
| LOWER 95% MEAN | 5.9138862 |
| N | 20 |

CAPABILITY ANALYSIS

| SPECIFICATION | VALUE | PORTION | % ACTUAL |
|---|---|---|---|
| LOWER SPEC LIMIT | 6 | BELOW LSL | 80.0000 |
| UPPER SPEC LIMIT | 8 | ABOVE USL | 0.0000 |
| SPEC TARGET | 7 | TOTAL OUTSIDE | 80.0000 |

OVERALL, SIGMA=0.30164

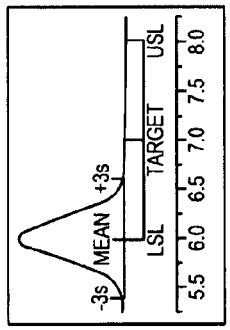

| CAPABILITY | INDEX | LOWER CI | UPPER CI |
|---|---|---|---|
| CP | 1.658 | 1.135 | 2.180 |
| CPK | 0.013 | -0.141 | 0.168 |
| CPM | 0.329 | 0.246 | 0.412 |
| CPL | 0.013 | | |
| CPU | 3.302 | | |

| PORTION | PERCENT | PPM |
|---|---|---|
| BELOW LSL | 48.4133 | 484133.13 |
| ABOVE USL | 0.0000 | 0.0000 |
| TOTAL OUTSIDE | 48.4133 | 484133.13 |

METHOD AND SYSTEM FOR BATCH MANUFACTURING OF SPRING ELEMENTS

This applications is a continuation-in-part of U.S. patent application Ser. No. 11/083,031, filed Mar. 18, 2005, now U.S. Pat. No. 7,597,561 which is incorporated herein by reference in its entirety for all purposes and which in turn is a continuation-in-part of U.S. patent application Ser. No. 10/412,729, filed Apr. 11, 2003 now U.S. Pat. No. 7,056,131.

This application is also a continuation-in-part of U.S. patent application Ser. No. 11/445,272, filed Jun. 2, 2006, which is incorporated herein by reference in its entirety for all purposes and which in turn is a continuation-in-part of U.S. patent application Ser. No. 10/412,729, filed Apr. 11, 2003, now U.S. Pat. No. 7,056,131 and is a continuation in part of U.S. patent application Ser. No. 10/731,213 filed Dec. 8, 2003 now abandoned.

This application is also a continuation-in-part of U.S. patent application Ser. No. 11/649,052 filed Jan. 3, 2007 now U.S. Pat. No. 7,371,073 which is incorporated herein by reference in its entirety for all purposes and which is a continuation of U.S. patent application Ser. No. 11/445,285 filed Jun. 2, 2006 now abandoned which in turn is a continuation-in-part of prior U.S. patent application Ser. No. 10/412,729 filed Apr. 11, 2003 now U.S. Pat. No. 7,056,131 and U.S. patent application Ser. No. 10/731,213 filed Dec. 18, 2003 now abandoned.

BACKGROUND

1. Field of the Invention

The present invention relates to manufacturing spring elements using a batch process.

2. Background of the Invention

Electrical interconnects or connectors are used to connect two or more electronic components together or to connect an electronic component to a piece of electrical equipment, such as a computer, router, or tester. The term "electronic component" includes, but is not limited to, printed circuit boards, and the connector can be a board-to-board connector. For instance, an electrical interconnect is used to connect an electronic component, such as an integrated circuit (an IC or a chip), to a printed circuit board. An electrical interconnect is also used during integrated circuit manufacturing for connecting an IC device under test to a test system. In some applications, the electrical interconnect or connector provides a separable or remountable connection so that the electronic component attached thereto can be removed and reattached. For example, it may be desirable to mount a packaged microprocessor chip to a personal computer motherboard using a separable interconnect device so that malfunctioning chips can be readily removed, or upgraded chips can be readily installed.

There are also applications where an electrical connector is used to make direct electrical connection to metal pads formed on a silicon wafer. Such an electrical connector is often referred to as a "probe" or "probe card" and is typically used during the testing of the wafer during the manufacturing process. The probe card, typically mounted on a tester, provides electrical connection from the tester to the silicon wafer so that individual integrated circuits formed on the wafer can be tested for functionality and compliance with specific parametric limits.

Conventional electrical connectors are usually made of stamped metal springs, which are formed and then individually inserted into an insulating carrier to form an array of electrical connection elements. Other approaches to making electrical connectors include using isotropically conductive adhesives, injection molded conductive adhesives, bundled wire conductive elements, springs formed by wirebonding techniques, and small solid pieces of metal.

Land grid array (LGA) refers to an array of metal pads (also called lands) that are used as the electrical contact points for an integrated circuit package, a printed circuit board, or other electronic component. The metal pads are usually formed using thin film deposition techniques and are coated with gold to provide a non-oxidizing surface. Ball grid array (BGA) refers to an array of solder balls or solder bumps that are used as the electrical contact points for an integrated circuit package. Both LGA and BGA packages are widely used in the semiconductor industry and each has its associated advantages or disadvantages. An LGA connector is usually used to provide removable and remountable socketing capability for LGA packages connected to PC boards or to chip modules.

Conventional interconnect devices, such as stamped metal springs, bundled wire, and injection molded conductive adhesives, become difficult to manufacture as the dimensions are scaled down. Stamped metal spring elements, in particular, become brittle and difficult to manufacture as the dimensions are scaled down, rendering them unsuitable for accommodating electronic components with normal positional variations. This is particularly true when the spacing between the contacts scales below one millimeter, as well as where the electrical path length requirement also scales to below one millimeter to minimize inductance and meet high frequency performance requirements. At this size, spring elements made by existing manufacturing technologies become even more brittle and less elastic and cannot accommodate normal variations in system coplanarity and positional misalignments with a reasonable insertion force of about 30 to 40 grams per contact.

DESCRIPTION OF THE DRAWINGS

FIGS. 66 and 67 are data sheets that illustrate the effect of changing the adhesive type and flow restrictor configuration on elastic contact working range.

DETAILED DESCRIPTION

Figure 1:
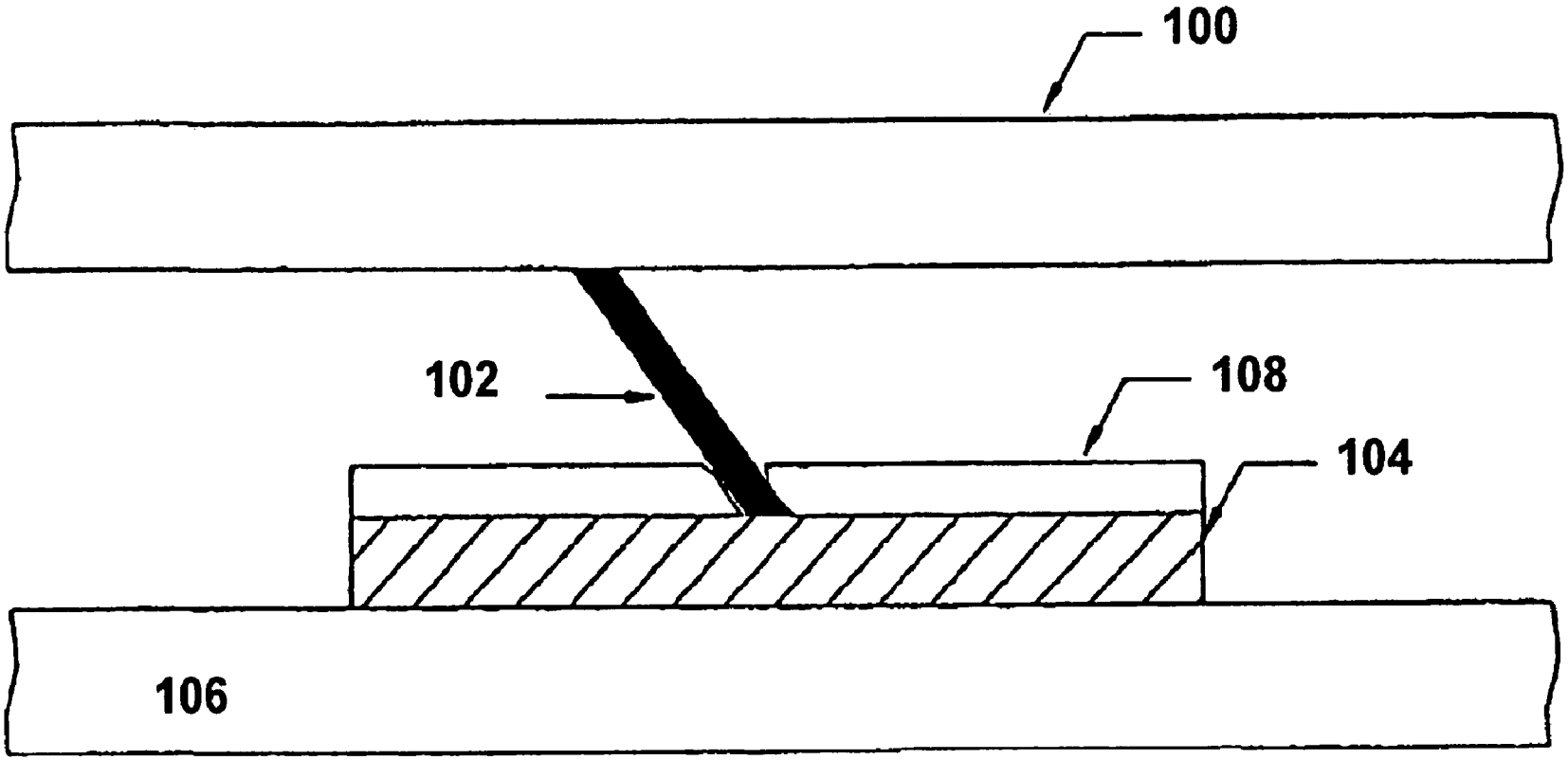
FIG. 1 is a schematic diagram of an existing contact element engaging a metal pad on a substrate.
Figure 2A:
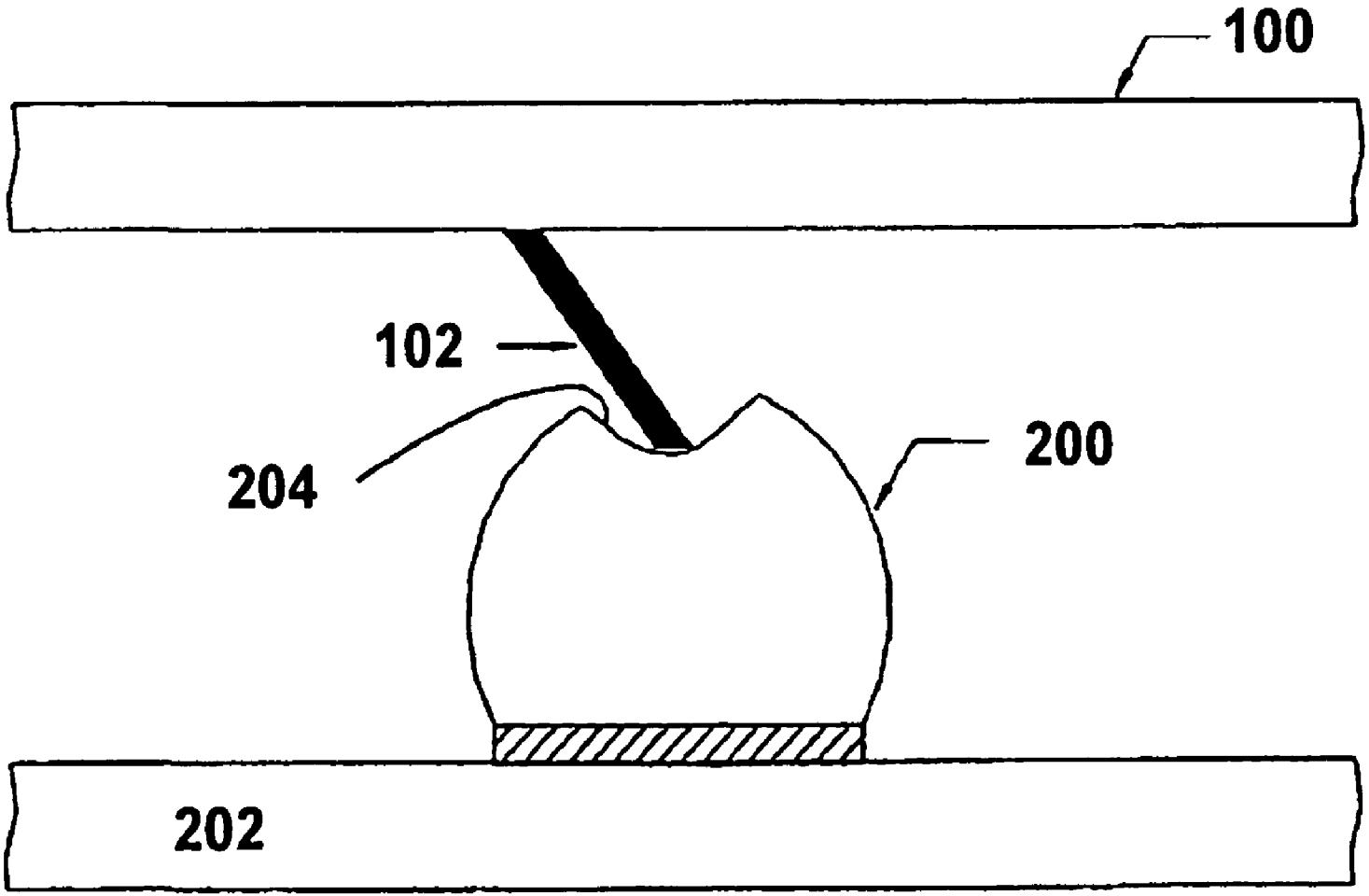
FIG. 2*a* is schematic diagram of an existing contact element contacting a solder ball.
Figure 2B:
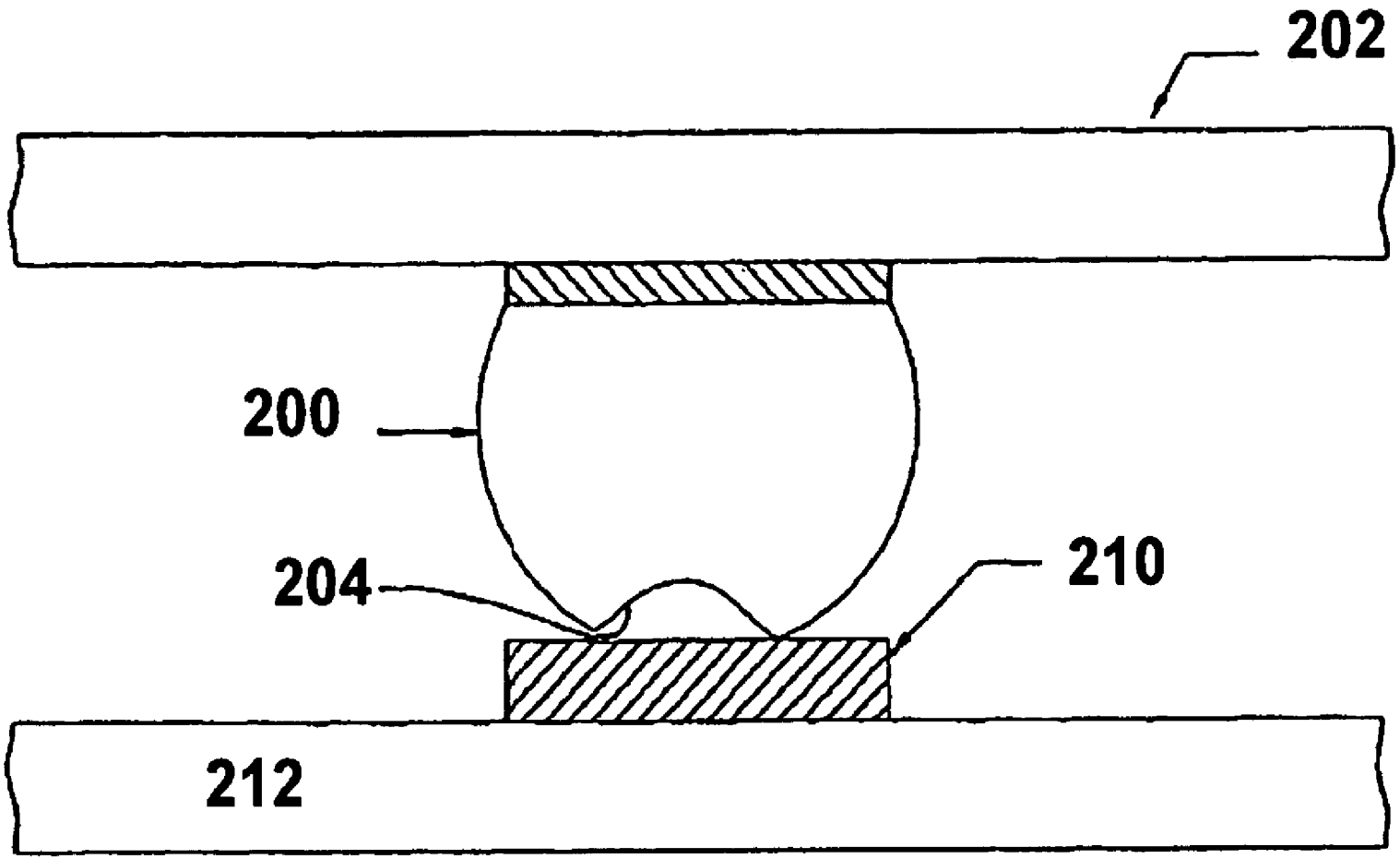
FIGS. 2*b* and 2*c* are schematic diagrams illustrating the result of attaching a damaged solder ball to a metal pad of a substrate.
Figure 2C:
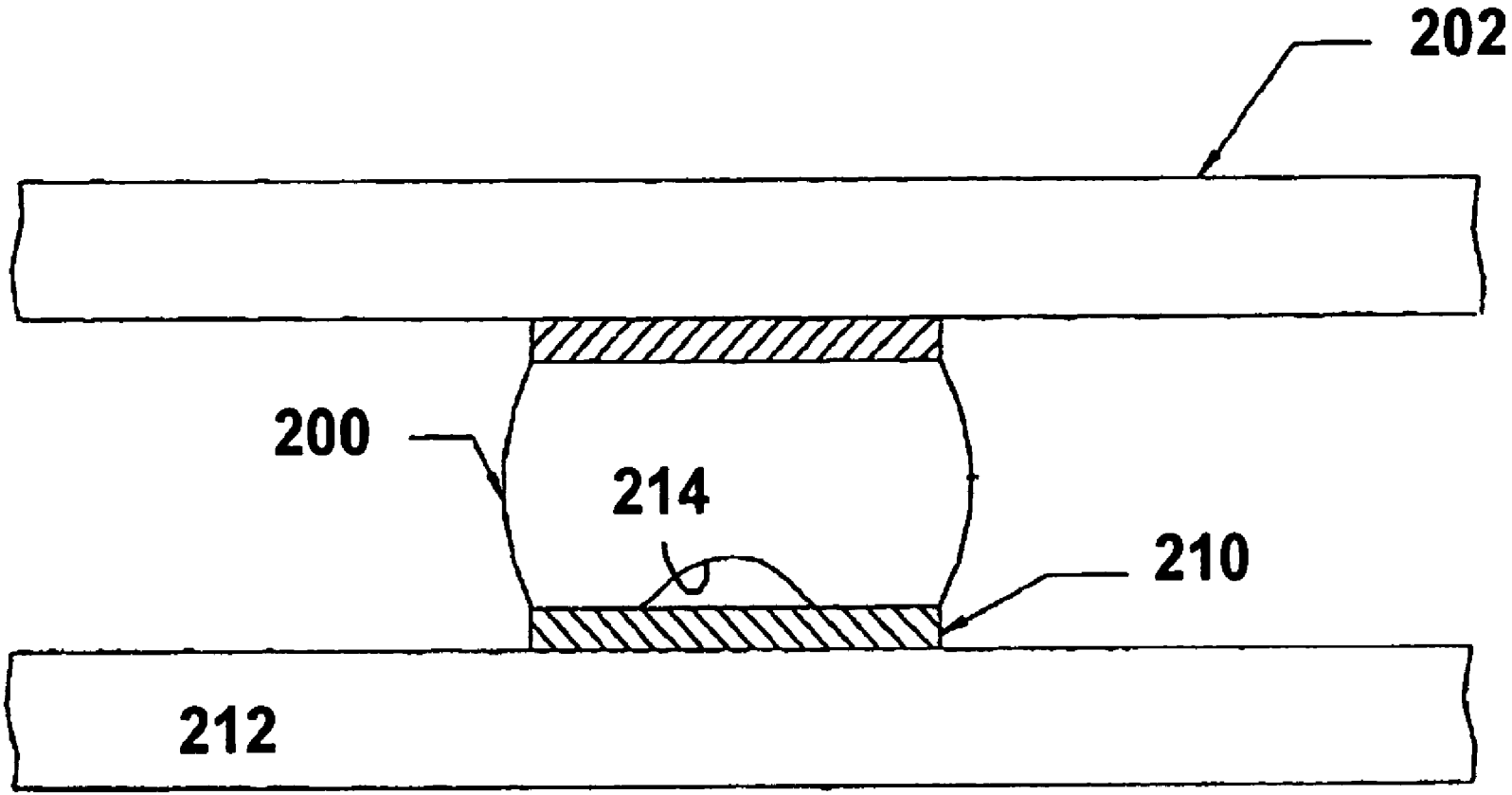

Aspects of the present invention are related to methods for fabricating electrical connectors by lithographic patterning of metallic layers to form an array or arrays of contact elements. The metallic layers can be applied to a connector substrate before patterning to form the contact elements, or can be free standing layers that are subjected to patterning before joining to the connector substrates. In general, the contacts can be formed from a single layer of metallic material, but can also be formed from multiple layers of the same material, or of different materials, in which one or more layers can be added to the contacts after a metallic layer is patterned to form a contact array. Connectors formed by these methods include substrates having a contact array disposed on a single side, or having contact arrays disposed on both sides, such as interposers.

Connector elements and interposer layers fabricated according to aspects of the present invention can be produced using one or more of the guidelines set forth below.

Choice of metal for the metallic contacts can be guided by the desired combination of properties for the contact. Examples include choice of material for a core region of the metallic contact to impart the desired elastic properties. Cu, Cu-alloys, and stainless steel are examples of metallic materials that may form a core region of a contact. For example, a stainless steel or Cu-alloy layer can be chosen as a core layer from which to form a contact, due to the strong mechanical elasticity; an intermediate Cu layer can chosen to coat the core layer because of the good conductivity of pure Cu; and an Au or Au-alloy layer can be chosen as an outer layer for low interface resistance and good corrosion resistance.

The choice of a dielectric (electrically insulating) or semiconducting material for the contact array substrate is guided by the particular application. Exemplary configurations of the present invention include connectors having FR4, polymer, ceramic, and semiconductor substrates.

Other configurations of the invention include connectors having multiple, redundant conductive contacts to improve electrical connection between components that are coupled using the connector.

Inclusion of extra structural features in contacts can be chosen to improve performance. In some configurations of the present invention, for example, elastic contacts having asperities are fabricated to improve electrical contact to an external electrical component. The asperities on a contact facilitate making good electrical contact by providing concentrated force to break through any passivation layers covering a conductive surface being engaged by the contact.

The choice of the mix of contact types used in a connector fabricated in accordance with the present invention is generally guided by the particular application. For example, it may be desirable to have the same type of elastic contacts on both sides of the interposer substrate to connect similar components on either side of the interposer. On the other hand, it may be desirable to use solder, conductive adhesive, or some other electrical contact method on one side of a double sided connector, and an elastic contact array on the other side of the connector.

The inclusion of additional features, such as metallic features, within a connector substrate is also guided by the particular application for the connector. For example, additional metal planes or circuits may be chosen for inclusion within the interior of the connector substrate in the case where good thermal dissipation is desired. Inclusion of additional metal planes or circuits within the connector may be guided by the need for electrical shielding, power delivery, addition of electronic components, or otherwise improving the electrical performance of the connector.

The discussion to immediately follow discloses methods for forming electrical connectors containing arrays of elastic contacts, in accordance with aspects of the present invention.

Figure 3:
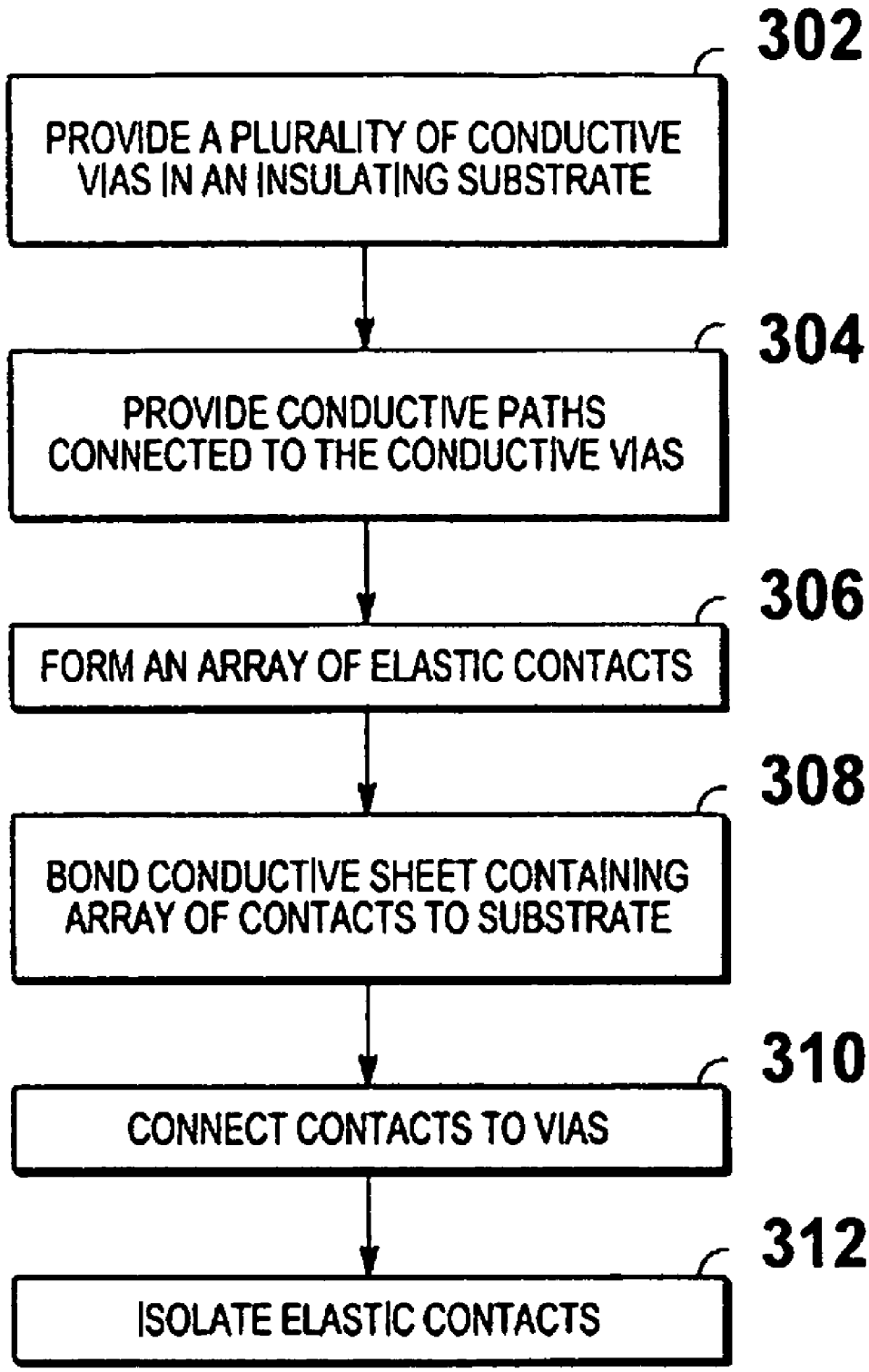
FIG. 3 is a flow chart that illustrates a method for forming an interposer, according to one aspect of this invention.

FIG. 3 generally illustrates a method for forming an interposer according to one aspect of this invention. In step 302, a plurality of conductive vias are provided within an insulating substrate. The insulating substrate can be, for example, a PCB-type material or a ceramic. The conductive vias can be formed by a number of methods including electroless plating of through holes formed in a substrate. In one example, the substrate is further provided with a copper cladding on one or both sides. Preferably, the copper cladding thickness is in the range of about 0.2-0.7 mils. The conductive vias can be formed, for example, by drilling the insulating substrate and subsequent plating of the vias.

In step 304, a plurality of (electrically) conductive paths that are coupled to respective vias are provided for the substrate. The term "provided for the substrate" indicates that the conductive paths are affixed to the substrate, either on an outer surface of the substrate or embedded within the substrate. In one configuration, the conductive paths are provided on at least one surface of the insulating substrate. The conductive paths are arranged so that one end of the conductive path electrically connects to a conductive via. In one variant of the invention, steps 302 and 304 are performed in a single step. For example, plated through holes can be formed in which a conductive layer extends onto a surface of the substrate, such that the portion extending on a surface of the substrate constitutes a conductive path that maintains electrical contact with the conductive via. In the case where a substrate is provided with a surface copper (or other metal) cladding, the plating of the vias in step 302 can serve to connect conductive vertical via walls with the copper cladding that lies on the surface of the substrate and surrounds the via. Subsequently, for example, the surface copper cladding is etched into conductive capture pads that surround the via.

On the other hand, the conductive paths can consist of elaborate circuit patterns each of whose conductive lines connect to a respective via and extend along a surface of the substrate or are embedded within the substrate. The circuit patterns can be formed and embedded within a substrate below the substrate surface in step 302. For example, embedded conductive lines can each be formed that contact a via within the substrate. Provisions can be made so that the end of the embedded conductive line opposite the via can be further contacted through a conductive material contained in a second via that extends to a substrate surface. The second via can subsequently be connected to a conductive elastic contact providing an electrical connection from the first conductive via to the elastic contact.

In another variation, a circuit pattern having lines that extend to the conductive vias can be formed within the copper (metal) cladding. The ends of the lines opposite to those connected to vias can be connected to respective elastic contacts in subsequent processing steps.

In step 306, an array of elastic contacts is formed. Preferably, the array of elastic contacts is formed within an electrically conducting sheet. Examples of such electrically conductive sheets include copper alloys, such as BeCu. The sheet thickness is configured to impart the desired elastic behavior to contact arms formed from the conductive sheet. For example, for contact arms having a length in the range of 5-50 mils, the sheet thickness is preferably in the range of about 1-3 mils. The formation of an array of elastic contacts (described further below) generally includes the substeps of patterning a planar conductive sheet; selectively etching the patterned sheet to form two dimensional contact structures; and forming the two dimensional contact structures into three dimensional contacts having elastic contact portions that extend above the plane of the contact sheet. Once formed, the array of elastic contacts comprises an array of semi-isolated features, such as array 402 illustrated in FIG. 4, and discussed further below. After formation, heat treatment of the contacts can be performed to adjust the mechanical properties of the elastic contacts.

In step 308, the conductive sheet containing the array of elastic contacts is bonded to the substrate. This step can be repeated to affix a separate conductive sheet with an array of elastic contacts on a second side of the insulating substrate. As described further below, the bonding step can involve, for example, preparation of the conductive sheet surface to be bonded, providing an adhesive layer between the conductive sheet and substrate, providing features in the substrate and/or conductive sheet to account for adhesive layer flow during bonding, and affixing the conductive sheet to the interposer substrate surface under heat and pressure.

During the bonding process, the positions of contacts within the conductive sheet can be registered so that they are aligned with respect to conductive vias to which the contacts are to be coupled. For example, each contact can be placed above a pre-existing conductive path that is connected to a via. Alternatively, during the bonding process, the positions of contacts within the conductive sheet need to be aligned with vias to which the contacts are to be coupled. After bonding, conductive paths between contacts and respective vias can be defined.

To aid in the bonding process, a lamination spacer is typically provided on an outer surface of the conductive spring sheet. The spacer typically is configured as a thin sheet having an array of holes that correspond to the positions of elastic contacts in the conductive sheet. The lamination spacer is placed such that the surface of the spacer contacts the surface of the spring sheet only in planar portions of the spring sheet, and the holes of the lamination spacer accommodate the elastic contacts, such that the contact arms remain untouched. The thickness of the lamination spacer typically is equal to or greater than the height at which the distal ends of the elastic contacts extend above the conductive sheet surface. In this manner, a planar press plate can be clamped against the outer surface of the lamination spacer without contacting the elastic contact arms, which do not protrude above the top surface of the lamination spacer.

In step 310, the elastic contacts are electrically connected to respective conductive vias. As described in more detail below with respect to FIGS. 5A and 5B, contacts formed in the conductive sheet can be connected to the vias by means of a plating process that fills gaps between the conductive sheet that contain the contacts and the conductive vias.

In step 312, the electrical contacts are electrically isolated from one another (singulated). In this step, unwanted portions of a conductive spring sheet are removed. In so doing, an array of electrical contacts can be formed on one or both sides of an interposer, where some (partially singulated) or all (completely singulated) of the contacts can be electrically isolated from other contacts while individual contacts remain electrically coupled to respective conductive vias. This step of singulation, as discussed further below, is accomplished according to lithographic patterning and etching of the conductive spring sheet. In one variation, also discussed below, the singulation step can also act to define conductive paths in the conductive sheet that connect elastic contacts to conductive vias.

Figure 5A:
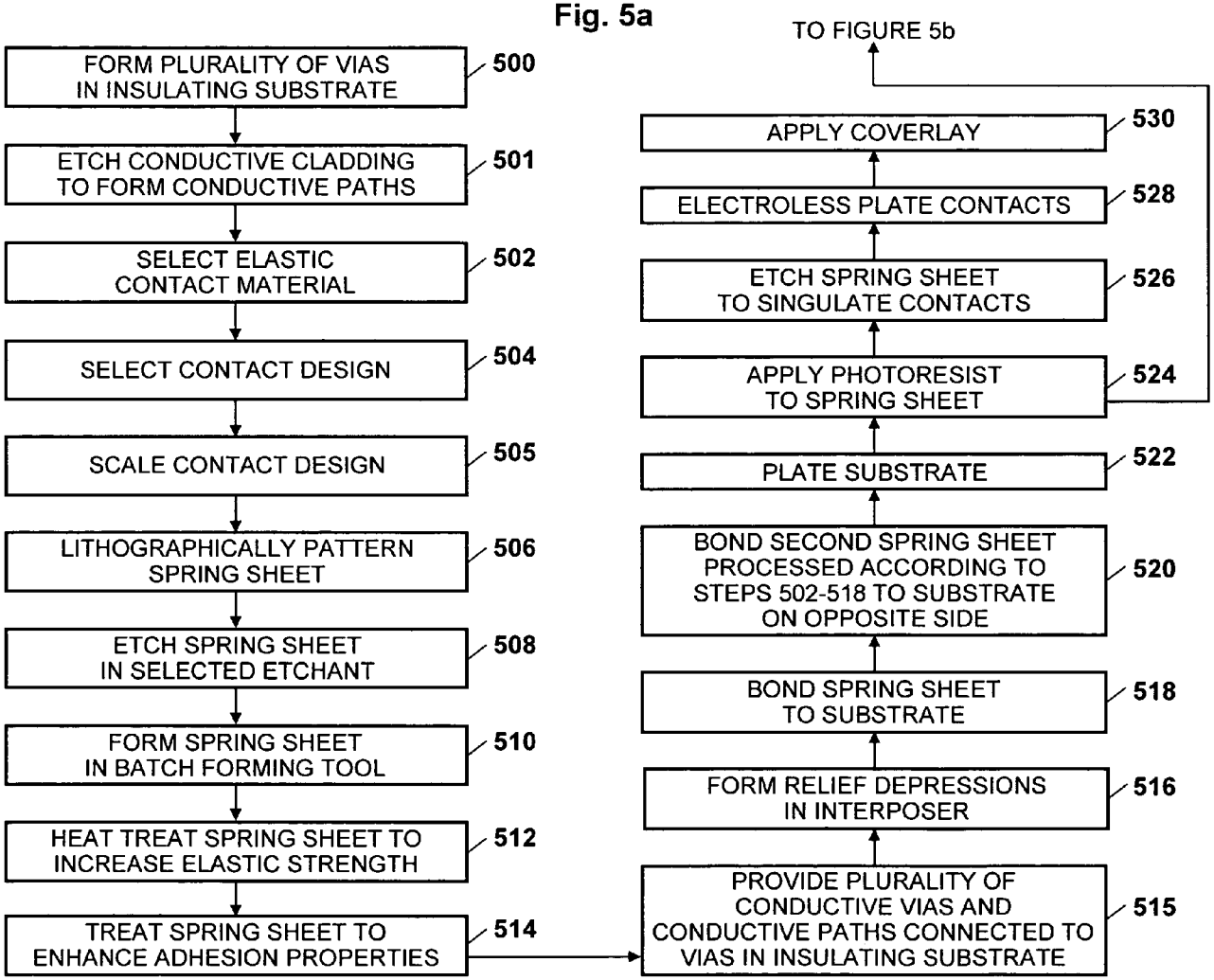
FIG. 5*a* is a flow chart that illustrates exemplary steps involved in a method for forming an interposer, according to one aspect of the present invention.
Figure 5B:
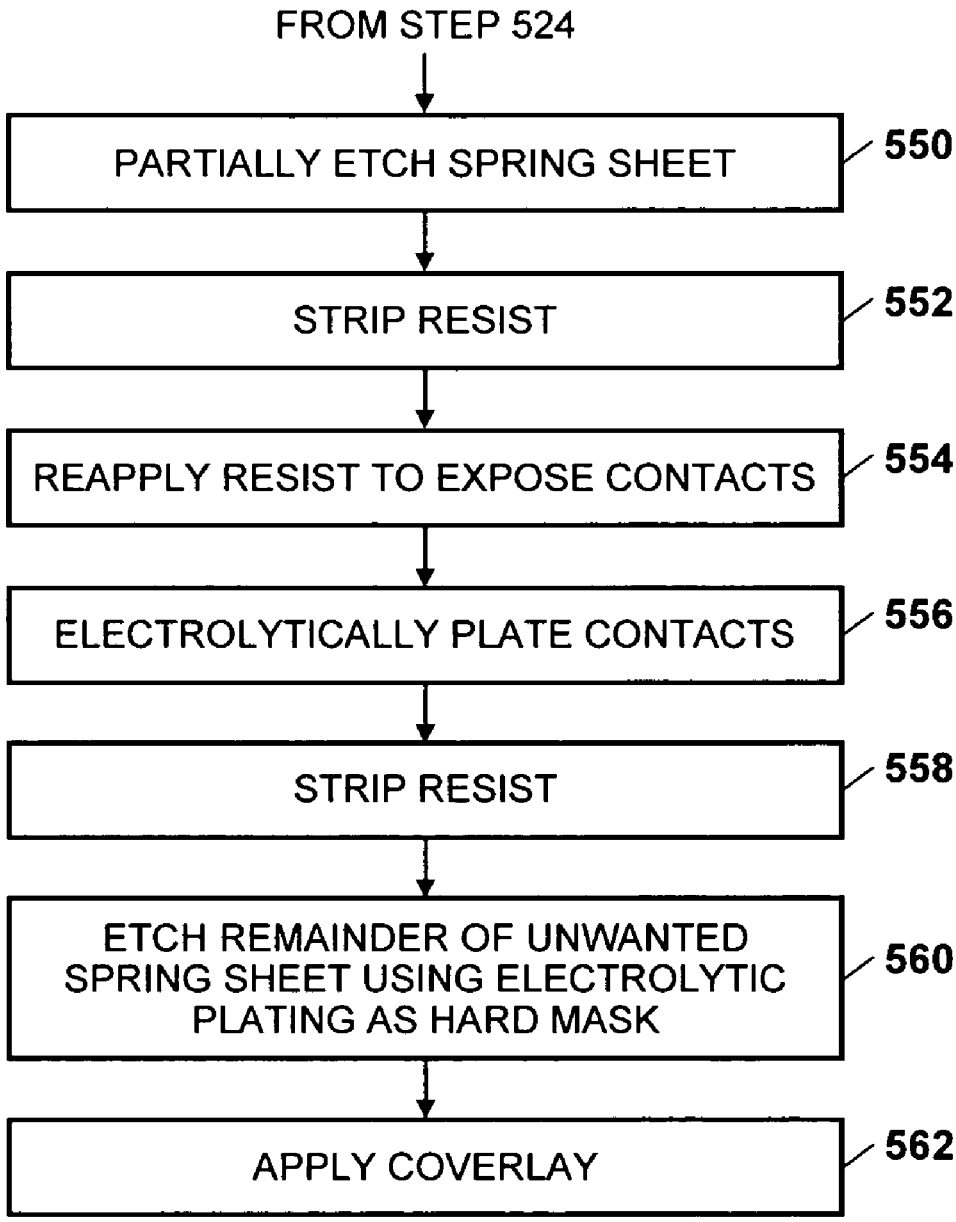
FIG. 5*b* is a flow chart that depicts exemplary steps involved in a method for forming an interposer, according to another aspect of the present invention.

The methods described below with respect to FIGS. 5*a* and 5*b* represent more detailed variations derived from the method of FIG. 3. These steps can be used to fabricate interposer contact structures such as those described in FIGS. 8*a*-14, 16*a*-24, 58-59, and 62*a*-70 to follow.

FIG. 5*a* illustrates exemplary steps involved in a method for forming an interposer, according to one aspect of the present invention.

In step 500, a plurality of vias are formed in an insulating substrate. In one configuration of this invention, the insulating substrate is clad on top and bottom surfaces with a conductive cladding layer. In one example, the vias are patterned into a two dimensional array of vias according to a desired pattern. Preferably, the vias are drilled through the entire thickness of the insulating substrate such that a conductive path can be formed from one side of the substrate to the opposite side by plating the vias. Preferably, the vias are subject to at least a seed layer deposition in step 500. The seed layer forms the template for a thicker conductive coating that is subsequently formed by plating.

Figure 6A:
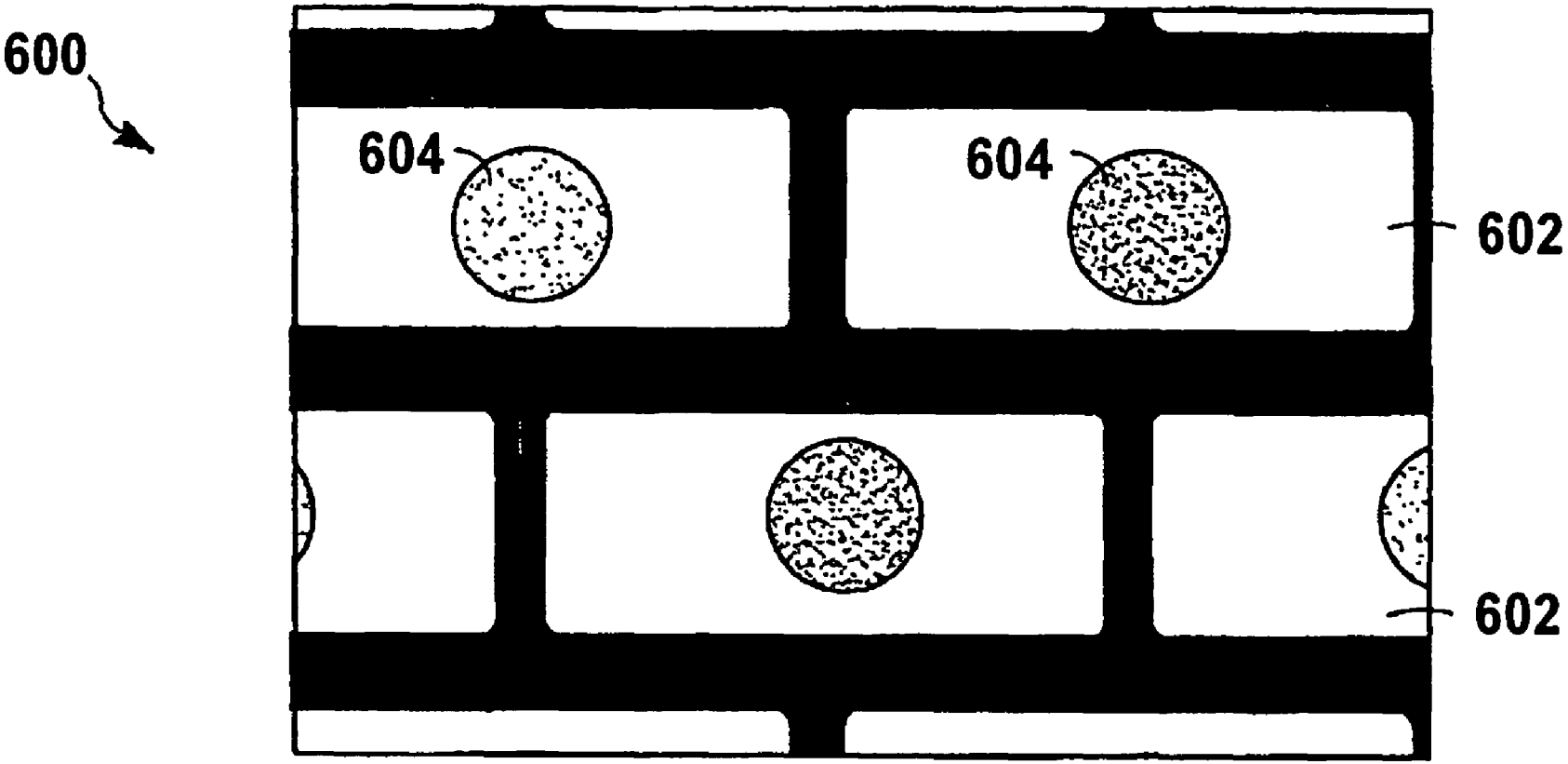
FIG. 6*a* is an image that illustrates a plan view of an array of capture pads disposed on a substrate, according to one configuration of this invention.

In step 501, if the interposer substrate is provided with a conductive cladding, the cladding can be etched to form isolated conductive regions, where one or more of the isolated conductive regions can form at least a portion of a conductive path to a respective elastic contact, wherein the conductive path serves to electrically connect the elastic contact to a respective conductive via. For example, the isolated conductive regions can be arranged as an array of conductive capture pads. FIG. 6*a* illustrates a plan view of an arrangement 600 of conductive capture pads 602, according to one configuration of the invention. The conductive capture pads are arranged in a two dimensional array and each include an inner circular region 604 in which the conductive material comprising the pad is removed. The spacing and size of circular portions 604 can be designed to align over an array of conductive vias provided in the substrate, such that the capture pads do not cover the vias. Subsequently, the interposer substrate provided with capture pads can be prepared using a combination of an alkaline clean and a micro etch that includes a dilute sulfuric acid solution. Elastic contacts can subsequently be placed on such capture pads, for example, by bonding a spring sheet containing the elastic contacts to the interposer substrate. The elastic contacts can be electrically connected to the pads, such that an electrical connection between the contact and conductive via is formed.

Figure 6B:
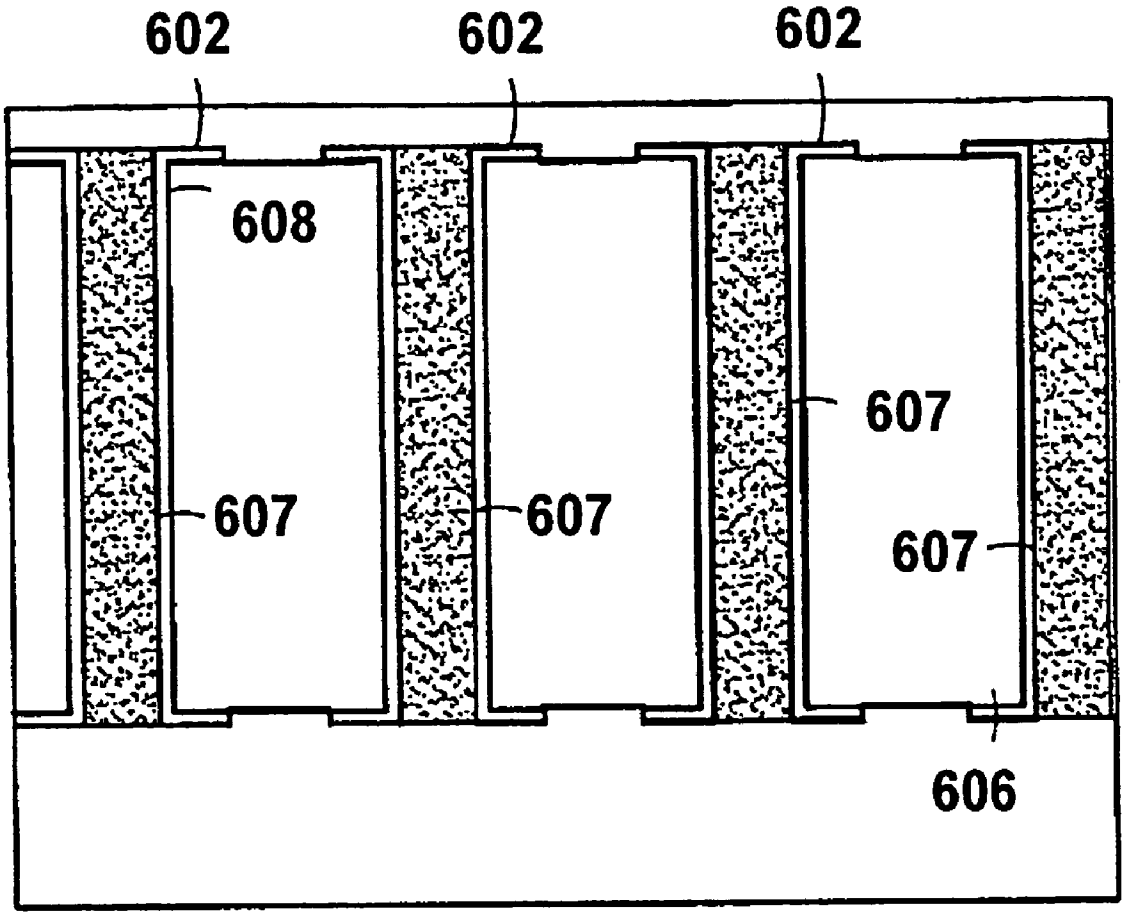
FIG. 6*b* is an image that illustrates a cross section of an exemplary substrate illustrating a series of conductive vias surrounded by capture pads, according to one configuration of this invention.

FIG. 6*b* shows a cross section of a substrate 606, arranged according to a configuration of this invention, illustrating a series of conductive vias 607 whose outer portions 608 are each surrounded by capture pads 602 at the surfaces of the substrate. The capture pads 602 are arranged so that a conductive contact structure placed on top of a pad can be conveniently electrically connected to a conductive via.

In step 502, an elastic contact material such as Be—Cu, Spring Steel, titanium copper, phosphor bronze or any other alloy with suitable mechanical properties is selected. The selected material is then provided in the form of a spring sheet to serve as a layer from which contact elements of the interposer are fabricated. The selection of material can be based on the desired application and may entail considerations of mechanical and electrical performance of contacts to be fabricated from the spring sheet, as well as process compatibilities, such as etch characteristics and formability of contacts.

Optionally, the spring sheets can be heat treated prior to subsequent processing or can be treated after subsequent formation of contact elements. In one example, an alloy of copper beryllium (Cu—Be) is chosen that comprises a supersaturated solution of Be. The supersaturated solution has relatively low strength and high ductility and can readily be deformed to form elastic contact elements, such as contact arms as described further below. Subsequent to formation of contact arms, the supersaturated alloy can be treated at a temperature such that precipitation of a second phase occurs, wherein dislocation are pinned and the multiphase material imparts a high strength to the resulting contact arms.

In step 504, a contact shape is designed. The design can comprise simply selecting a known design that can be stored for use within a design program, or can entail designing contacts using CAD tools such as Gerber art work. The design can be loaded into a tool used to pattern a spring sheet to be etched to form elastic contacts. The design can be used, for example, as a mask design, to fabricate a lithography mask used to pattern a resist layer on the spring sheet with the contact design. Because the shape of contacts can be readily altered using design tools such as Gerber, modification of contact design can be quickly accomplished as needed.

In one variation, the contact shape design step includes the use of modeling of contact behavior. For example, an interposer designer may have certain performance criteria for a contact in mind, such as mechanical behavior. Modeling tools such as COSMOS®, produced by Structural Research and Analysis Corporation, and ANSYS™ produced by ANSYS, Inc., can be used to model the behavior of a basic contact shape in three dimensions, aiding in selection of an overall design of contact shape and size. Once the desired contact shape and size is determined, this information can be stored as a mask design and subsequently used for patterning the spring sheet.

As part of the contact design process of step 504, the desired orientation of a contact shape with respect to a spring sheet used to form the contacts can be specified. The grain structure of metallic sheets is generally anisotropic. Contacts formed in specific alignments with respect to the grain orientation are more resilient as a spring. Consequently, contact alignment with respect to the grain orientation can be used to select the degree of resiliency desired. Accordingly, after establishing the relative grain anisotropy within a spring sheet to be used for forming contacts, the grain anisotropy can be used to select the alignment direction of longitudinal portions of an elastic contact arm design, in order to impart the desired resiliency to the contact.

Figure 7:
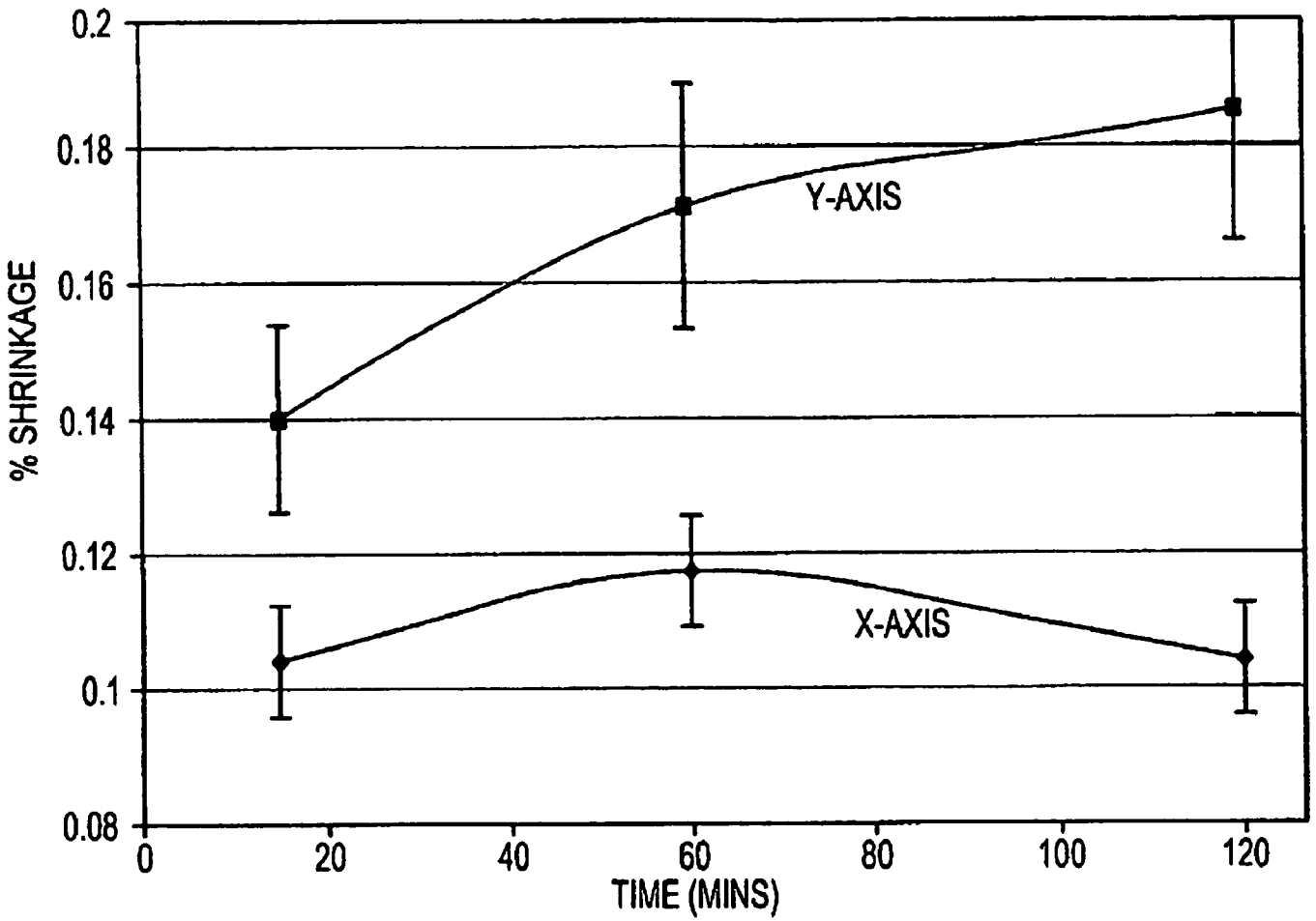
FIG. 7 is a graph that illustrates the shrinkage in a sheet of Be—Cu alloy after annealing at 600 F, in accordance with exemplary processing steps of FIG. 5*a*.

In step 505, a contact design is scaled. The scaling of a design, such as a mask design, first entails determining the desired final dimensions and shape of the two dimensional contact to be fabricated. Next, the desired final dimensions are scaled to produce a scaled two dimensional design having dimensions appropriately altered (typically enlarged) to account for processing effects taking place after two dimensional patterning that affect the final contact structure obtained. In one example, once a final desired contact structure is determined, a contact design that is to be used to produce the determined contact structure in an etched spring sheet is scaled to take into account shrinkage in the spring sheet after subsequent annealing that takes place during contact fabrication. FIG. 7 illustrates the shrinkage in a sheet of Be—Cu alloy after annealing at 600 F, which can be used to precipitation harden a contact after the contact is formed. While the shrinkage along the X-axis remains relatively constant at about 0.1%, the Y-axis shrinkage monotonically increases up to about 0.19% at 120 minutes annealing time. Accordingly, since the contact arms may be patterned and etched before an annealing process, a design pattern for contacts can be altered to take into account the absolute shrinkage that takes place and the relatively larger shrinkage along the Y-axis that would take place after the two dimensional contacts are patterned and heated.

In general, metallic sheet material provided for use as elastic contact source material is subject to a rolling process that introduces anisotropy in grain microstructure that is largest as between the rolling direction and the direction orthogonal to the rolling direction. This leads to anisotropic shrinkage after annealing in the case of an alloy material that undergoes grain boundary precipitation of a phase during annealing. Even in the absence of a sheet rolling process that introduces an anisotropic grain structure a sheet material with a uniform isotropic (within the plane of the sheet) microstructure that is subject to annealing that induces grain boundary precipitation will also experience shrinkage during the annealing. In the latter case, however, the shrinkage may be equal in the X- and Y-directions within the plane of the sheet.

Thus, either isotropic or anisotropic scaling of the reference mask design is preferable to produce a lithography mask whose dimensions are scaled to account for the shrinkage of the contacts during annealing. In the example of FIG. 7, the mask design can be scaled to increase the X-dimension by about 0.1% and the Y-dimension by about 0.2% above the desired contact size, for a contact to be annealed at about 120 minutes after the contact shape is patterned. Accordingly, after contact patterning (described further below), the initial oversize dimensions of the contact would shrink to the desired final dimensions after the annealing process.

Mask design scaling can be used to take into account additional effects besides the in-plane shrinkage experienced by a blanket spring sheet material. For example, pattern density of etched contacts within the spring sheet can affect the overall in-plane shrinkage. Accordingly, design scaling can be modified according to pattern density effects. In general, in a first sub-step of step 505, a two dimensional contact array design is fabricated in a spring sheet. In an experiment, the design can be fabricated in a series of spring sheets, where the sheet thickness and design density, among other things, is varied. Next, the patterned spring sheet is subject to an annealing condition or conditions to be used to harden the contacts. Subsequently, the shrinkage of the spring sheet in the X- and Y-directions is measured empirically. In an experiment, the X-Y shrinkage can be determined as a function of material, sheet thickness, pattern density, pattern shape, and annealing conditions, among other parameters. These X- and Y-scaling factors are then stored in a matrix that can include the material type, thickness, annealing condition, contact design and contact density. For example, each entry in such a matrix can contain an X- and Y-shrinkage factor that can be applied to a reference design corresponding to the desired final contact shape. For each entry, the size and shape of the reference design is then altered using a scaling function based on the X- and Y-shrinkage factors, using a CAD or similar program, to produce a final mask design.

In step 506, lithographic patterning is applied to the spring sheet. This step typically comprises the substeps of applying a lithographically sensitive film ("photoresist" or "resist"), exposing the photoresist using the artwork selected in step 504, and developing the exposed resist to leave a patterned resist layer containing openings that lie above regions of the spring sheet to be etched. In one example, the resist is applied to both sides of the spring sheet, such that the spring sheet can be patterned and etched from both sides. In this case, matching two dimensional patterns are formed on both sides of the spring sheet so that the shape and size of the feature being etched at a given horizontal position on one side of the spring sheet matches the shape and size of the feature on the other side of the spring sheet at the same horizontal position. Dry film can be used as a resist for larger feature sizes of about 1-20 mil, and liquid resist can be used for feature sizes less than about 1 mil.

Figure 8A:
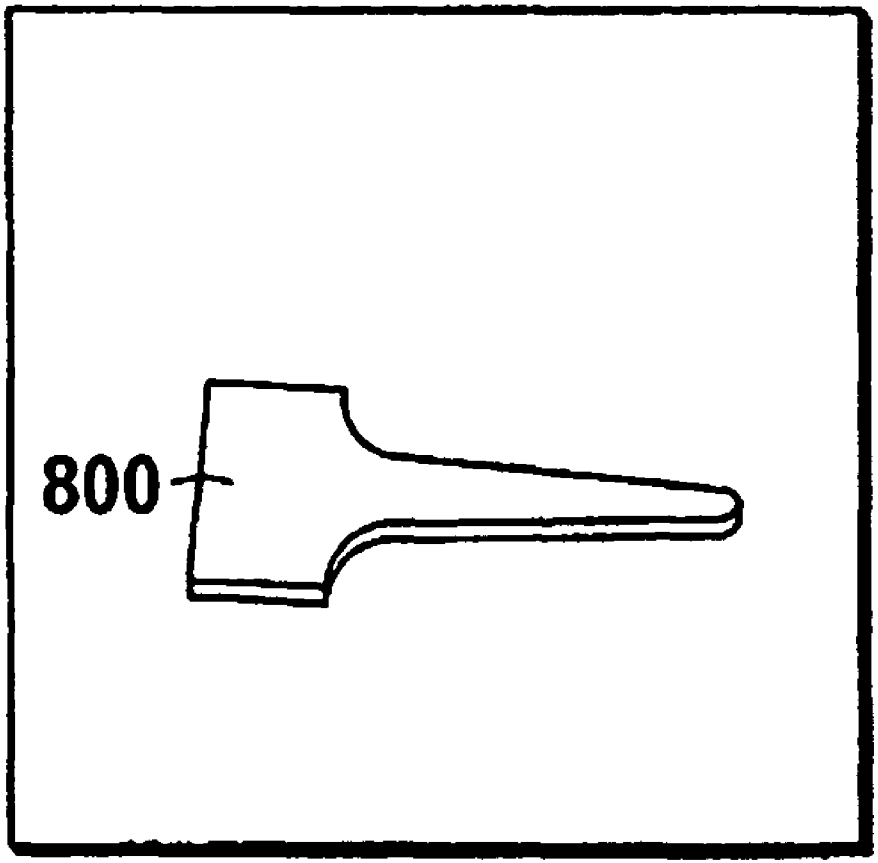
FIGS. 8*a* and 8*b* are schematic diagrams that illustrate a perspective view of exemplary two dimensional contact structures.
Figure 8B:
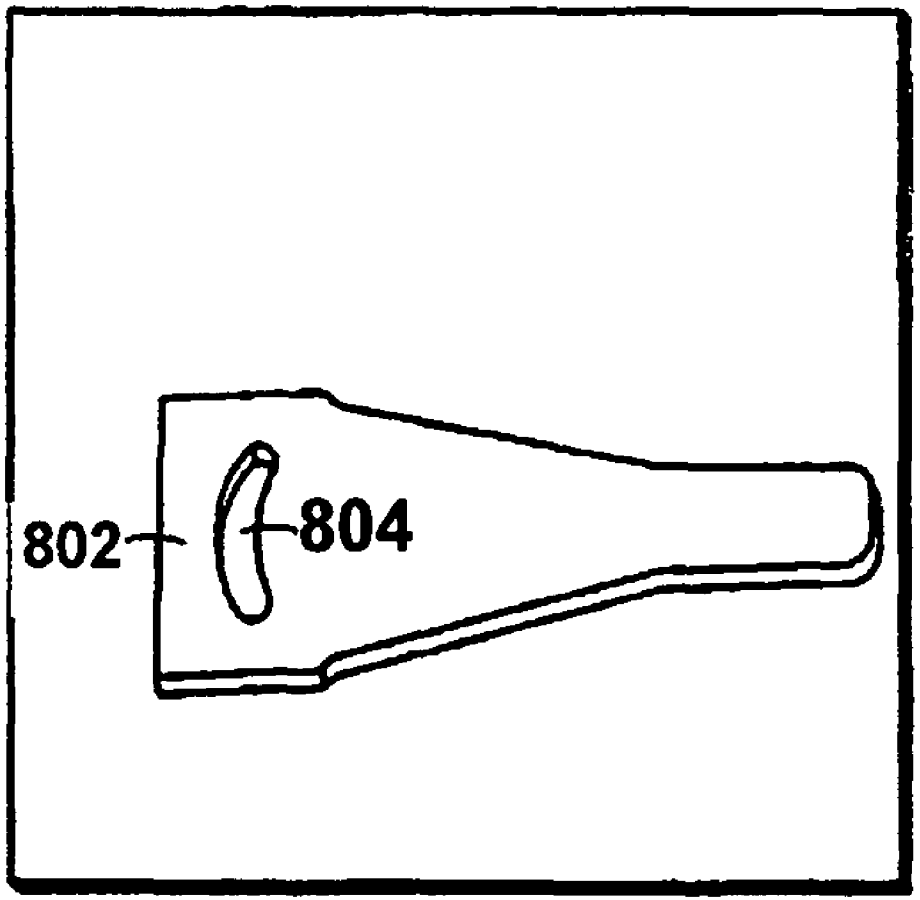

In step 508, the sheets are etched in a solution, for example, one that is specifically selected for the spring sheet material being used. Cupric or Ferric Chloride etchants are commonly used in the industry for etching copper alloy and spring steels. After etching, the protective layer of resist is removed from the spring sheet in a stripping process that leaves the etched features in the spring sheet. The etched features can comprise, for example, an array of contact features that contain two dimensional arms that lie within the plane of the spring sheet. FIGS. 8*a* and 8*b* illustrate a perspective view of exemplary two dimensional contact structures (contact features) 800 and 802, respectively. It is to be noted that the two dimensional features are shown as isolated features for the purposes of clarity. However, at step 508, portions of such contact features are actually integrally connected to a spring sheet, at least in portions. Contact structure 802 includes aperture 804, which is configured to act as an adhesive flow restrictor, as described below with respect to steps 516-520.

In step 510, a spring sheet is placed onto a batch forming tool that is configured to form the contact features into three dimensional features. The batch forming tool can be designed based on the original artwork used to define the two dimensional contact array features. For example, the batch forming tool can be a die having three dimensional features whose shape, size, and spacing are designed to match the two dimensional contact array and impart a third dimension into the contact features.

In one variation, a male and female component of the batch forming tool is fabricated by stacking together laminated slices, for example, using stainless steel. Each slice can be patterned by etching a pattern (for example, with a laser) through the slice that matches the cross-sectional shape of a contact structure or array of contact structures, as the contacts would appear when viewed along the plane of the interposer. For example, the cross-sectional shape can be designed to match the contact array profile as viewed along an X-direction of an X-Y contact array. To define the full die structure, the pattern of each slice is varied to simulate the variation of the contact array profile in the X-direction as the Y-position is varied. After assembly, the slices would constitute a three dimensional die designed to accommodate the two dimensional spring sheet and compress the two dimensional contacts into a third dimension. After the spring sheet is placed in the batch forming tool, the tool acts to form the features ("flanges") in all three dimensions to produce desired contact elements. For example, by pressing the spring sheet within an appropriately designed die, the two dimensional contact arms can be plastically deformed such that they protrude above the plane of the spring sheet after removal from the die.

In order to properly match the batch forming tool to the scaled two dimensional contact pattern, the etched pattern is scaled to match the scaled two dimensional contact array structure along a first direction, such as the X-direction. Scaling of the die in the Y-direction (the direction orthogonal to the slices) can, but need not be, performed. Preferably, the X-direction in which the die dimensions are scaled represents the direction having the larger scaling factor. In some cases, the die can be designed with enough tolerance so that strict scaling in the Y-direction is not needed.

Figure 8C:
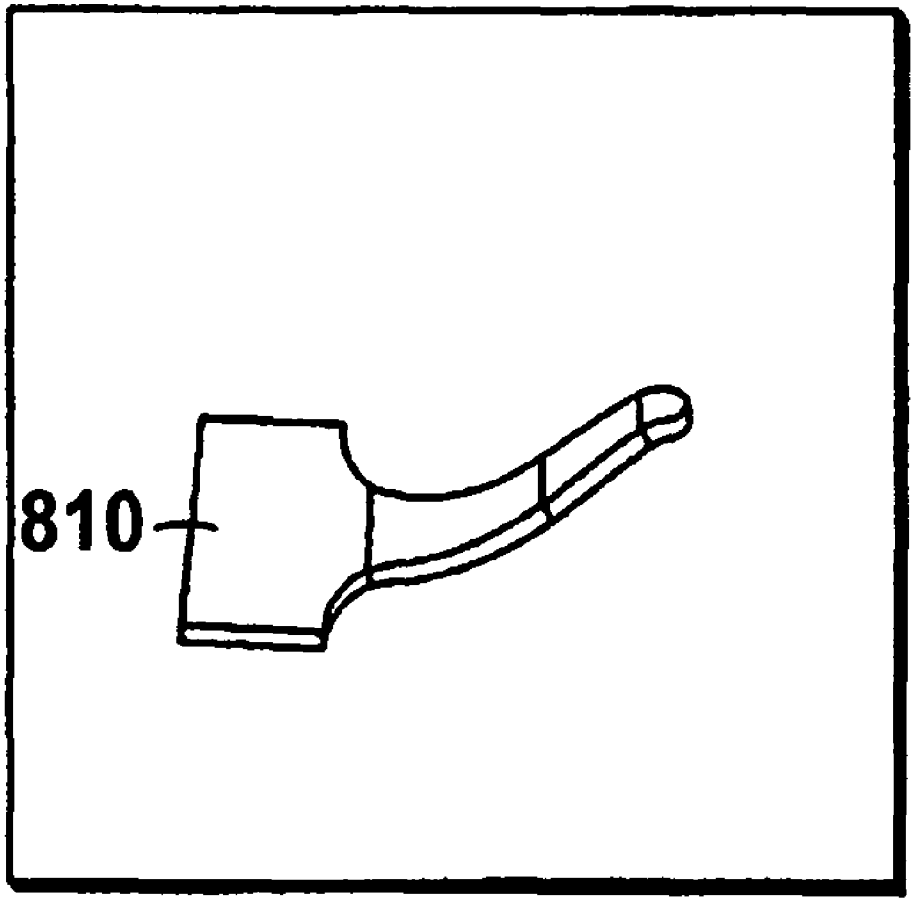
FIGS. 8*c* and 8*d* are schematic diagrams that illustrate a perspective view of exemplary three dimensional formed contact structures based on the two dimensional precursor structures of 8*a*, and 8*b*, respectively.
Figure 8D:
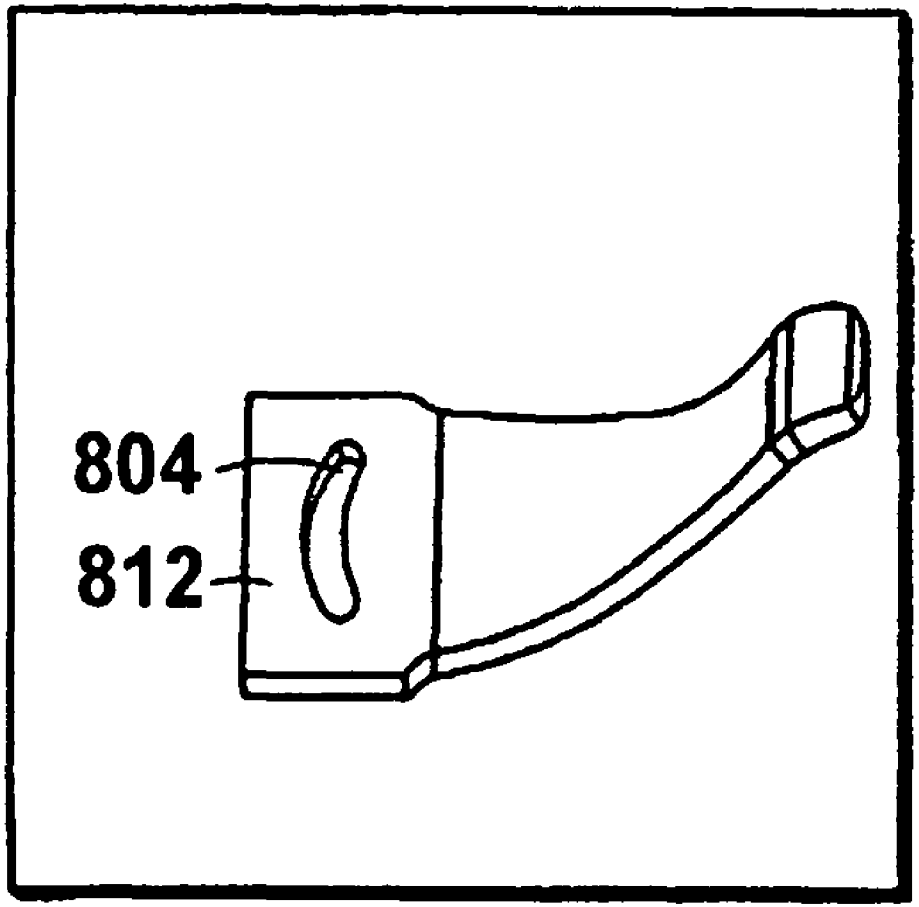

FIGS. 8*c* and 8*d* illustrate a perspective view of three dimensional formed contact structures 810 and 812, which are based on the two dimensional precursor structures of 8*a* and 8*b*, respectively. It is to be noted that the three dimensional contacts are shown as isolated features for the purposes of clarity. However, at step 510, portions of such contact features are actually integrally connected to a spring sheet, at least in portions, as illustrated in FIG. 4.

Figure 4:
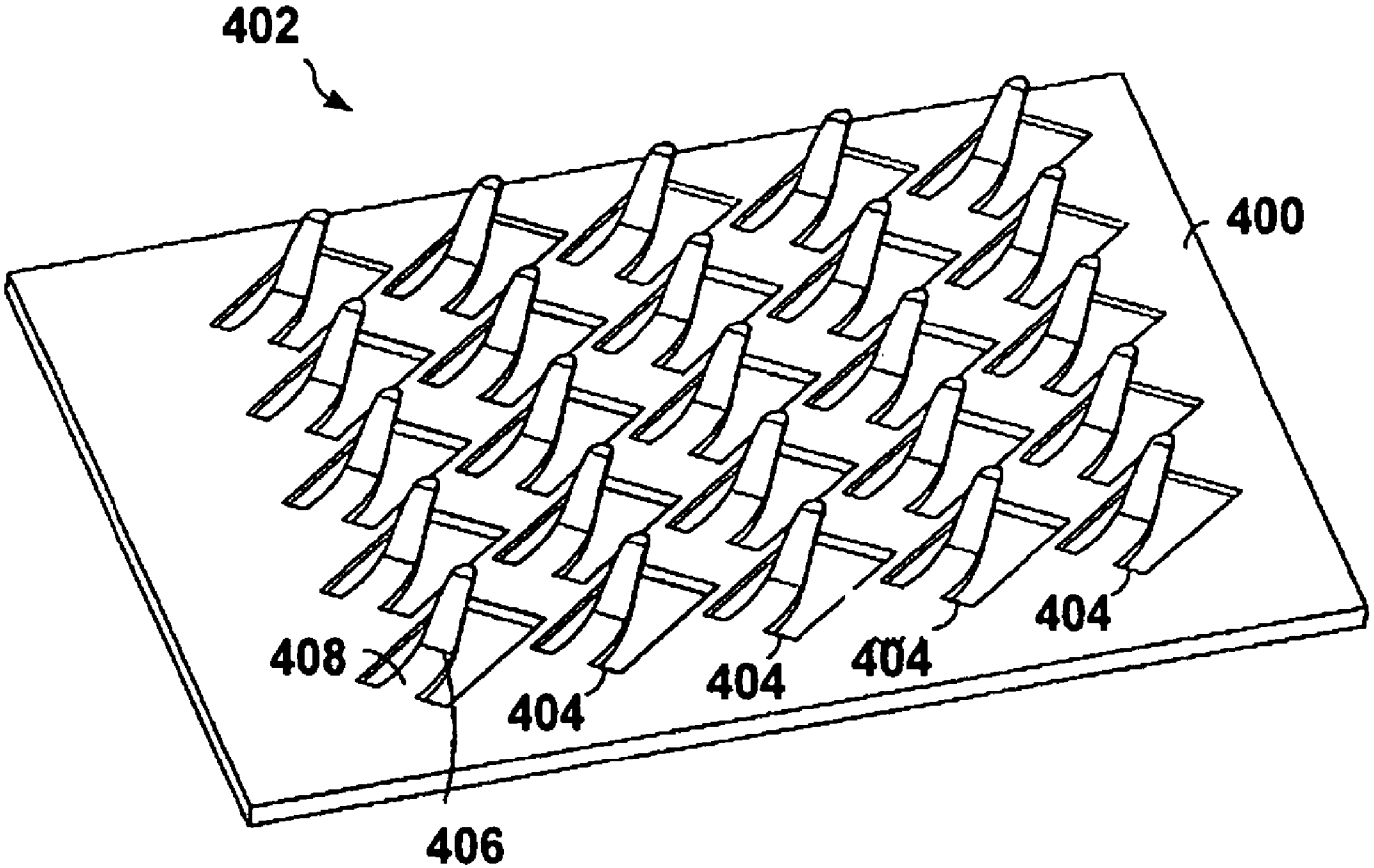
FIG. 4 is a schematic diagram that illustrates an exemplary conductive sheet having a pre-formed contact array, according to a configuration of the present invention.

FIG. 4 illustrates one example of a conductive sheet having an array of elastic contacts formed in three dimensions according to the steps outlined above. Conductive sheet 400 includes contact array 402 containing a plurality of three dimensional contacts 404, each having a base portion 408 and contact arm portions 406. At this stage of processing the contacts of array 402 are integrally connected to sheet 400 and are therefore not electrically isolated from each other. Base portions 408 are partially etched but sufficient material remains between the bases and the rest of the spring sheet to maintain the semi-isolated contacts and sheet as a unitary structure. In other configurations of the invention, no partial etch to define base portions is performed up to step 510.

In step 512, the conductive sheets can be heat treated to precipitation harden and enhance spring properties of the contacts. As mentioned above, this can impart higher strength, such as higher yield strength, and/or higher elastic modulus to the contact arms by, for example, precipitation hardening of a supersaturated alloy. Heat treatment can be performed in a non-oxidizing atmosphere, such as nitrogen, inert gas, or forming gas, to prevent oxidation of the conductive sheet.

In step 514, spring sheets having three-dimensionally formed contact elements are subjected to cleaning and surface preparation. For example, an alkaline clean can be performed, followed by a sulfuric oxide/hydrogen peroxide etch (micro-etch) to enhance adhesion properties of the spring sheet surface for subsequent lamination processing. The micro-etch can be used to roughen the surface, for example.

In step 515, the processes generally outlined in steps 302 and 304 of FIG. 3 are performed. An interposer substrate is provided with plated vias leading from one surface to the opposite surface of the substrate. Preferably, though not necessarily, a plurality of electrical conductive paths are provided that connect to respective conductive vias on one end and extend onto and over a portion of the surface of the substrate or within the substrate on the other end. For example, the plurality of electrical paths may simply comprise capture pads defined around conductive vias by etching a metal cladding layer of the substrate as described above. In other cases, the conductive paths can be surface or embedded traces arranged to provide connection to elastic contacts located at a distance from the conductive vias.

Figure 9A:
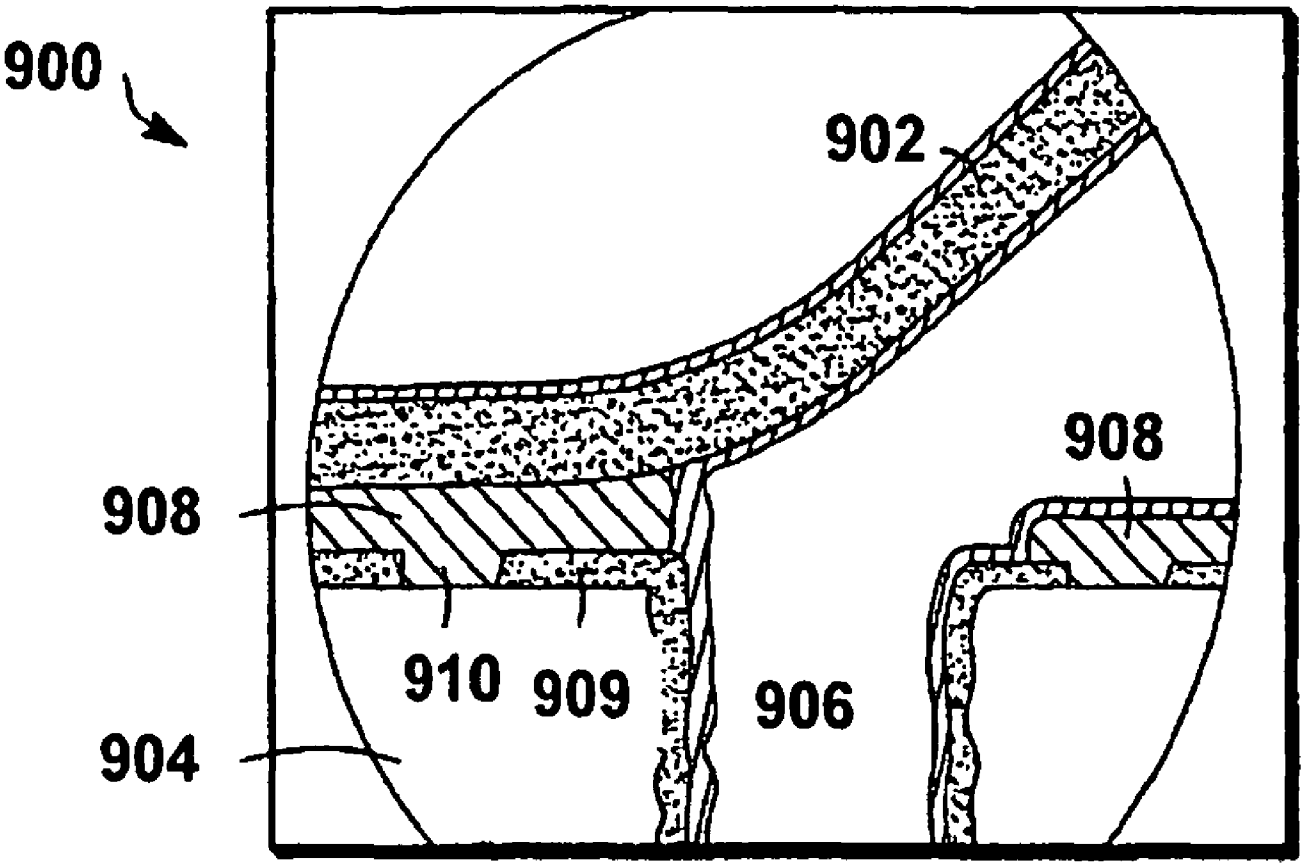
FIGS. 9*a* and 9*b* are images that illustrate an example of the effect of relief depressions on a contact structure according to the method of FIG. 5*a*.
Figure 9B:
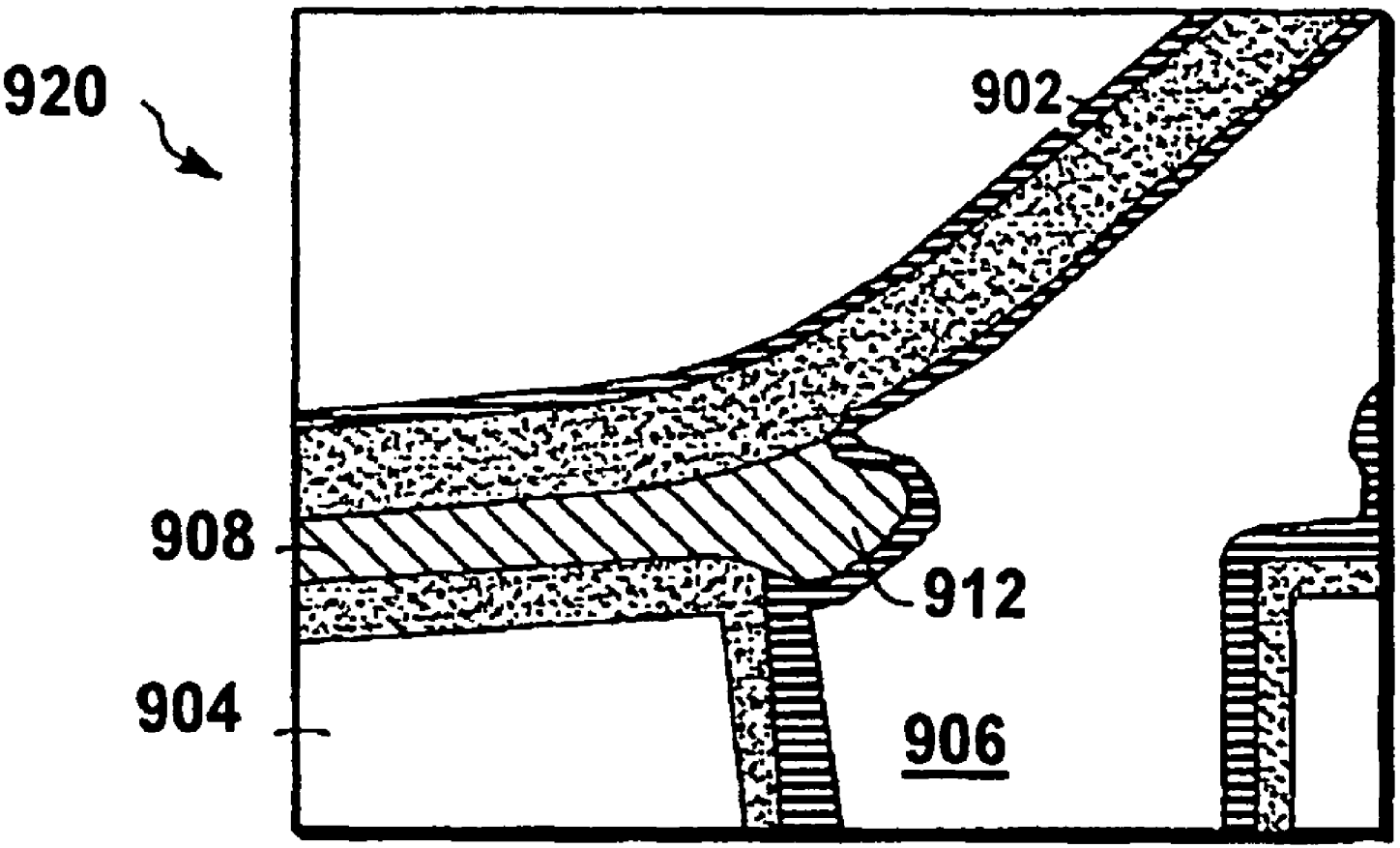

In step 516, flow restriction features are introduced into the substrate. These flow restriction features, discussed further below in relation to FIGS. 9*a* and 9*b*, provide reservoirs for adhesive layers used during bonding of the conductive spring sheet to the substrate. The reservoirs are located proximate to regions of the substrate that support the elastic contacts and serve to retain excess adhesive and reduce the flow of adhesive material under elastic contacts. Optionally, flow restrictors can be placed in the spring sheet material near contact arms in addition to or instead of in the substrate. This prevents undesirable alteration of mechanical properties of the elastic arms that can render them unsuitable for use. In one variant step 516 is performed during step 515.

In step 518, the spring sheet is bonded to a surface of a substrate. In one example, the substrate includes a low flow adhesion material that covers a dielectric core. When the spring sheet and substrate are joined together, an adhesive layer serves to bond the spring sheet and substrate. The substrate and spring sheet are pressed together under temperature and heat conditions that can be optimized for desired adhesion and flow based on the adhesion material. In one variant of the process, before placing the spring sheet and substrate together, the adhesive is placed on the bottom side of the spring sheet opposite to the side from which the elastic contacts protrude.

After bonding, the spatial relationship between the elastic contacts within the spring sheet and respective vias is fixed. For example, referring again to FIG. 4, array 402 can be arranged with respect to a substrate such that contacts 404 align with conductive vias in the substrate. In other words, array 402 can comprise an X-Y array of contacts whose spacing between contacts and number of contacts corresponds to a similarly spaced array of conductive vias having a similar number of vias as compared to the contacts. The relative direction of array of contacts 402 can be arranged so that each contact has the same relative position with respect to a corresponding via. For example, a 5×6 X-Y contact array of equally spaced contacts can be aligned on top of a 5×6 X-Y array of equally spaced conductive vias having the same spacing as the contacts, such that the X and Y directions of the contact array and conductive via array are the same.

Figure 9C:
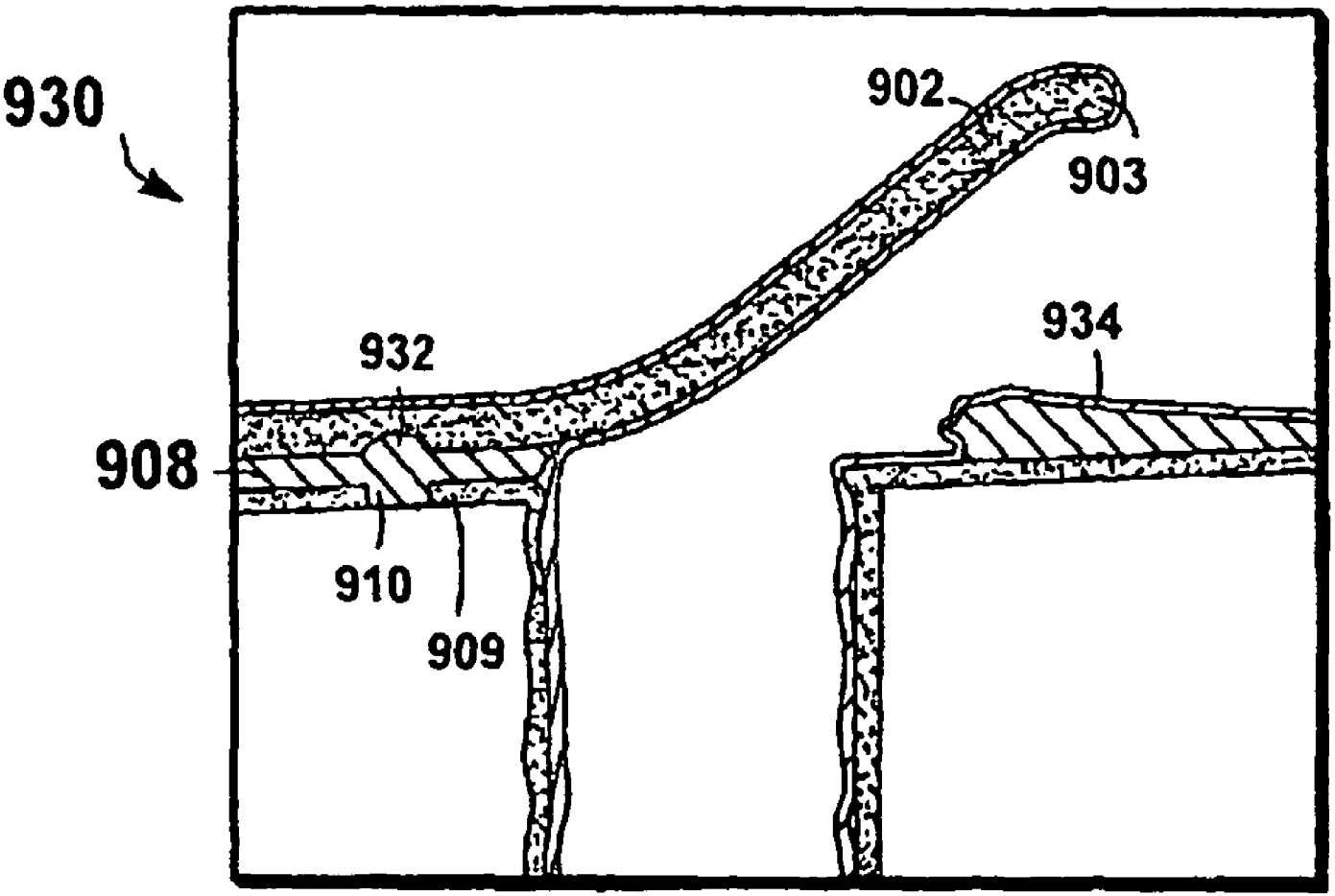
FIG. 9*c* is an image that illustrates another exemplary contact arrangement having a depression in the contact sheet containing the elastic arm.

After bonding, the adhesive layer is disposed between the spring sheet and substrate except in portions of the substrate such as vias. FIGS. 9*a* and 9*b* illustrate an example of the effect of the presence of flow restrictors on the interposer structure after step 518, in the region of an elastic contact, for the case where the contacts are placed adjacent to conductive vias. In this case, the adhesive flow restrictors (or "flow restrictors") are small through holes etched within a copper cladding layer on the substrate. The cladding layer shown can be a portion of a landing pad previously defined in step 515. In other cases, the flow restrictors can be partial depressions within the copper cladding layer or within the spring sheet, or through holes within the spring sheet. All such configurations serve to allow adhesive material to flow into initially empty space defined by the flow restrictor. In FIGS. 9*a* and 9*b* having contact structures 900 and 920, respectively, contact arms 902 are joined to substrates 904 having vias 906. The contact arms 902 are disposed over vias 906 and joined to substrate 904 using adhesion layer 908. The contact arms can be displaced downwardly during contact with an external component. In FIG. 9*a*, the presence of a through hole 910 in the copper cladding 909 on the substrate that acts as a flow restrictor results in no discernible flow of layer 908 into via 906. In contrast, in FIG. 9*b*, the absence of a relief structure (flow restrictor) results in appreciable flow of adhesion layer 912 material under the base of contact arm 902. FIG. 9*c* illustrates another contact arrangement 930 having a depression 932 in the contact sheet containing elastic arm 902. The depression acts as another adhesive flow restrictor in addition to hole 910. Again, no adhesive flow under the contact arm is observed.

Figure 9D:
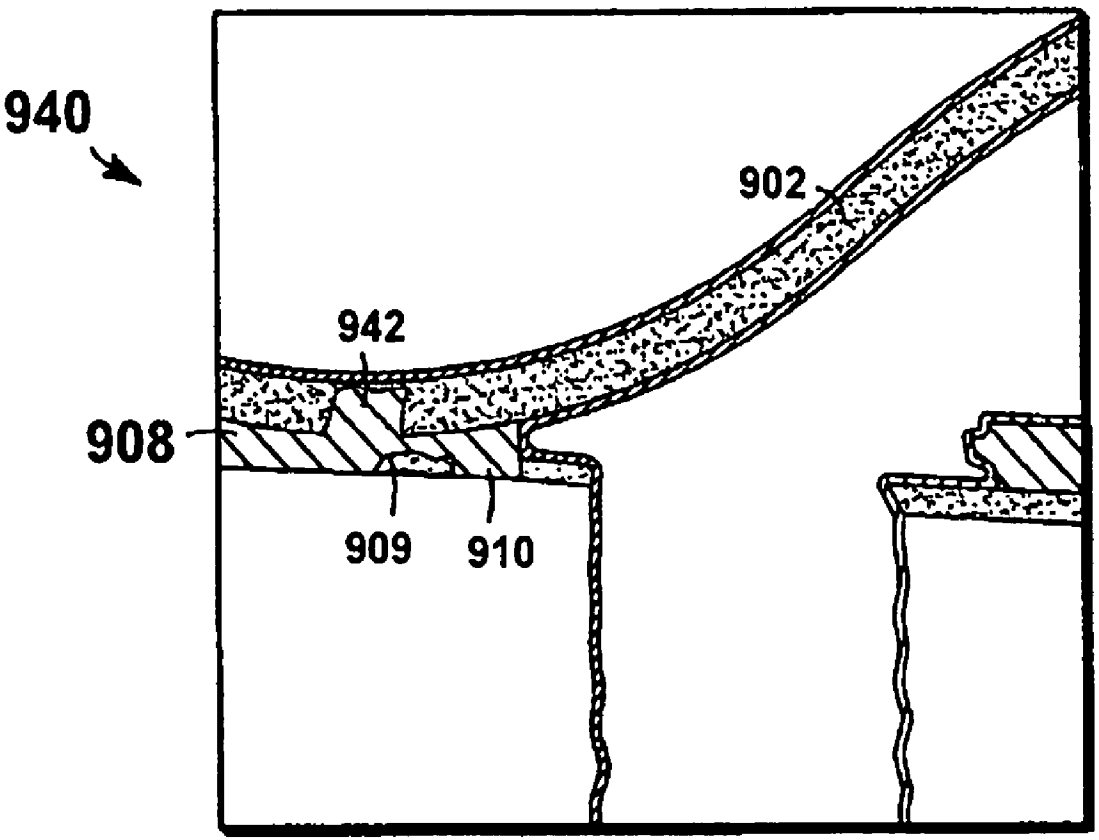
FIG. 9*d* is an image that illustrates an exemplary contact arrangement having a spring sheet through hole that is filled with extruded adhesive material from layer.

In one variant of the invention, in step 516, a through hole is formed in a spring sheet before bonding to a substrate, such that the through hole receives adhesive material that is extruded from the adhesive layer during bonding. Preferably, the spring sheet through hole is formed in step 508 when two dimensional contact features are etched, as illustrated, for example, by contact structure 802 of FIG. 8*b*. FIG. 9*d* illustrates contact arrangement 940 having spring sheet through hole 942 that is filled with extruded adhesive material from layer 908.

Figure 9E:
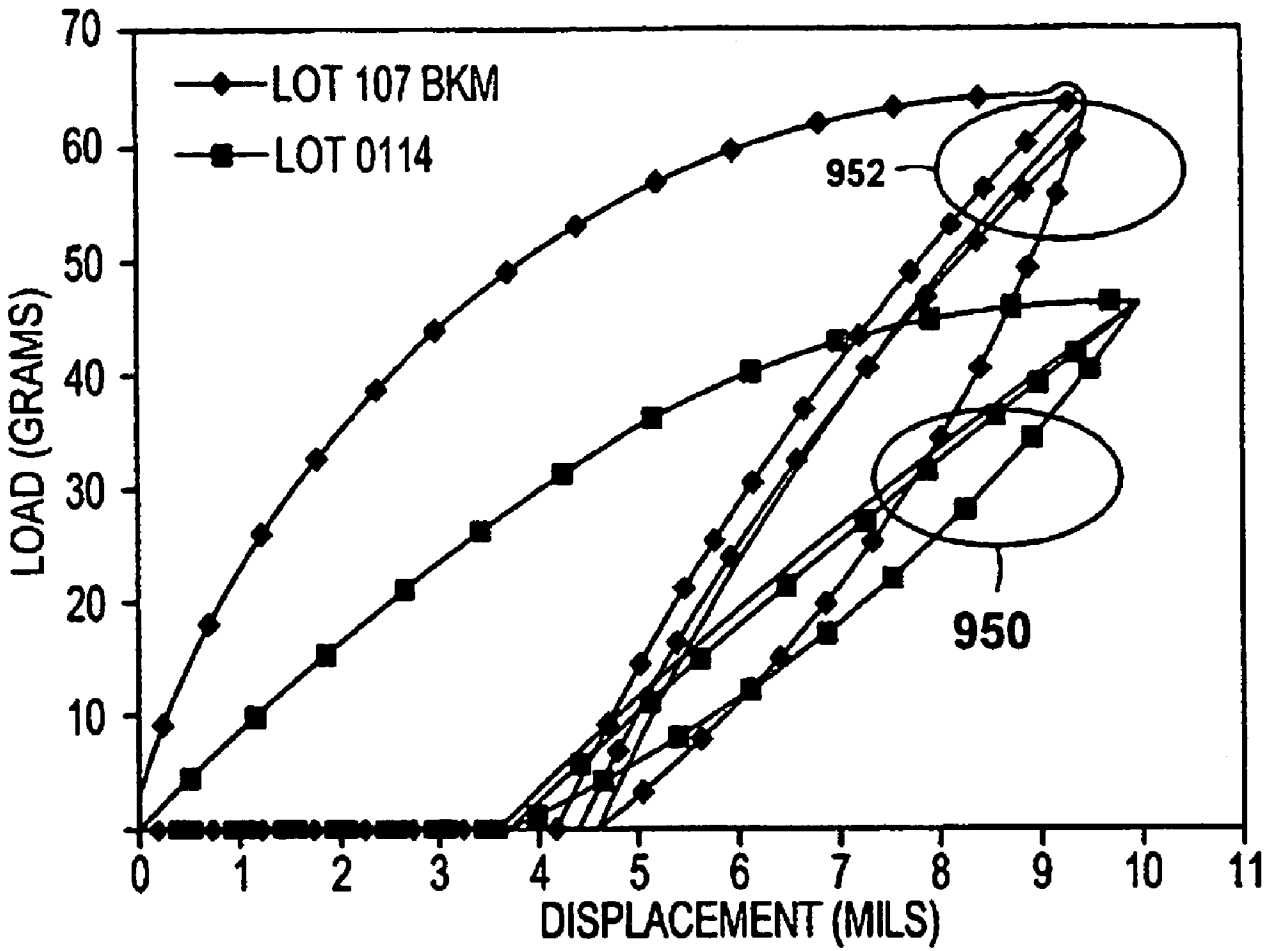
FIG. 9*e* is a graph that depicts load-displacement curves of exemplary contact arms in substrates with and without relief depressions, respectively.

As illustrated in FIG. 9*e*, which depicts load-displacement curves of contact arms in substrates with (950) and without (952) flow restrictors, the contacts not having restrictors are elastically much stiffer, requiring greater force to displace through a given distance.

In another variant of step 518, an adhesive layer and spring sheet through hole is tailored to produce an extruded bump that protrudes above the surface of the base of the spring sheet material. By proper arrangement of the position of the through hole, the extruded bump can be formed at least partially underneath a contact arm in a contact array formed from the spring sheet. For example, in an array of rolling beam contacts having the configuration illustrated in FIG. 9*c*, an extruded portion of layer 908 can be formed as a bump or region (see region 934) whose top surface is raised with respect to other portions of the substrate surface and whose raised surface lies underneath a distal end 903 of contact arm 902, such that the bump acts as a hard stop for contact arm 902 when it is displaced by contacting an external component.

In optional step 520, the process of step 518 is repeated for the substrate surface opposite of that used in step 518, resulting in a substrate having spring sheets that contain contact arrays joined to opposite sides of the substrate.

The contact array can be arranged so that each contact in the array is disposed on the interposer substrate near a respective conductive via to which it is electrically connected, or at some distance from the conductive via.

In other configurations of the present invention, during the bonding step of 518, the spring sheet may be joined to the interposer substrate such that the base of contacts are not located near vias. In this case, the array of contacts formed within the spring sheet may extend over portions of the substrate that do not contain vias. During the bonding steps 518 and 520, the array of contacts can be arranged with respect to substrate vias, so that contact arms of the contacts are located and extend in any desired direction with respect to vias to which the respective contact arms are to be electrically connected. Thus, because the contacts can be located remotely from vias, the contact arm design and length need not be constrained by the via size and via spacing. This facilitates the ability to increase the beam length of a contact arm and therefore the working range of the contacts, in comparison to contacts whose bases are formed around a via and whose distal ends are formed over vias, thereby limiting the contact arm length to the via diameter (see FIGS. 10*a-b*, discussed further below, for examples of the latter).

In step 522, the interposer substrate is subjected to a plating process. The plating process is used to plate desired portions of the substrate surface, which may include top and bottom surfaces, as well as vias (that may already be plated) that connect the top and bottom surfaces. This can serve to provide electrical connection, for example, between spring sheets disposed on opposite sides of the substrate, and therefore, contact elements on opposite sides of the substrate. Thus, vias extending from one substrate surface to the other surface become plated with a conductive layer that extends to the conductive sheet. After contacts residing on one or both surfaces of the substrate are subsequently singulated (electrically isolated by etching completely through the thickness the of spring sheet in a region surrounding each contact), the plated vias can serve as electrical connection paths between designated singulated contacts disposed on opposite surfaces of the substrate.

Preferably, in a preliminary sub-step before plating takes place, the interposer substrate is prepared for plating using a high pressure Al2O3 scrub process to remove debris and roughen surfaces to be plated.

The plating process can take place in two steps. In a first step, a relatively thinner electroless plating is performed. In one variant, the first step includes formation of a carbon seed layer. In the second step, an electrolytic plating process is performed. Step 522 can be used, for example, to form a continuous conductive layer that connects a conductive via to a spring sheet that is disposed on top of an adhesive layer separating the spring sheet from conductive layers coating the vias, which causes the contacts to be initially electrically isolated from the vias, as illustrated in FIG. 11.

Figure 11:
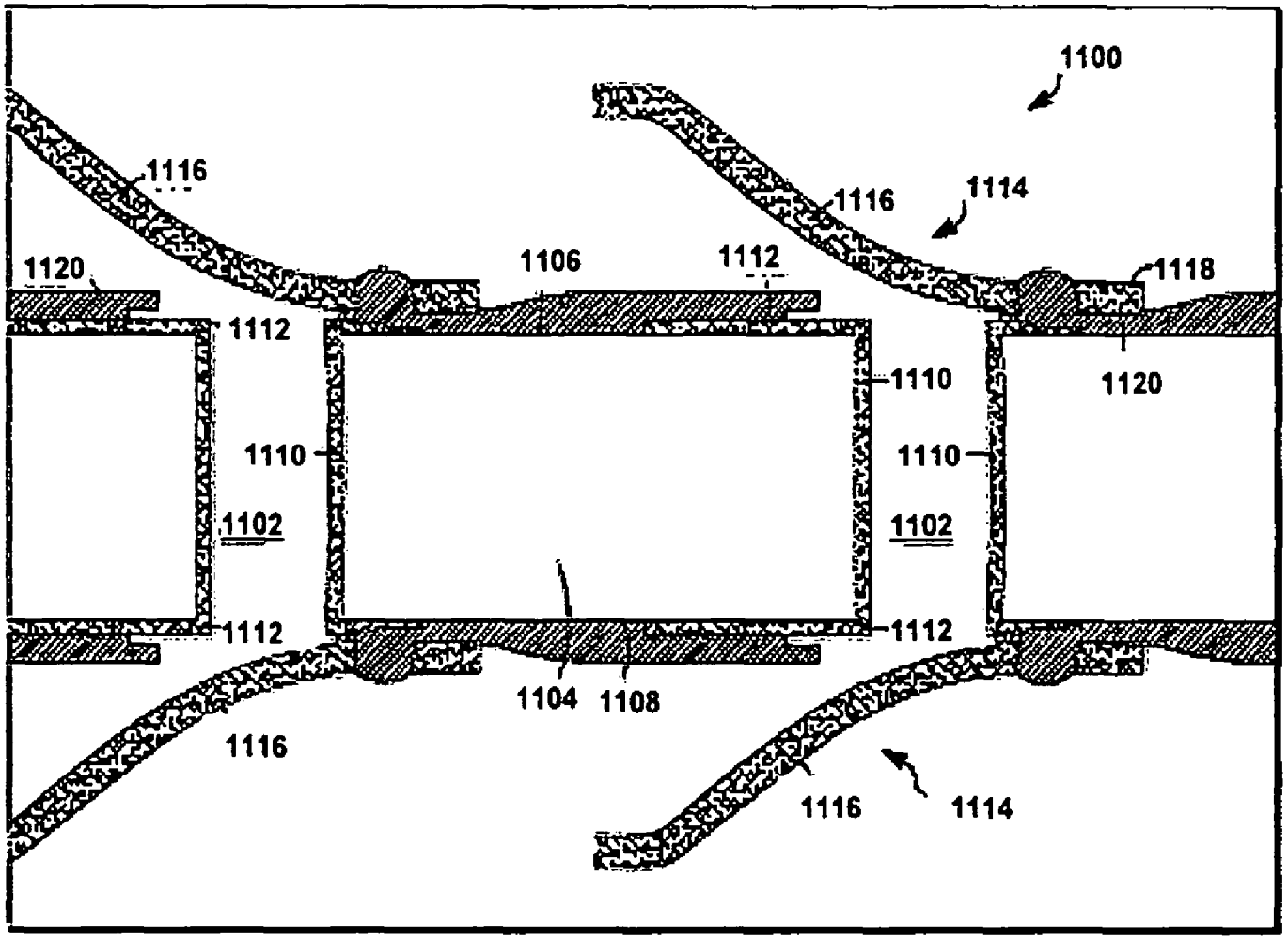
FIG. 11 is an image that illustrates a cross-sectional view of a portion of an interposer arranged according to another configuration of this invention.

FIG. 11 illustrates a cross-sectional view of a portion of an interposer 1100, arranged according to one configuration of this invention. The arrangement of FIG. 11 corresponds to a stage of processing after step 520 and before step 522. In the portion of interposer 1100 illustrated, two conductive vias 1102 extend through substrate 1104 from outer surface 1106 to outer surface 1108. The terms "outer surface" or "substrate surface," as used herein, refer to the substantially planar and relatively flat surfaces of the interposer, also referred to as top or bottom surfaces. It will be apparent that interposer 1100 can include dozens, hundreds, or thousands of conductive vias 1102, which can be arranged in a two dimensional X-Y pattern, for example. Vias 1102 can be, for example, cylindrical in shape. Vias 1102 can be regularly spaced, but need not be so spaced. For any X-Y array of vias, the spacing in the X-direction can differ from the spacing in the Y-direction.

Conductive vias 1102 include a conductive layer 1110 disposed on the vertical surface of the vias. In the exemplary interposer shown, the conductive layer 1110, together with surface conductive paths 1112, form a continuous metallic layer that extends from substrate surface 1106 to substrate surface 1108.

Surface conductive paths 1112 may comprise a metal cladding material and are electrically connected to via conductive layers 1110. Interposer 1100 also includes elastic contacts 1114 formed from a conductive sheet not visible in the figure. In the configuration illustrated in FIG. 11, elastic contacts 1114 are formed on both sides (top and bottom surfaces) of substrate 1104. However, in other configurations, contacts 1114 may be formed on a single side of substrate 1104. Elastic contacts 1114 include contact arm portions 1116 and base portions 1118, which can be formed according to methods described above, and further described in discussion to follow. Contact arms 1116 are electrically coupled to base portions 1118, although not in the plane of the cross-section illustrated. Although the contact arms 1116 are located directly above surface conductive paths 1112, the base portion 1118 of the contacts is clearly electrically isolated from the conductive paths 1112 by adhesive layer 1120. Accordingly, the plating process applied in step 522 is used to form a conductive layer that bridges the gap between layers 1110, 1112 and contacts 1114. In so doing, a continuous path can be formed between pairs of contacts 1114 disposed on opposite sides of the substrate.

Figure 12:
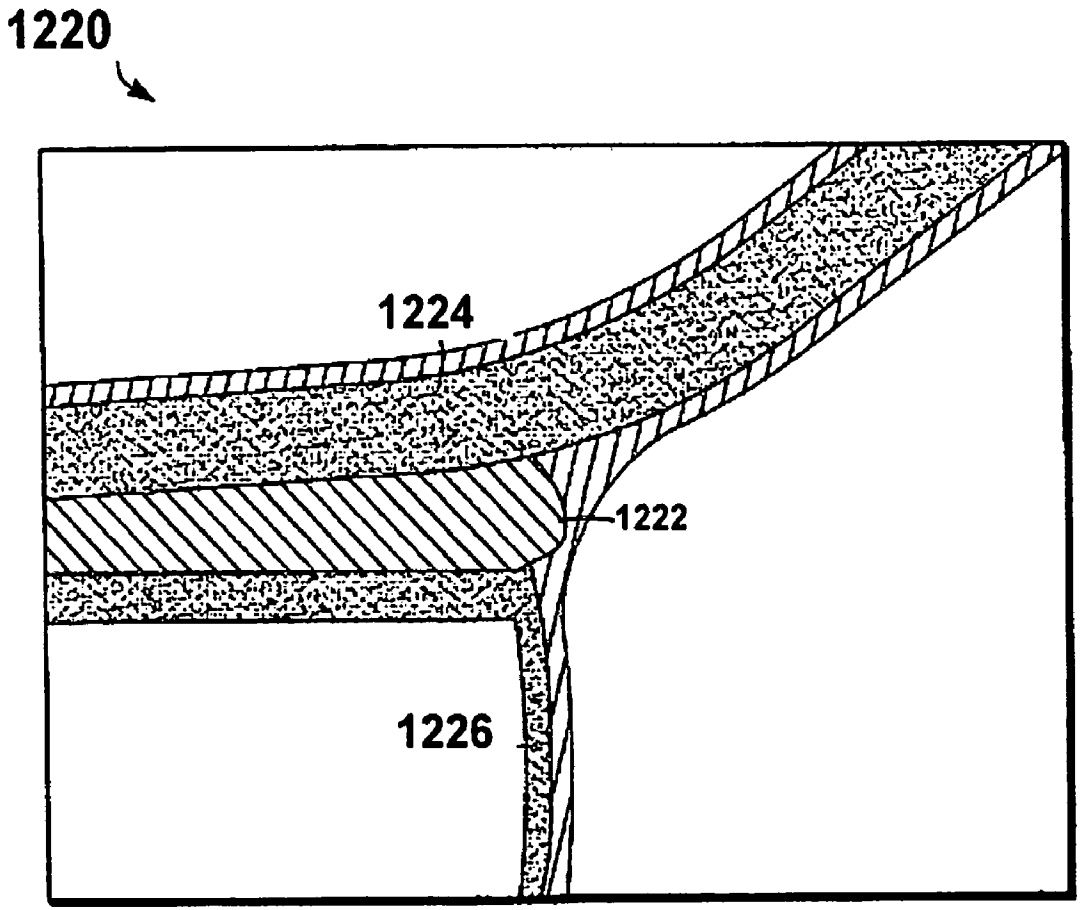
FIG. 12 is an image that illustrates a contact structure after formation of a conductive path between a contact and conductive via, according to one aspect of this invention.

FIG. 12 illustrates a contact structure 1220 after formation of a conductive path 1222 between a contact 1224 and conductive via 1226, according to one aspect of this invention.

In step 524, a photoresist material is applied to the substrate containing the spring sheet(s) and the resist layer is patterned to define individual contact elements within a spring sheet. In other words, the resist layer is patterned such that desired portions of the spring sheet between contact arms are unprotected by resist, while the contact arms and nearby portions are protected by the resist after development. In the case of a substrate with spring sheets applied on both surfaces, this step is performed for both substrate sides.

In step 526, an etch is performed that completely removes exposed portions of the spring sheet(s), such that individual contacts within a spring sheet become electrically isolated from each other (singulated). The contacts remain affixed to the substrate by a base portion defined in the singulation patterning process, such that the base portion (as well as contact arm(s)) is covered with resist during the etch. As described above, this process can also define conductive paths in the spring sheet material that lead from contacts to vias.

The singulated contacts are thus isolated from other contacts and from the spring sheet material, but can remain electrically connected to respective conductive vias through previous step 522.

If the singulated contacts are to be electrically connected to vias that do not lie underneath the contacts, the pattern of the exposed and developed resist layer can include remaining resist portions that define conductive paths from the contact base regions to the vias. For example, a patterned spring sheet can include holes having the approximate shape and size of vias and that are placed over vias when the spring sheet is bonded to a substrate. The spring sheet material would thus extend to the edge of the vias and can be connected to the conductive vias during step 522. During singulation of contacts contained within the spring sheet and located at a distance from the holes, the base portions can be isolated from other contacts by etching the spring sheet material immediately surrounding the portion of the spring sheet that is to constitute the contact base. However, a portion of the spring sheet can be protected during the singulation step that defines a path from the base portion to a conductive via, thus linking the base to the conductive via.

In a variant in which base portions of singulated contacts are to be connected to the ends of conductive paths formed on the surface of the interposer substrate underneath the adhesive layer, selected regions of the adhesive layer adjacent to the contact base can be removed to expose the conductive trace, and a subsequent plating process used to connect the trace to the base contact.

Figure 13:
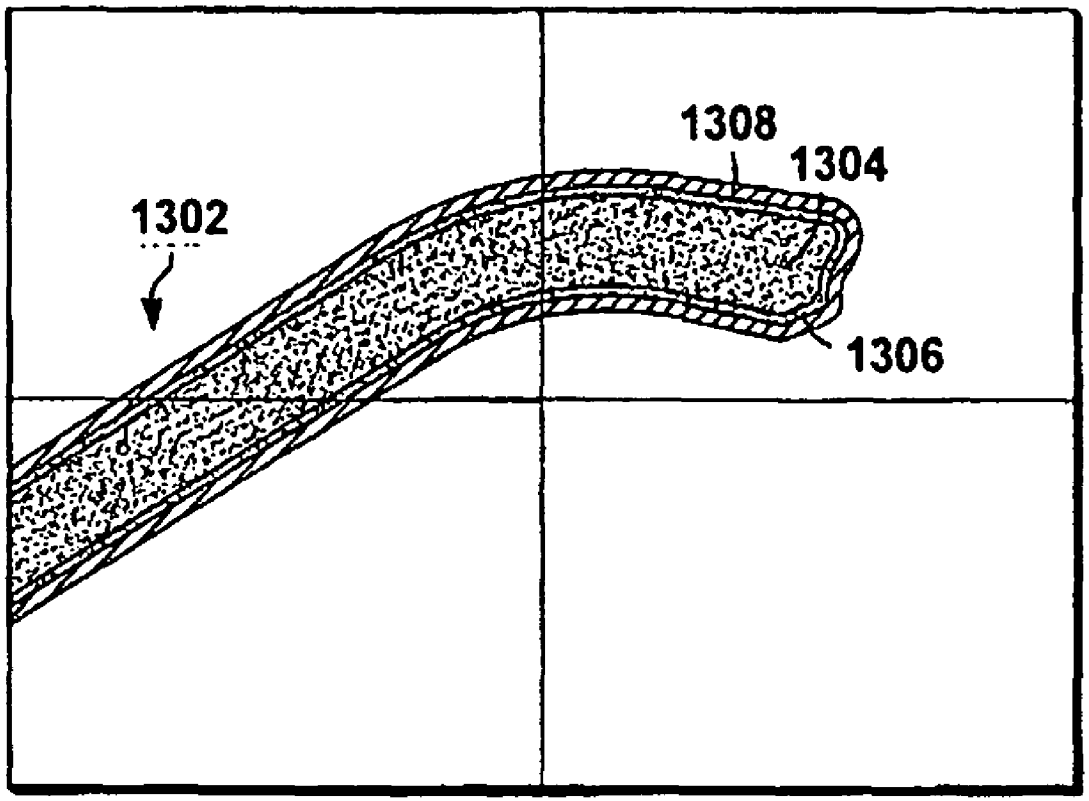
FIG. 13 is an image that illustrates a cross-sectional image of a contact arm, according to one configuration of the present invention.

After removal of resist, in step 528, an electroless plating process is performed to finish the contact elements. The electroless plating includes, for example, a Ni/Au stack (soft gold). The electroless plating is designed to add a coating layer to the contacts. Thus, in one configuration of the present invention, as illustrated in FIG. 13, the elastic contact arms 1302 contain an elastic core 1304, such as Be—Cu, typically 1-3 mils in thickness, which is coated in succession by plated Cu layer 1306 and Ni—Au layer 1308, having typical thicknesses in the range of 0.3-0.5 mils and 0.05-0.15 mils, respectively. The plated Cu and Ni—Au layers are preferably of a thickness that does not substantially degrade the elastic properties of the contact arms.

Figure 14:
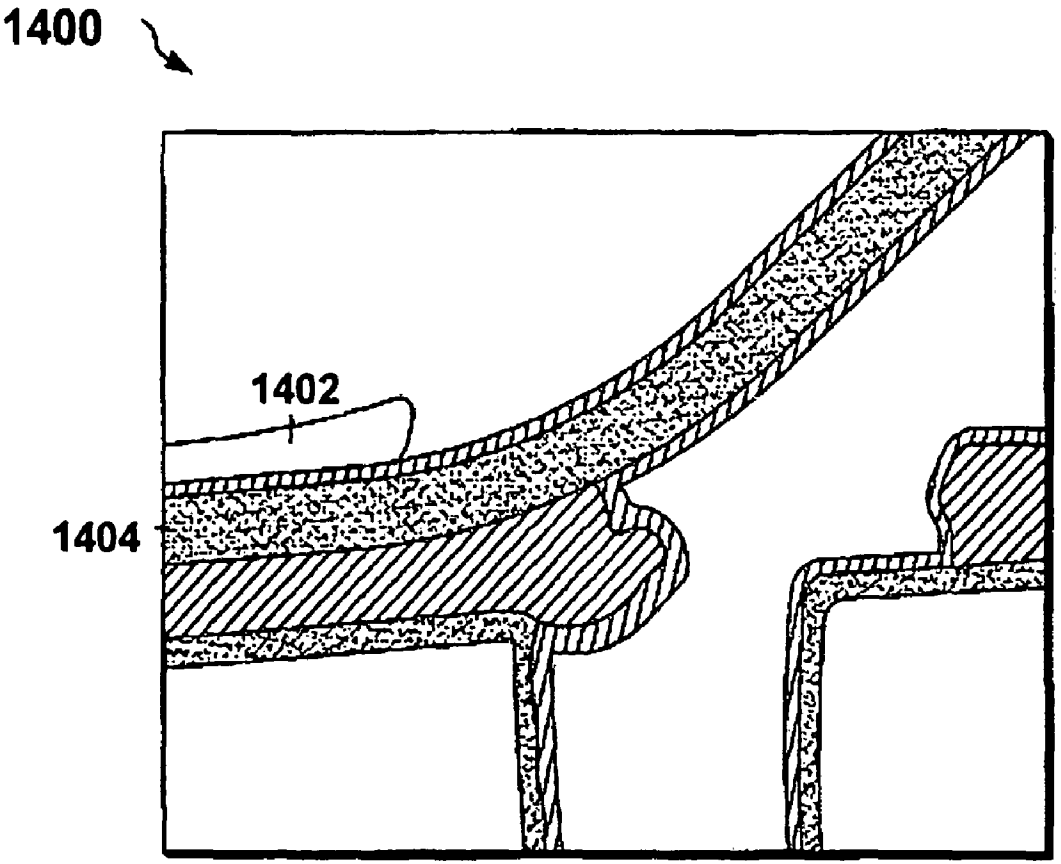
FIG. 14 is an image that illustrates an exemplary contact structure that includes a coverlay disposed on the contact.

In step 530, a coverlay is applied to the substrate having the array of isolated elastic contacts. The coverlay is a thin, semi-rigid material, for example, a bilayer material comprising an acrylic adhesive layer that faces and forms a bond to the substrate, and an upper layer, such as Kapton. The coverlay material is designed to encapsulate the contacts in regions adjacent to the contact arms. FIG. 14 illustrates a contact structure 1400 that includes coverlay 1402 on contact 1404.

The coverlay is preferably provided with holes that can be matched to the underlying substrate, such that the coverlay material does not extend substantially over contact arms of a contact or over vias provided in the substrate. The coverlay material can extend over the base portion of contacts up to the region where the elastic contact rises from the plane of the interposer substrate surface. By exact positioning of the end of the coverlay opening, the amount of counterforce from the coverlay layer acting on the contact arm can be modified such that the distal end of the contact arm is retained at a further distance above the substrate surface than without the coverlay present. The coverlay acts to provide a force to restrain the base of the contact when a force is applied to the contact arm, preventing rotation of the contact and separation from the substrate. This restraining force has the additional effect of retaining the distal end of the contact at a further distance above the surface of the substrate, which can increase the contact working distance on the order of 10% or so for contacts in the size range of about 40 mils.

As depicted in FIG. 5*b*, according to a different aspect of the present invention, exemplary steps involved are the same as those outlined in FIG. 5*a* up to and including step 524.

In step 550, a partial etch of the spring sheet is performed. The etch is performed such that a large portion of the spring sheet material is removed, wherein the contacts are nearly singulated. For example, the relative depth of the etched portions of the spring sheet can be 40-60% of the spring sheet thickness.

In step 552, the resist is stripped.

In step 554, resist is reapplied to the spring sheet(s) and the resist is patterned such that only the previously etched (exposed) portions of the substrate are masked after exposure and development.

In step 556, the substrate is exposed to an electrolytic plating process, such as a Cu/Ni/Au (hard gold) process. This serves to coat contact arms and portions of contacts near the contact arms that were exposed after resist development.

In step 558, the resist is removed to expose previous partially etched scribe lines.

In step 560, the interposer substrate is subjected to an etch, with the electrolytic Ni/Au that coats the contact arms and adjacent areas acting as a protective hard mask, such that the regions between contacts containing thin layers of spring sheet are completely removed, resulting in singulated contacts.

In step 562, a coverlay material is applied.

Figure 15:
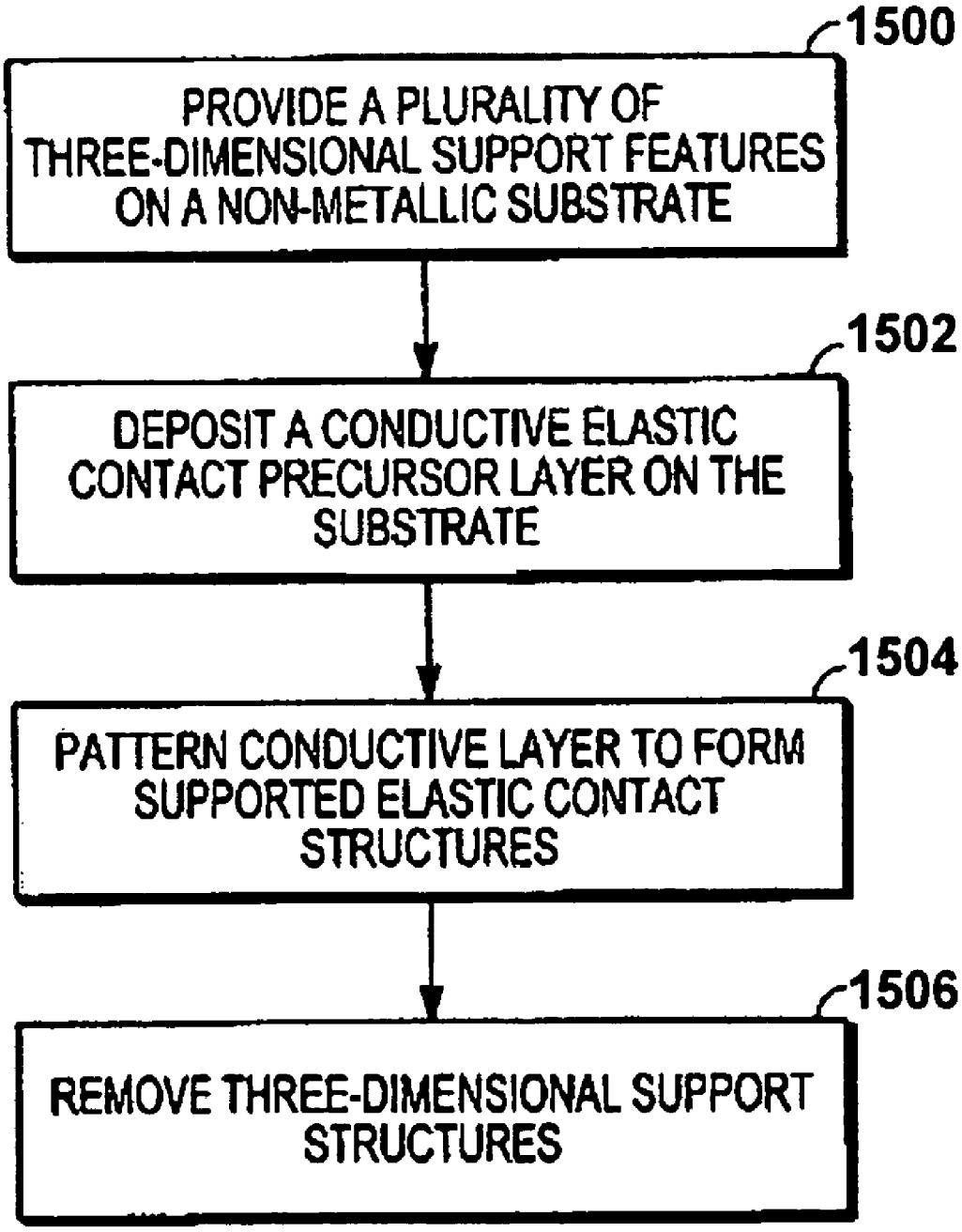
FIG. 15 is a schematic diagram that illustrates a method for forming an interposer, according to another aspect of this invention.

FIG. 15 illustrates exemplary steps involved in a method for forming an array connector, according to another aspect of this invention. The steps outlined in FIG. 15 are useful, for example, for fabricating single sided array connectors. The array connectors fabricated in accordance with the process of FIG. 15 can be formed on non-metallic substrates, such as a PCB board, a silicon wafer, or a ceramic substrate. The term "non-metallic substrates," as used herein, refers to substrates that are poor electrical conductors or electrical insulators, and can include semiconductor substrates as well as electrically insulating substrates.

The method that is outlined generally in FIG. 15, and disclosed in several variations with respect to FIGS. 16*a*-19*h* discussed below, facilitates fabrication of elastic contact arrays having contact size and pitch on the scale of microns or tens of microns, as opposed to the millimeter scale of present day connectors having elastic contacts. Advances in semiconductor technologies have led to shrinking dimensions within semiconductor integrated circuits and particularly, decreasing pitch for the contact points on a silicon die or a semiconductor package. The pitch, that is, the spacing between each electrical contact point (also referred to as a "lead") on a semiconductor device is decreasing dramatically in certain applications. For example, contact pads on a semiconductor wafer can have a pitch of 250 microns (10 mils) or less. At the 250-micron pitch level, it is very difficult and prohibitively expensive to use conventional techniques to make separable electrical connections to these semiconductor devices. The problem is becoming even more critical as the pitch of contact pads on a semiconductor device decreases below 50 microns and simultaneous connection to multiple contact pads in an array is required.

In step 1500, a non-conducting substrate is provided with a plurality of three dimensional support structures on a surface of the substrate. Details of an exemplary process used for forming the three dimensional support structures are disclosed in the discussion to follow with respect to FIGS. 16*a*-19*h*. In one example in which the substrate is a silicon wafer, the three dimensional support structures can be formed by depositing a blanket support layer, lithographically patterning the support layer, and selectively removing portions of the support layer. The remaining portions of the support layer form three dimensional support features that can be used to define the elastic contacts. Because semiconductor lithography processes using fine featured masks can be employed in the step of patterning the support layer, the three dimensional support features can have lateral dimensions on the order of microns or smaller. Accordingly, contact arms that are in part defined by the support features can be fabricated having dimensions similar to the support features.

However, the process of step 1502 can also be used in conjunction with PCB-type substrates provided, for example, with conductive vias. The scale of three dimensional support features arranged on a PCB-type substrate can be tailored toward the appropriate contact size to be used on the PCB substrate.

In step 1502, a conductive elastic contact precursor layer is deposited on the substrate provided with the support features. The term "conductive elastic contact precursor layer" refers to a metallic material that is generally formed as a layer on top of the substrate, and typically is at least partially conformal, such that a continuous layer is formed on flat parts of the substrate, as well as on the three dimensional support features. The term "precursor" is used to indicate that the metallic layer is a precursor to the final elastic contacts, in that the final elastic contacts are formed from the metallic layer. The mechanical properties of the metallic precursor layer are such that the desired elastic properties can be obtained once contact arms are formed. The metallic layer can be, for example, a Be—Cu alloy.

In step 1504, the metallic layer is patterned to form supported elastic contact structures. The term "supported elastic contact structures" refers to the fact that such structures have the general shape and size of the final elastic contacts of the contact array, but are not free-standing. In other words, at least portions of the contact arms are disposed on top of the support structures and are not free to move. The metallic layer patterning that forms the elastic contact support structures may also be used to singulate the contact structures. In this case, as in the case of singulation of spring sheets described above, individual contact structures are electrically isolated from other contact structures by removing at least portions of the metallic layer between the elastic contacts.

In step 1506, the support structures are selectively removed, leaving an array of three dimensional contacts having contact arms that extend above the substrate surface, and whose shape is in part defined by the removed three dimensional support structures.

Many variations of the above method are possible, as described below. For example, substrates can be provided with internal conductive paths that form circuits that connect to the elastic contacts on the substrate surface. Additional conductive layers can be provided on the substrate below the support layer that serve to extend base portions of the contacts.

According to another aspect of the present invention, a method for forming a connector having an array of contact elements includes providing a substrate, forming a support layer on the substrate, patterning the support layer to define an array of support elements, isotropically etching the array of support elements to form rounded corners on the top of each support element, forming a metal layer on the substrate and on the array of support elements, and patterning the metal layer to define an array of contact elements where each contact element includes a first metal portion on the substrate and a second metal portion extending from the first metal portion and partially across the top of a respective support element. The method further includes removing the array of support elements. The array of contact elements thus formed each includes a base portion attached to the substrate and a curved spring portion extending from the base portion and having a distal end projecting above the substrate. The curved spring portion is formed to have a concave curvature with respect to the surface of the substrate.

According to another aspect of the present invention, a method for forming a connector including an array of contact elements includes providing a substrate, providing a conductive adhesion layer on the substrate, forming a support layer on the conductive adhesion layer, patterning the support layer to define an array support elements, isotropically etching the array of support elements to form rounded corners on the top of each support element, forming a metal layer on the conductive adhesion layer and on the array of support elements, patterning the metal layer and the conductive adhesion layer to define an array of contact elements. Each contact element includes a first metal portion formed on a conductive adhesion portion and a second metal portion extending from the first metal portion and partially across the top of a respective support element. The method further includes removing the array of support elements.

Figure 16A:
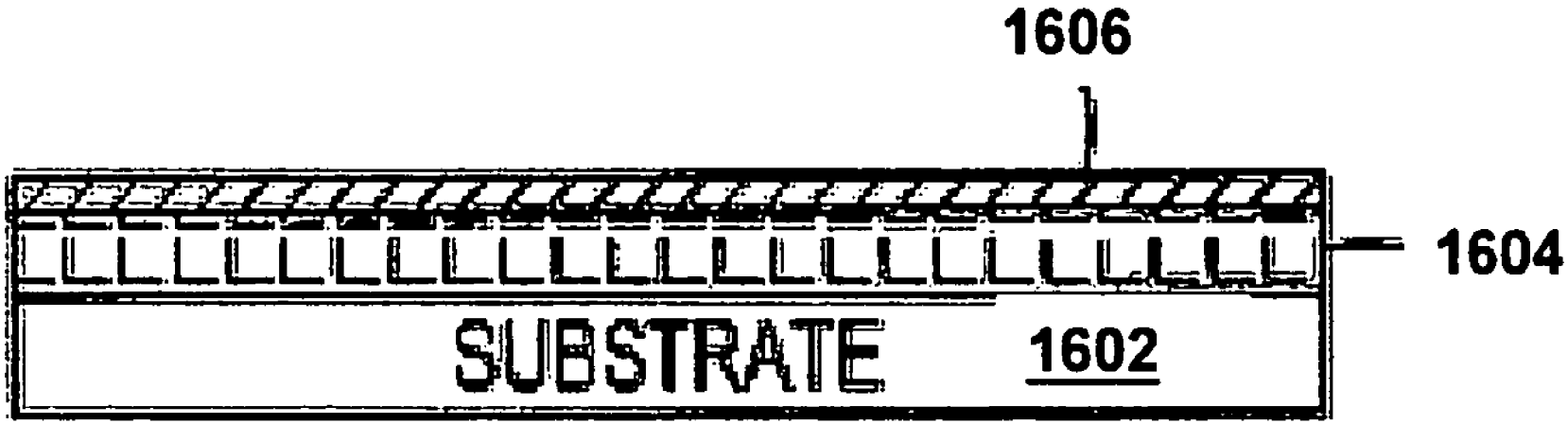
FIGS. 16*a* to 16*h* are schematic drawings that illustrate the processing steps for forming a connector according to one aspect of the present invention.
Figure 16B:
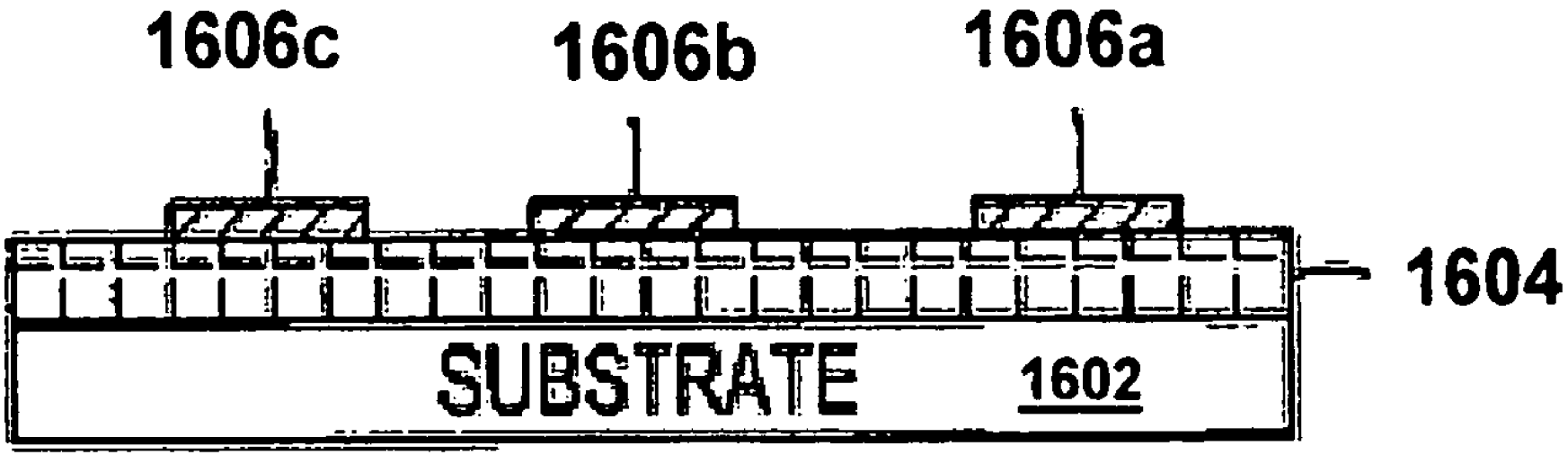

FIGS. 16*a* to 16*h* illustrate the processing steps for forming a connector containing an array of elastic contacts, according to one aspect of the present invention. Referring to FIG. 16*a*, a substrate 102 on which the contact elements are to be formed is provided. Substrate 1602 can be a silicon wafer or ceramic wafer for example and may include a dielectric layer formed thereon (1604). As described above, a dielectric layer of SOS, SOG, BPTEOS, or TEOS layer can be formed on substrate 1602 for isolating the contact elements from substrate 1602. Then, a support layer 1604 is formed on substrate 1602. Support layer 1604 can be a deposited dielectric layer, such as an oxide or nitride layer, a spin-on dielectric, a polymer, or any other suitable etchable material. In one configuration, support layer 1604 is deposited by a chemical vapor deposition (CVD) process. In another configuration, support layer 1604 is deposited by a plasma vapor deposition (PVD) process. In yet another configuration, support layer 1604 is deposited by a spin-on process. In yet another configuration, when substrate 1602 is not covered by a dielectric layer or a conductive adhesive layer, the support layer can be grown using an oxidation process commonly used in semiconductor manufacturing.

After the support layer 1604 is deposited, a mask layer 1606 is formed on the top surface of support layer 1604. Mask layer 1606 is used in conjunction with a conventional lithography process to define a pattern on support layer 1604 using mask layer 1606. After the mask layer is printed and developed (FIG. 16*b*), a mask pattern, including regions 1606*a* to 1606*c*, is formed on the surface of support layer 1604 defining areas of support layer 1604 to be protected from subsequent etching.

Figure 16C:
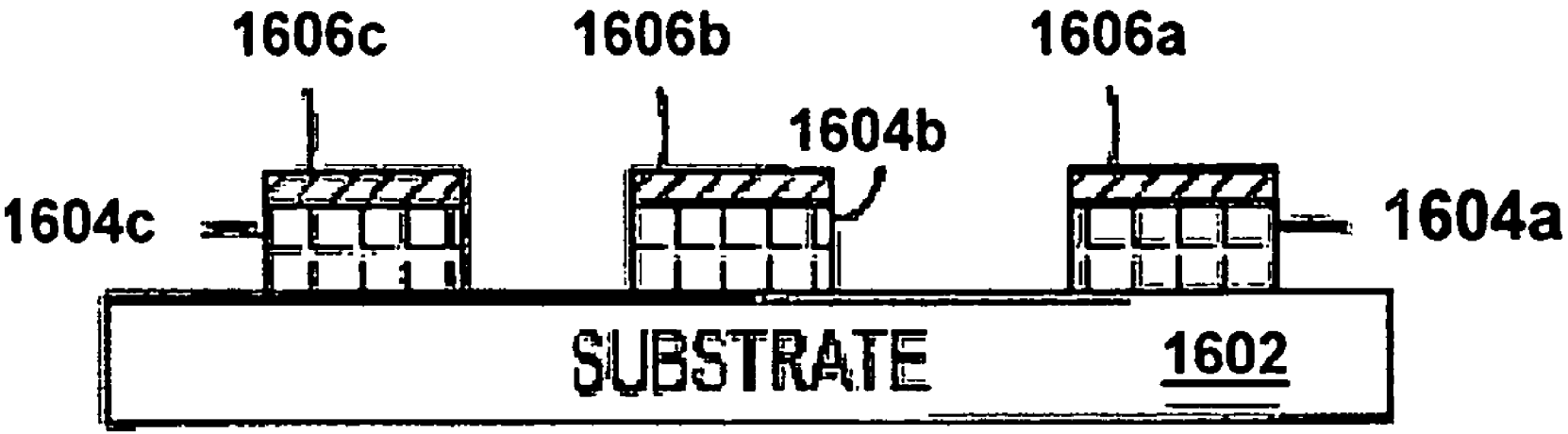
Figure 16D:
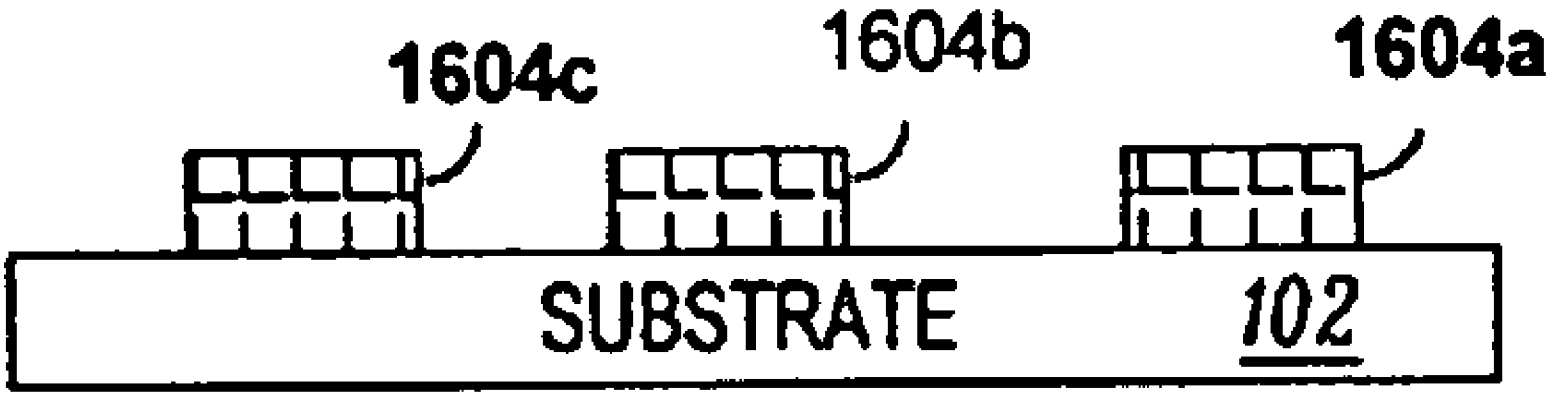

Referring to FIG. 16*c*, an anisotropic etching process is performed using regions 1606*a* to 1606*c* as a mask. As a result of the anisotropic etching process, support layer 1604 not covered by a patterned mask layer is removed. Accordingly, support regions 1604*a* to 1604*c* are formed. The mask pattern including regions 1606*a* to 1606*c* is subsequently removed to expose the support regions (FIG. 16*d*).

Figure 16E:
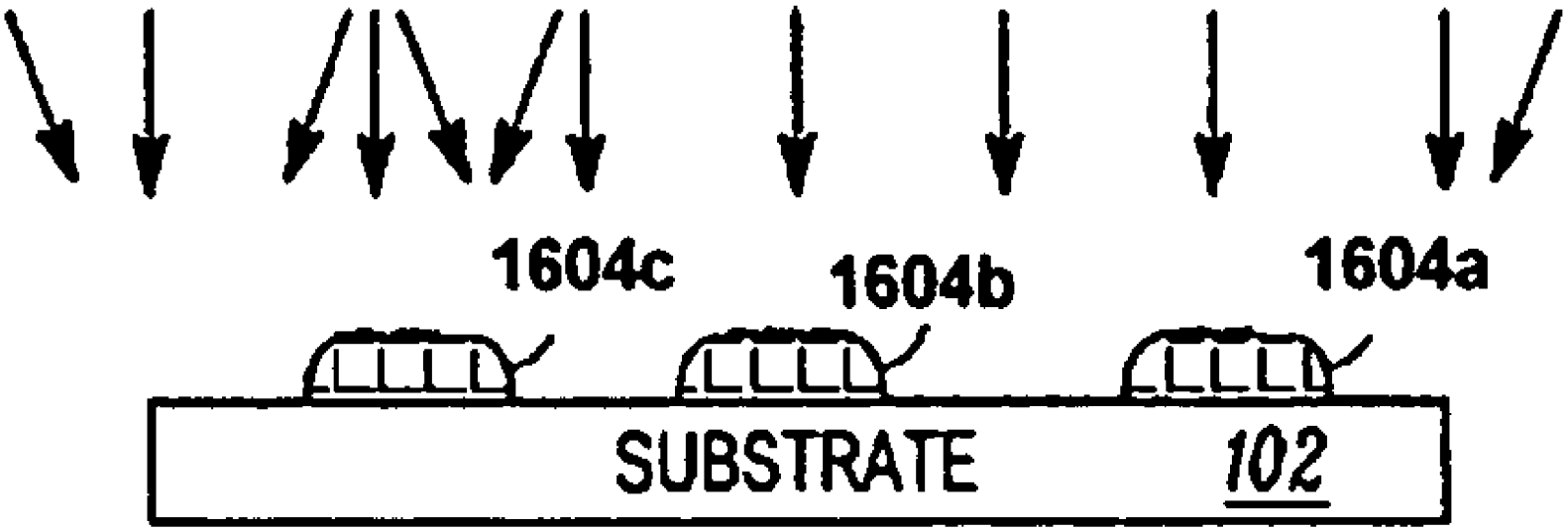

Referring to FIG. 16*e*, support regions 1604*a* to 1604*c* are then subjected to an isotropic etching process. An isotropic etching process removes material under etch in the vertical and horizontal directions at substantially the same etch rate. Thus, as a result of the isotropic etching, the top corners of support regions 1604*a* to 1604*c* are rounded off as shown in FIG. 16*e*. In one configuration, the isotropic etching process is a plasma etching process using SF6, CHF3, CF4 or other well known chemistries commonly used for etching dielectric materials. In an alternate configuration, the isotropic etching process is a wet etch process, such as a wet etch process using a buffered oxide etch (BOE).

Then, referring to FIG. 14*f*, a metal layer 1608 is formed on the surface of substrate 1602 and the surface of support regions 1604*a* to 1604*c*. Metal layer 1608 can be a copper layer or a copper-alloy (Cu-alloy) layer or a multilayer metal deposition such as Tungsten coated with Copper-Nickel-Gold (Cu/Ni/Au). In a preferred configuration, the contact elements are formed using a small-grained copper beryllium (CuBe) alloy and then plated with electroless Nickel-Gold (Ni/Au) to provide a non-oxidizing surface. Metal layer 108 can be deposited by a CVD process, by electro plating, by sputtering, by physical vapor deposition (PVD) or using other conventional metal film deposition techniques. A mask layer is deposited and patterned into mask regions 1610*a* to 1610*c* using a conventional lithography process. Mask regions 1610*a* to 1610*c* define areas of metal layer 1608 to be protected from subsequent etching.

Figure 16F:
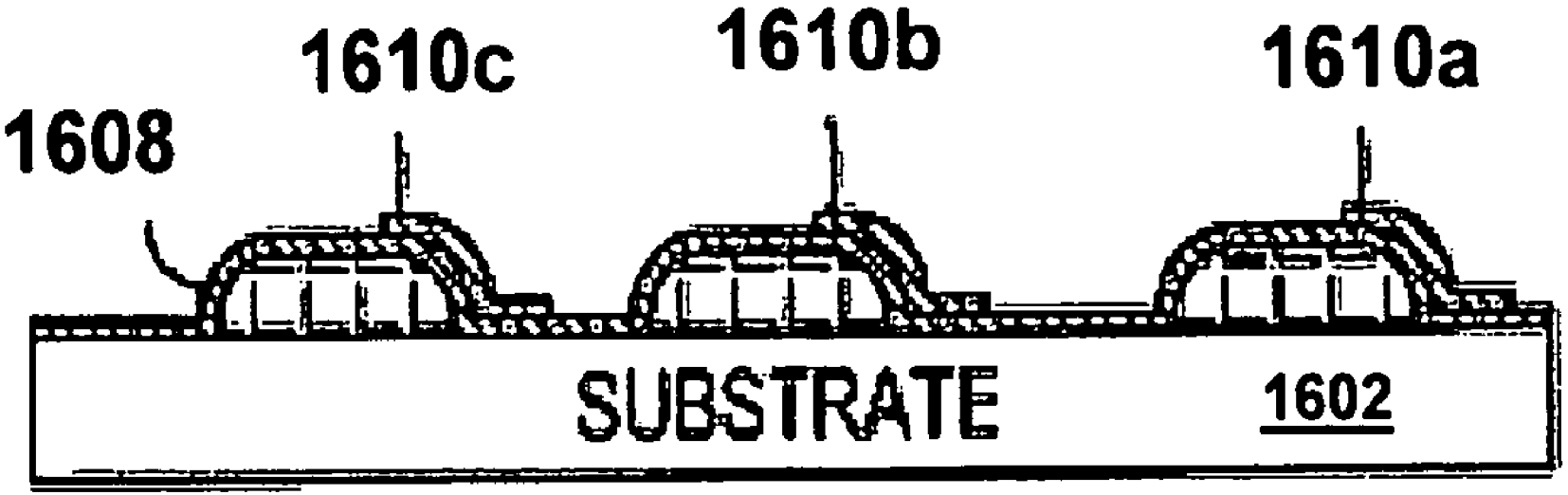
Figure 16G:
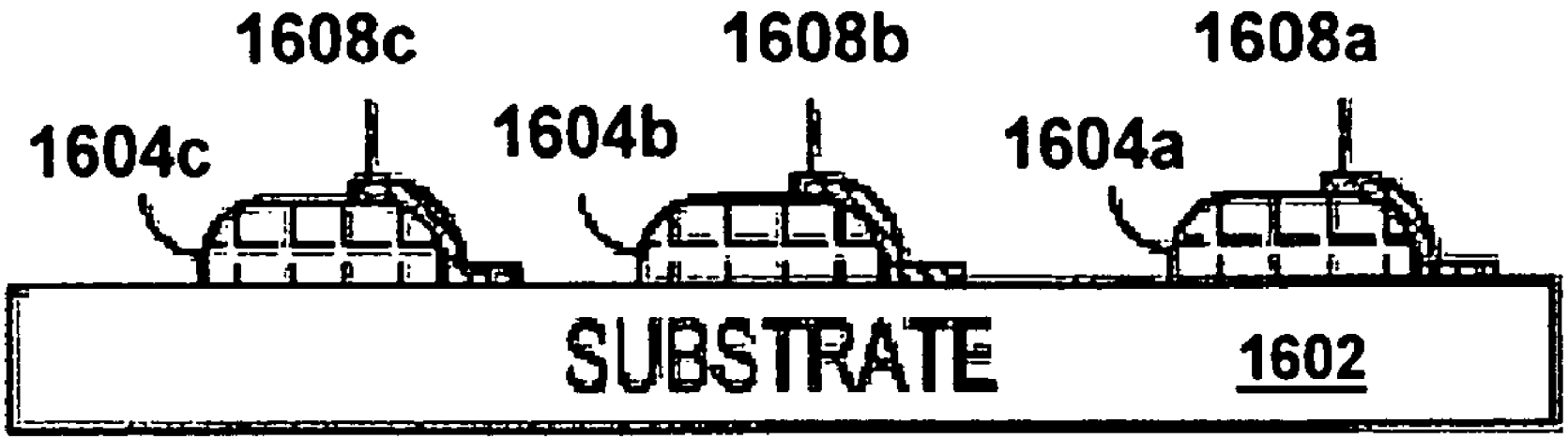
Figure 16H:
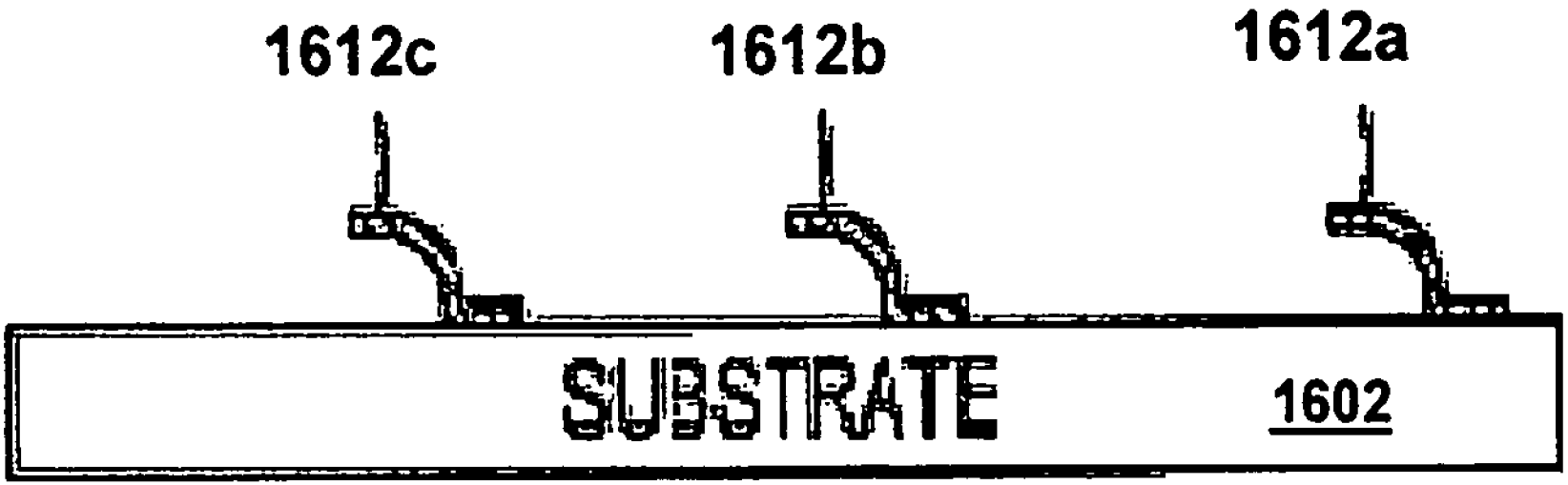

Then, the structure in FIG. 16*f* is subjected to an etching process for removing metal layer not covered by mask regions 1610*a* to 1610*c*. As a result, metal portions 1608*a* to 1608*c* are formed as shown in FIG. 16*g*. Each of metal portions 1608*a* to 1608*c* includes a base portion formed on substrate 1602 and a curved spring portion formed on a respective support region (1604*a* to 1604*c*). Accordingly, the curved spring portion of each metal portion assumes the shape of the underlying support region, projecting above the substrate surface and having a curvature that provides a wiping action when engaging a contact point.

To complete the connector, support regions 1604*a* to 1604*c* are removed (FIG. 16*h*), such as by using a wet etch or an anisotropic plasma etch or other etch process. If the support layer is formed using an oxide layer, a buffered oxide etchant can be used to remove the support regions. As a result, free standing contact elements 1612*a* to 1612*c* are formed on substrate 1602.

One of ordinary skill in the art, upon being apprised of the present invention, would appreciate that many variations in the above processing steps are possible to fabricate the connector of the present invention. For example, the chemistry and etch condition of the isotropic etching process can be tailored to provide a desired shape in the support regions so that the contact elements thus formed have a desired curvature. Thus, because contact properties can be altered by changing the contact shape, the processing steps describe above provide a method for tailoring contact properties by facilitating the ability to etch contact elements to obtain desired shapes. Furthermore, one of ordinary skill in the art would appreciate that through the use of semiconductor processing techniques, a connector can be fabricated with contact elements having a variety of properties. For example, a first group of contact elements can be formed with a first pitch while a second group of contact elements can be formed with a second pitch greater or smaller than the first pitch. Other variations in the electrical and mechanical properties of the contact element are possible, as will be described in more detail below.

FIGS. 17*a* to 17*h* illustrate the processing steps for forming a connector according to one configuration of the present invention. The processing steps shown in FIGS. 17*a* to 17*h* are substantially the same as the processing steps shown in FIGS. 16*a* to 16*h*. However, FIGS. 17*a* to 17*h* illustrate that different configuration of contact elements can be fabricated by using suitably designed mask patterns.

Figure 17A:
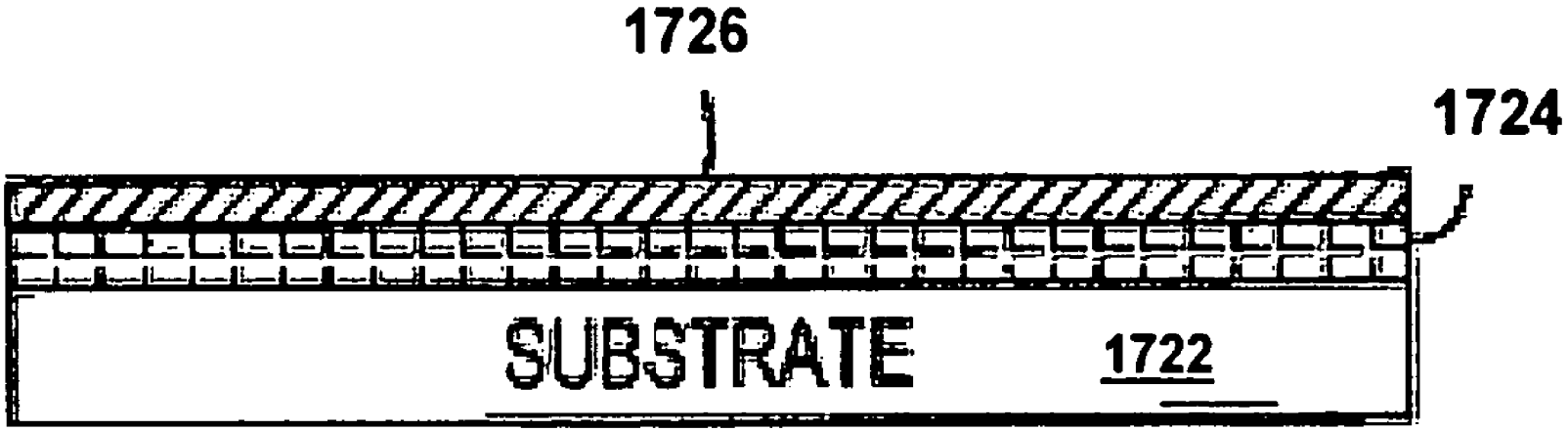
FIGS. 17*a* to 17*h* are schematic drawings that illustrate the processing steps for forming a connector according to one aspect of the present invention.
Figure 17B:
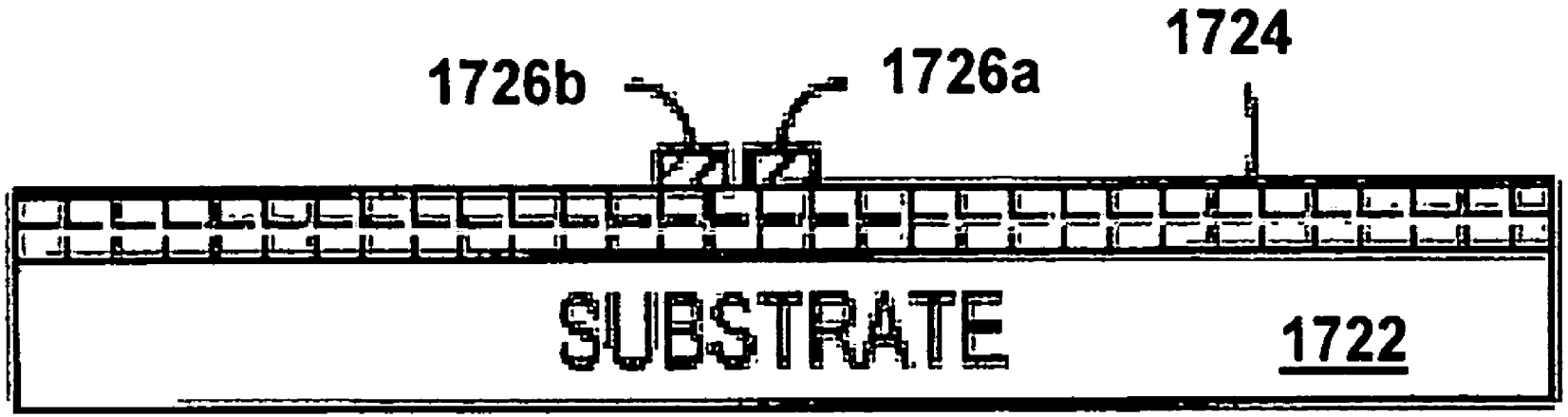

Referring to FIG. 17*a*, a support layer 1724 is formed on a substrate 1722. A mask layer 1726 is formed on the support layer for defining mask regions for forming the connector. In the present configuration, mask regions 1726*a* and 1726*b* (FIG. 17*b*) are positioned close together to allow a contact element including two curved spring portion to be formed.

Figure 17C:
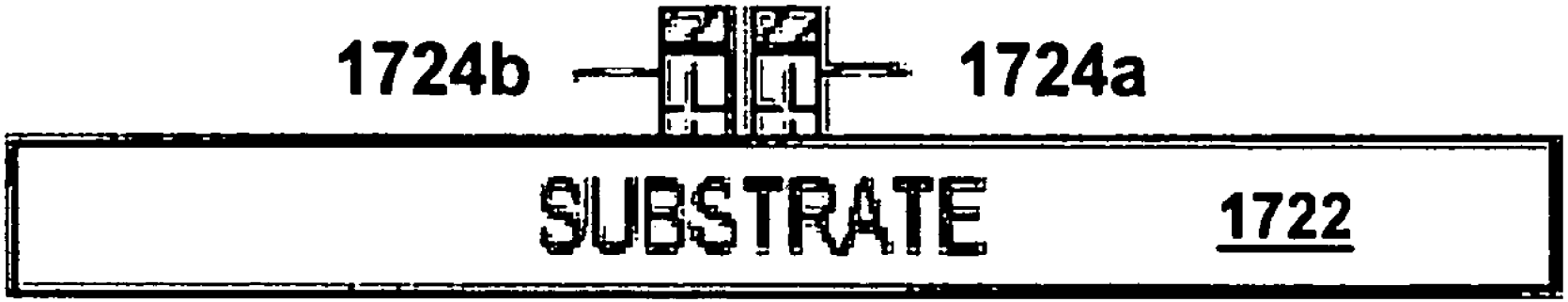
Figure 17D:
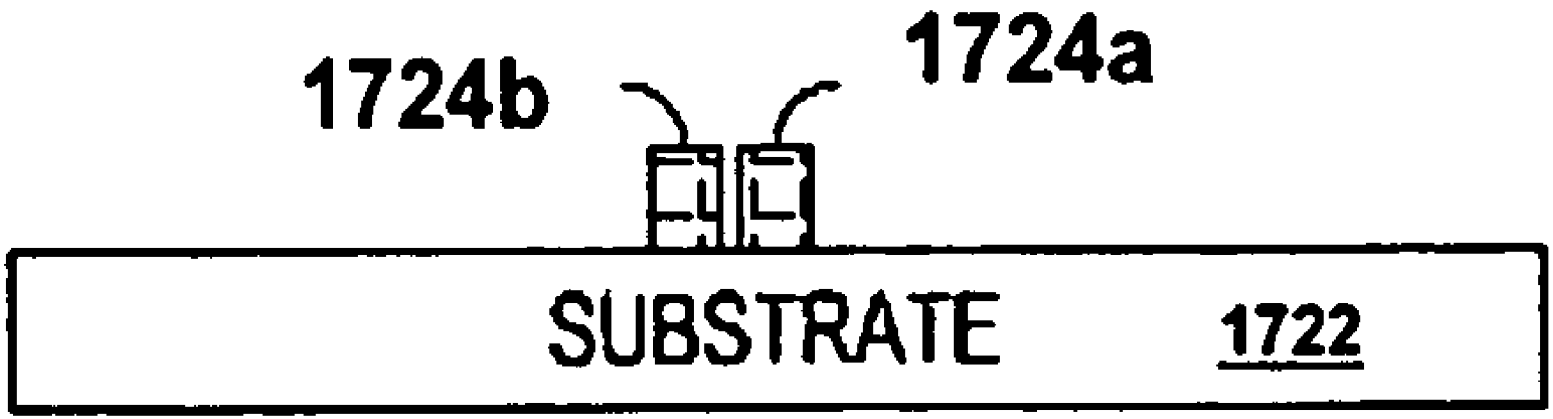
Figure 17E:
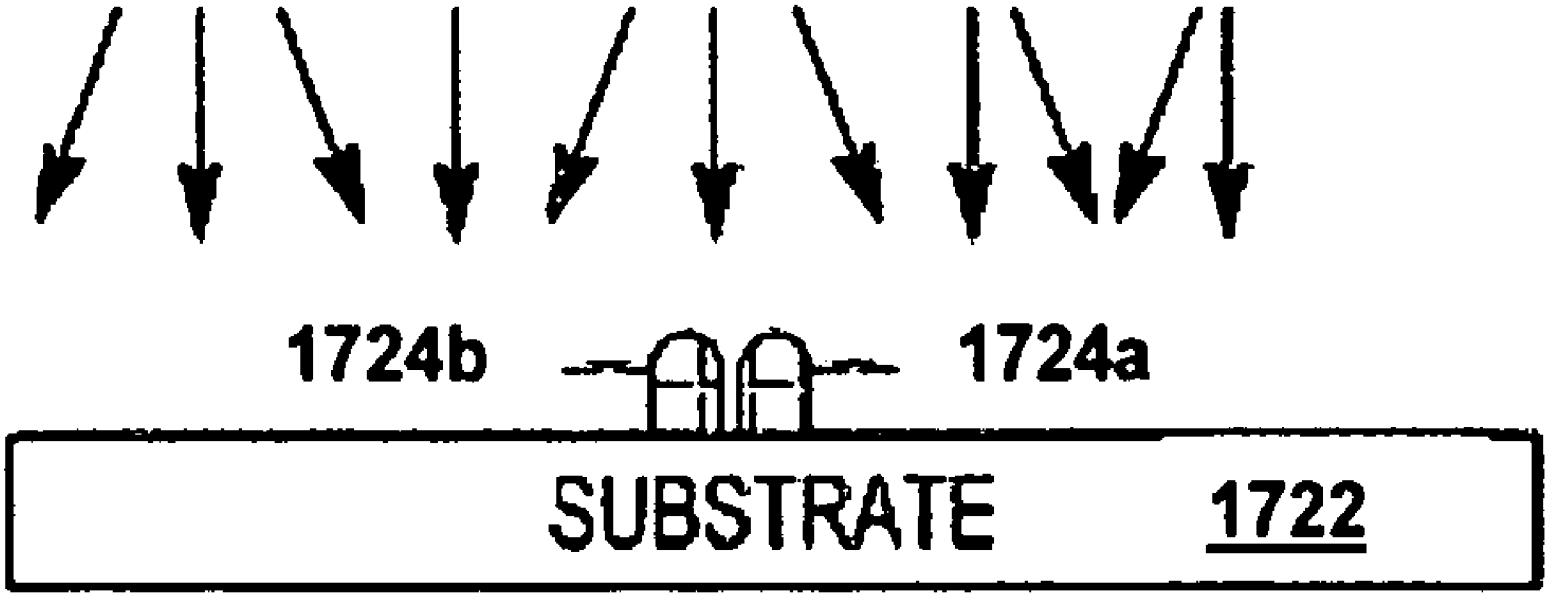

After an isotropic etching process is performed using mask regions 1726*a* and 1726*b* as mask, support regions 1724*a* and 1724*b* are formed (FIG. 17*c*). The mask regions are removed to expose the support regions (FIG. 17*d*). Then, support regions 1724*a* and 1724*b* are subjected to an isotropic etching process to shape the structures so that the top surface of the support regions includes rounded corners (FIG. 17*e*).

Figure 17F:
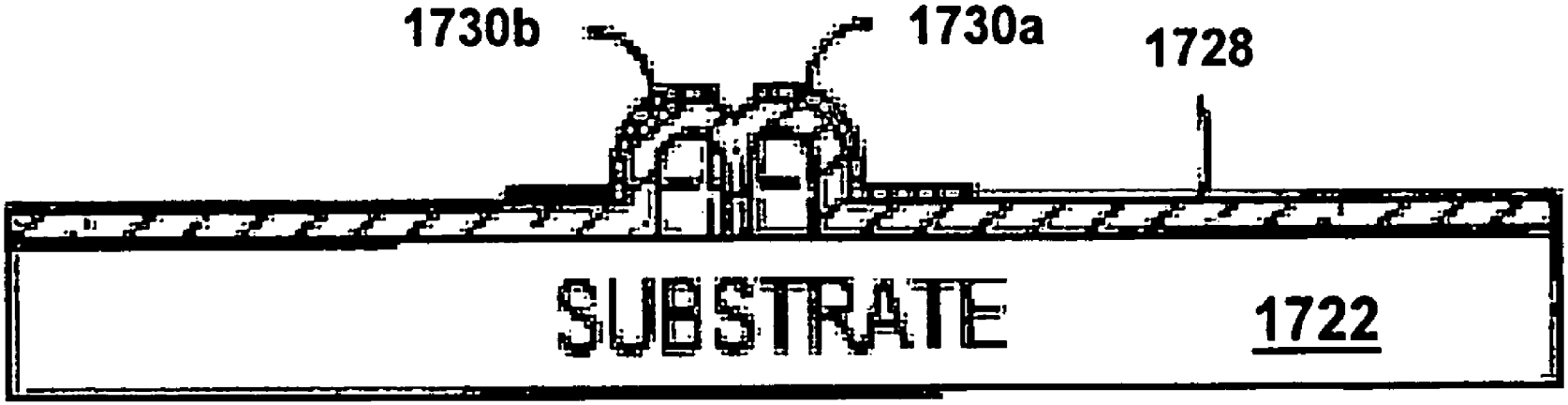
Figure 17G:
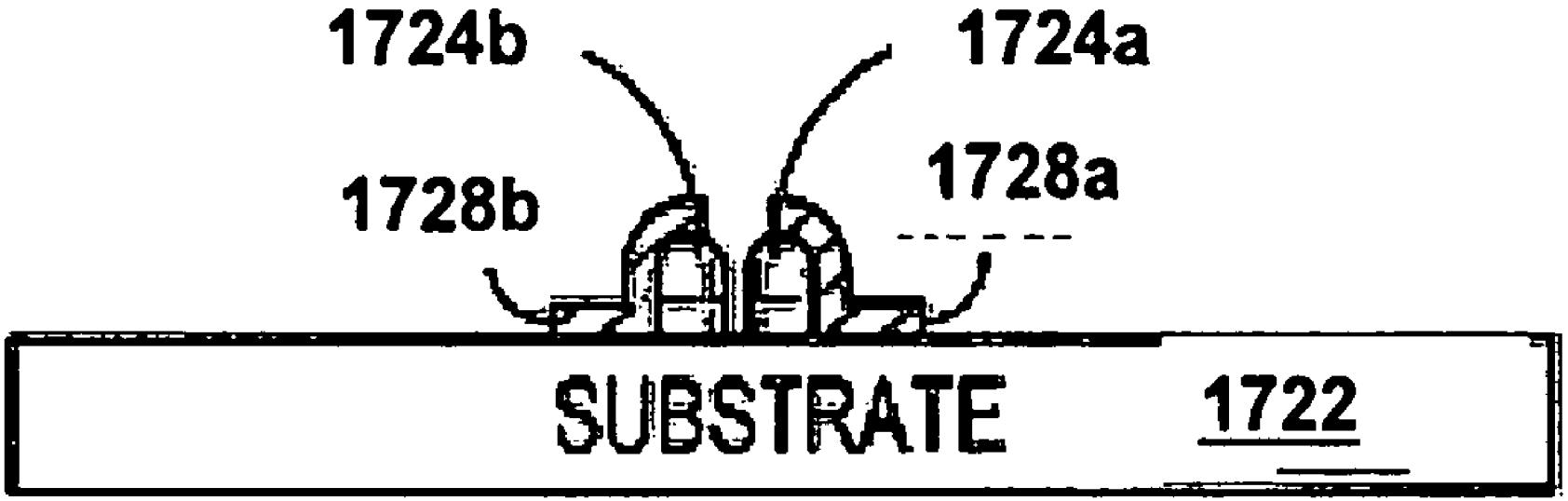
Figure 17H:
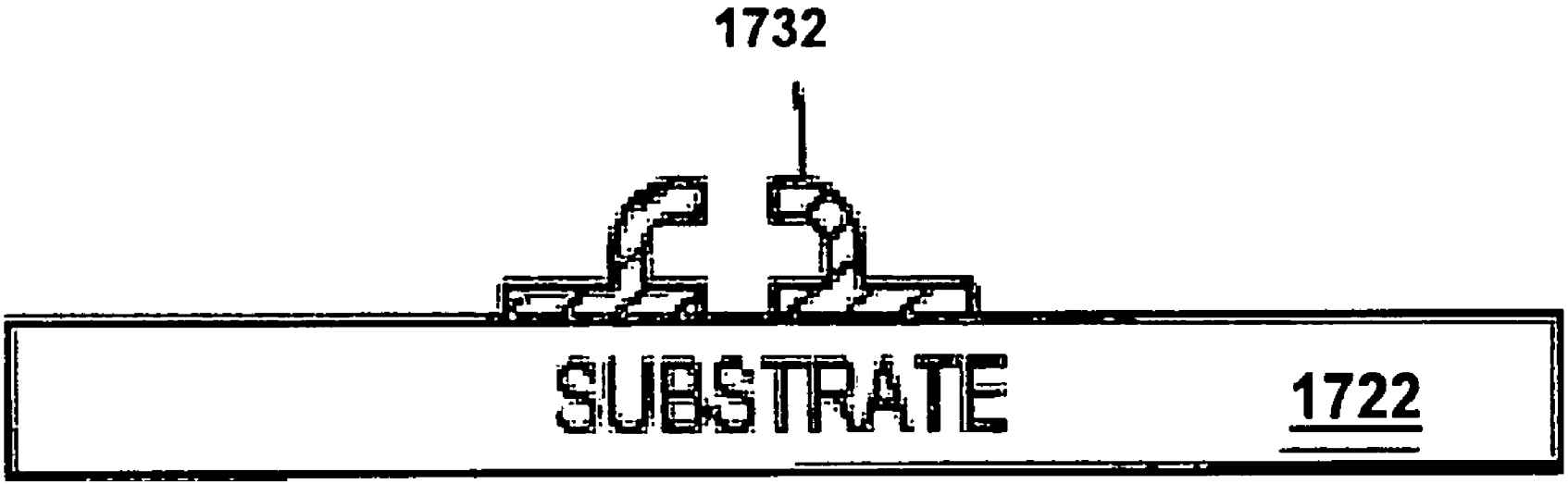

A metal layer 1728 is deposited over the surface of substrate 1722 and over the top surface of support regions 1724*a* and 1724*b* (FIG. 17*f*). A mask pattern, including regions 1730*a* and 1730*b*, is defined on metal layer 1728. After metal layer 1728 is etched using mask regions 1730*a* and 1730*b* as mask, metal portions 1728*a* and 1728*b* are formed (FIG. 17*g*). Each of metal portions 1728*a* and 1728*b* includes a base portion formed on substrate 1722 and a curved spring portion formed on the respective support region (1724*a* or 1724*b*). The curved spring portion of each metal portion assumes the shape of the underlying support region, projecting above the substrate surface and having a curvature that provides a wiping action when engaging a contact point. In the present configuration, the distal ends of metal portions 1728*a* and 1728*b* are formed facing each other. To complete the connector, support regions 1724*a* to 1724*b* are removed (FIG. 17*h*). As a result, a free standing contact element 1732 is formed on substrate 1602. In the cross-sectional view of FIG. 17*h*, the two metal portions of contact element 1732 appear to be unconnected. However, in actual implementation, the base portions of the metal portions are connected such as by forming a ring around the contact element or the base portions can be connected through conductive layers formed in substrate 1722.

Figure 18A:
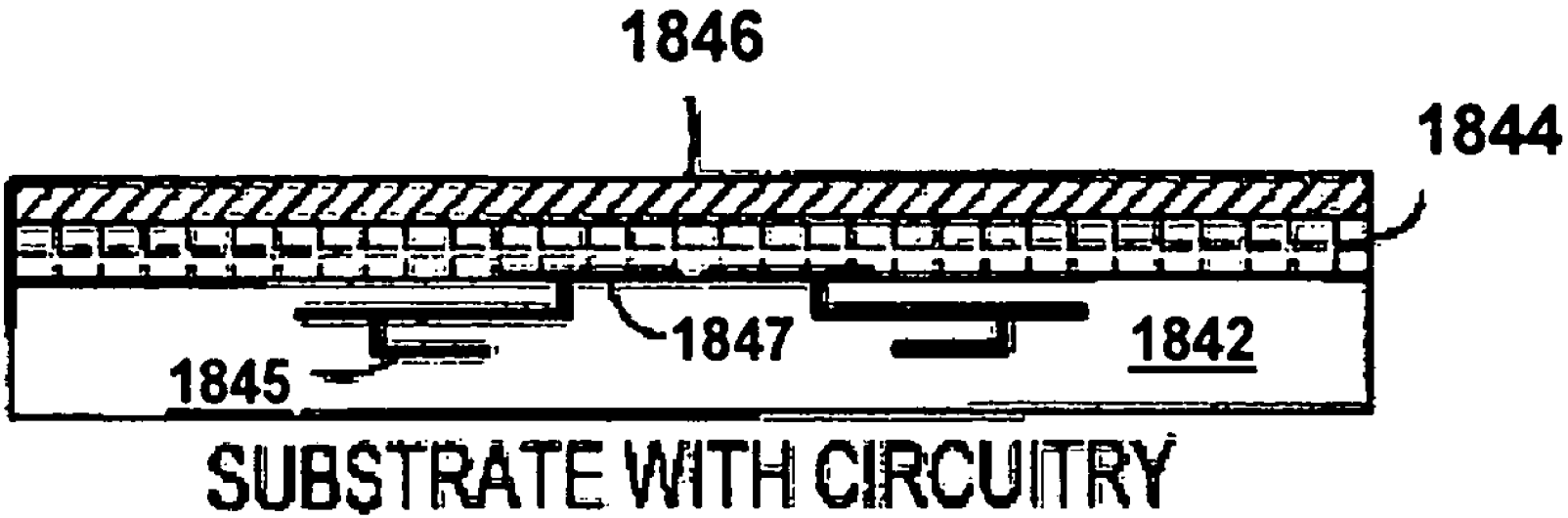
FIGS. 18*a* to 18*h* are schematic drawings that illustrate the processing steps for forming a connector according to another aspect the present invention.
Figure 18B:
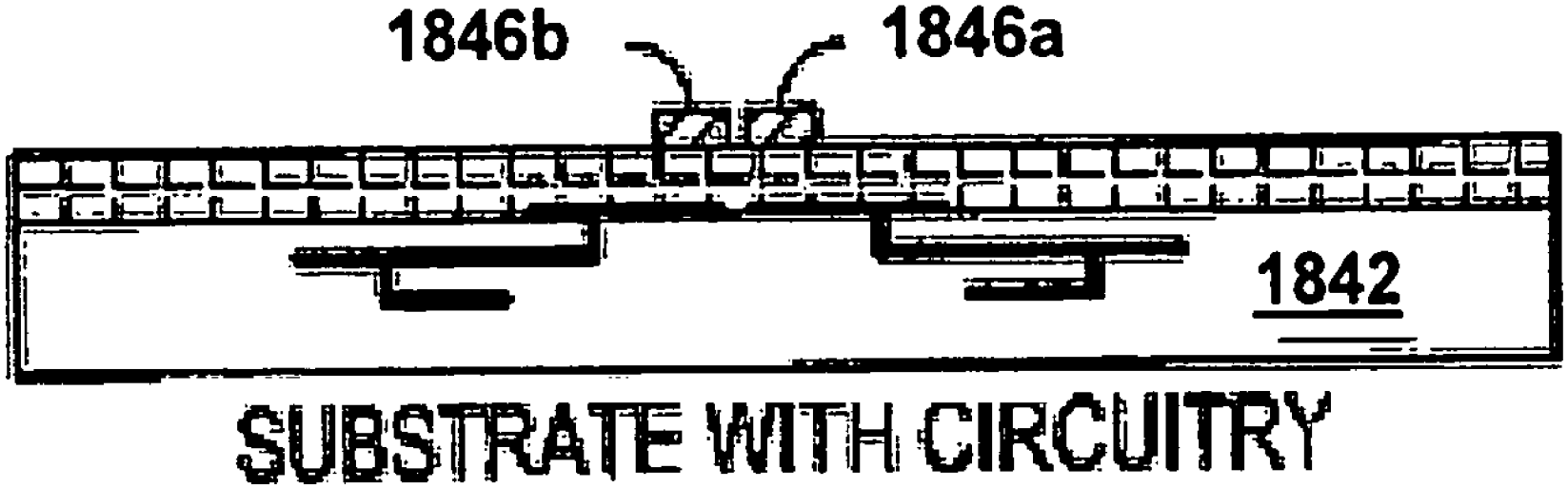

FIGS. 18*a* to 18*h* illustrate the processing steps for forming a connector, according to an alternate configuration of the present invention. Referring to FIG. 18*a*, a substrate 1842 including predefined circuitry 1845 is provided. Predefined circuitry 1845 can include interconnected metal layers or other electrical devices, such as capacitors or inductors, which are typically formed in substrate 1842. In the present configuration a top metal portion 1847 of circuitry 1845 is exposed at the surface of substrate 1842. Top metal portion 1847 is formed at the top surface of substrate 1842 to be connected to the contact element to be formed. To form the desired contact element, a support layer 1844 and a mask layer 1846 are formed on the top surface of substrate 1842.

Figure 18C:
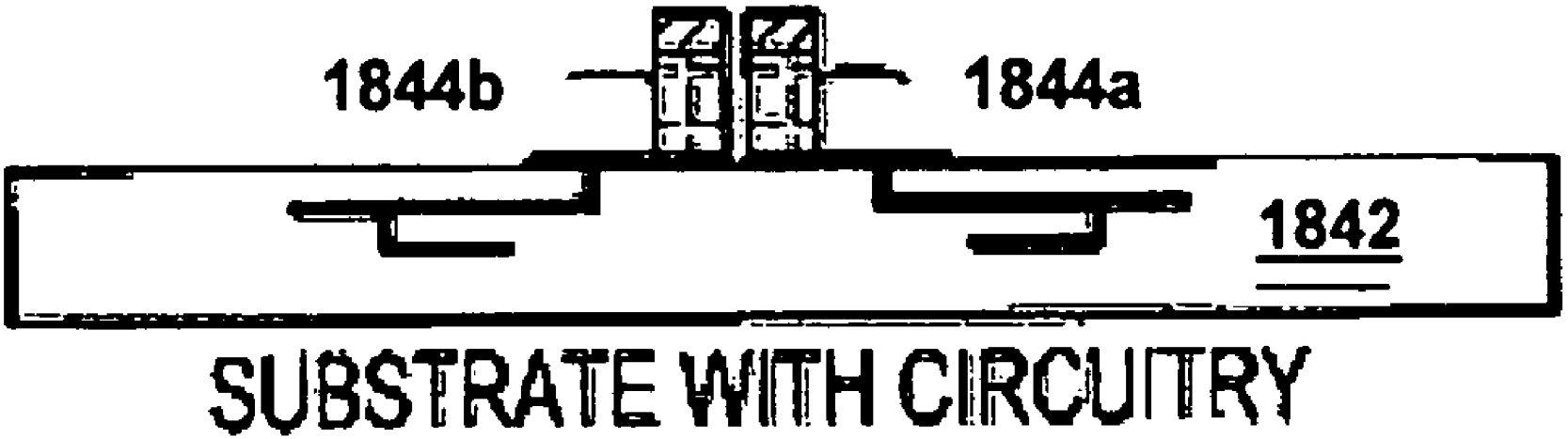
Figure 18D:
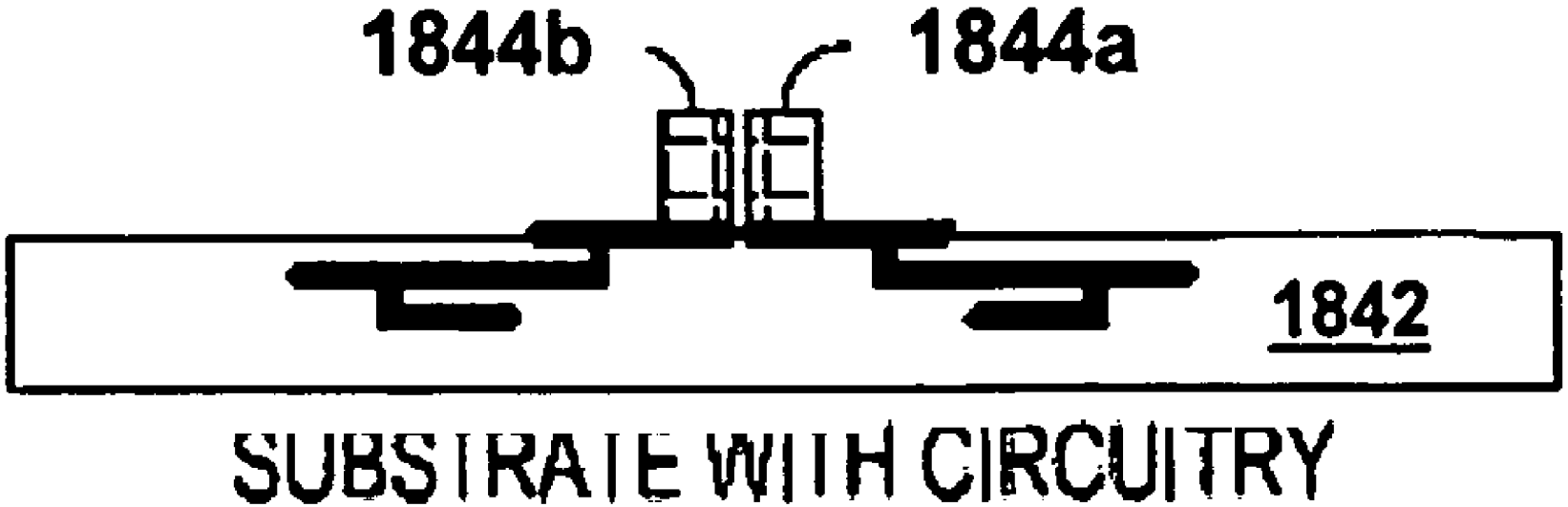
Figure 18E:
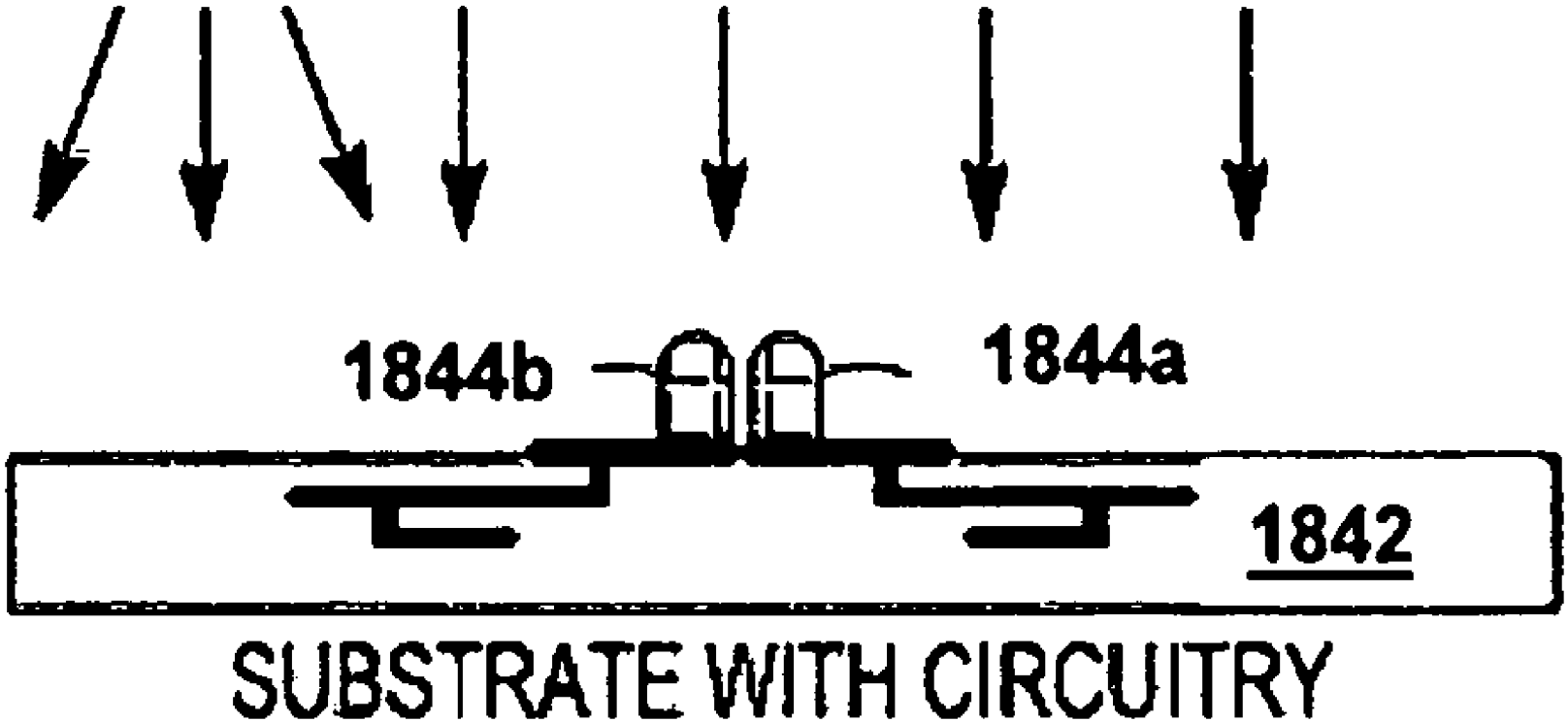
Figure 18F:
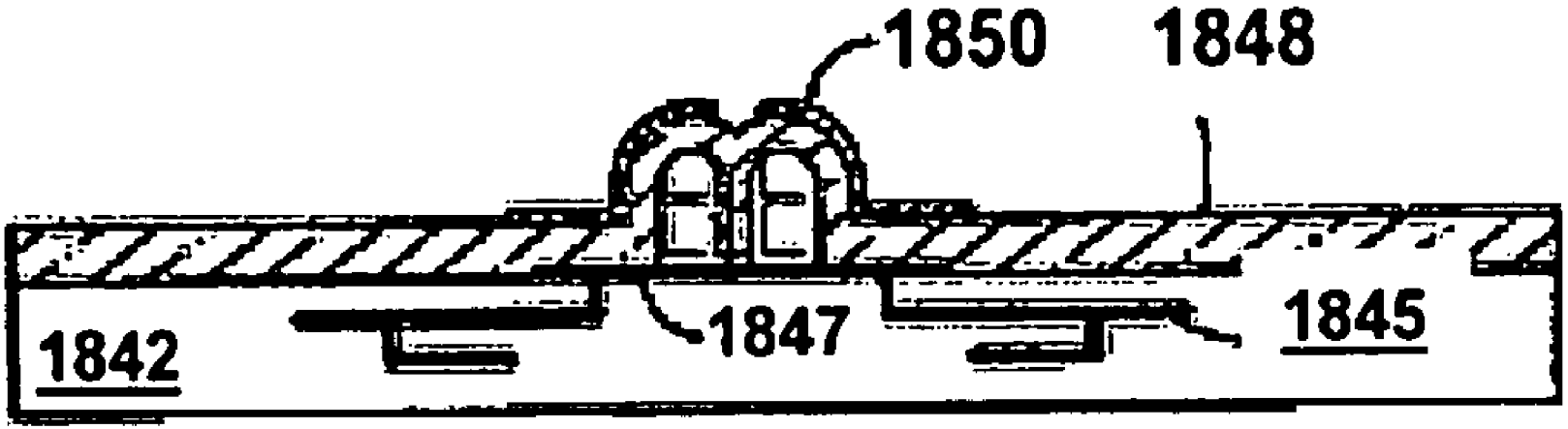
Figure 18G:
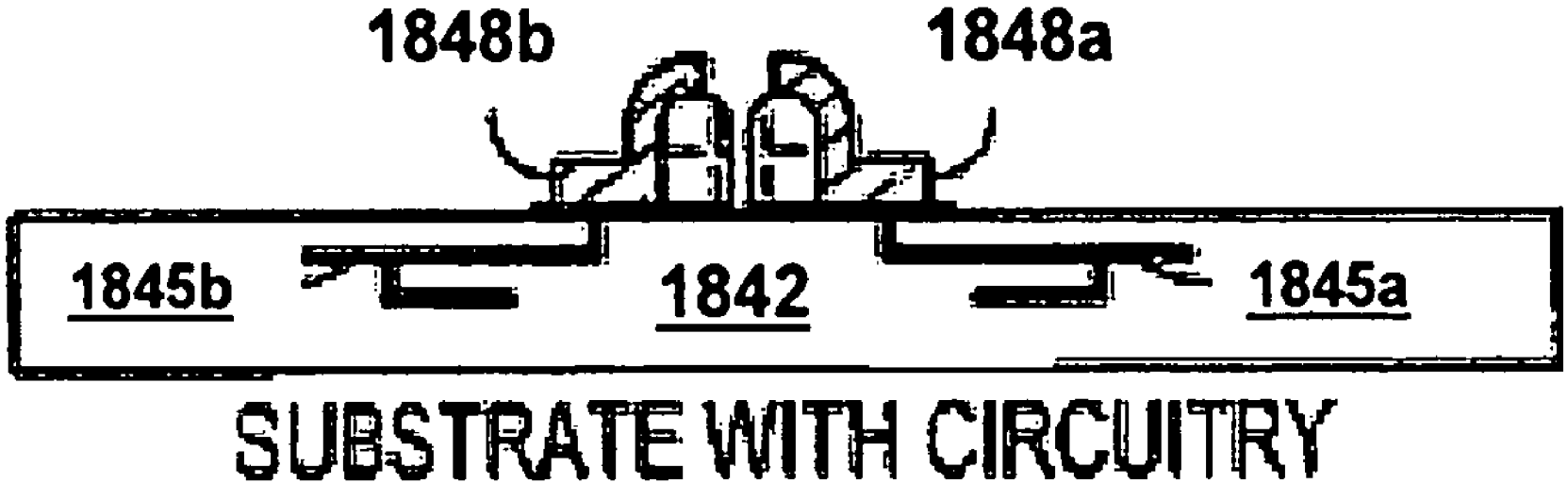

The processing steps proceed in a similar manner as described above with reference to FIGS. 17*a* to 17*h*. Mask layer 1846 is patterned (FIG. 18*b*) and support layer 1844 is etched accordingly to form support regions 1844*a* and 1844*b* (FIG. 18*c*). The mask regions are removed to expose the support regions (FIG. 18*d*). Then, an isotropic etching process is carried out to round out the top corners of support regions 1844*a* and 1844*b* (FIG. 18*e*). A metal layer 1848 is deposited on the surface of substrate 1842 and over the support regions (FIG. 18*f*). Metal layer 1848 is formed over top metal portion 1847. As a result, metal layer 1848 is electrically connected to circuit 1845.

Figure 18H:
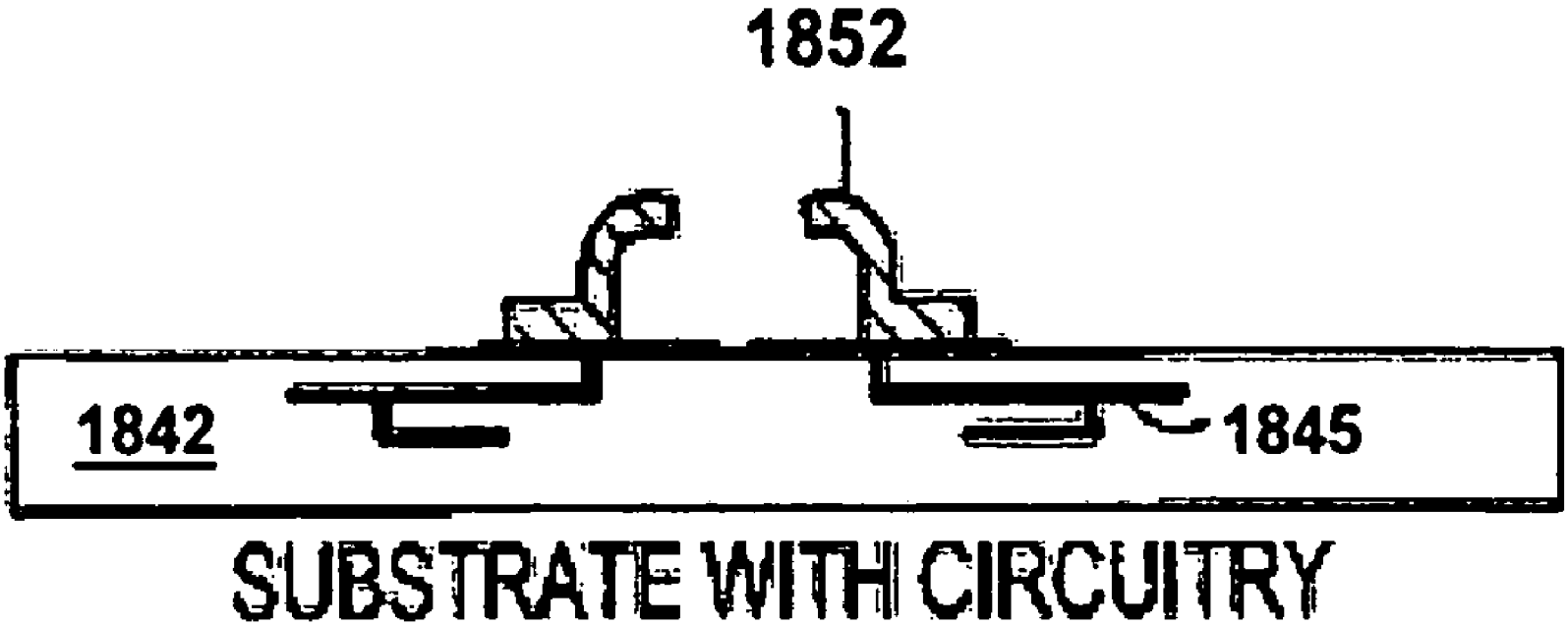

Metal layer 1848 is patterned by a mask layer 1850 (FIG. 18*f*) and subjected to an etching process. Metal portions 1848*a* and 1848*b* are thus formed (FIG. 18*g*) having distal ends pointing towards each other. Support portions 1844*a* and 1844*b* are removed to complete the fabrication of contact element 1852 (FIG. 18*h*).

As thus formed, contact element 1852 is electrically connected to circuit 1845. In the manner, additional functionality can be provided by the connector of the present invention. For example, circuit 1845 can be formed to electrically connect certain contact elements. Circuit 1845 can also be used to connect certain contact elements to electrical devices such as a capacitor or an inductor formed in or on substrate 1842.

Fabricating contact element 1852 as part of an integrated circuit manufacturing process provides further advantages. Specifically, a continuous electrical path is formed between contact element 1852 and the underlying circuit 1845. There is no metal discontinuity or impedance mismatch between the contact element and the associated circuit. In some prior art connectors, a gold bond wire is used to form the contact element. However, such a structure results in gross material and cross-sectional discontinuities and impedance mismatch at the interface between the contact element and the underlying metal connections, resulting in undesirable electrical characteristics and poor high frequency operations. The contact element of the present invention does not suffer from the limitations of the conventional connector systems and a connector built using the contact elements of the present invention can be used in demanding high frequency and high performance applications. In particular, the present invention provides connectors that do not have pin-type connection elements that can act as antenna during transmission of electrical signals at high frequency. Additionally, the unitary structure of elastic contacts wherein base and elastic portions are formed from a common sheet reduces the electrical impedance mismatch along the conductive path of a connector, thereby improving the high frequency performance.

FIGS. 19*a* to 19*h* illustrate the processing steps for forming an array of connectors according to an alternate configuration of the present invention. Like elements in FIGS. 16*a* to 16*h* and 19*a* to 19*h* are given like reference numerals to simplify the discussion. Contact elements of a connector fabricated according to the steps outlined in FIGS. 19*a-h* include a conductive adhesion layer in the base portion of the contact element for improving the adhesion of the contact element to the substrate.

Figure 19A:
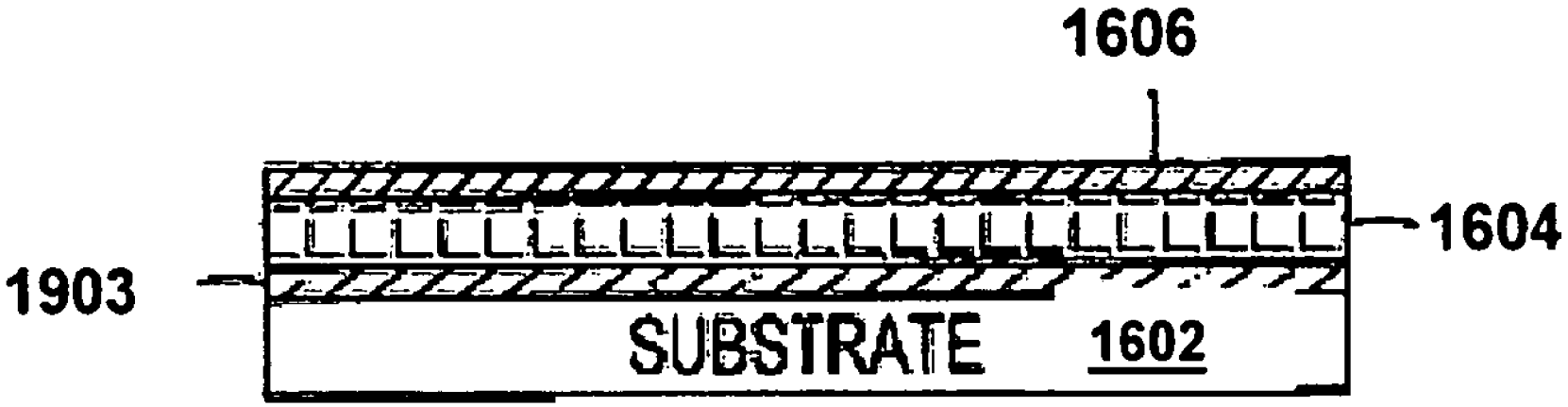
FIGS. 19*a* to 19*h* are schematic drawings that illustrate the processing steps for forming an array of connectors, according to a further aspect of the present invention.

Referring to FIG. 19*a*, a substrate 1602 on which the contact elements are to be formed is provided. Substrate 1602 can be a silicon wafer or ceramic wafer and may include a dielectric layer formed thereon (not shown in FIG. 19*a*). A conductive adhesion layer 1903 is deposited on substrate 1602 or on top of the dielectric layer if present. Conductive adhesion layer 1903 can be a metal layer, such as copper beryllium (CuBe) or titanium (Ti), or a conductive polymer-based adhesive, or other conductive adhesive. Then, a support layer 1604 is formed on the adhesion layer 1903. Support layer 1604 can be a deposited dielectric layer, such as an oxide or nitride layer, a spin-on dielectric, a polymer, or any other suitable etchable material.

After the support layer 1604 is deposited, a mask layer 1606 is formed on the top surface of support layer 1604. Mask layer 1606 is used in conjunction with a conventional lithography process to define a pattern on support layer 1604 using mask layer 1606. After the mask layer is printed and developed (FIG. 19*b*), a mask pattern, including regions 1606*a* to 1606*c*, is formed on the surface of support layer 1604 defining areas of support layer 1604 to be protected from subsequent etching.

Figure 19B:
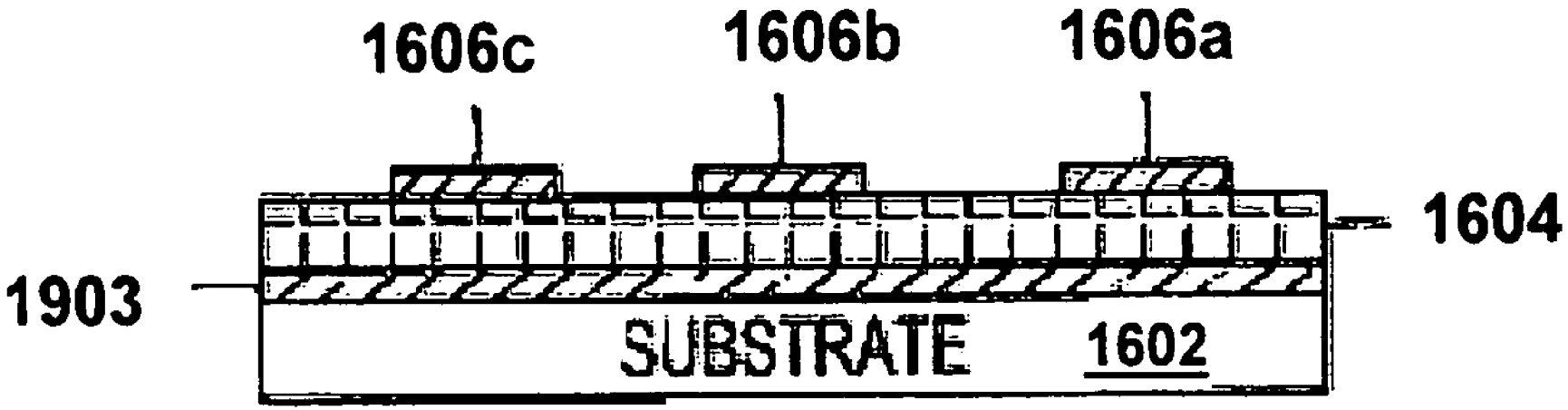
Figure 19C:
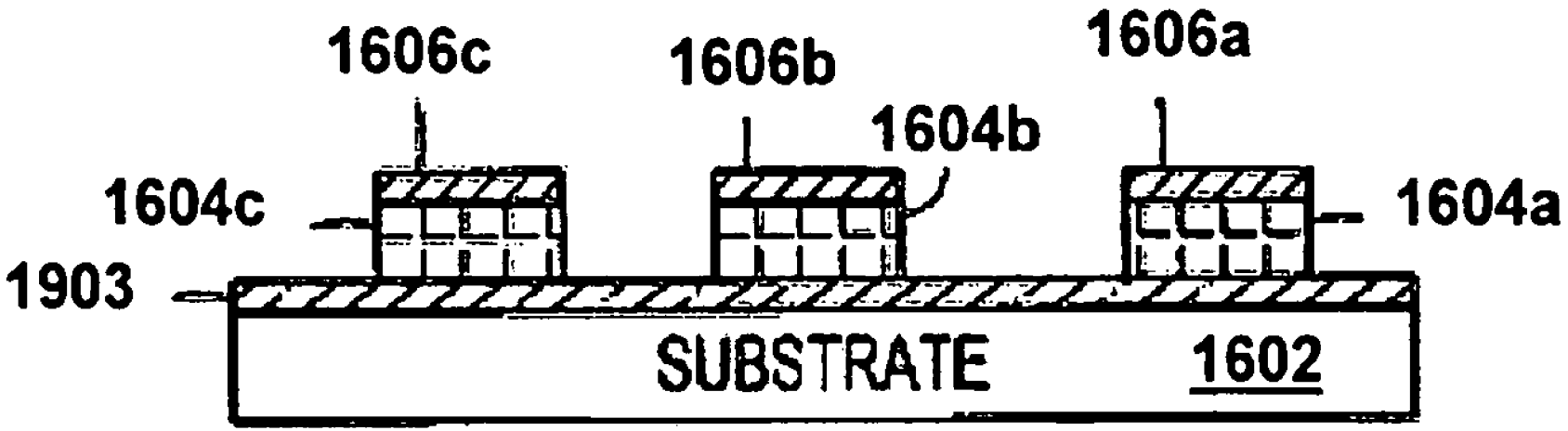
Figure 19D:
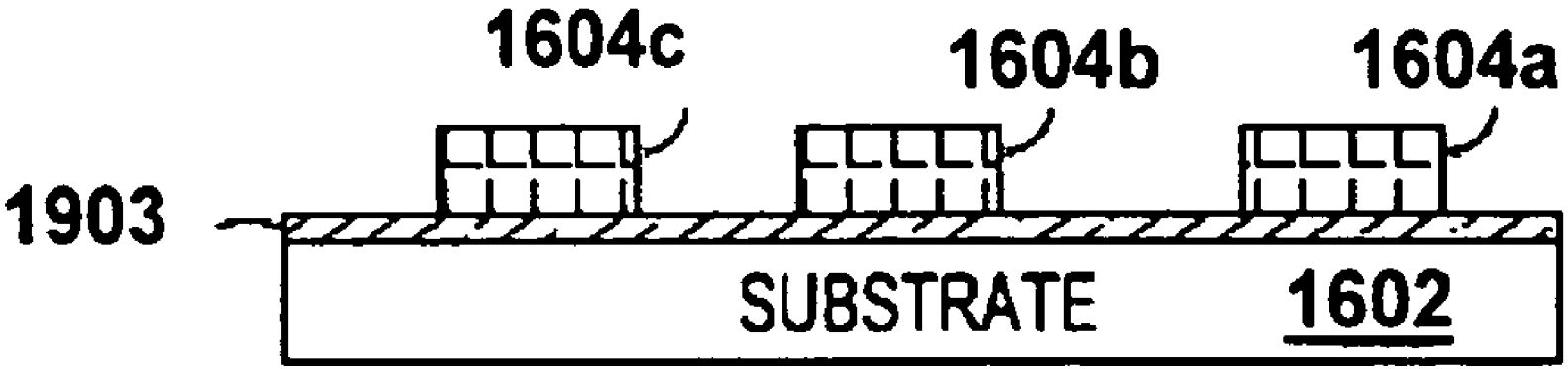

Referring to FIG. 19*c*, an anisotropic etching process is performed using regions 1606A to 1606*c* as a mask. As a result of the anisotropic etching process, portions of support layer 1604 not covered by a patterned mask layer are removed. The anisotropic etching process stops on conductive adhesion layer 1903 or partially in conductive adhesion layer 1903. Thus, conductive adhesion layer 1903 remains after the anisotropic etch process. Accordingly, support regions 1604*a* to 1604*c* are formed on the conductive adhesion layer. The mask pattern including regions 1606*a* to 1606*c* is subsequently removed to expose the support regions (FIG. 19*d*).

Figure 19E:
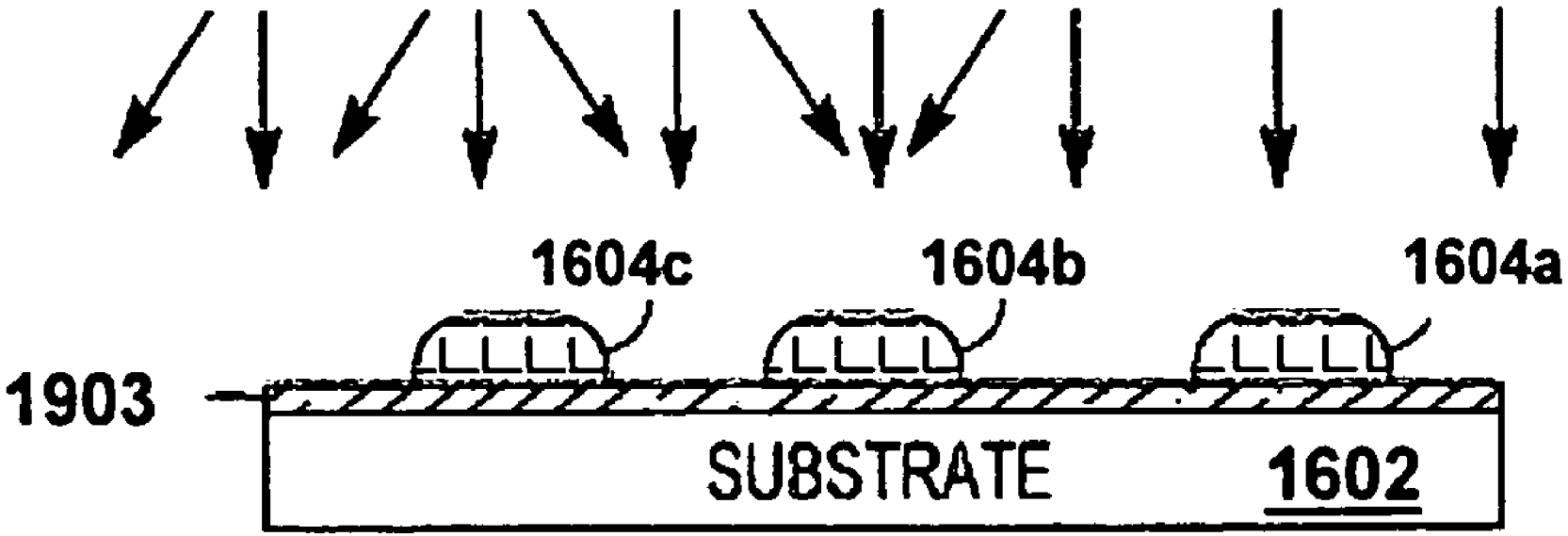

Referring to FIG. 19*e*, support regions 1604*a* to 1604*c* are then subjected to an isotropic etching process. An isotropic etching process removes material under etch in the vertical and horizontal directions at substantially the same etch rate. Thus, as a result of the isotropic etching, the top corners of support regions 1604*a* to 1604*c* are rounded off as shown in FIG. 19*e*.

Figure 19F:
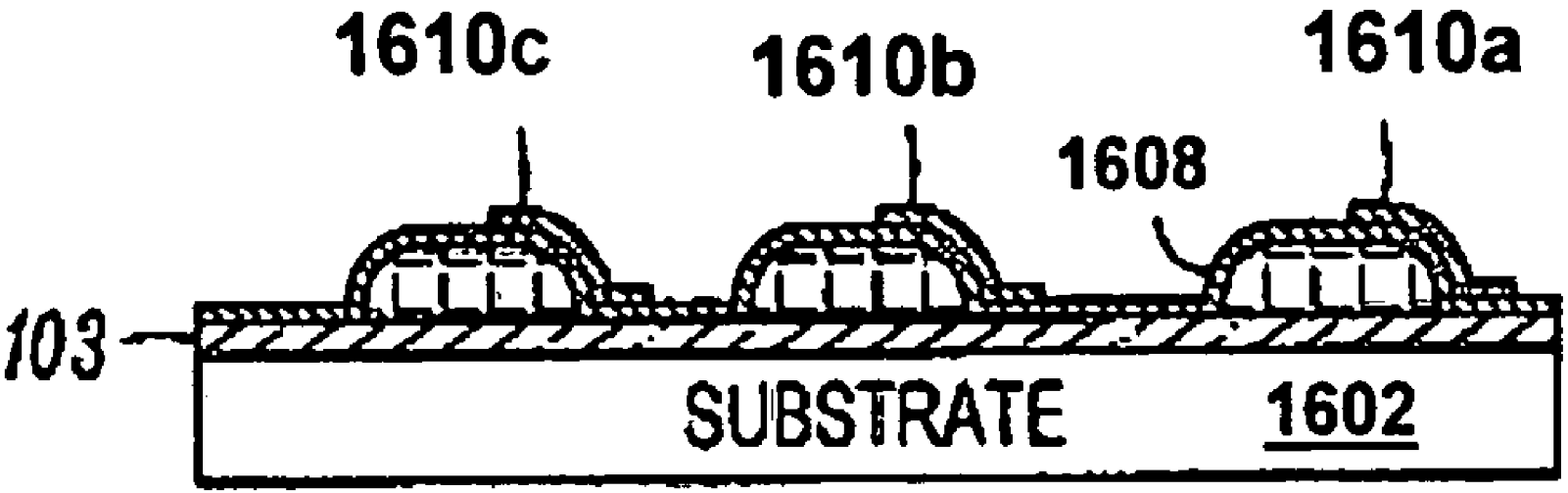

Then, referring to FIG. 19*f*, a metal layer 1608 is formed on the surface of conductive adhesion layer 1903 and the surface of support regions 1604*a* to 1604*c*. Metal layer 1608 can be a copper layer or a copper-alloy (Cu-alloy) layer or a multilayer metal deposition such as Tungsten coated with Copper-Nickel-Gold (Cu/Ni/Au). In a preferred configuration, the contact elements are formed using a small-grained copper beryllium (CuBe) alloy and then plated with electroless Nickel-Gold (Ni/Au) to provide a non-oxidizing surface. Metal layer 108 can be deposited by a CVD process, by electro plating, by sputtering, by physical vapor deposition (PVD) or using other conventional metal film deposition techniques. A mask layer is deposited and patterned into mask regions 1610*a* to 1610*c* using a conventional lithography process. Mask regions 1610*a* to 1610*c* define areas of metal layer 1608 to be protected from subsequent etching.

Figure 19G:
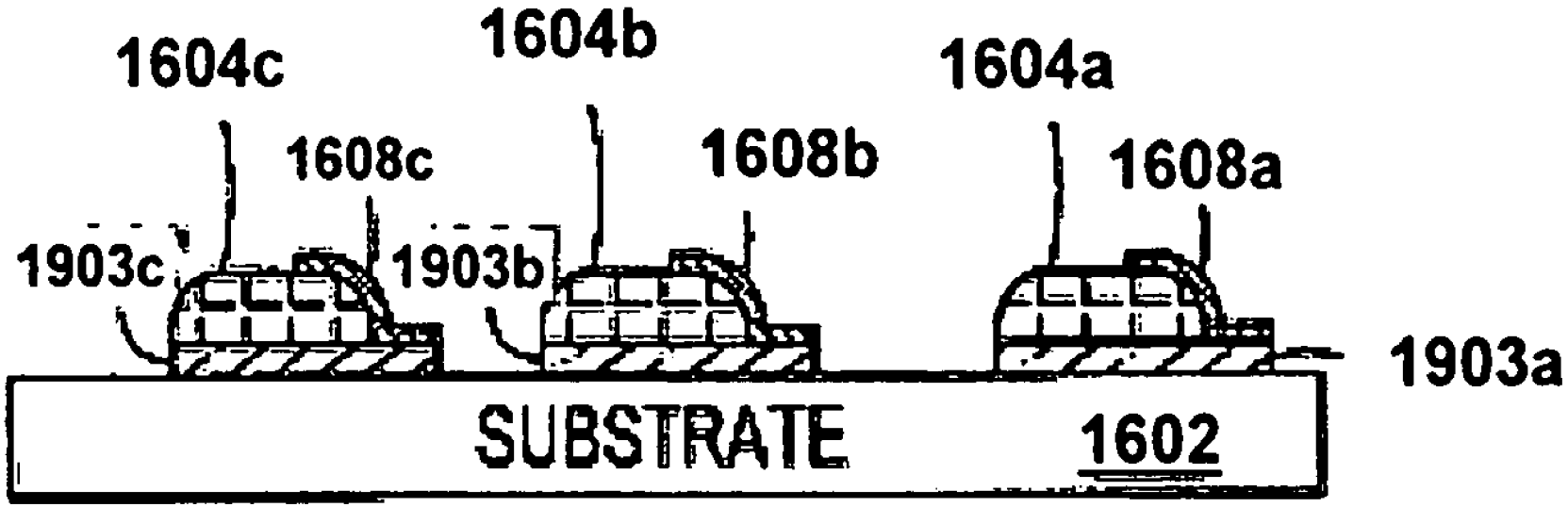

Then, the structure in FIG. 19*f* is subjected to an etching process for removing portions of metal layer and conductive adhesion layer not covered by mask regions 1610*a* to 1610*c*. As a result, metal portions 1608*a* to 1608*c* and conductive adhesion portions 1903*a* to 1903*c* are formed as shown in FIG. 19*g*. Each of metal portions 1608*a* to 1608*c* includes a base portion formed on a respective conductive adhesion portion and a curved spring portion formed on a respective support region (1604*a* to 1604*c*). Accordingly, the curved spring portion of each metal portion assumes the shape of the underlying support region, projecting above the substrate surface and having a curvature that provides a wiping action when engaging a contact point. The base portion of each metal portion is attached to a respective conductive adhesion portion which functions to enhance the adhesion of each base portion to substrate 1602.

Figure 19H:
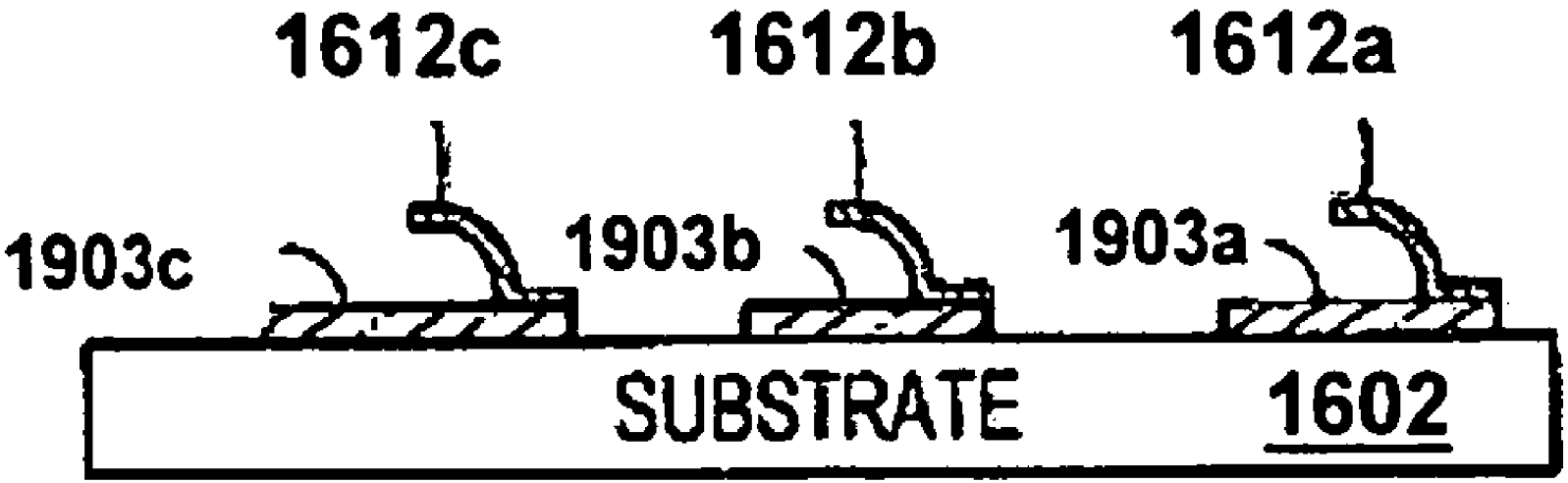

To complete the connector, support regions 1604*a* to 1604*c* are removed (FIG. 19*h*), such as by using a wet etch or an anisotropic plasma etch or other etch process. If the support layer is formed using an oxide layer, a buffered oxide etchant can be used to remove the support regions. As a result, free standing contact elements 1612*a* to 1612*c* are formed on substrate 1602. As thus formed, each of contact elements 1612*a* to 1612*c* effectively includes an extended base portion. As shown in FIG. 19*h*, each conductive adhesion portion serves to extend the surface area of the base portion to provide more surface area for attaching the contact element to substrate 1602. In this manner, the reliability of the contact elements can be improved.

As one of ordinary skill in the art would appreciate, some details of the process flows outlined in FIGS. 16*a*-19*h* can be tailored according to the type of substrate used for the connector. For example, the processing temperature used for layers deposited on the contact array substrate can be adjusted according to the ability of a substrate to withstand high temperature processing. Similarly, the type of deposition process can be chosen to have maximum compatibility with the substrate type. For example, deposition processes that do not require high vacuum environments would be preferred for substrates that have very high outgassing rates.

Generally speaking, configurations of the present invention provide a scalable, low cost, reliable, compliant, low profile, low insertion force, high-density, separable and reconnectable electrical connection for high speed, high performance electronic circuitry and semiconductors. The electrical connection can be used, for example, to make electrical connections from one PCB to another PCB, MPU, NPU, or other semiconductor device.

In one configuration of this invention, there is provided a separable and reconnectable contact system for electronically connecting circuits, chips, boards, and packages together. The system is characterized by its elastic functionality across the entire gap of separation between the circuits, chips, boards, or packages being connected, i.e., across the thickness of the connection system. The invention includes a beam land grid array (BLGA) configuration but is not limited to that particular structural design.

Figure 20A:
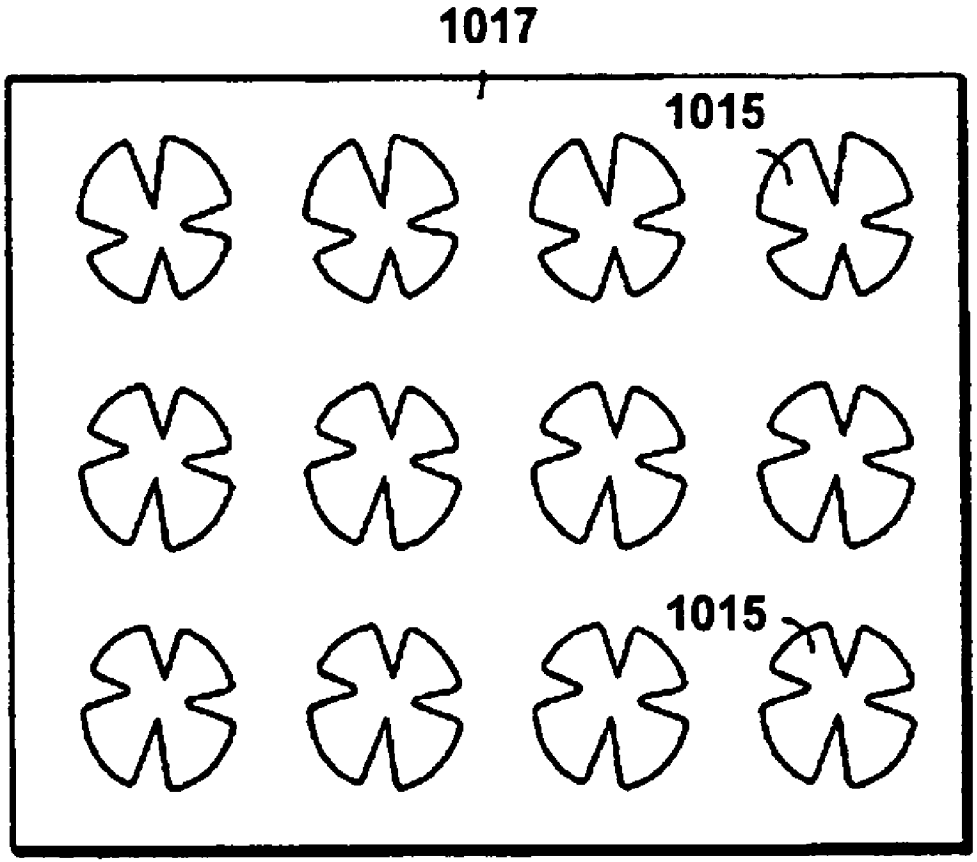
FIG. 20*a* is a schematic diagram that illustrates plan views of a contact arm array, in accordance with one configuration of the present invention.
Figure 20B:
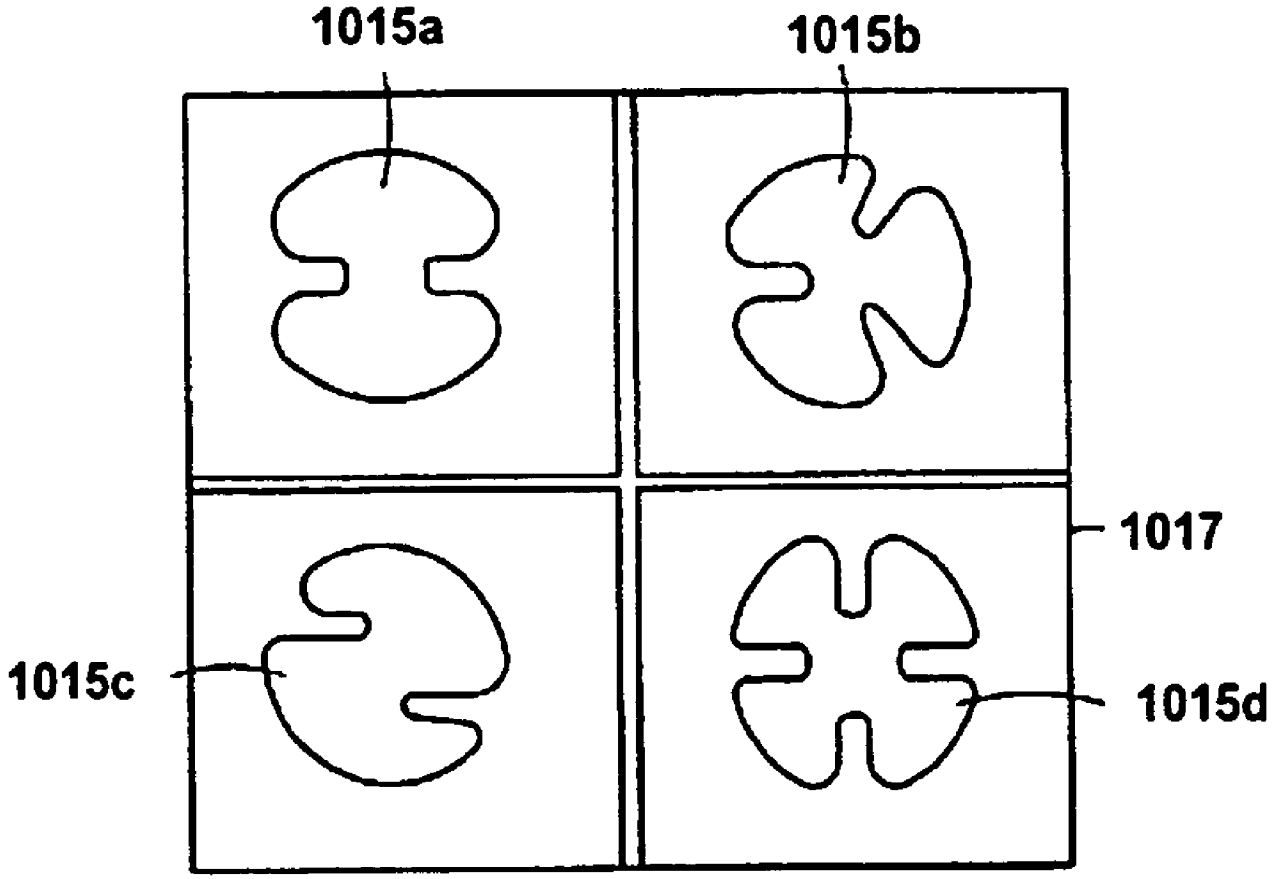
FIG. 20*b* is a schematic diagram that depicts a plan view of several different exemplary contact arm designs.

An exemplary array according to one configuration of the invention is illustrated in FIG. 20*a*. Contact arms 1015 are fabricated in carrier layer 1017. Different design patterns for the contact arms 1015 are respectively illustrated by elements 1015*a*, 1015*b*, 1015*c*, and 1015*d* in FIG. 20*b*.

Figure 21:
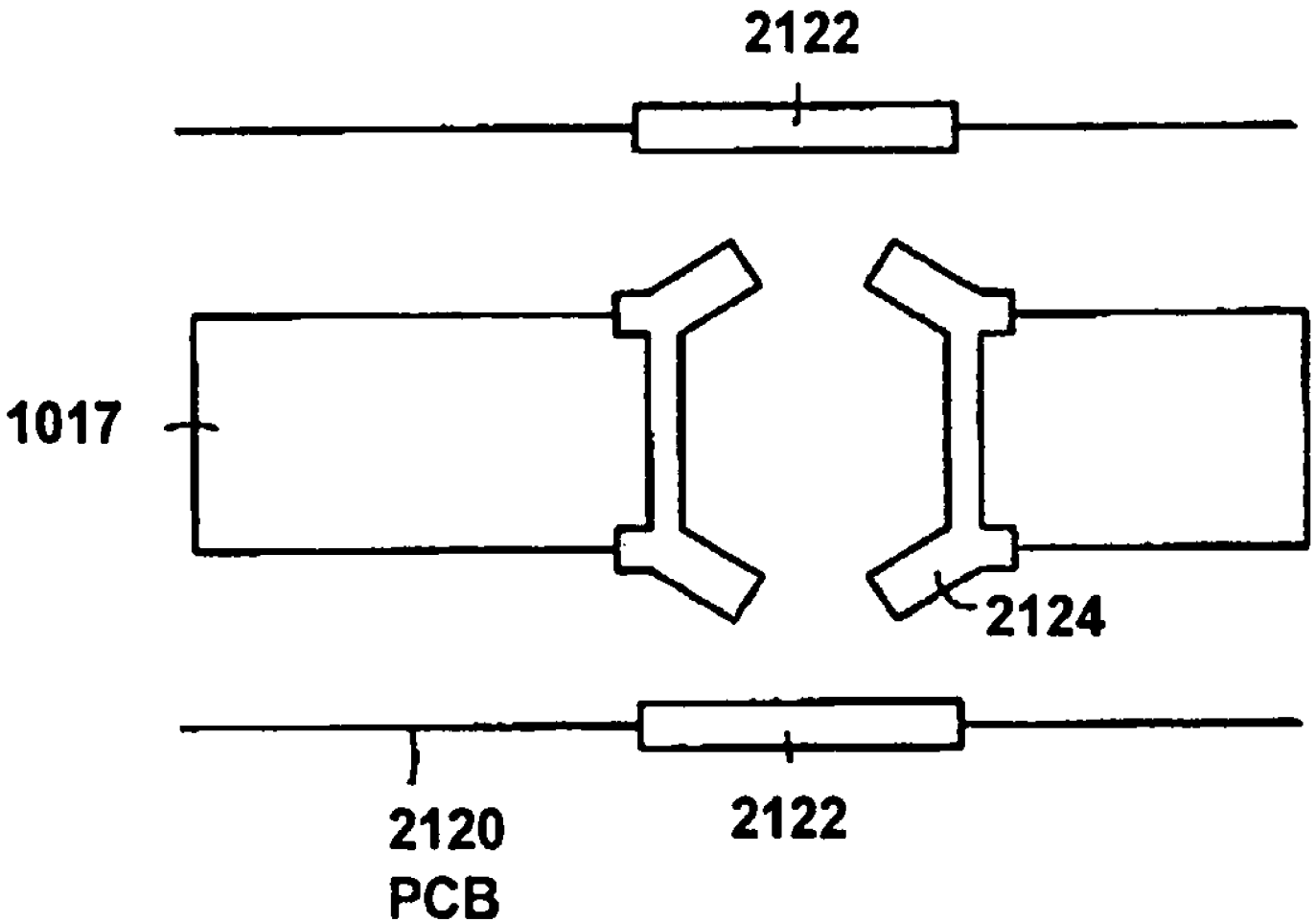
FIG. 21 is a schematic diagram that depicts a sectional view of an exemplary BLGA system of this invention, and its attachment to a PCB.

In FIG. 21, carrier 1017 is shown making contact with the pad 2122 of PCB 2120 by means of BLGA contact wipers 2124, similar to the contact arms 1015 at the top of the carrier.

Figure 22:
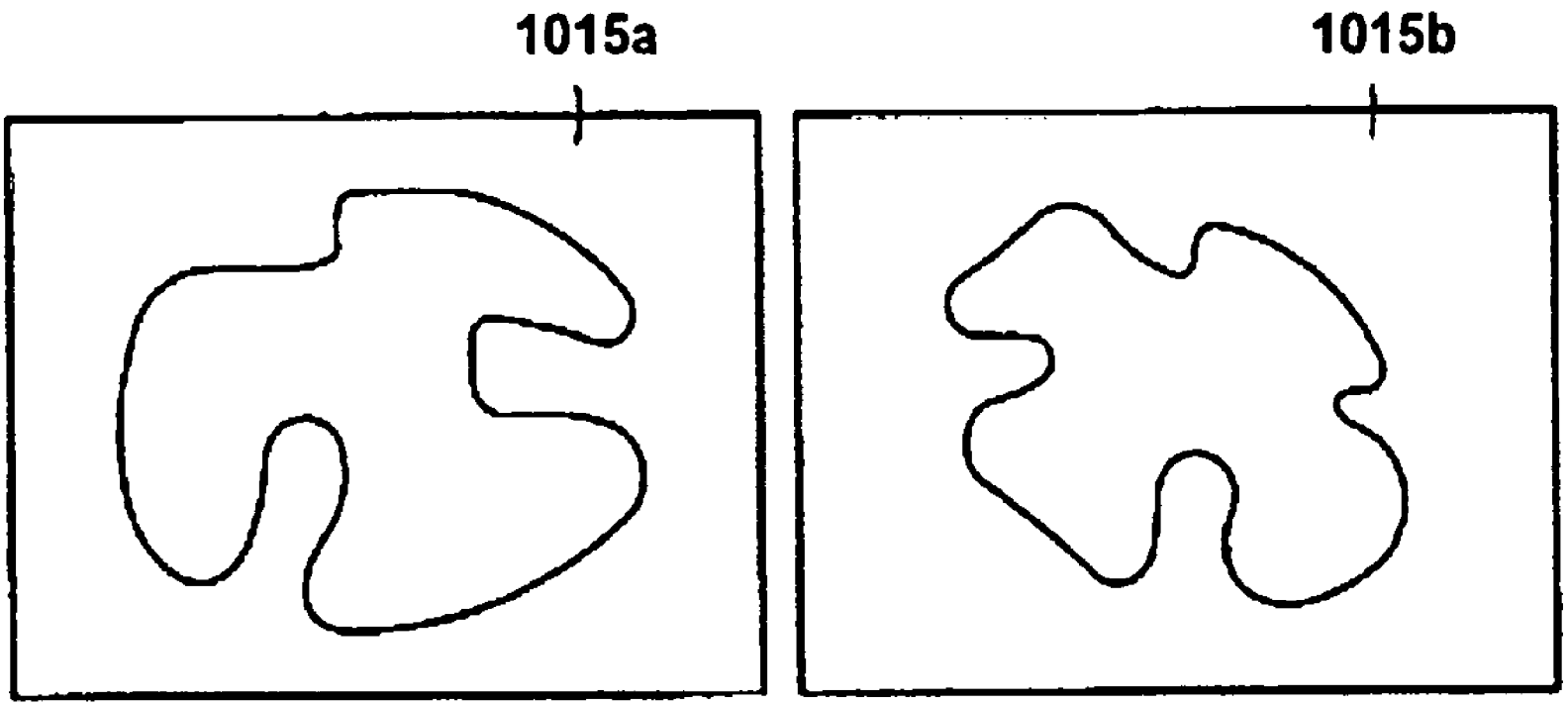
FIG. 22 is a schematic diagram that depicts angled plan views of two example contact arm designs for the BLGA system of this invention.

FIG. 22 depicts angled plan views 1015*a* and 1015*b* of exemplary contact arm designs for a BLGA system according to two different configurations of this invention.

Figure 23:
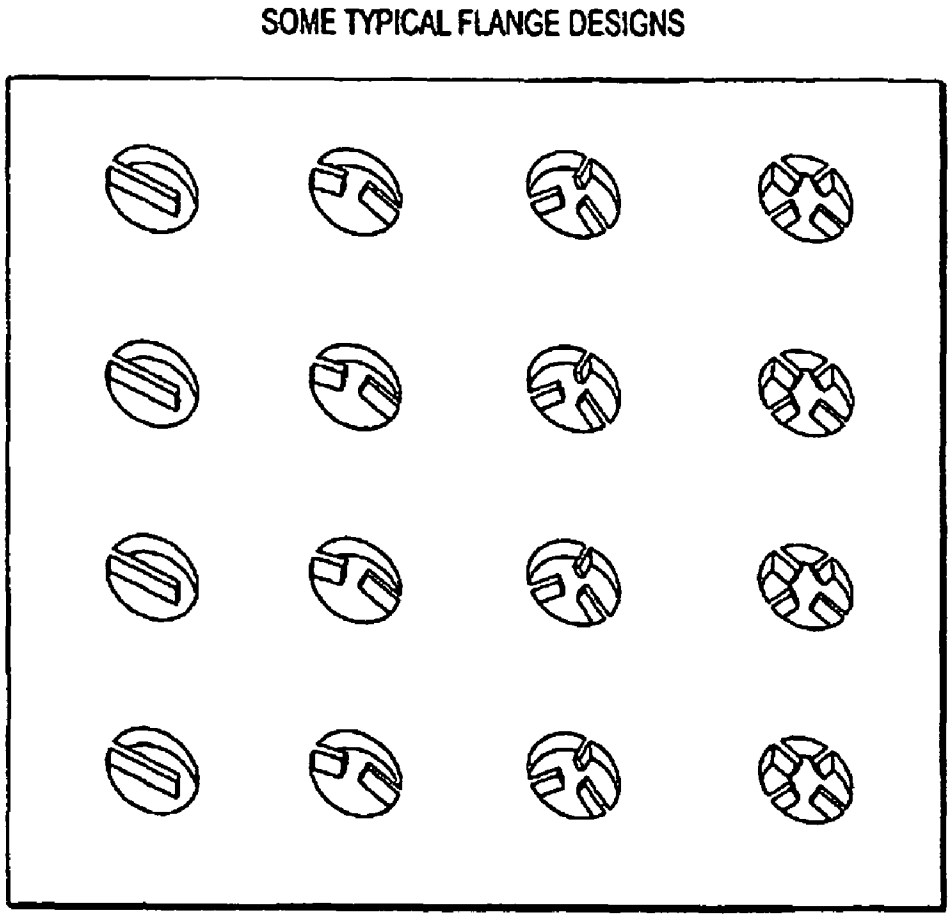
FIG. 23 is a schematic diagram that shows an enlarged perspective view of different exemplary contact arm designs for contacting solder balls.

Referring to FIG. 23, a plurality of contact arm designs are shown for a BLGA system. Like those mentioned, these contact patterns can also be used to fabricate spring-like (elastic) contact structures in a contact array device such as an interposer or BLGA, according to processes described further below. A typical material used for the elastic contacts is Be/Cu.

Referring again to FIGS. 10*a* and 10*b*, enlarged top and side views of one exemplary version of contact elements 1015 are illustrated.

Figure 10A:
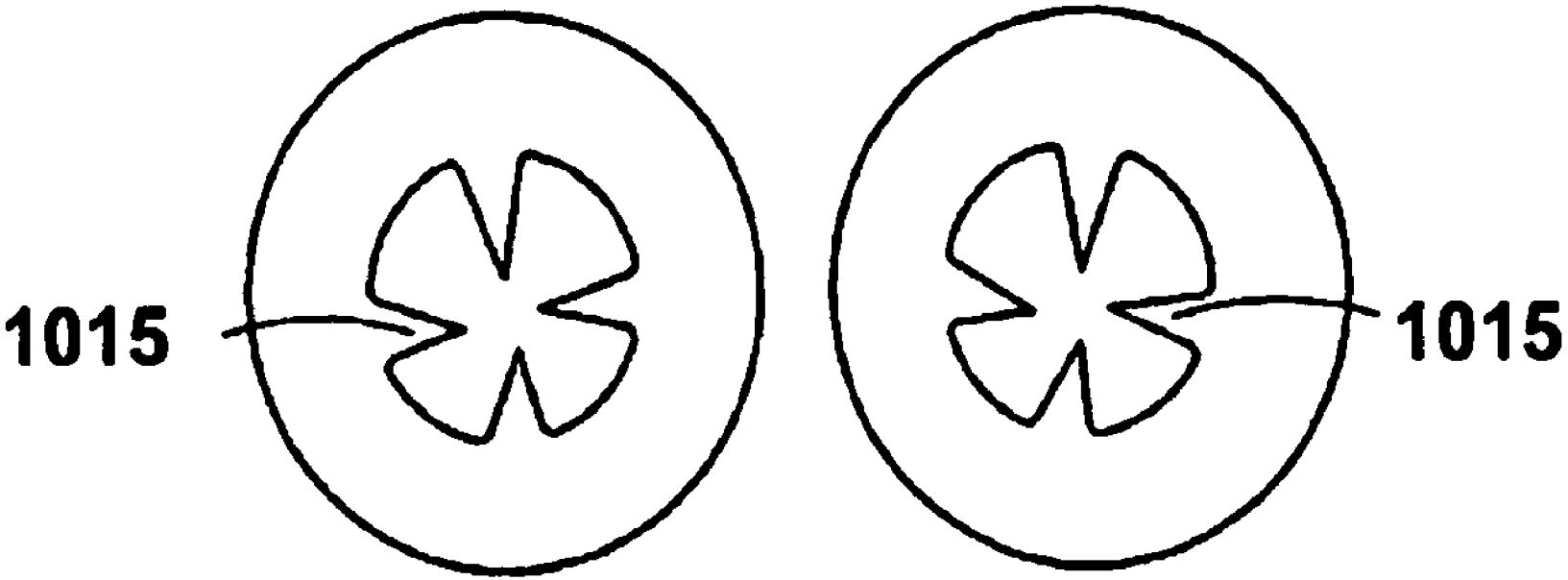
FIGS. 10*a* and 10*b* are schematic diagrams that illustrate top and side views of contact arms arranged in accordance with configurations of this invention.
Figure 10B:
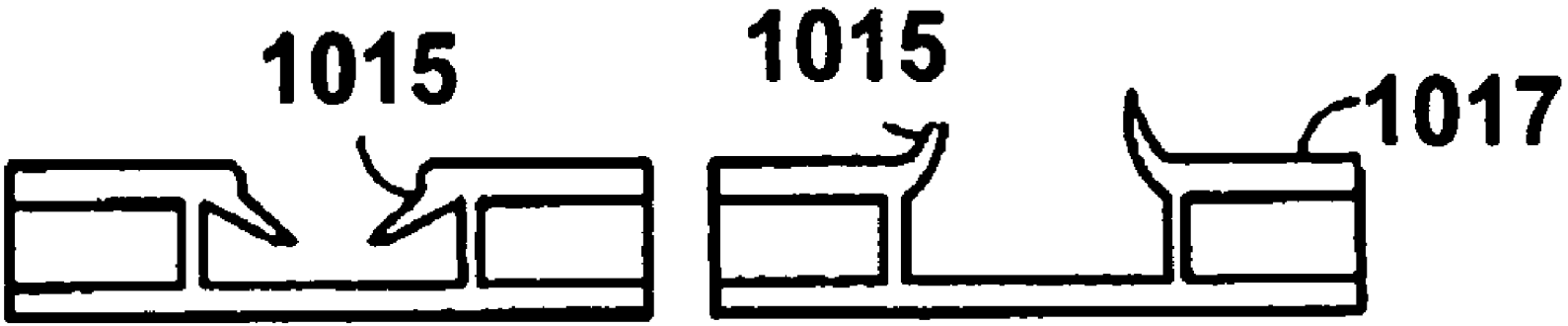
Figure 10C:
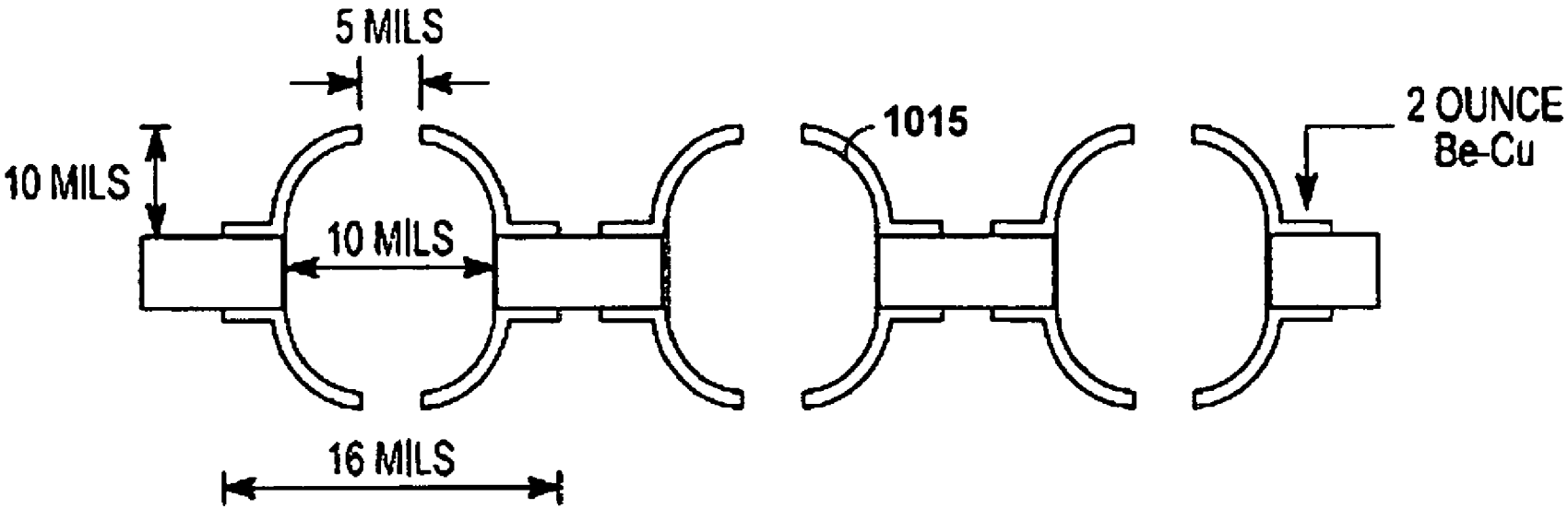
FIG. 10*c* is a schematic diagram that depicts an enlarged sectional view of exemplary contact arms for a BLGA contact array.

Referring to FIG. 10*c*, a sectional, an enlarged view of an exemplary set of contact elements 1015 for a BLGA or interposer system is shown. The elements can be etched into a sheet of beryllium-copper, for example. Beryllium copper (BeCu) alloys have high strength and good elastic properties. In other words, BeCu can be elastically deformed over a significant range without substantial plastic flow. The BeCu alloy can be formed by precipitation hardening processes, wherein Be-rich precipitates form within a Cu-rich matrix. This can occur, for example, during slow cooling from high temperature, which can cause a Be-rich phase to precipitate from a Cu matrix due to decreased solubility of the Be at lower temperatures. Accordingly, in one configuration of this invention, contact elements 1015 comprising a BeCu alloy can be elastically displaced over a large range in a repeated fashion without undergoing plastic deformation.

Figure 24:
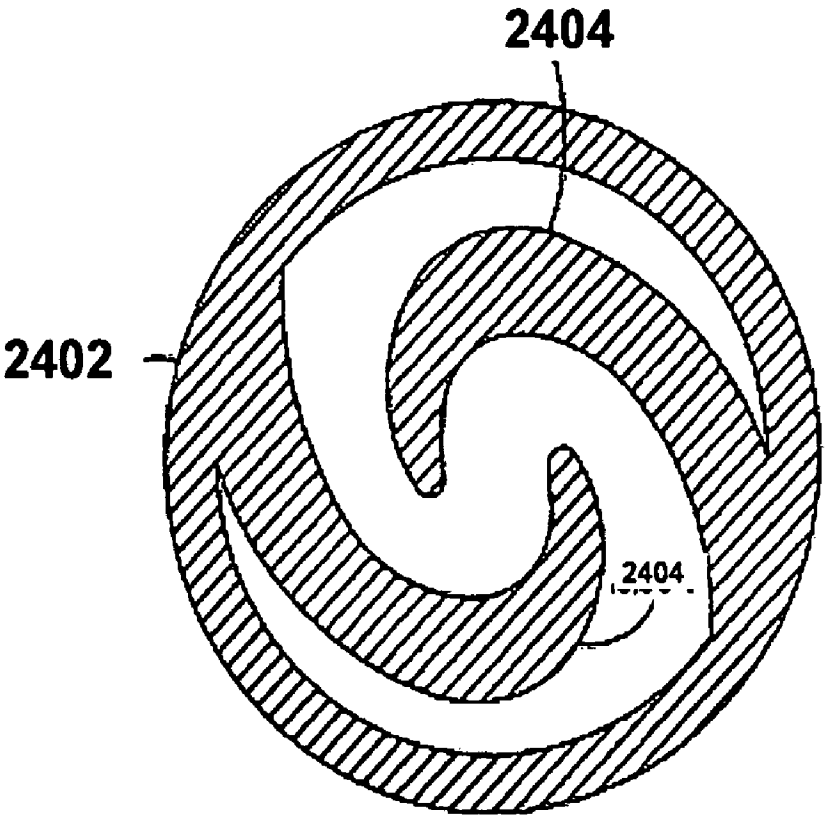
FIG. 24 is a schematic diagram that illustrates a top schematic view of a contact arranged in accordance with another configuration of this invention.

FIG. 24 illustrates a top schematic view of a contact arranged in accordance with another configuration of this invention. In this arrangement, contact 2402 includes two spiral shaped contact arms 2404.

FIGS. 25*a* to 25*d* are flowcharts of a similar method 2500 for forming contact elements in accordance with one configuration of the present invention. FIGS. 26-29*b* will be discussed in the context of the discussion of the method 2500. The method 2500 also relates to batch fabrication of the contact elements using masking, etching, forming, and lamination techniques. The method 2500 produces a plurality of highly engineered electrical contacts, capable of use in a separable connector such as in an interposer, or the contacts can be directly integrated into a substrate as a continuous trace that then functions as a permanent onboard connector. However, rather than using additional masking and etching steps to form the three dimensional spring portions, they are created in flat arrays and are then formed into three dimensional shapes.

First, a base spring material for the sheet of contacts is selected, such as beryllium copper (Be—Cu), spring steel, phosphorous bronze, or any other material with suitable mechanical properties (step 2502). The proper selection of material enables the contact elements to be engineered to have the desired mechanical and electrical properties. One factor in the selection of the base material is the working range of the material. Working range is the range of displacement over which the contact element meets both contact force (load) and contact resistance specifications. For example, assume that the desired contact resistance is less than 20 milliohms and the maximum allowed contact load is 40 grams. If the contact element reaches a resistance range of less than 20 milliohms at 10 grams of load and then is carried over to the maximum load of 40 grams for the beam member, while maintaining a resistance of less than 20 milliohms, then the distance over which the contact element has traveled between 10 grams and 40 grams of load would be the working range of the contact.

The sheet can be heat treated prior to subsequent processing (step 2504). Whether the sheet is heated at this point in the process is determined by the type of material selected for the sheet. The heating is performed to move the material from a half-hard state into a hard state or highly-tensile state that provides desired mechanical properties for forming the contacts.

A contact element is designed and is copied into an array form, for use in batch processing (step 2506). The number of contacts in an array is a design choice, and can vary depending on the requirements for the connector. The arrays are repeated into a panel format, analogous to chips or die in a semiconductor wafer, resulting in a scalable design that lends itself to batch processing. After the contact design has been completed (usually in a CAD drawing environment), the design is ported to a Gerber format, which is a translator that enables the design to be ported to a fabrication facility to produce the master slides or film to be used in the subsequent steps.

The panel format can have anywhere between one and a large number of contacts, because the use of lithography permits placing a high density of contacts onto a panel. This high density of contacts provides an advantage over existing methods in that a batch process can be used to singulate the contacts, as opposed to stamping and forming individual contacts. The method 2500 permits a large number of contacts to be patterned, developed, and etched at once.

Figure 26:
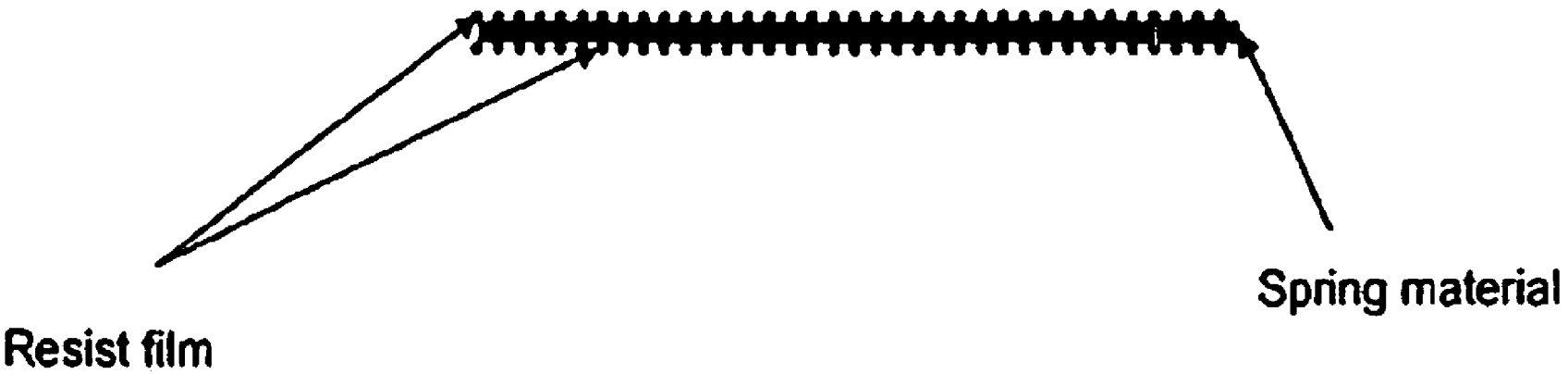
FIG. 26 is a schematic diagram of a cross-sectional view of an exemplary resist film applied to a sheet of spring material in accordance with the method shown in FIGS. 25*a-d*.
Figure 27:
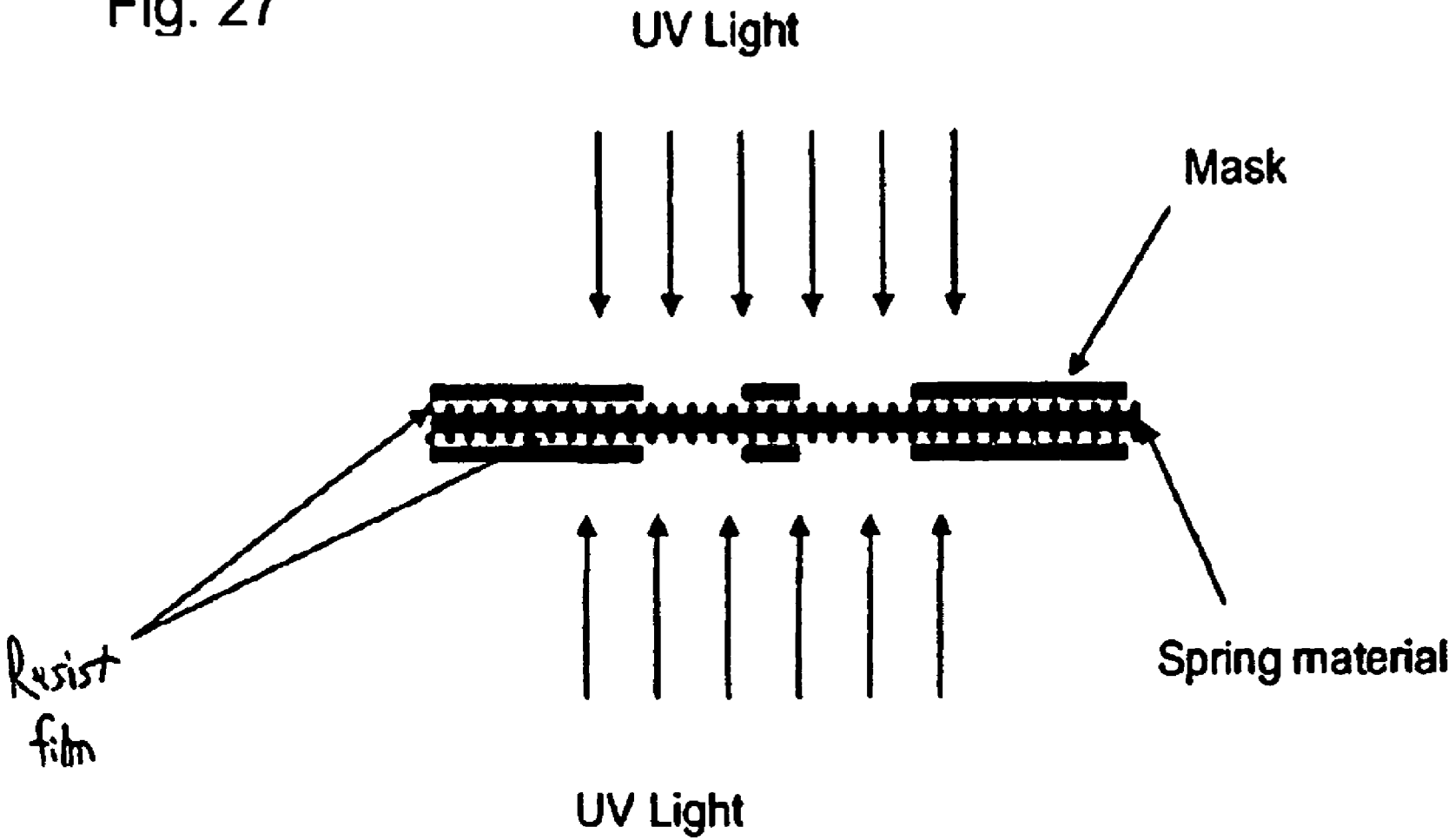
FIG. 27 is a schematic diagram of a cross-sectional view of UV light being applied to the resist film, in accordance with the method shown in FIGS. 25*a-d*.
Figure 28:
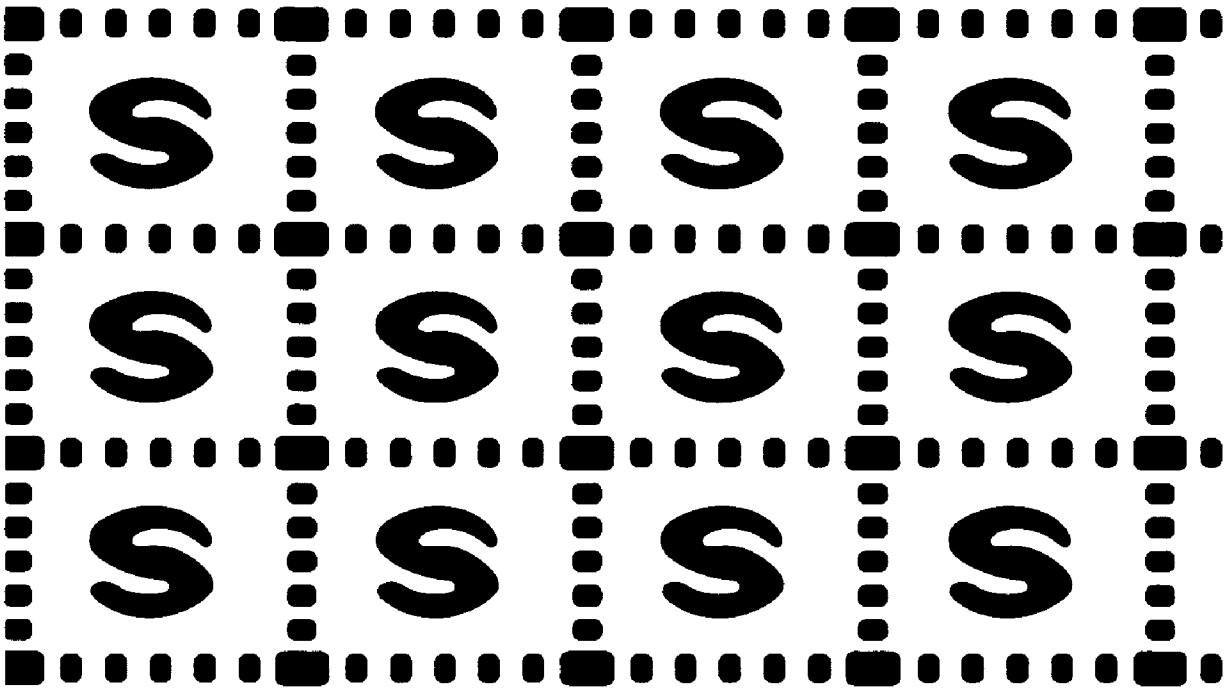
FIG. 28 is a schematic diagram of a plan view of an exemplary sheet of contact elements formed in accordance with the method shown in FIGS. 25*a-d*.

A lithographically sensitive resist film is then applied to both sides of the sheet (step 2508 and FIG. 26). A dry film can be used for larger feature sizes ranging from one to 20 mils, and a liquid resist can be used for feature sizes less than one mil.

Using the artwork defined in step 2506, both the top and bottom of the sheet are exposed to ultraviolet (UV) light and then developed to define contact features in the resist (step 2510 and FIG. 26). Portions that are intended to be etched are left unprotected by the mask. Using a lithographic process to define the contact elements enables the printing of lines with a fine resolution, similar to that found in semiconductor manufacturing.

The sheet is then etched in a solution specifically selected for the material being used (step 2512). Each particular material that can be selected for the sheet typically has a specific etch chemistry associated with it to provide the best etch characteristics, such as etch rate (i.e., how well and how fast the solution performs the etch). This is an important consideration in the context of throughputs. The etchant selected also effects other characteristics like the sidewall profile, or the straightness of a feature as seen in cross section. In the method 2500, chemicals common in the industry are used, such as cupric chloride, ferric chloride, and sulfuric hydroxide. Once etched, the protective layer of resist is removed in a stripping process, leaving the etched features in the sheet (step 2514 and FIG. 28).

A batch forming tool is designed, based upon the artwork defined in step 2506 (step 2516). In one configuration, the batch forming tool includes a plurality of ball bearings arranged into an array format, preferably by being set into an array of openings in a support surface. The ball bearings can be of different sizes, to apply different forces to the contacts, thereby imparting different mechanical characteristics to contacts on the same panel. The curvature of the ball bearings is used to push the flanges away from the plane of the sheet. The flanges of the contacts are then formed in all three axes by applying the forming tool to the sheet, to produce the desired contact elements in a batch process (step 2518), as discussed in more detail with reference to FIGS. 30-36 below.

The sheet can be heat treated to correct grain dislocations caused by the forming process (step 2520). As with step 2504, the heating step 2520 is optional, and is dependent upon the material selected for the sheet. Based upon the material and the size of the contacts to be defined on the sheet, heating may be performed to obtain the physical properties desired for optimal forming conditions.

The sheet is then surface treated to enhance adhesion properties for a subsequent lamination process (step 2522). If there is inadequate adhesion, there is a propensity for the sheet to separate from a substrate or delaminate. Several methods for performing the surface treating can be used, including micro etching and a black oxide process. The micro etching is used to pit the surface of the sheet, effectively creating a greater surface area (by making the surface rough and cratered) to promote better adhesion. However, if the micro etching is not properly controlled, it can lead to damage on the sheet.

The black oxide process is a replacement process involving a self-limiting reaction in which an oxide is grown on the surface of the sheet. In this reaction, the oxygen diffuses only through a set thickness, thereby limiting the amount of oxide grown. The oxide has a rough surface in the form of bumps, which helps to promote adhesion. Either the micro etching or the black oxide processes can be used for the surface treatment step, and a preference for one process over the other is a design choice.

Prior to pressing, a low flow adhesion material and dielectric core are processed with relief depressions or holes located beneath flange elements (step 2524). This is intended to prevent excess flow of material up on the flange during the lamination process. Should this flow happen, the contact properties would be altered, causing the contact element to be unsuitable for electrical and mechanical use.

Figure 29A:
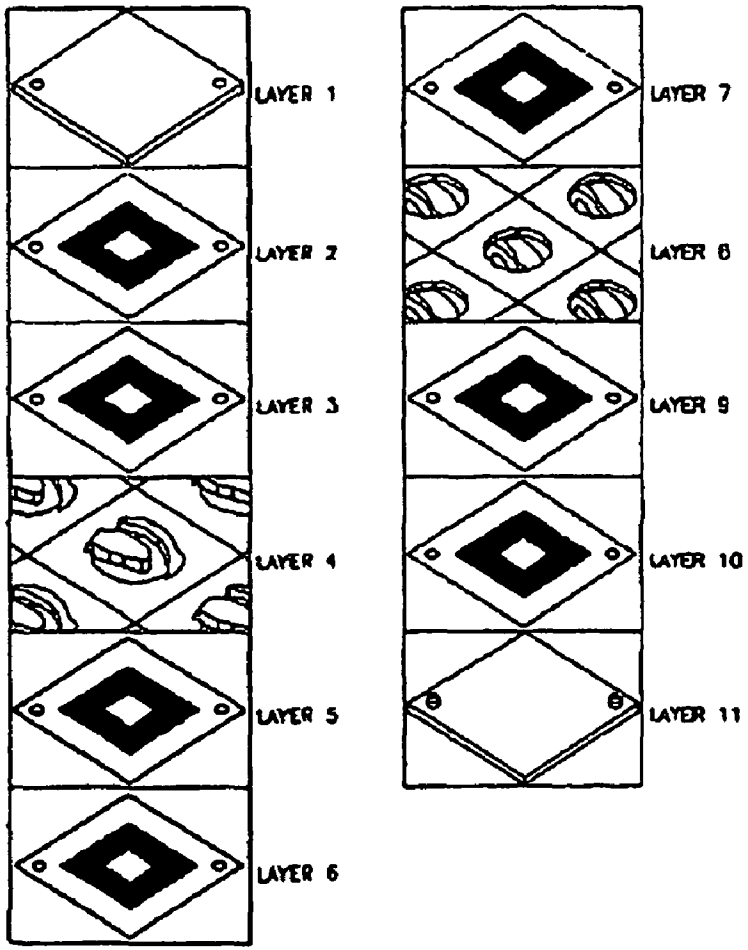
FIG. 29*a* is a schematic diagram of a view of each layer of an exemplary stack up used in one of the steps of the method shown in FIGS. 25*a-d*.
Figure 29B:
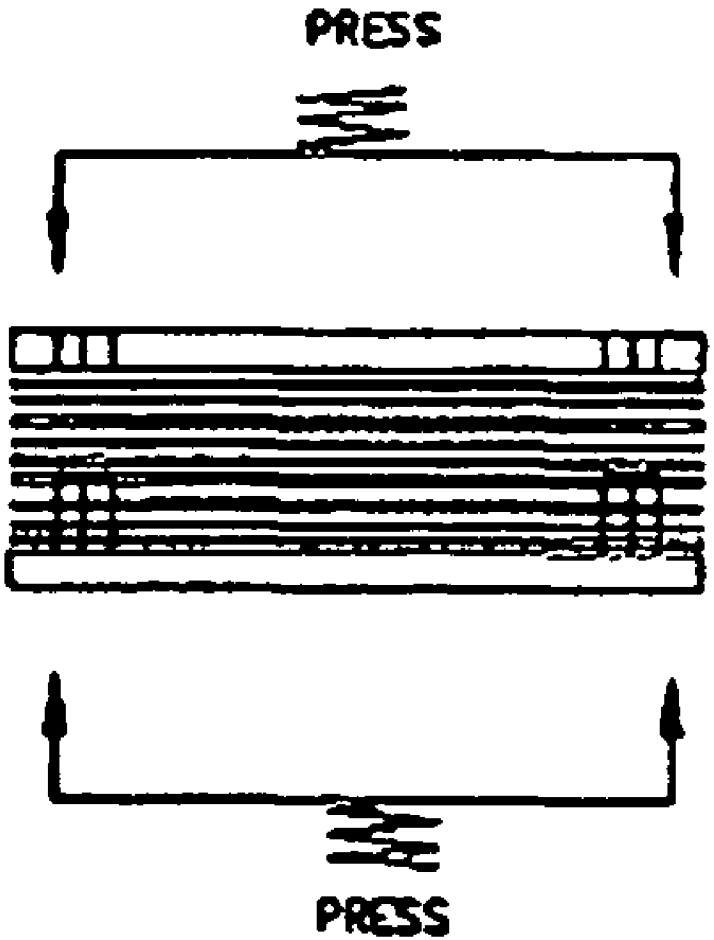
FIG. 29*b* is a schematic diagram of a side view of the assembled stack up shown in FIG. 29*a*.

The following list is a typical stack up generated for lamination pressing (step 2526). This arrangement could be altered to have the contact elements inserted as internal layers. FIG. 29*a* shows each layer of the stack up.

a. Layer 1 is a top press plate material b. Layer 2 is a spacer material with a relief hole over the spring contact element c. Layer 3 is a release material with a relief hole over the spring contact d. Layer 4 is a top sheet of formed contact sheets e. Layer 5 is an adhesion material with a relief hole beneath the spring contact f. Layer 6 is a core dielectric with relief holes under and above the spring contact g. Layer 7 is an adhesion material with a relief hole above the spring contact h. Layer 8 is a bottom sheet of formed contact elements i. Layer 9 is a release material with a relief hole below the spring contact j. Layer 10 is a spacer material with a relief hole below the spring contact element k. Layer 11 is a bottom press plate material The stack up is pressed under temperature conditions optimized for desired adhesions and flow conditions for the adhesion material (step 2528 and FIG. 29*b*). During this operation, the top and bottom contact sheets are bonded to a core dielectric material. After a cool down period, the stack up is removed from the press plates, leaving a panel comprised of Layers 4-8 (step 2530).

The panel surfaces and openings are then plated to electrically connect the top and bottom flanges (step 2532). This step takes the top flange and electrically connects it to the bottom flange by a plating process known as an electroless process. The process effectively deposits a conductive material on the top surface, into the through hole to connect both sheets of contact elements, and then onto the sheet on the other side of the substrate. The plating process creates a route for an electrical current to travel from one side of the board to the other.

Next, a photosensitive resist film is applied to both sides of the panel (step 2534). A pattern is exposed and developed to define the individual contact elements (step 2536). A determination is then made as to the contact finish type, either hard gold or soft gold (step 2538). Hard gold is used in specific applications where the numbers of insertions required are high, such as a test socket. Hard gold itself has impurities that cause the gold to be more durable. Soft gold is a pure gold, so it effectively has no impurities, and is typically used in the PCB or networking space, where the number of insertions is fairly low. For example, a package to board socket used in a PC (soft gold) will typically see on the order of one to 20 insertions, whereas other technology using hard gold will see a number of insertions between 10 and 1,000,000.

If the contact finish type is a hard gold, then a partial etching is performed to almost singulate the contact elements (step 2540). The resist film is removed via a stripping process (step 2542). A new layer of resist is applied, covering both sides of the panel (step 2544). The previously etched areas are exposed and developed (step 2546). The panel is then submitted for electrolytic Cu/Ni/Au plating via a hard gold process (step 2548).

The resist is removed to expose previous partially etched scribe lines (step 2550). The entire panel is etched using electrolytic Ni/Au as a hard mask to complete singulation of the contact array (step 2552). Final interposer outlines are routed out of the panel to separate the panel into individual connector arrays (step 2554), and the method terminates (step 2556).

If a soft gold finish is used (step 2538), then etching is used to completely singulate the contact elements (step 2560). The resist film is removed via a stripping process (step 2562). Electroless Ni/Au, also known as a soft gold, is plated onto the panel to complete the contact elements (step 2564). Final interposer outlines are routed out of the panel to separate the panel into individual connector arrays (step 2554), and the method terminates (step 2556).

The soft gold finishing process singulates the contacts prior to plating. Ni/Au will plate only on metal surfaces, and provides a sealing mechanism for the contact element. This helps to prevent potential corrosive activity that could occur over the system life of the contact, since gold is virtually inert. Singulation prior to plating is a means to isolate or encapsulate the copper contact with another metal, resulting in cleaner imaging and a cleaner contact, which has a low propensity for shorting.

Figure 30:
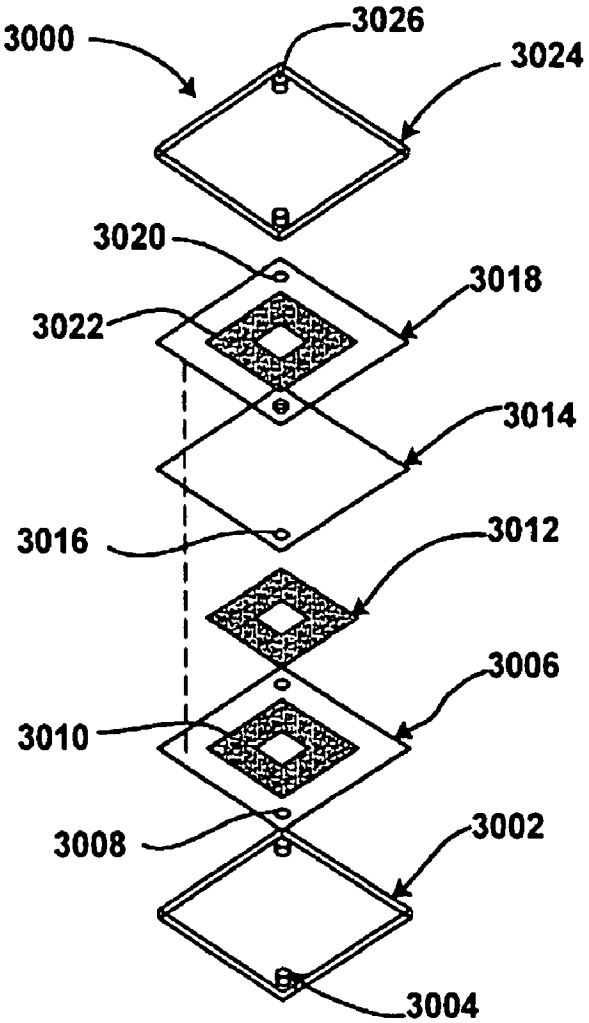
FIG. 30 is a schematic diagram of an exploded perspective view of an exemplary stack-up in accordance with one configuration of the present invention.
Figure 31:
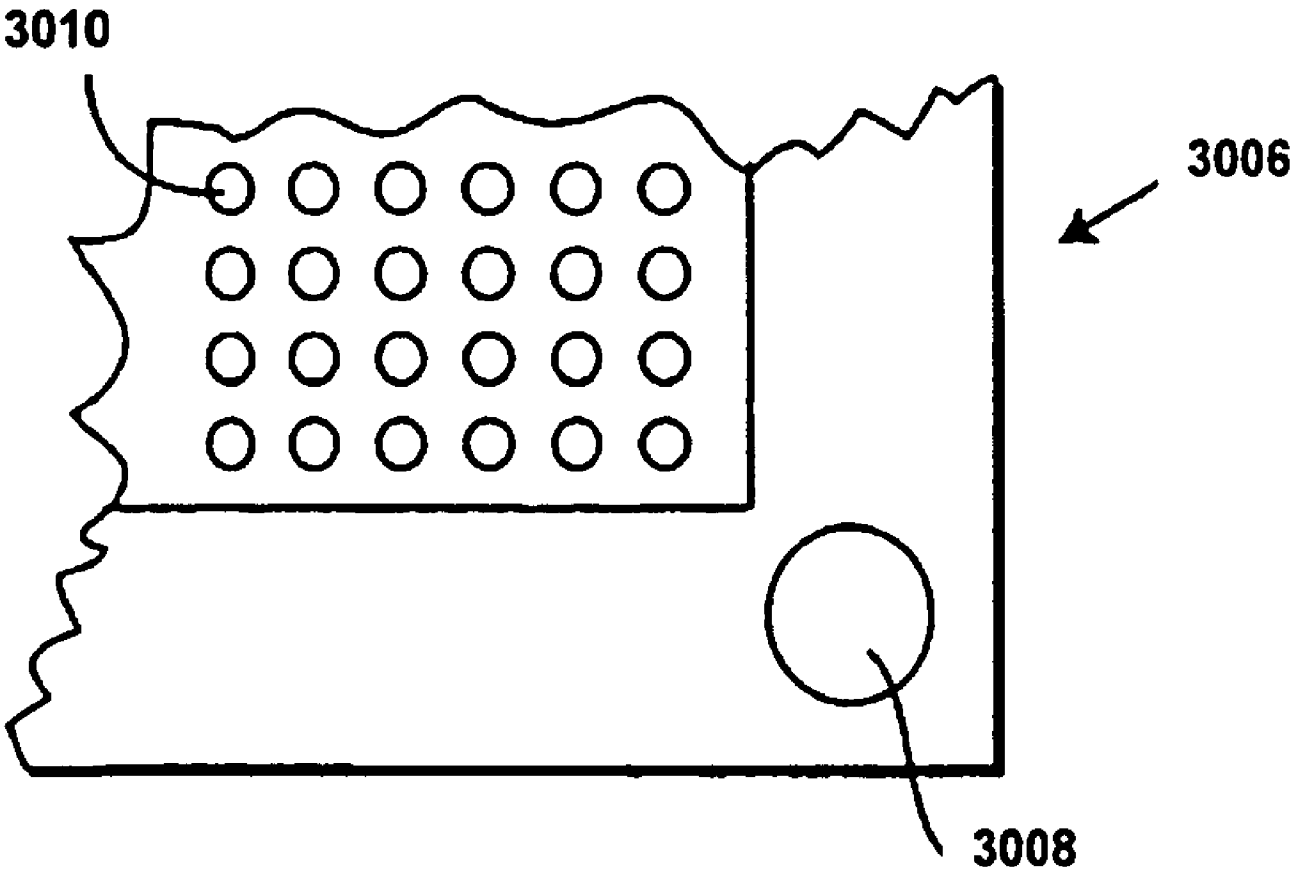
FIG. 31 is a schematic diagram of an enlarged partial top plan view of an exemplary spacer layer used in the stack-up shown in FIG. 30.

FIG. 30 shows an exemplary stack-up 3000 that can be used in step 2518 for batch forming spring elements in three dimensions in accordance with one configuration of the present invention. Stack-up 3000 has a bottom press plate 3002 as its bottom layer. Bottom press plate 3002 preferably includes at least two dowel pins 3004 or other aligning means such as reference holes, edges, or the like, for aligning the elements of stack-up 3000. The material used for bottom press plate 3002 can be any material with sufficient rigidity to support the force used for compressing the stack-up without deforming the press plate 3002, for example, steel or aluminum. While stack-up 3000 is shown utilizing two dowel pins 3004, any number of dowel pins can be used.

A bottom spacer layer 3006 (shown in partial top plan view in FIG. 31) is positioned above bottom press plate 3002. In one configuration, bottom spacer layer 3006 is made of a softer material than bottom press plate 3002, for example, metal or plastic. It is noted that layer 3006 could alternatively be made of a material similar to bottom press plate 3002. Layer 3006 has positioning holes 3008, or other suitable means as discussed above, to align layer 3006 with bottom press plate 3002. Layer 3006 also has a plurality of holes 3010. Each of holes 3010 is sized and shaped to hold a configurable die, for example, ball bearings 3012, depicted in the enlarged view of FIG. 32. The term configurable die, as used herein, refers to elements that can be used to form or impart a shape in another structure, such as a deformable sheet. In addition to spherical ball bearings, configurable die could also be conical, pyramidal or other shapes.

While the exemplary configuration shown in FIGS. 30-33 utilizes through holes 3010, openings that extend partially or all the way through layer 3006 can be provided. In one configuration of the present invention, holes 3010 are formed in precise positions using photolithographic mask and etch technology in order to form an array that exactly matches a particular contact arrangement, for example a contact arrangement of a device to be contacted by the finished spring element sheet. This arrangement can be done inexpensively at micron accuracy, with very fast turnaround to accommodate various contact patterns.

Figure 32:
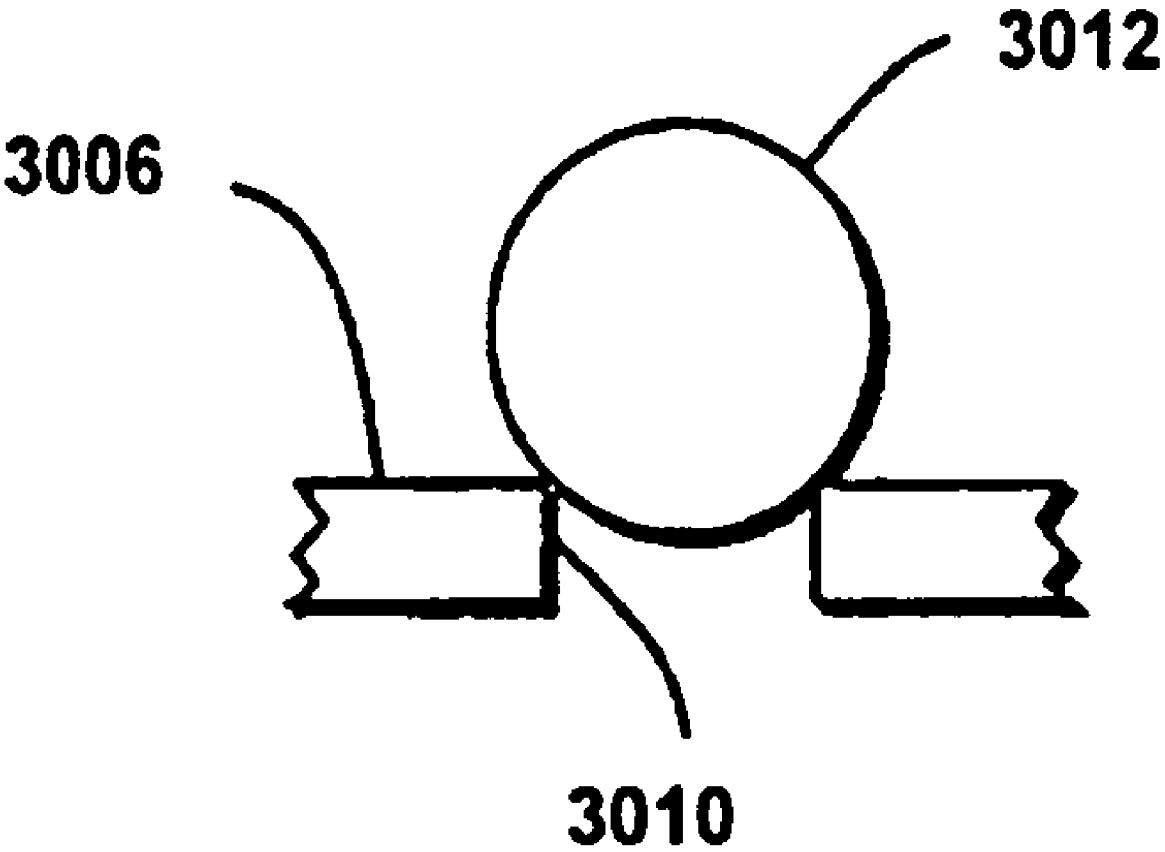
FIGS. 32 and 33 are schematic diagrams of cross-sectional views of an exemplary ball bearing configured die inserted into a spacer layer used in the stack-up shown in FIG. 1.
Figure 33:
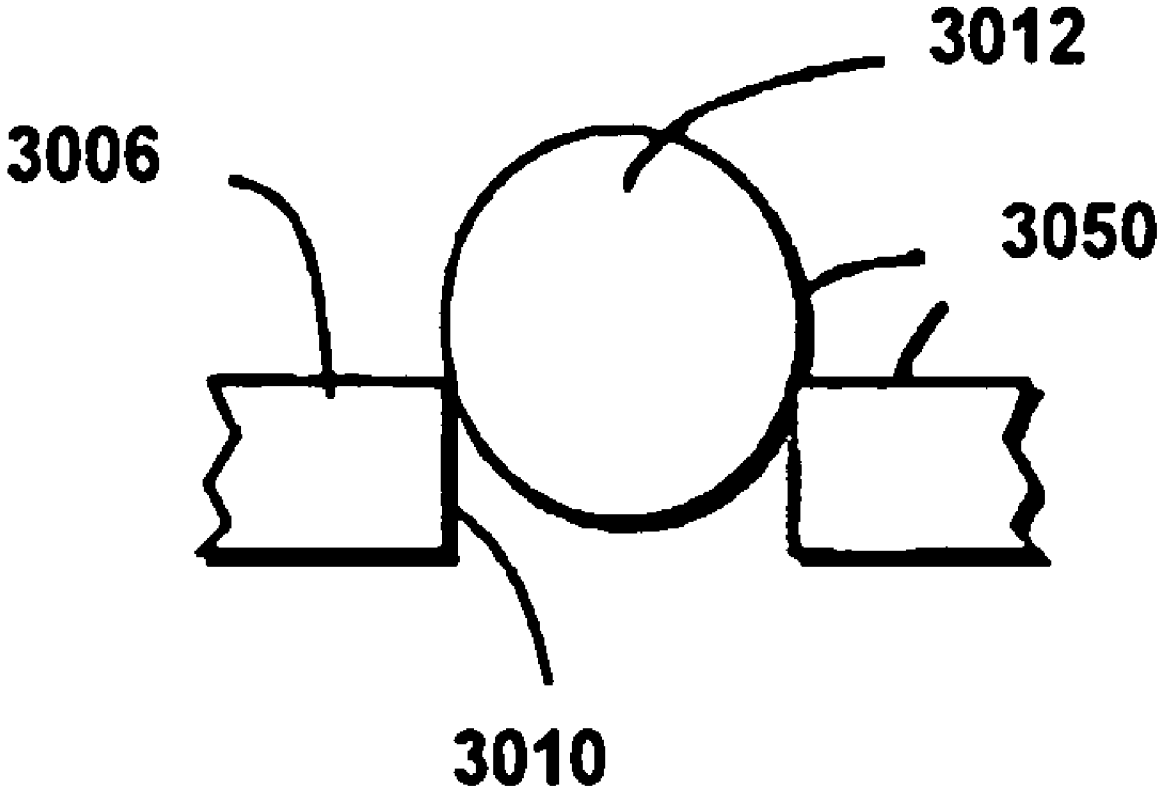
Figure 35:
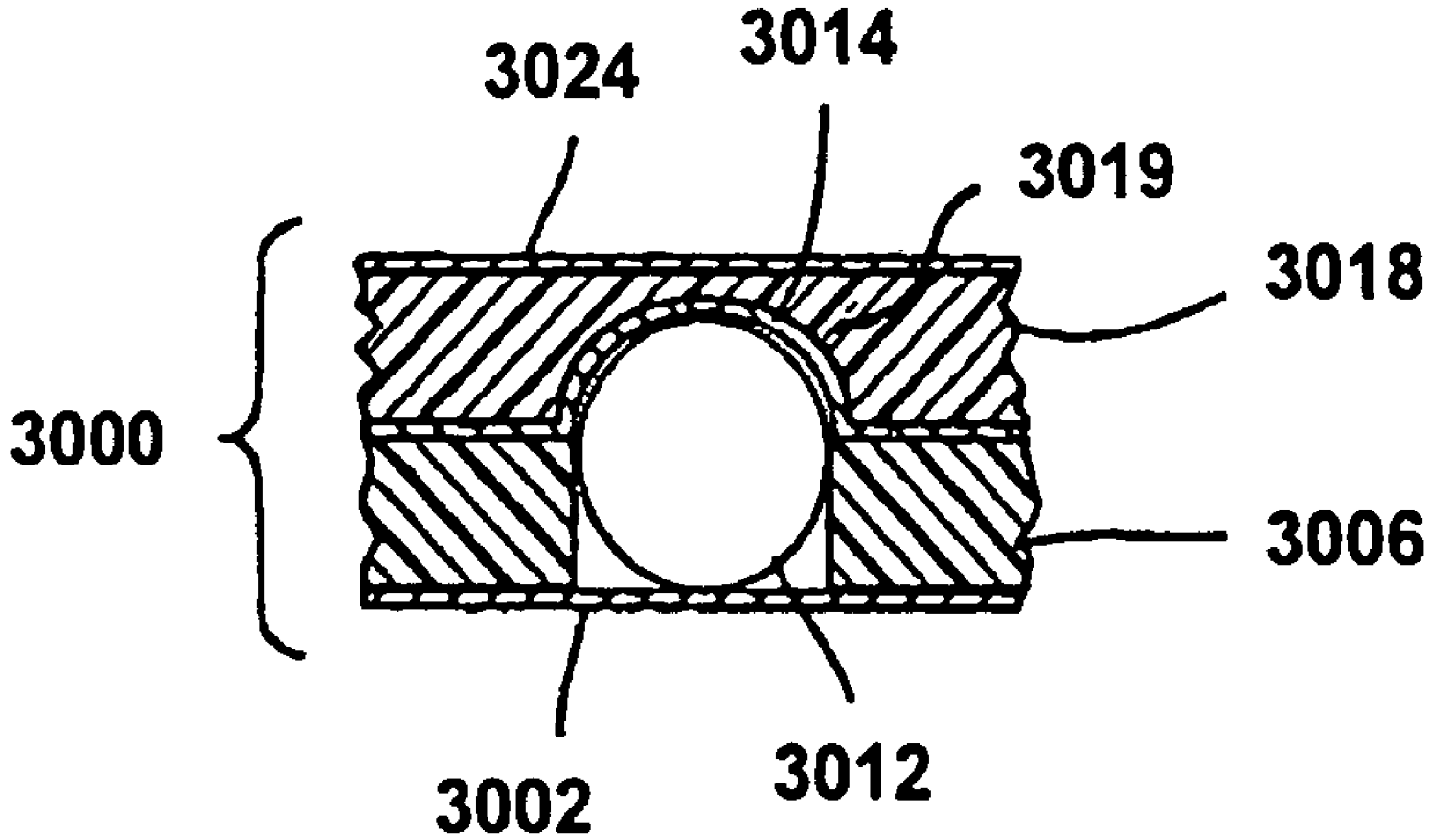
FIG. 35 is a schematic diagram of a cross-sectional side view of an alternate configuration of a spring element sheet after pressing.

Ball bearings 3012 or other configurable die are placed into holes 3010 by manual or mechanical means according to a desired pattern to form the spring elements or dome features that may then later be patterned and etched to form spring elements. Ball bearings 3012 can have a slight interference fit so that they are pressed and held in position. As shown in FIGS. 32 and 33, the height that the bearings protrude can be controlled by the hole diameter. Ball bearings 3012 can be inserted up to their equator or beyond for stability, as shown in FIG. 35. Holes 3010 are generally drilled slightly smaller than ball bearing 3012, e.g., 0.025 mm or smaller. By press fitting ball bearings 3012 into holes 3010, there is a slight elastic deformation of spacer layer 3006. This deformation applies a frictional force of spacer layer 3006 which helps keep ball bearing 3012 in place.

After one or more configurable die 3012, such as ball bearings, are inserted and press fit into holes 3010, spacer layer 3006 can retain the configurable die, such that the resulting spacer layer containing configurable die can operate as a die plate for shaping deformable sheets to form spring elements in the sheets. The resulting die plate contains three dimensional features corresponding in size and shape to the portions of individual configurable die protruding above the plane of spacer layer 3006, imparting a three dimensional surface, for example, surface 3050 as depicted in FIG. 33.

Thus, according to a predetermined design desired for the final three dimensional spring elements, the shape and size of features of surface 3050 can be tailored by changing the shape and size of configurable die inserted in spacer layer 3006. For example, a predetermined design may call for spring elements to have a shape of a circular arc as viewed in cross section, as illustrated for layer 3014 in FIG. 35. Accordingly, a spherical or cylindrical die could be used to impart such a design. In addition, if a design requires that a spring element protrude from a plane by a predetermined distance, the height that a configurable die protrudes above the planar surface portion of a die plate can be varied accordingly.

Ball bearings 3012 or other configurable die can be made of hardened tool steel or stainless steel and can vary in diameter depending upon the desired characteristics of the spring elements to be formed. Ball bearings 3012 could also be made of any other suitable material, such as AL 6061, AL 76075, chromium steel, or tungsten carbide. As an example, ball bearings 3012 can range in diameter from approximately 0.3 mm to approximately 127.0 mm. The depth of insertion of ball bearings 3012 into layer 3006 is limited by bottom press plate 3002. The depth of insertion of ball bearings 3012 (as shown in FIGS. 32 and 33) can also be varied to provide different spring characteristics to individual spring elements. Additionally, ball bearings 3012 or other configurable die of different sizes or shapes can be utilized to achieve different spring characteristics.

Figure 25A:
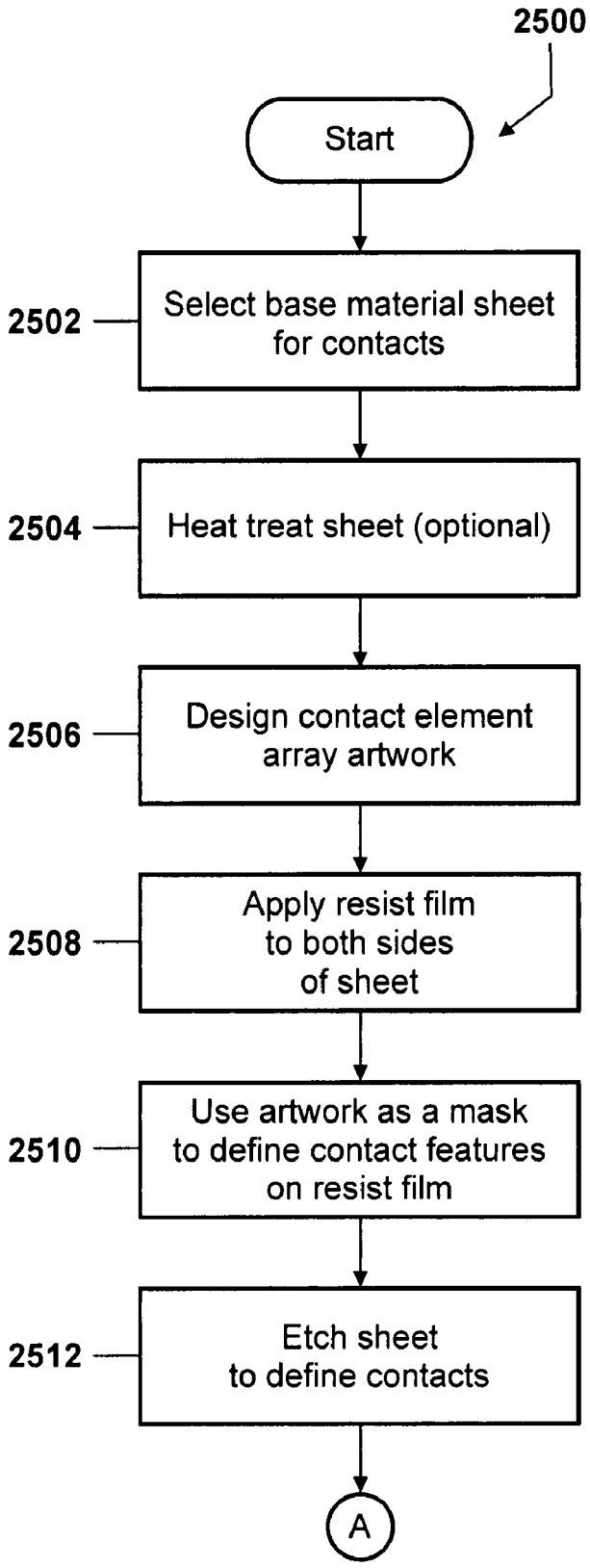
FIGS. 25*a* to 25*d* are flowcharts showing the steps of an exemplary method for making a connector in accordance with an alternate implementation of the present invention.
Figure 25B:
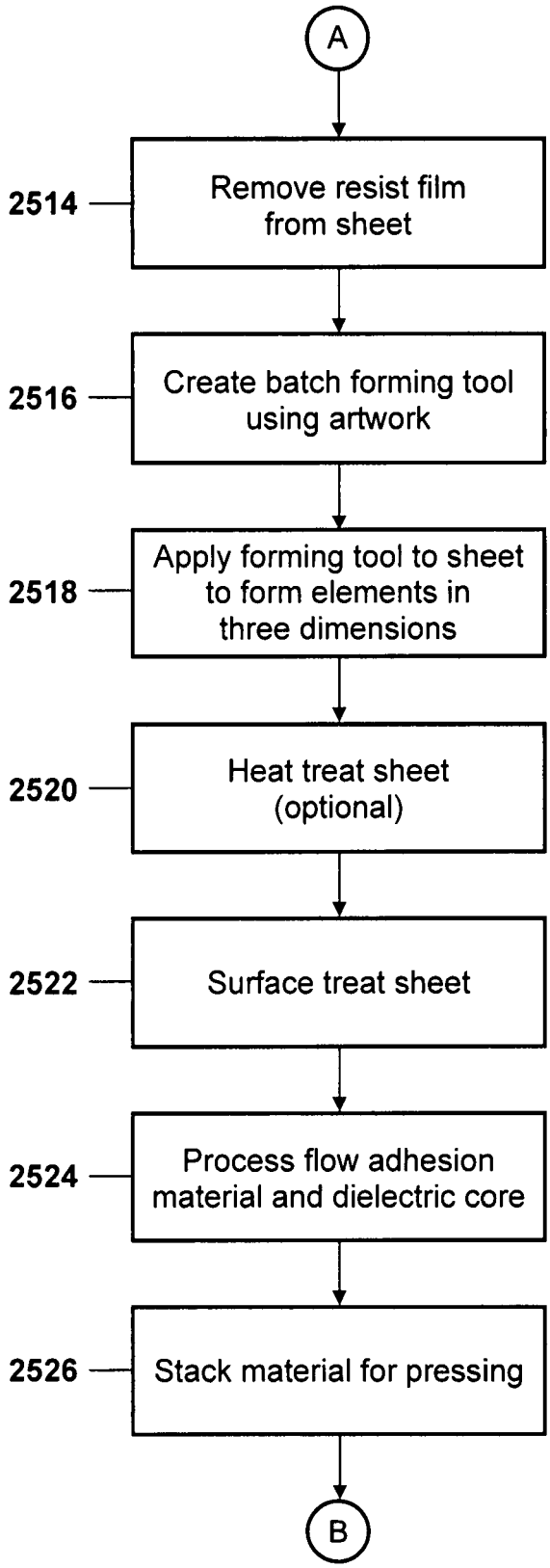
Figure 25C:
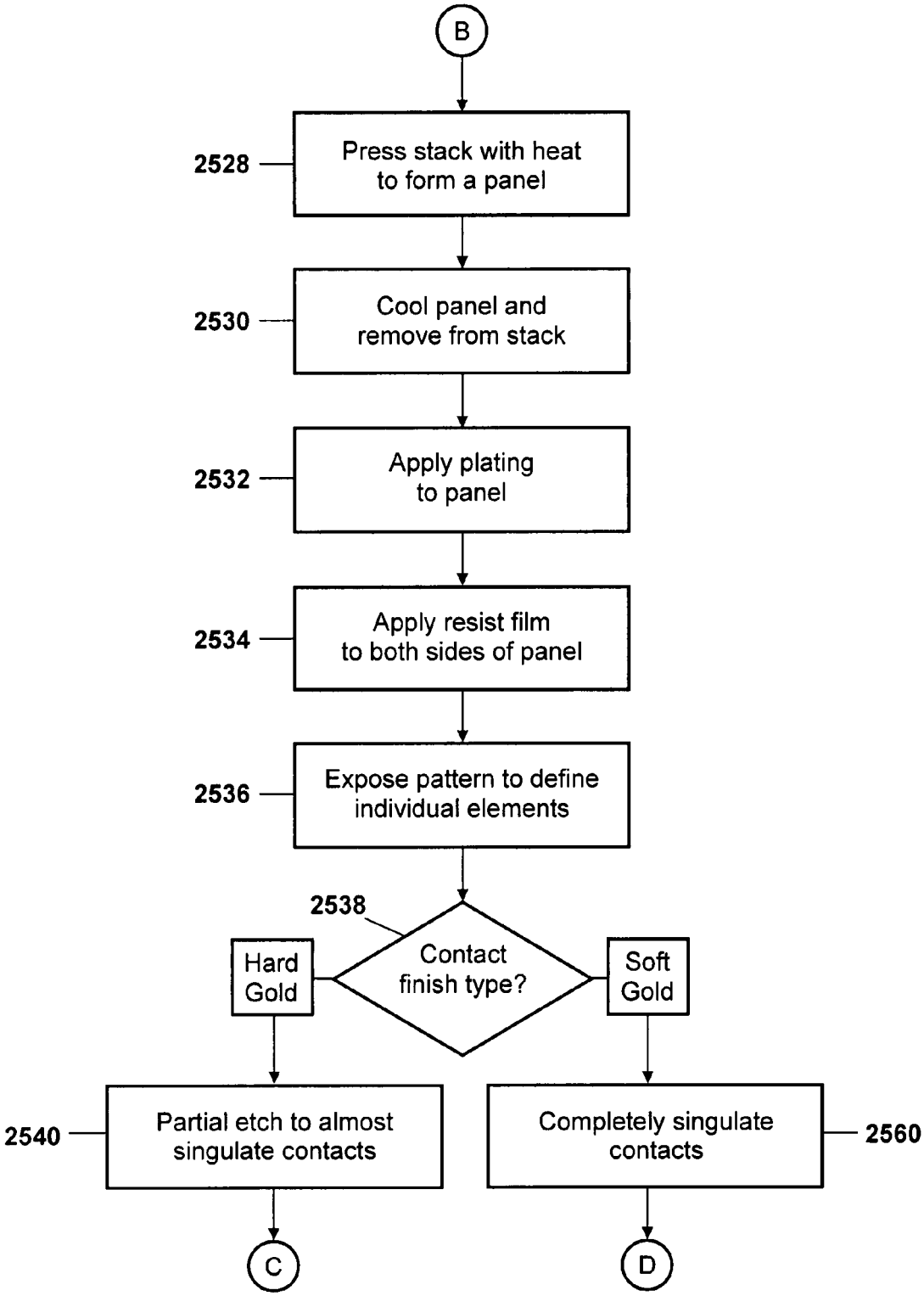
Figure 25D:
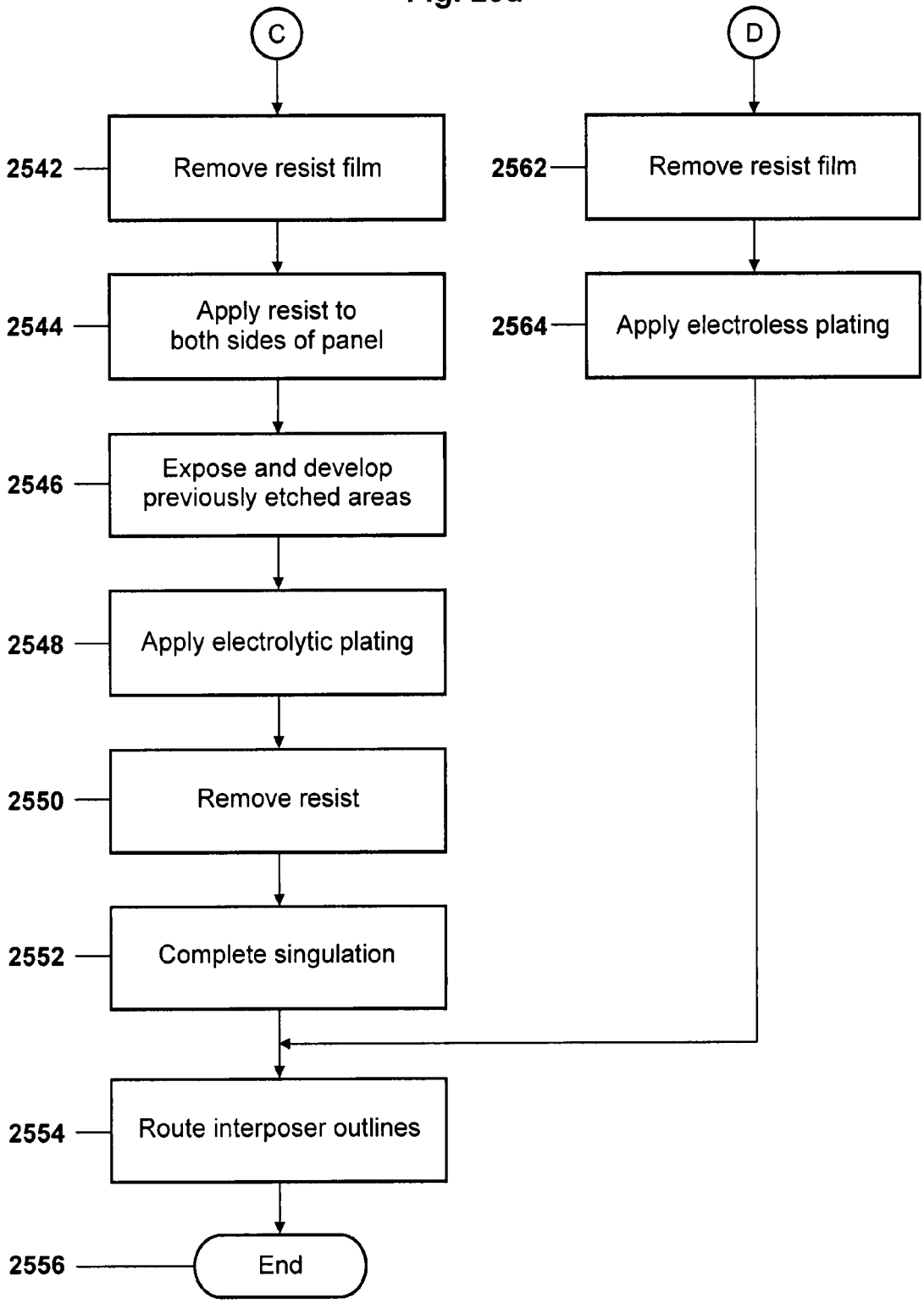
Figure 34:
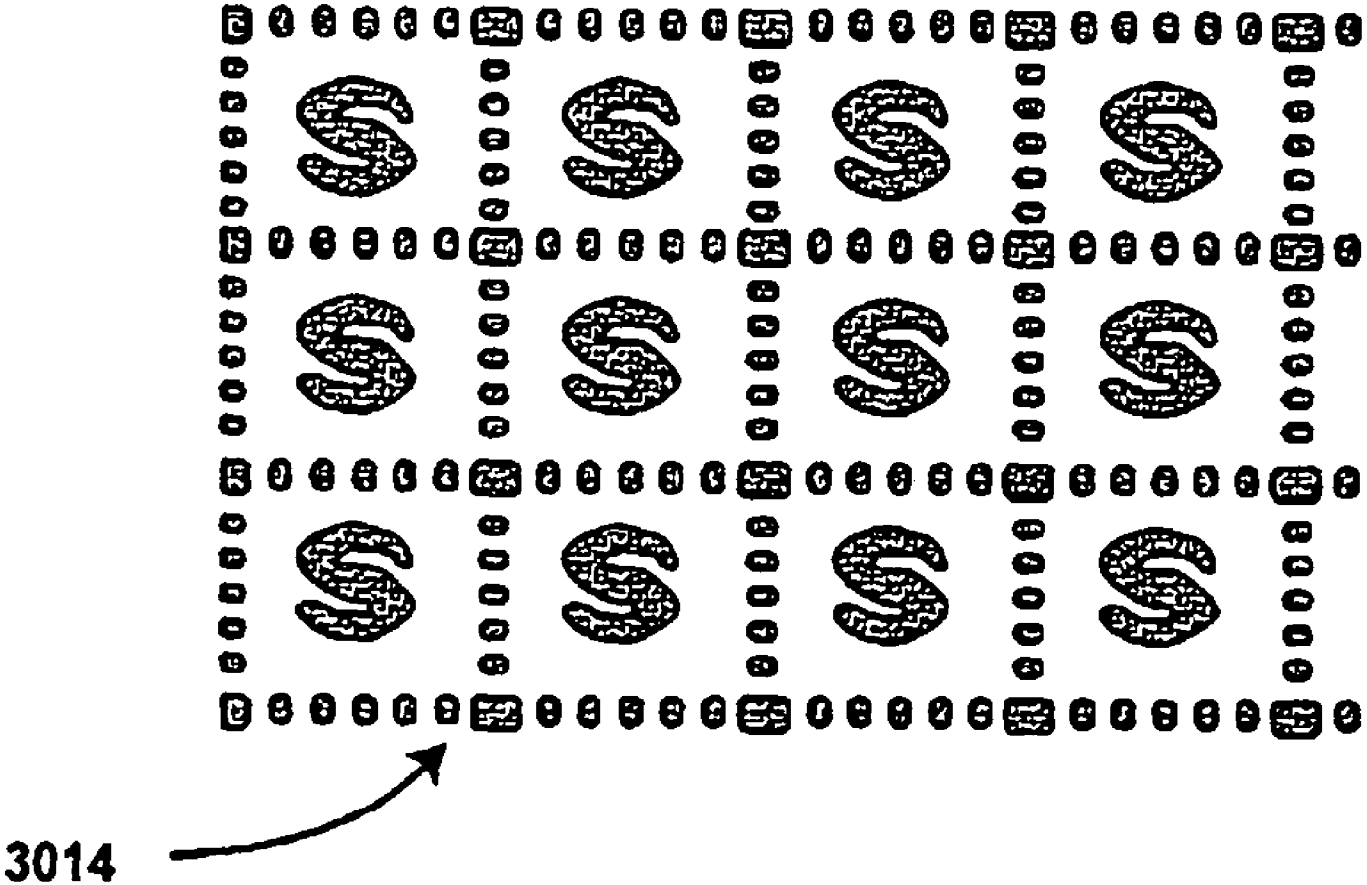
FIG. 34 is a schematic diagram of a top plan view of an exemplary

In one configuration, a spring element sheet 3014 having positioning holes 3016 for alignment with dowel pins 3004, or other alignment means, is placed on top of ball bearings 3012 or other configurable die. Sheet 3014 contains spring elements defined in two dimensions and can be formed by various methods, including etching or stamping. An example of a spring element sheet with the elements defined in two dimensions is shown in FIG. 34. Referring also to FIG. 25*b*, in this configuration, the forming tool of step 2518 thus comprises layers 3002, 3006, 3012, 3018 and 3024, which are applied to sheet 3014 to form three dimensional spring elements that are arranged, for example, in an array within sheet 3014.

Referring again to FIG. 30, the configurable die 3012 can be arranged in a two dimensional pattern in spacer layer 3006, such that the die positions in the resulting die plate correspond to the positions of at least some of the two dimensional spring elements arranged in spring sheet 3014, when the die plate (not shown) is brought into contact with spring sheet 3014. Thus, if a user determines that every other of the two dimensional spring elements (see FIG. 34) in spring sheet 3014 is to be formed into a three dimensional spring element, the pattern of configurable die 3012 placed within spacer layer 3006 is arranged accordingly. In this manner, the configurable die 3012 deform only the two dimensional spring elements that are desired to be formed into three dimensional spring elements. Configurations may readily change by adding or removing regions of die that result in a new form or size of contact.

Figure 36A:
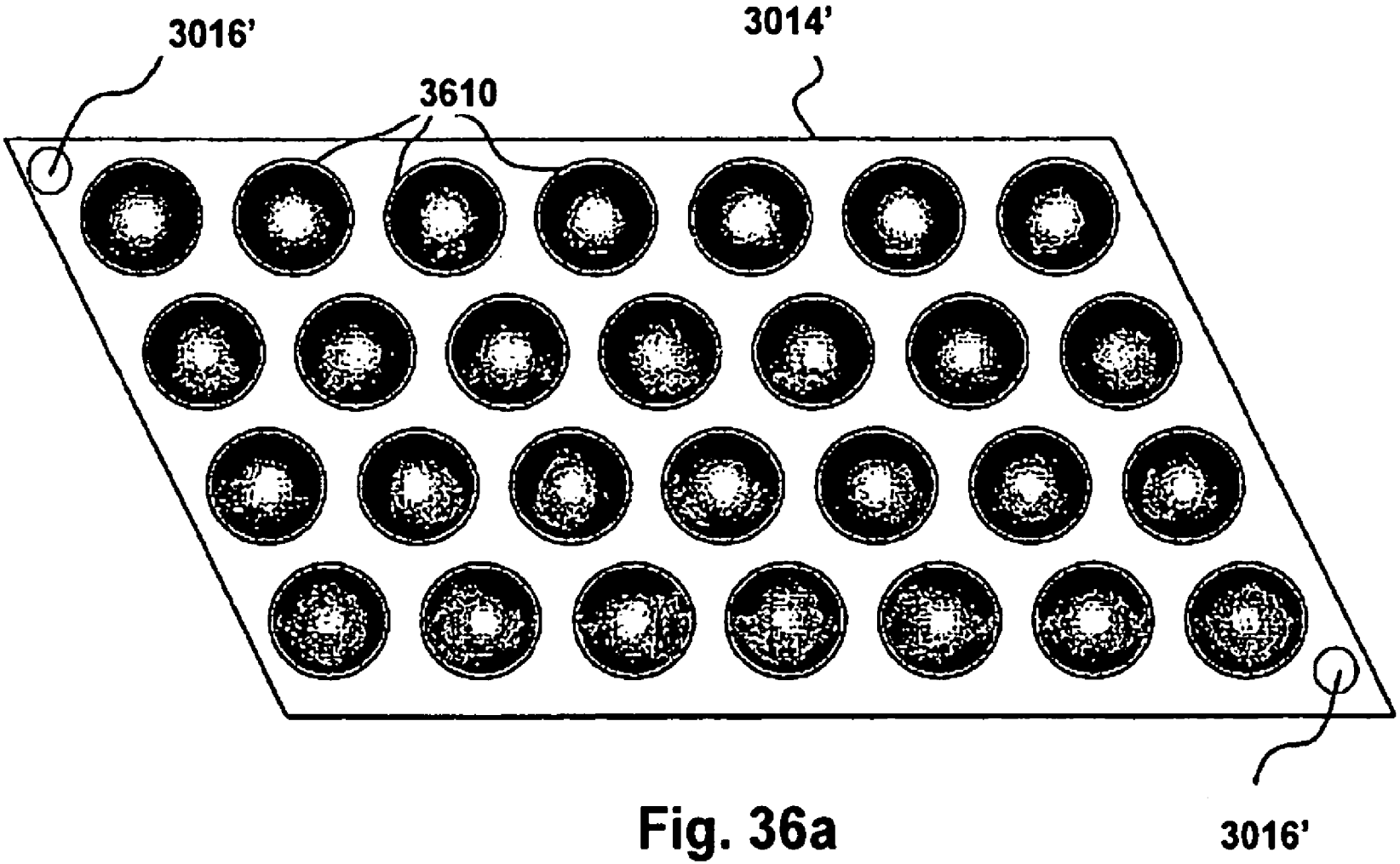
FIGS. 36*a* to 36*c* illustrate the formation of three dimensional features in an unpatterned spring sheet, according to one configuration of the invention.

In an alternative configuration shown in FIG. 36*a*, a spring element sheet 3014' without predefined spring elements may be used. Spring element sheet 3014' is a plain spring element sheet having only positioning holes 3016' to align sheet 3014' to other layers. The present invention operates in the same manner, regardless of whether sheet 3014 or sheet 3014' is used, except as noted below. For discussion proposes only, further discussion shall only refer to sheet 3014, but is equally applicable to sheet 3014'.

As shown in FIG. 30, a top spacer layer 3018 is placed on top of sheet 3014. Top spacer layer 3018 has positioning holes 3020 for aligning layer 3018 with dowel pins 3004, or other alignment means as discussed above. Top spacer layer 3018 can also contain a plurality of openings 3022 that are complementary to configurable die 3012, through which the spring elements are formed. As used herein, the term "complementary" signifies that openings 3022 are substantially aligned with positions of configurable die 3012 when top spacer layer 3018 is brought into contact with spring sheet 3014. Thus, local deformations of spring sheet 3014 around configurable die 3012 can be accommodated substantially within openings 3022 when top spacer layer 3018 contacts spring sheet 3014 and deforms it over configurable die 3012.

Top spacer layer 3018 may be constructed of similar or different materials as bottom spacer layer 3006. Openings 3022 in layer 3018 could be smaller, the same size or larger than holes 3010 in bottom spacer layer 3006. In this manner, some control over the final shape of the spring elements can be achieved by changing the size of openings 3022. In addition, the thickness of top spacer layer 3018 can also help to determine the final height of the spring elements above the surface of the sheet 3014.

Alternatively, spacer layer 3018 is made of a compliant material (for example, silicon rubber) substantially conformable around configurable die 3012 in order to form the spring elements on the contact area of configurable die 3012, as shown in FIG. 35. Thus, layer 3018 can initially comprise a layer having uniform thickness that can conform to three dimensional shapes by deformation of surface 3019, as shown in FIG. 35.

Referring again to FIG. 30, in an alternate configuration, top spacer layer 3018 can be designed as a top spacer sheet having a plurality of openings into which configurable die are pressed at defined locations. In this manner, top spacer layer 3018 forms a second die plate (not shown) that can be used to form spring elements below the plane of sheet 3014. In this manner, when layer 3018 and layer 3006 are brought into contact with spring sheet 3014, spring elements can be formed both above and below the plane of spring sheet 3014. The pattern of configurable die in top spacer layer 3018 are arranged so that the positions of individual die do not correspond to the same planar positions of configurable die in bottom spacer sheet 3006. That is, any planar position of spring sheet 3014, such as positions of two dimensional spring elements, can be contacted by a configurable die in either top spacer layer 3018 or bottom spacer sheet 3006, both not both. Thus, every configurable die of each set of configurable die, either arranged in the top spacer or bottom spacer, corresponds to a unique spring element position in spring sheet 3014. Accordingly, when stack up 3000 is brought together, every two dimensional spring element to be formed into a three dimensional spring element is forced to protrude either above or below the plane of spring sheet 3014.

As shown in FIG. 30, a top press plate 3024 is placed on top of top spacer layer 3018. Top press plate 3024 has positioning holes 3026 for alignment with dowel pins 3004 or other alignment means. Top press plate 3024 is constructed of similar materials as bottom press plate 3002. After the elements of stack-up 3000 have been assembled and aligned, preferably using dowel pins 3004, pressure is applied to both top press plate 3024 and bottom press plate 3002. This pressure forces configurable die 3012 against the underside of sheet 3014, pushing the spring elements upward to form them in three dimensions, as shown in FIG. 35.

The amount of force required to form the spring elements depends upon the properties of the material being formed, and can be limited by the yield strength of the bottom press plate 3002 if desired. However, in view of the size and scale of the contact arms being formed, this is generally not an issue.

As noted above, in alternate configurations, where configurable die are pressed into top layer 3018, a result similar to that shown in FIG. 35 can be obtained, the difference being that the configurable die would press the sheet downward instead of upward. Accordingly, in alternative configurations, some spring elements of a spring sheet can be pushed upwards by configurable die positioned below the spring sheet, while others are pushed downward by configurable die positioned above the sheet.

When the alternate configuration of spring element sheet 3014' is used, the pressure applied forces ball bearings 3012 against the underside of spring element sheet 3014', pushing spring element sheet 3014' upward to form three dimensional domes 3610, as shown in FIG. 36*a*. After pressing, domes 3610 can be patterned and etched to form three dimensional contact elements.

An electrical connector having a spring element formed by using a ball bearing in accordance with the present invention has unique characteristics. Pressing the spring element over the ball bearing causes the spring element to have a torsional force added to the spring force of the material, to provide additional spring characteristics. This results in unique physical configurations that provide the electrical connector with a better wiping action to an abutting electrical contact. The torsional force exists any time there is a twisting of the material; in the present case, the material is formed around a spherical ball bearing, causing it to be twisted around the surface of the sphere, thus supplying a torsional force. It is noted that arrangements of configurable die with surfaces having shapes other than the aforementioned spherical ball bearings are contemplated in the present invention. Accordingly, the degree and nature of forces imparted into electrical contacts formed over a configurable die of the present invention can be varied.

Figure 36B:
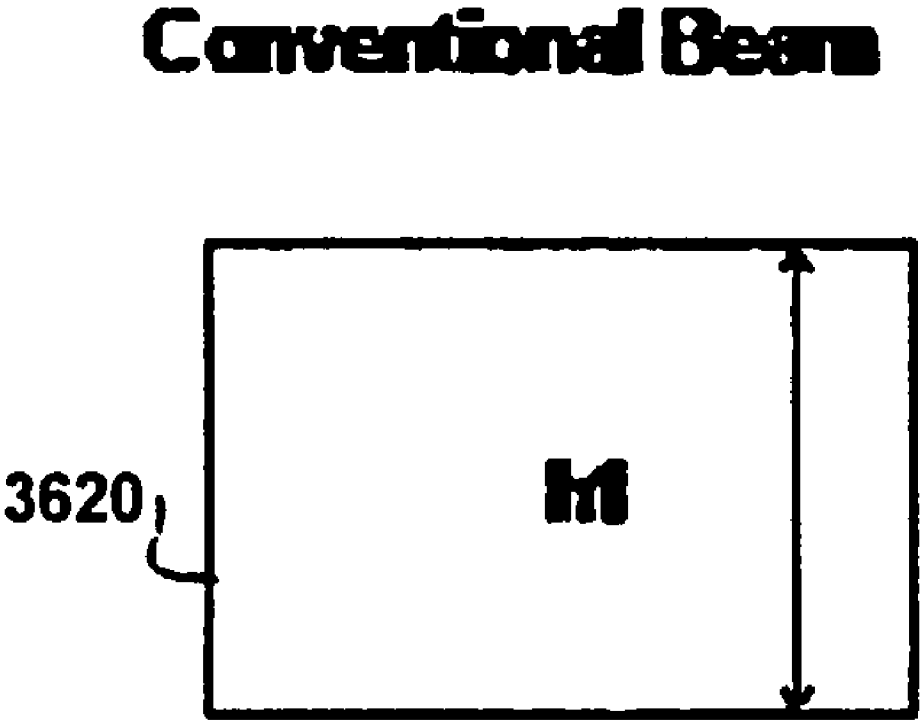
Figure 36C:
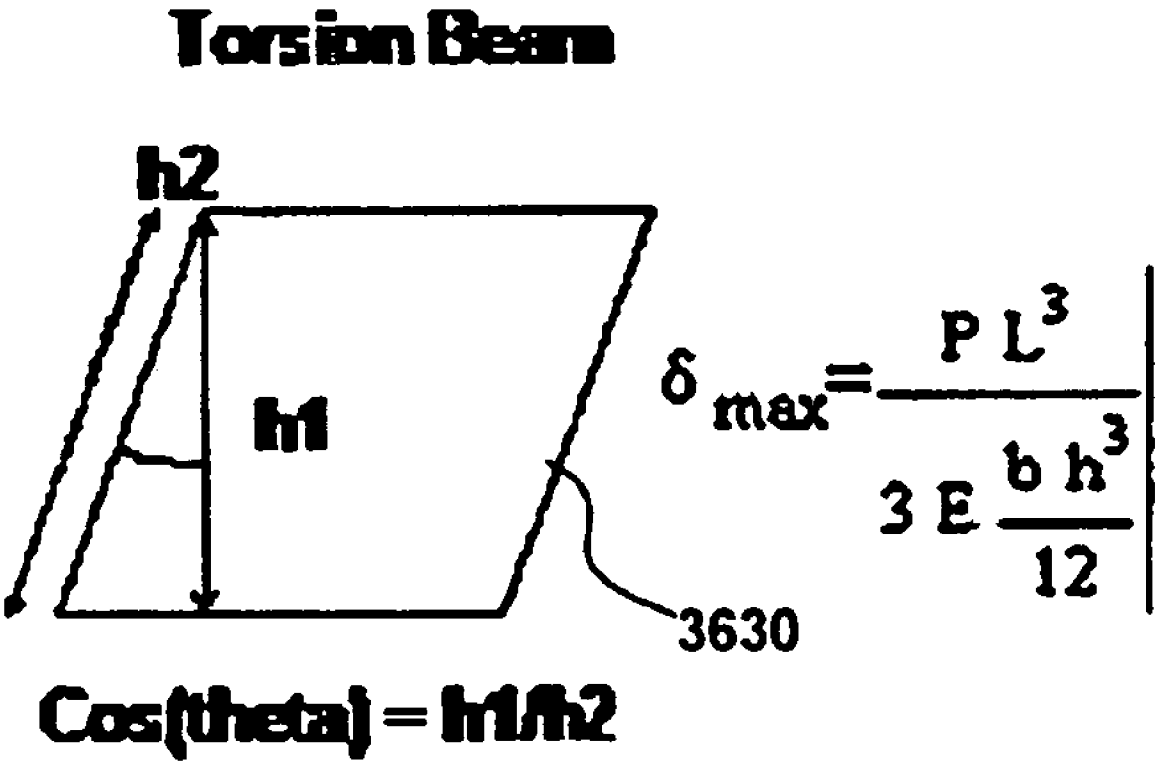

FIG. 36*b* illustrates in cross-section a conventional cantilever beam spring element 3620 that can form a spring element of a contact, while FIG. 36*c* illustrates in cross-section a torsion beam spring element 3630 of a contact, according to configurations of the invention. The maximum deflection 6 max in a cantilever beam of length L, width b, and height h, can be calculated according to the following formula: 6 max= (PL3)/(3Ebh3/12) where P is the load applied to the beam and E is the elastic modulus of the beam. In a comparison of the beam cross sections of the standard beam of FIG. 36*b* and the torsion beam of FIG. 36*c*, it is readily apparent that, in solving for h2 (height of the torsion beam), that h1 (height of the standard beam) is less than h2. Thus, the resultant load P for a given 6 max, can be significantly different from the standard un-torsional cantilever beam. Accordingly, by selecting an appropriate die element, such as a spherical ball bearing, for use in forming a three dimensional contact, one can impart more or less torsion into a formed three dimensional contact spring element such as a beam, so that the formed contact spring element can be engineered to meet certain desired mechanical responses.

Figure 37A:
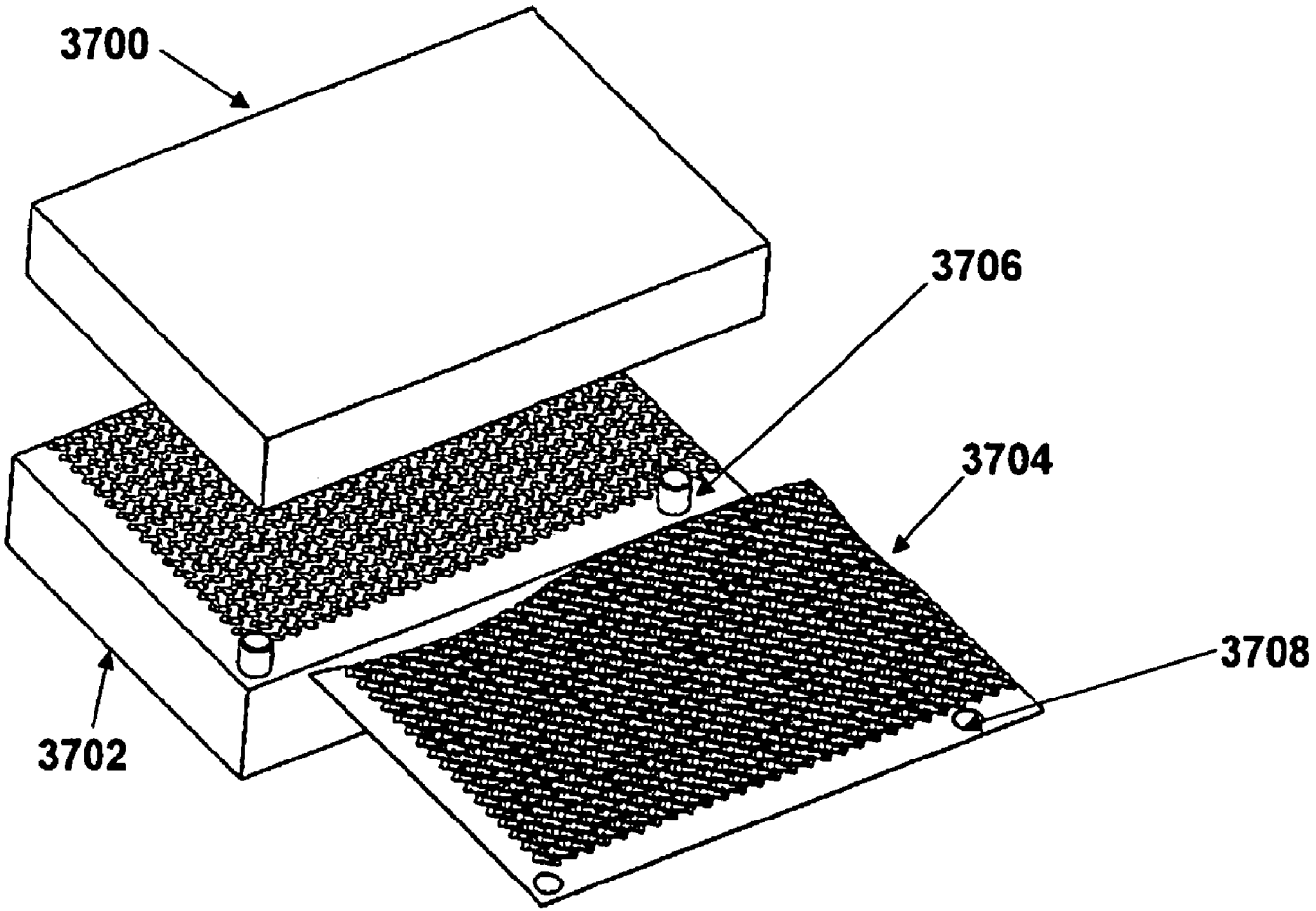
FIGS. 37*a* to 37*e* illustrate a male and female die plate with a patterned contact element sheet between them for forming contacts in a batch processing method of the present invention.
Figure 37B:
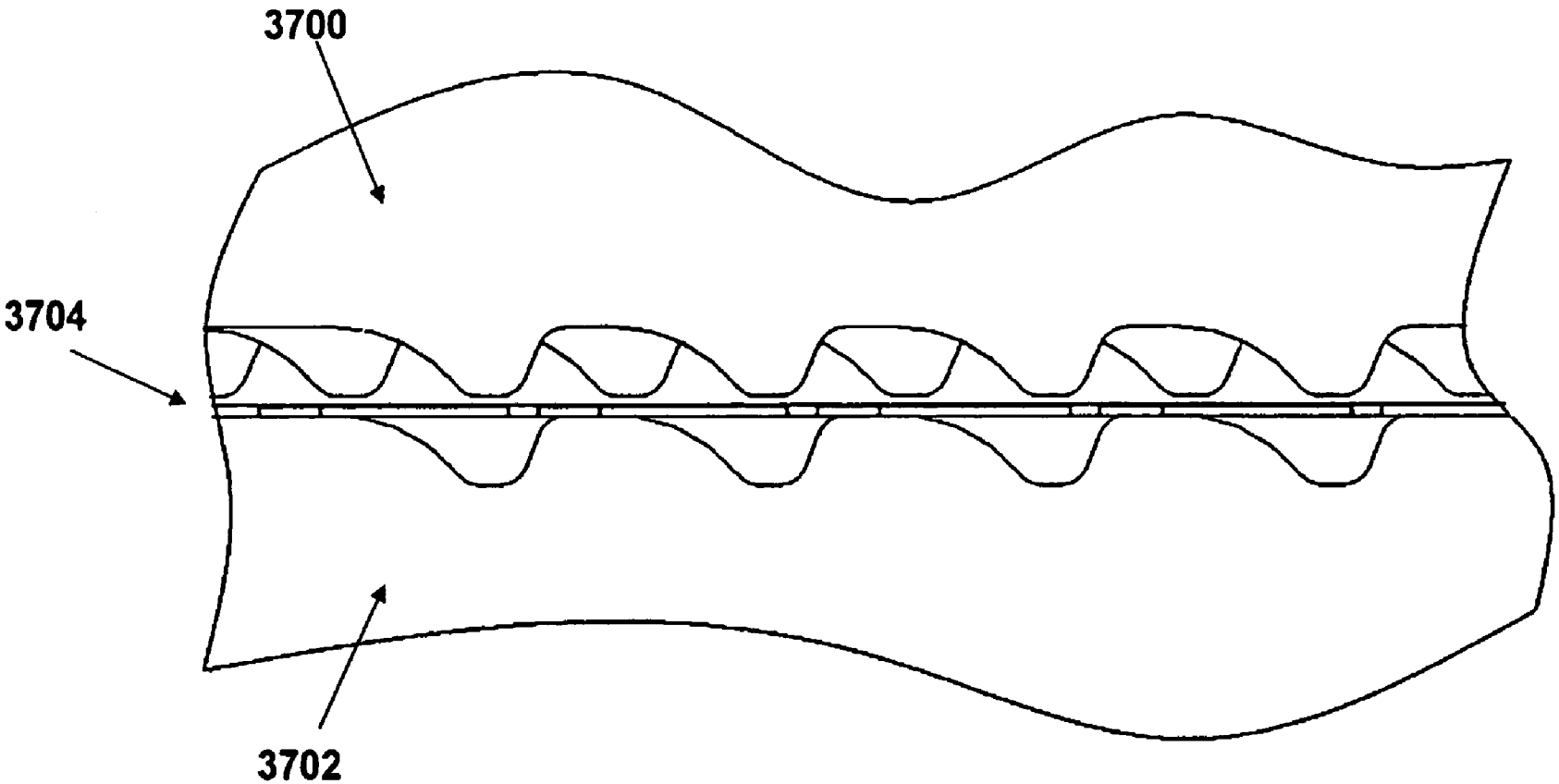
Figure 37C:
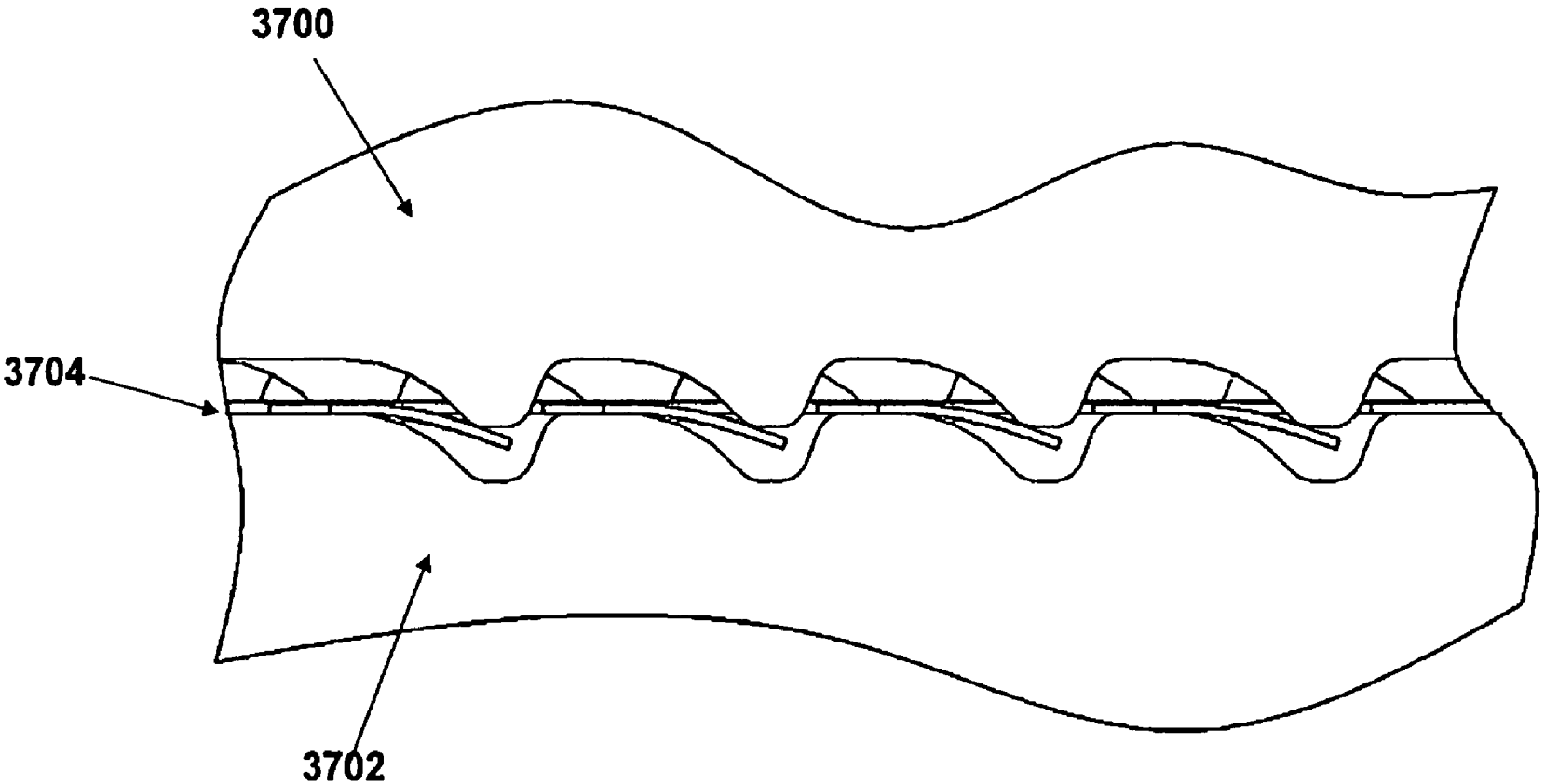
Figure 37D:
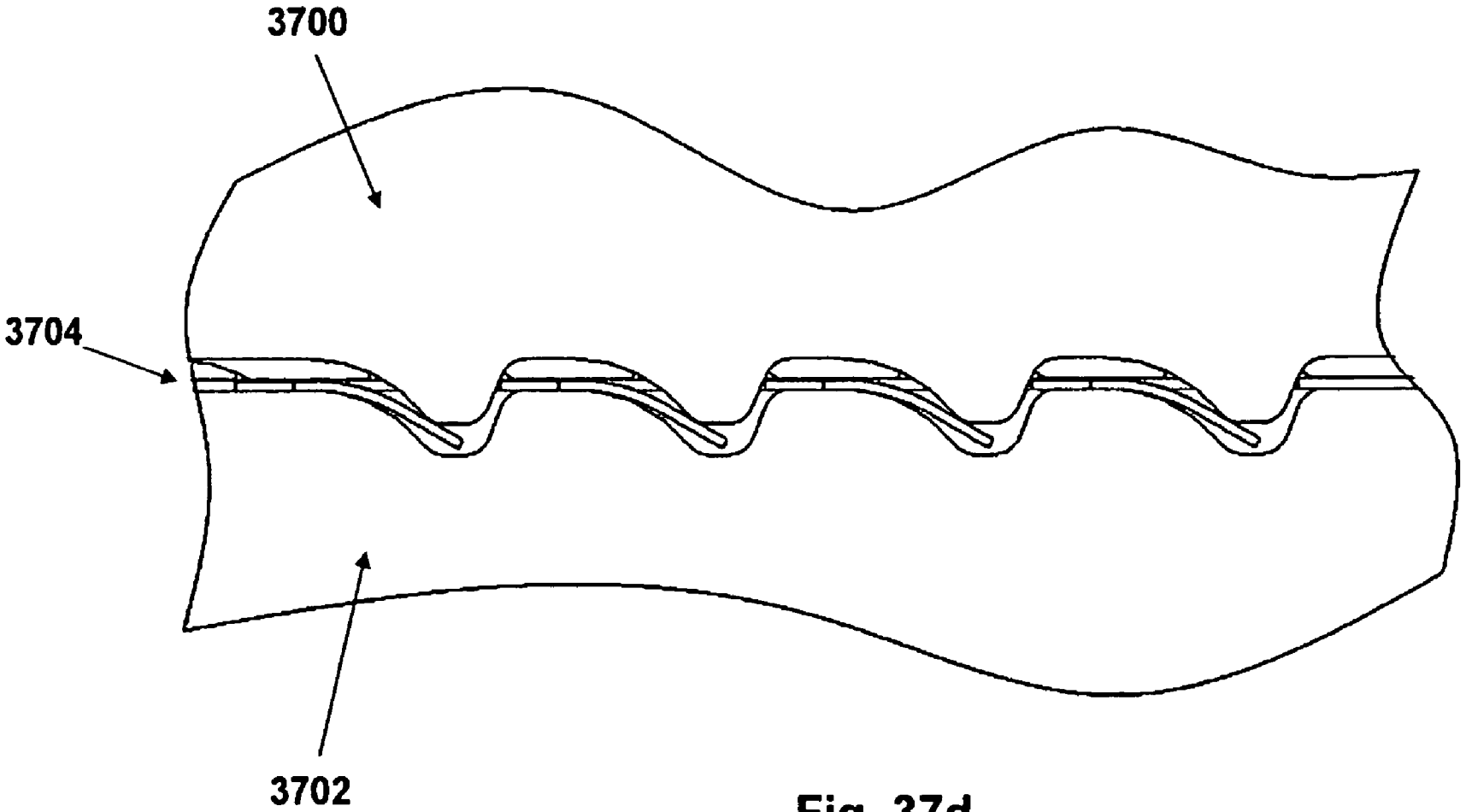
Figure 37E:
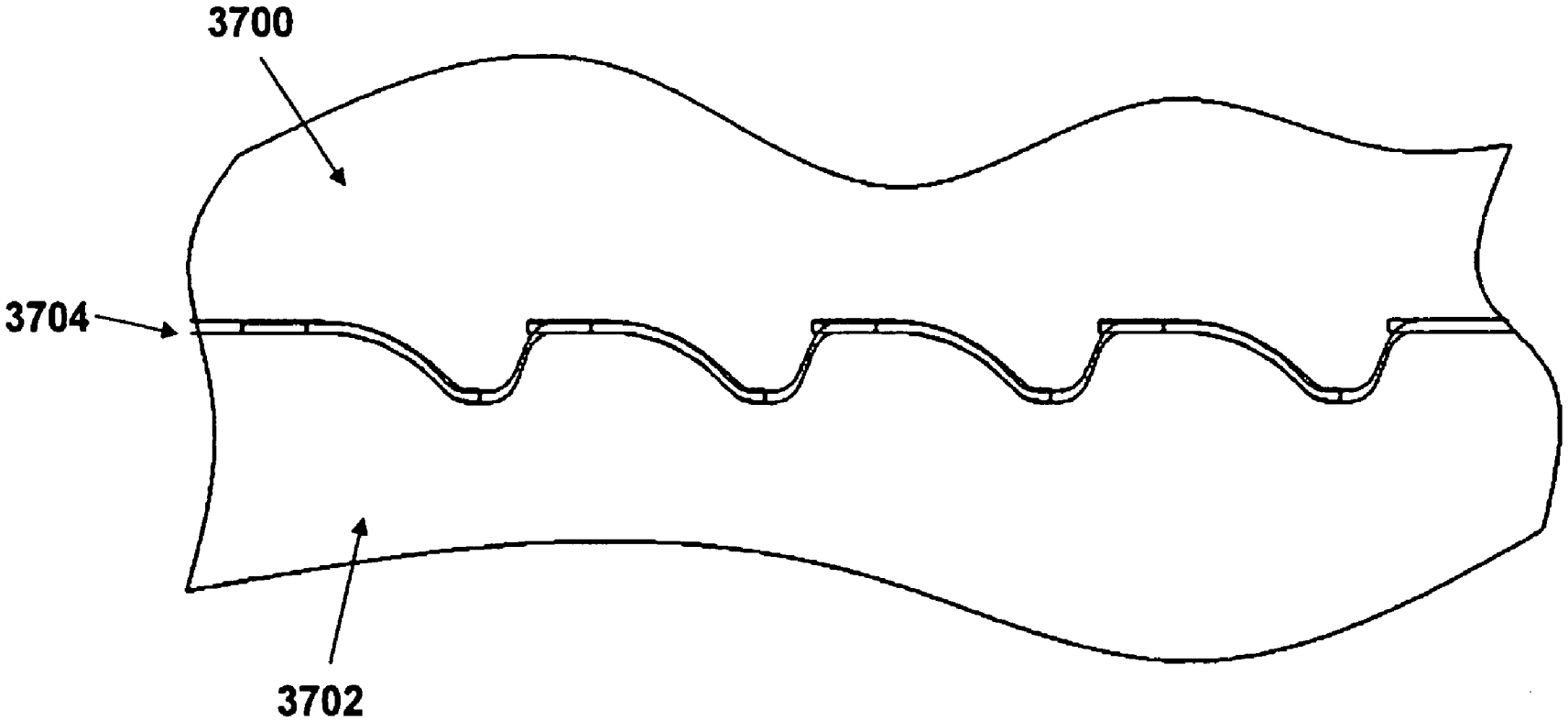

FIGS. 37*a* to 37*e* depict an exemplary stack-up that can be used in step 2518 for batch forming spring elements in three dimensions in accordance with another configuration of the present invention. FIG. 37*a* shows bottom 3702 and top 3700 mating die press plates with a spring element sheet 3704. Bottom die press plate 3702 preferably includes at least two dowel pins 3706 or other aligning means such as reference holes, edges, or the like, for aligning the elements of stack-up. As in FIG. 30, the spring element sheet is defined in two dimensions and can be formed by various methods, including etching or stamping. Spring element sheet 3704 which has positioning holes 3708 for alignment with dowel pins 3706, or other alignment means, is placed on top of the bottom die press plate 3702. The top die plate, which is the male die plate in the exemplified configuration, has protrusions on its surface for shaping the deformable spring element sheet 3704. The bottom die plate, which is the female die plate in the exemplified configuration, has indentations that correspond in shape to the protrusions on the male die plate such that the when the die plates are pressed together using sufficient force three-dimensional contacts are formed in contact element sheet 3704. The number of two-dimensional spring elements defined on a spring element sheet is limited only by the size of the sheet and the pitch and size of the spring elements. Preferably, the spring element sheet will contain an array of 25-10,000 two-dimensional contacts, but can contain an unlimited number.

FIGS. 37*b-e*, are progressive cross-sectional views of the spring elements formed on sheet 3704 during the pressing process. While the exemplified stack-up illustrates the male die press plate in the top position and the female die press plate in the bottom position, this configuration can be reversed. The material used for the die press plates 3700 and 3702 can be any material with sufficient rigidity to support the force used for compressing the stack-up without permanently deforming the die press plates, for example, steel or aluminum. Further, while the stack-up is shown utilizing two dowel pins, any number of dowel pins, or other alignment means, can be used.

After the elements of the stack-up illustrated in FIG. 37*a* have been assembled and aligned, pressure is applied to both the top die press plate 3700 and bottom die press plate 3702. This pressure forces male die press plate 3700 against the top of contact element sheet 3704, pushing the spring elements downward to form them in three dimensions. Pressing of the dies is typically performed using a hydraulic or electric press, but any machine including a manual press which applies a uniform pressure across the plates can be used. Pressure sufficient to shape the contact elements will vary according the material and number of contacts to be shaped.

Figure 38:
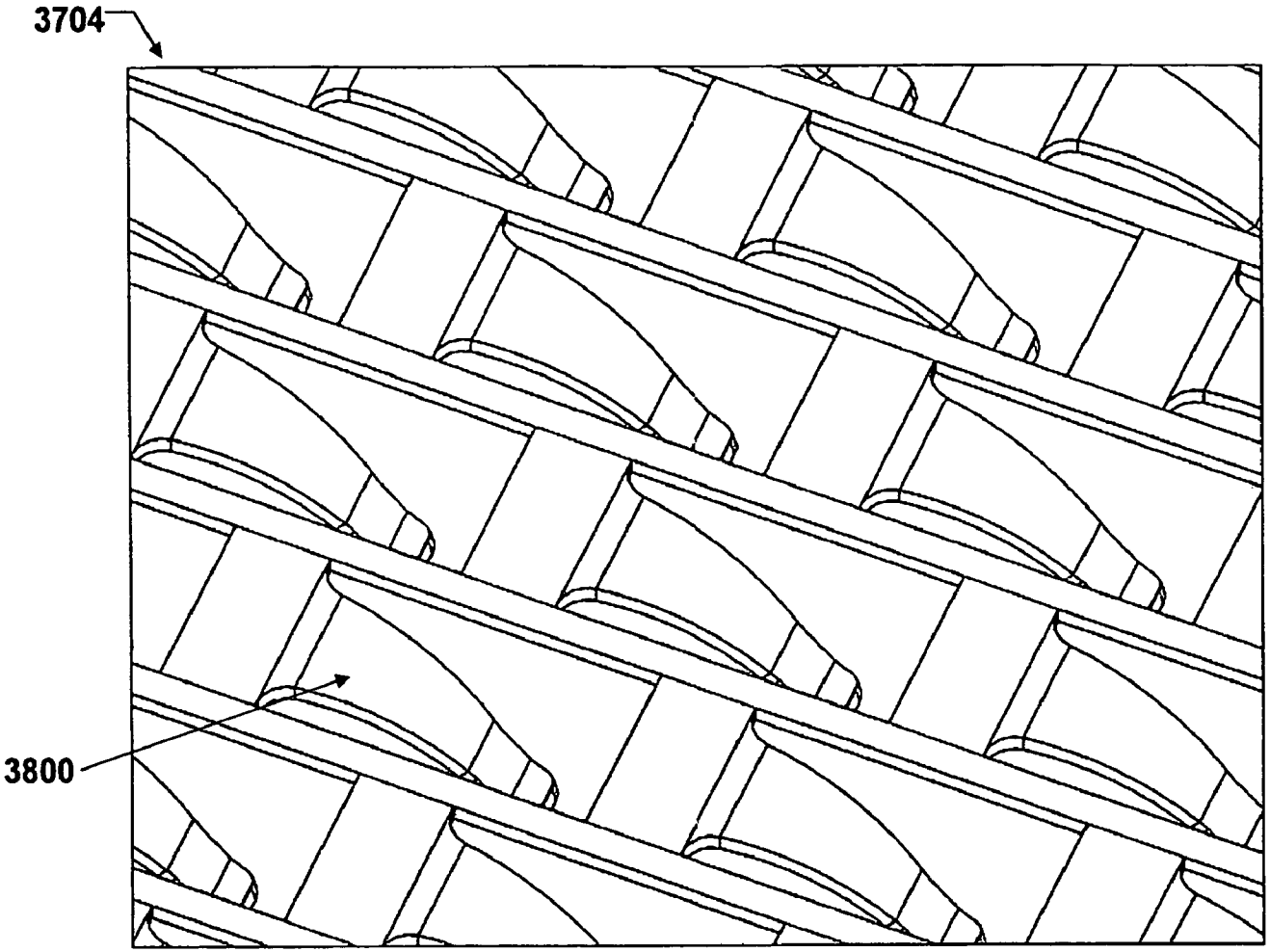
FIG. 38 shows an exploded view of the contact element sheet formed by the process illustrated in FIGS. 37*a-e*.

FIG. 38 is an exploded view of the three-dimensional contacts formed on the spring element sheet 3704 following pressing between the male and female die press plates. The protrusions on the male mating die press plate and corresponding indentations on the female die plate can be configured to shape a wide variety of contact shapes, sizes or directions corresponding to the two-dimensional etching or stamping on the spring element sheet.

The method illustrated in FIGS. 37*a* to 37*e* for forming contact arrays on a contact element sheet has many advantages over other methods utilized in the art for forming contacts in a sheet. For example, progressive stamping allows for only a few contacts to be formed at one time, typically 6-8 contacts, whereas the present invention allows for a large array of contacts to be formed in a single stroke of the press machine.

Figure 39A:
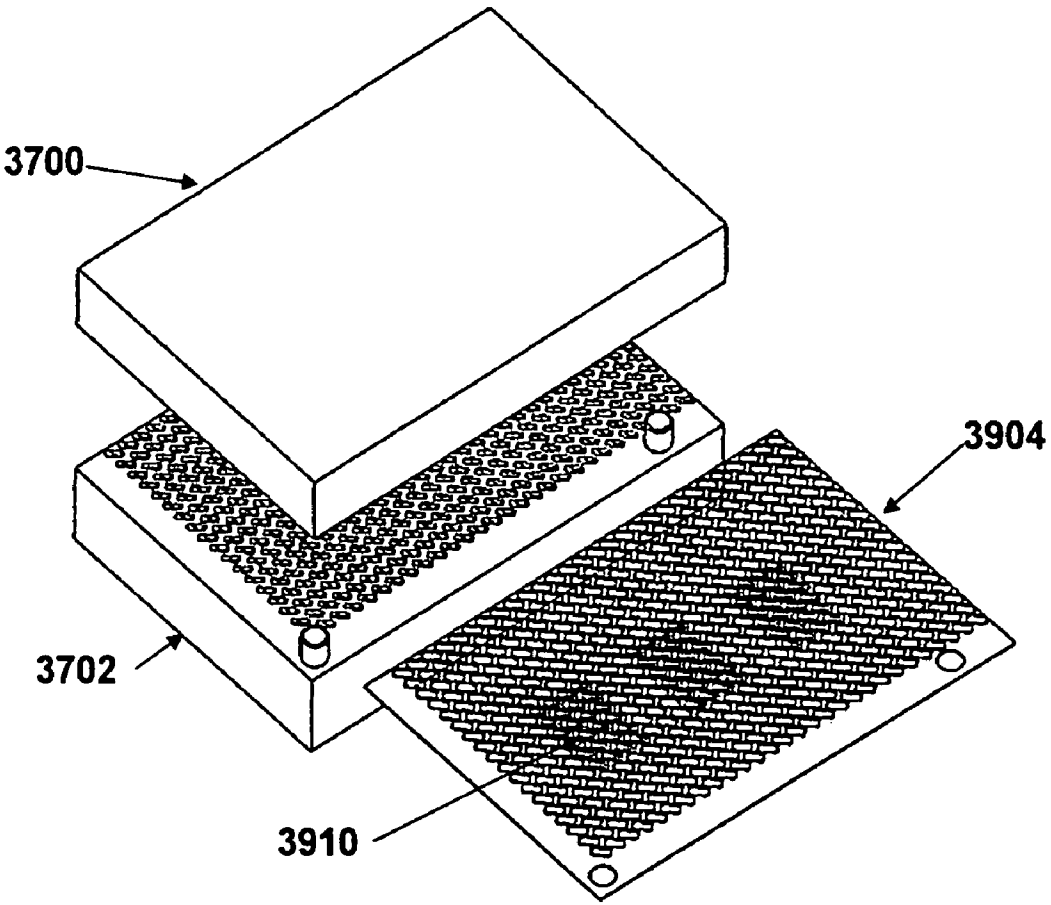
FIG. 39*a* illustrates a stack-up with subset of contact arrays defined on a contact element sheet in the batch processing method illustrated in FIGS. 37*a-e*.
Figure 39B:
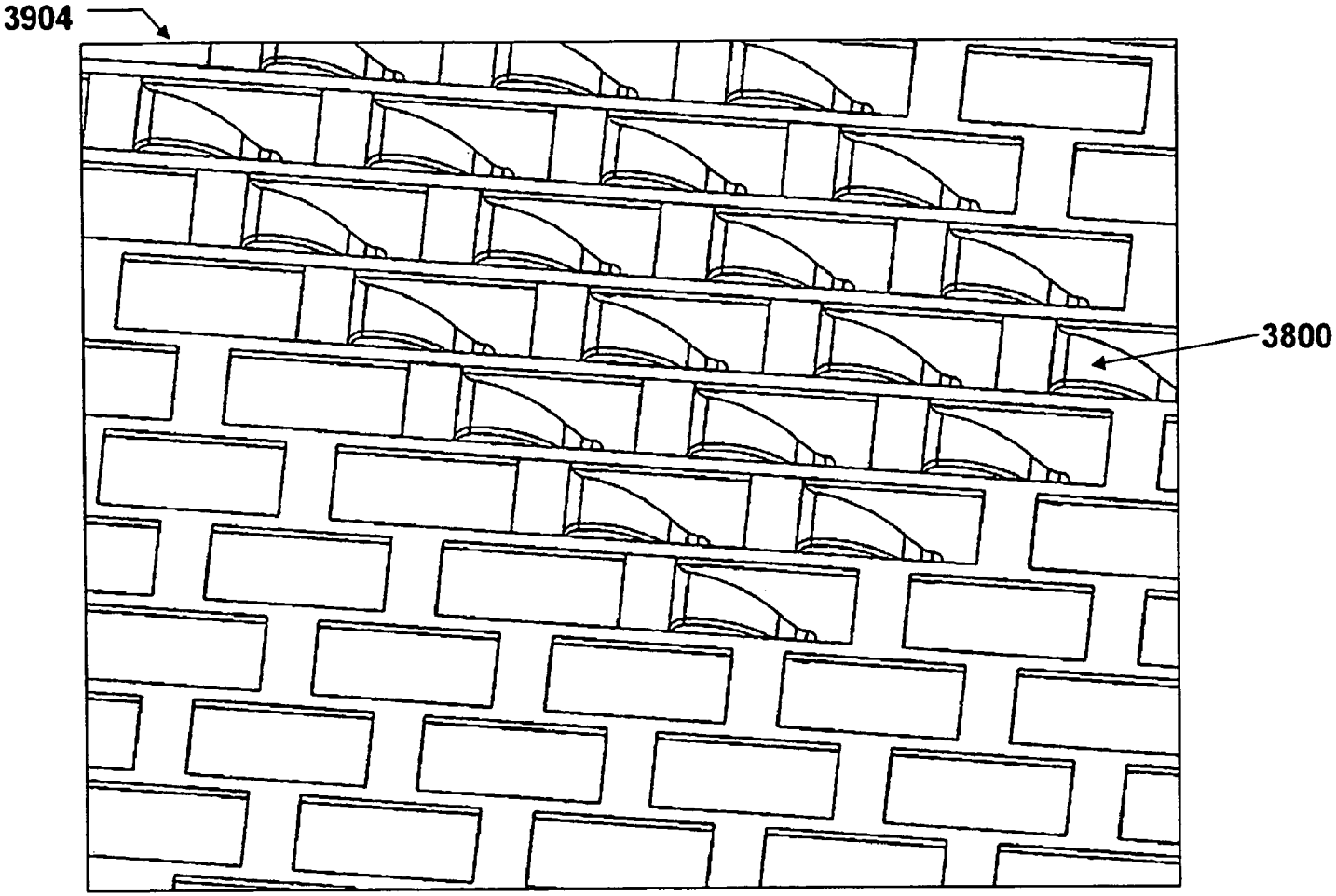
FIG. 39*b* shows an exploded view of the contact element sheet formed by the stack-up illustrated in FIG. 39*a*.

As illustrated in FIGS. 39*a* to 39*c*, universal male and female die press plates can be created such that the plates have protrusions and indentations corresponding to all possible contact formation locations on a spring element sheet. However, it may be desirable to form contacts only in select locations on the spring element sheet. In this instance, only select locations where the contacts desired to be formed are etched or stamped on the sheet. FIG. 39*a* shows universal male 3700 and female 3702 die press plates with selectively etched or stamped spring element sheet 3904. The dark areas 3910 on the spring element sheet are the areas where contacts are to be formed. The light area surrounding dark areas 3910 on the contact element sheet contains holes through which the male protrusions pass when the die plates are pressed together. FIG. 39*b* shows an exploded view of the selectively formed contact elements.

In the batch forming methods disclosed herein, there exist the possibility that the male die press plates illustrated in FIGS. 37*a-e* and 39*a* do not exactly match the shape and/or size of their female counterparts. This situation might lead to contacts that are not fully formed according to a desired specification. A method for absorbing these small shape and/or size variations is to construct the male plate of an elastic material, such as rubber or plastic, such that the elastic material is of sufficient hardness to form the contacts in three-dimensions, yet pliable enough to conform to the shape of the corresponding female indentation. A preferable material suitable for such an application is urethane with a durometer of approximately 90. However, it should be understood that other materials with suitable durometers for fully forming contacts in three dimensions can be used. Alternatively, the female die press plate is constructed of an elastic material of sufficient hardness to form the contacts in three-dimensions, yet pliable enough to conform to the shape of the corresponding male protrusion.

Figure 40A:
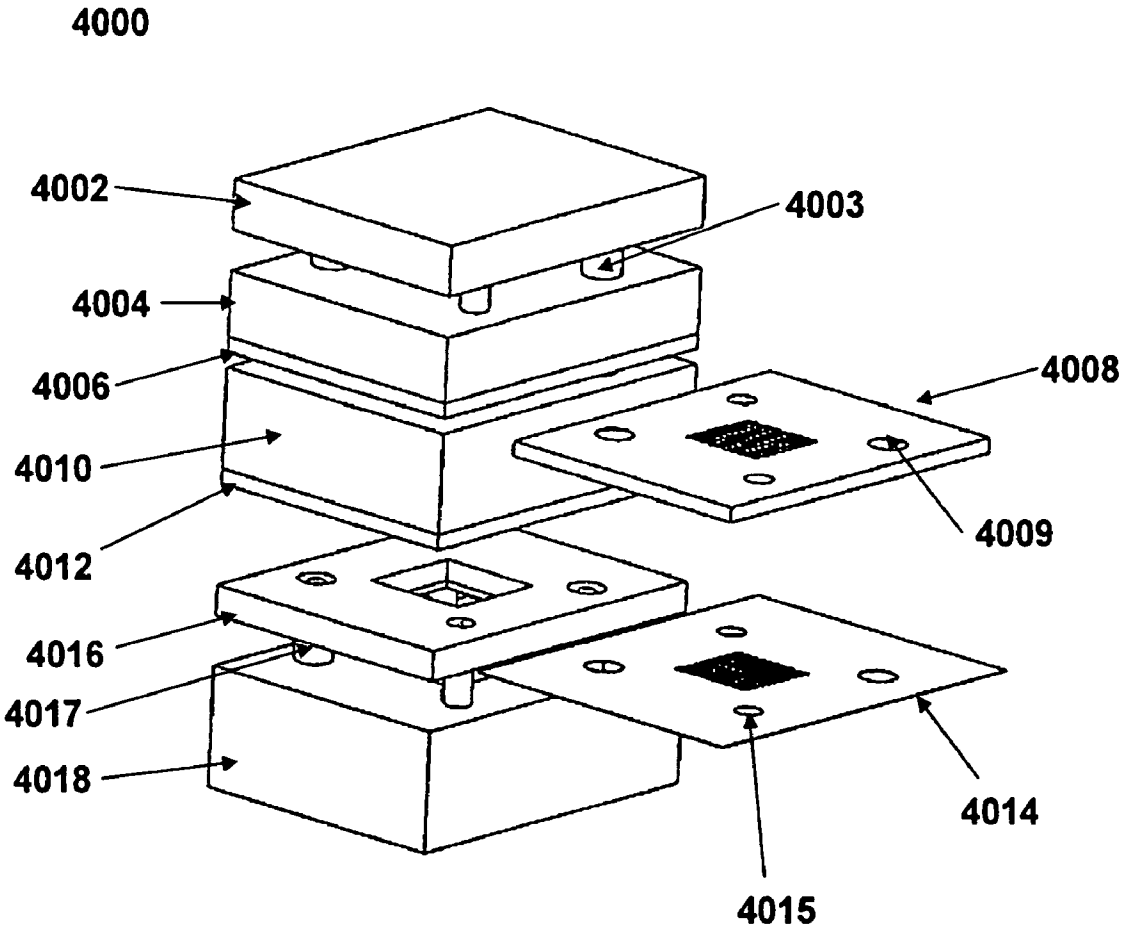
FIGS. 40*a* to 40*g* illustrate a configurable press for forming contacts in a batch processing method of the present invention.
Figure 40B:
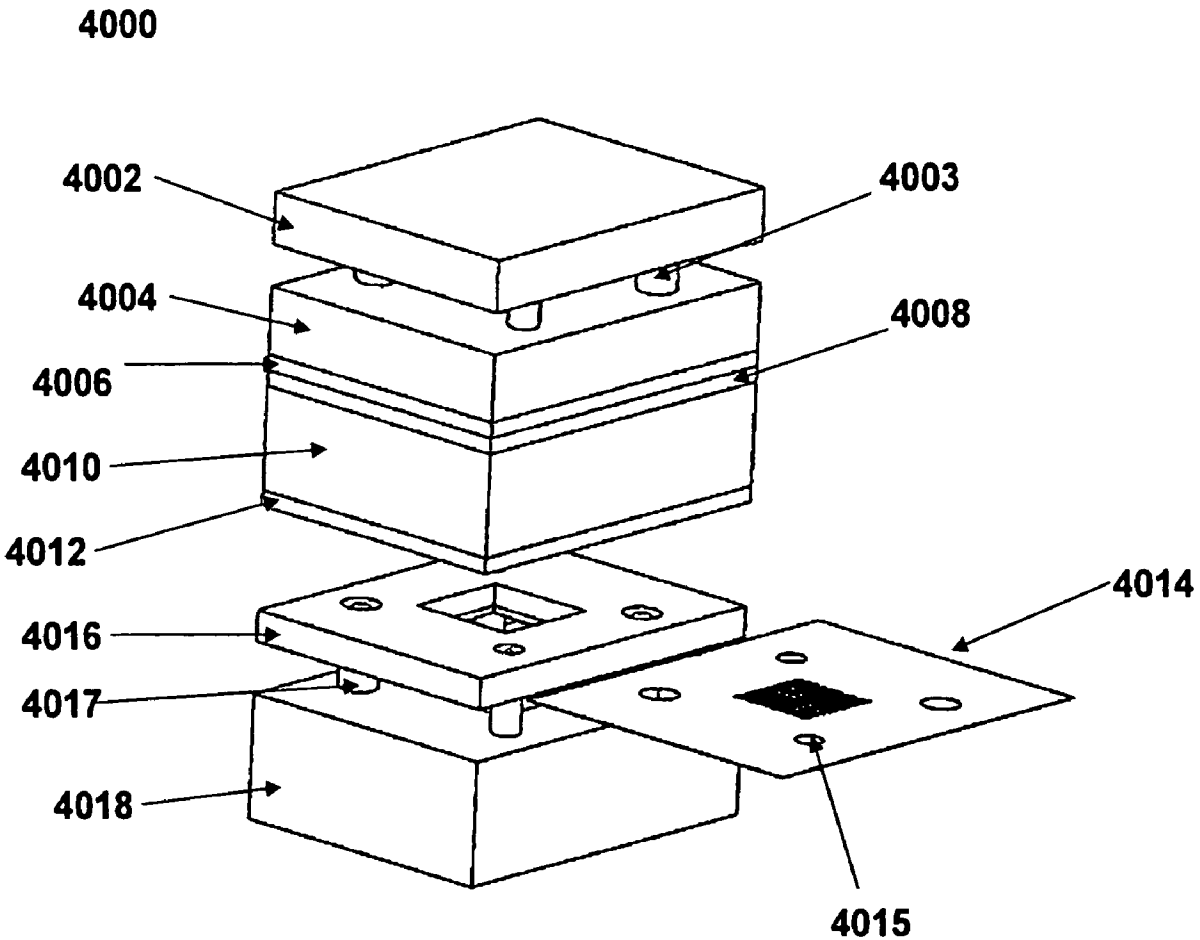
Figure 40C:
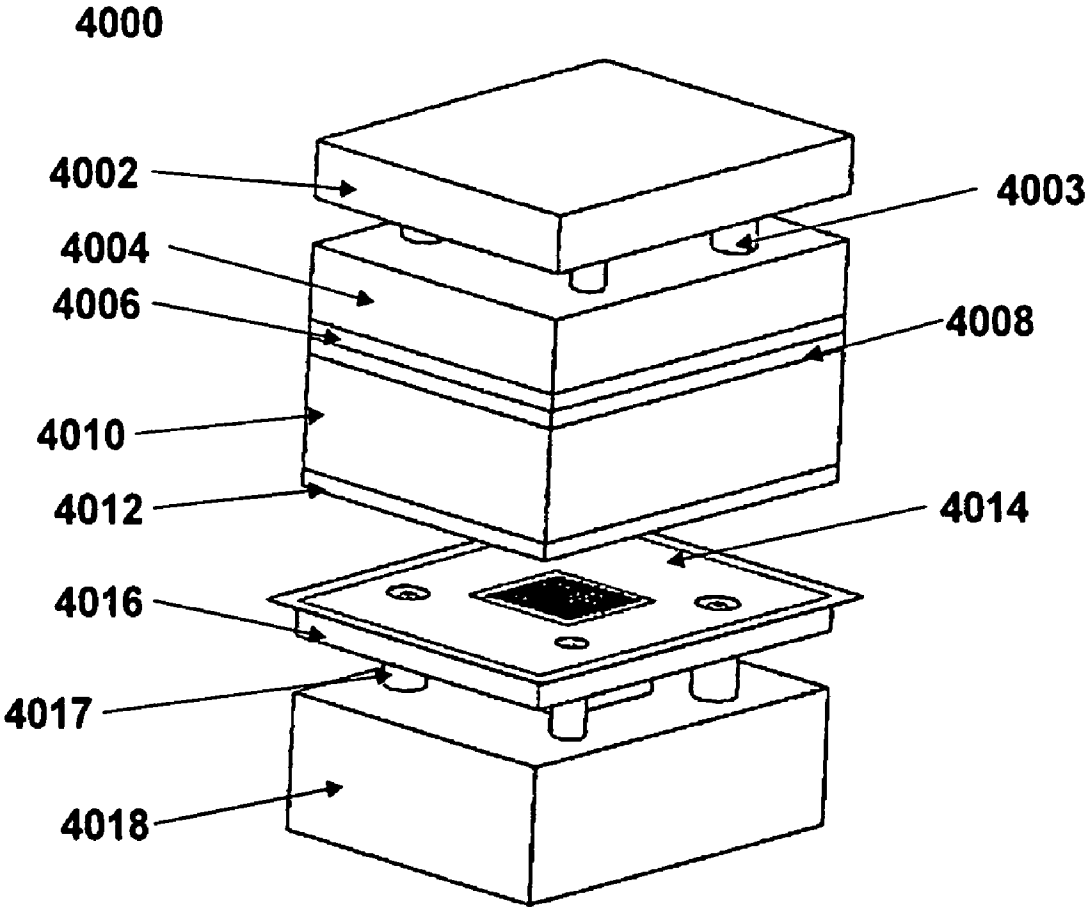

FIG. 40*a* depicts another exemplary stack-up that can be used in step 2518 for batch forming spring elements in three dimensions in accordance with a configuration of the present invention. Configurable press 4000 is used to selectively form contacts in three dimensions on contact element sheet 4014 in a wide variety of arrangements. FIG. 40*a* represents the configurable press in its fully opened position. Top press plate 4002 is preferably attached by four movable press rods 4003 to spring pin holder 4004 which is in turn attached to spring pin retainer 4006. Programming plate 4008 sits between the spring plate retainer 4006 and die punch holder 4010 as illustrated in FIG. 40*b*. Optional stripper plate 4012 sits between die punch holder 4010 and contact element sheet 4014. Contact element sheet 4014 sits on top of ejector plate 4016, as shown in FIG. 40*c*. Ejector plate is attached to the bottom press base 4018 by four guide rods 4017 or other aligning means for aligning the elements of the stack-up.

Figure 40D:
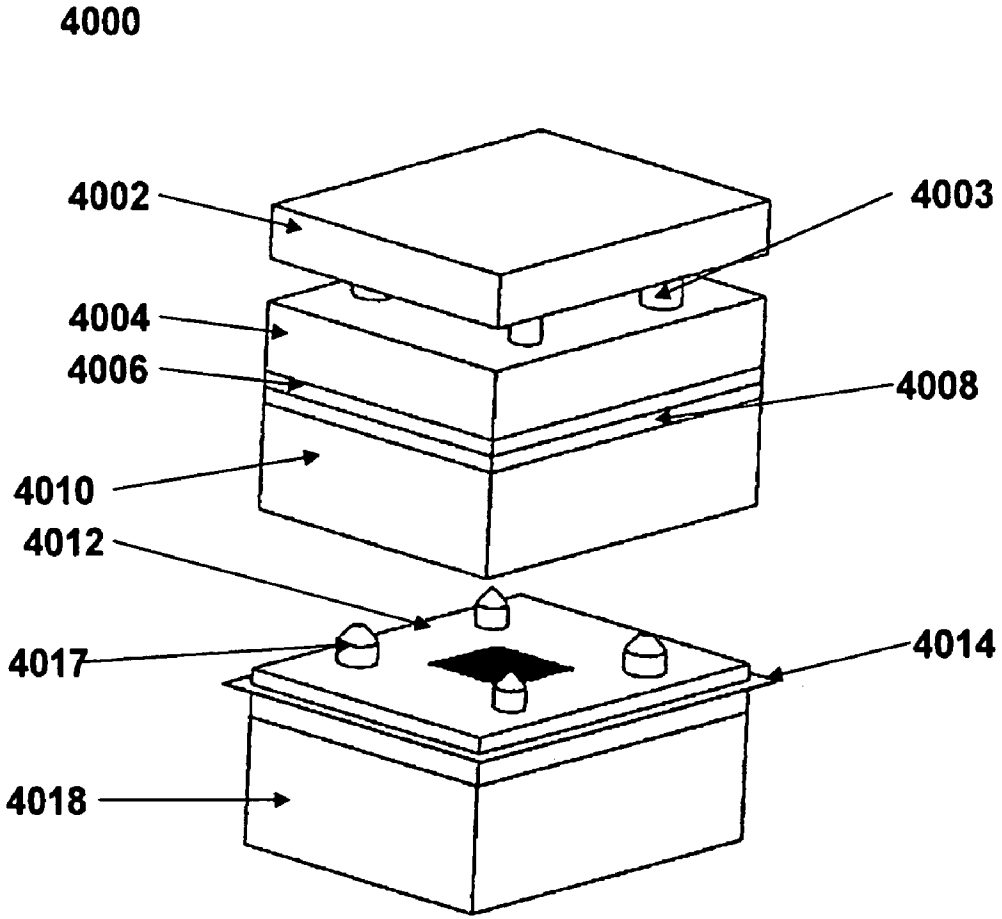

As in FIG. 30, the contact element sheet 4014 is defined in two dimensions and can be formed by various methods, including etching or stamping. Contact element sheet 4014, which has positioning holes 4015 for alignment with guide rods 4017, or other alignment means, is placed on top of ejector plate 4016 as shown in FIG. 40*c*. Stripper plate 4012 sits on top of the contact element sheet and has positioning holes 4013 for alignment with guide rods 4017 as shown in FIG. 40*d*. FIG. 40*d* shows ejector plate 4016, contact element sheet 4014, and stripper plate 4012 sitting on top of bottom press plate 4018 with guide rods 4017 protruding above the stripper plate ready to engage die punch holder 4010. Guide rods 4017 similarly align die punch holder 4010, programming plate 4008, spring pin retainer 4006 and spring pin holder 4004 through positioning holes located in each element such as the positioning holes 4009 on programming plate 4008 as shown in FIG. 40*a*.

Figure 40E:
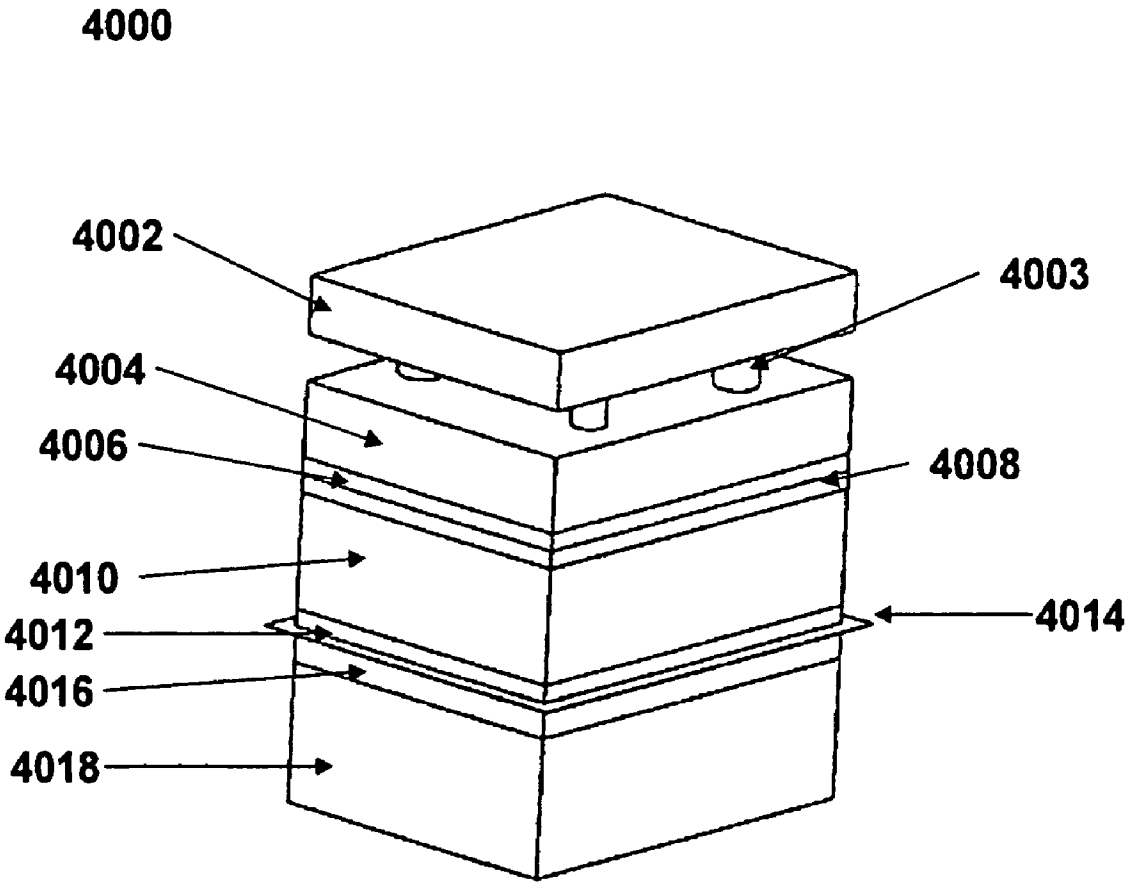
Figure 40F:
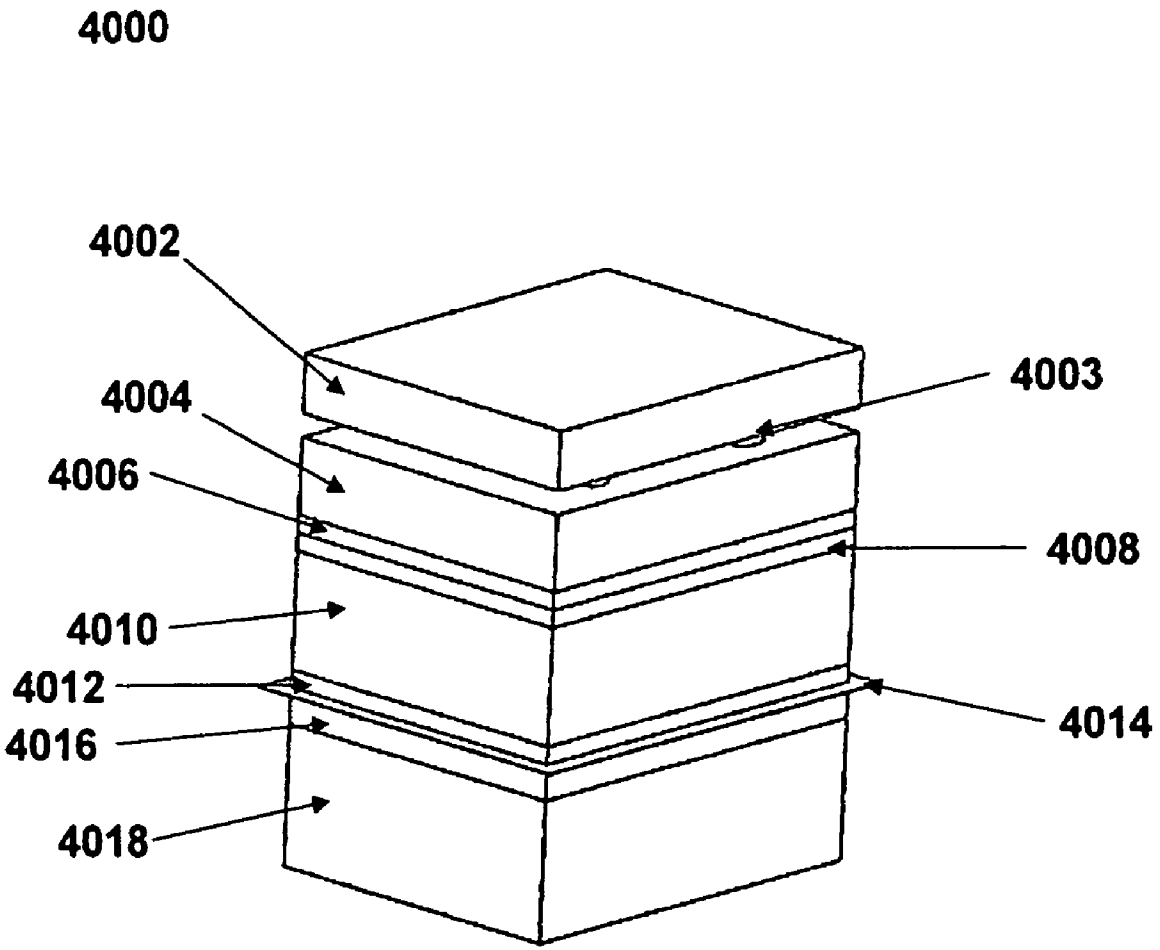

After the elements of the stack-up have been assembled and aligned, as shown in FIG. 40*e*, pressure is applied to top press plate 4002. FIG. 40*f* illustrates the stack-up in a compressed state.

Figure 40G:
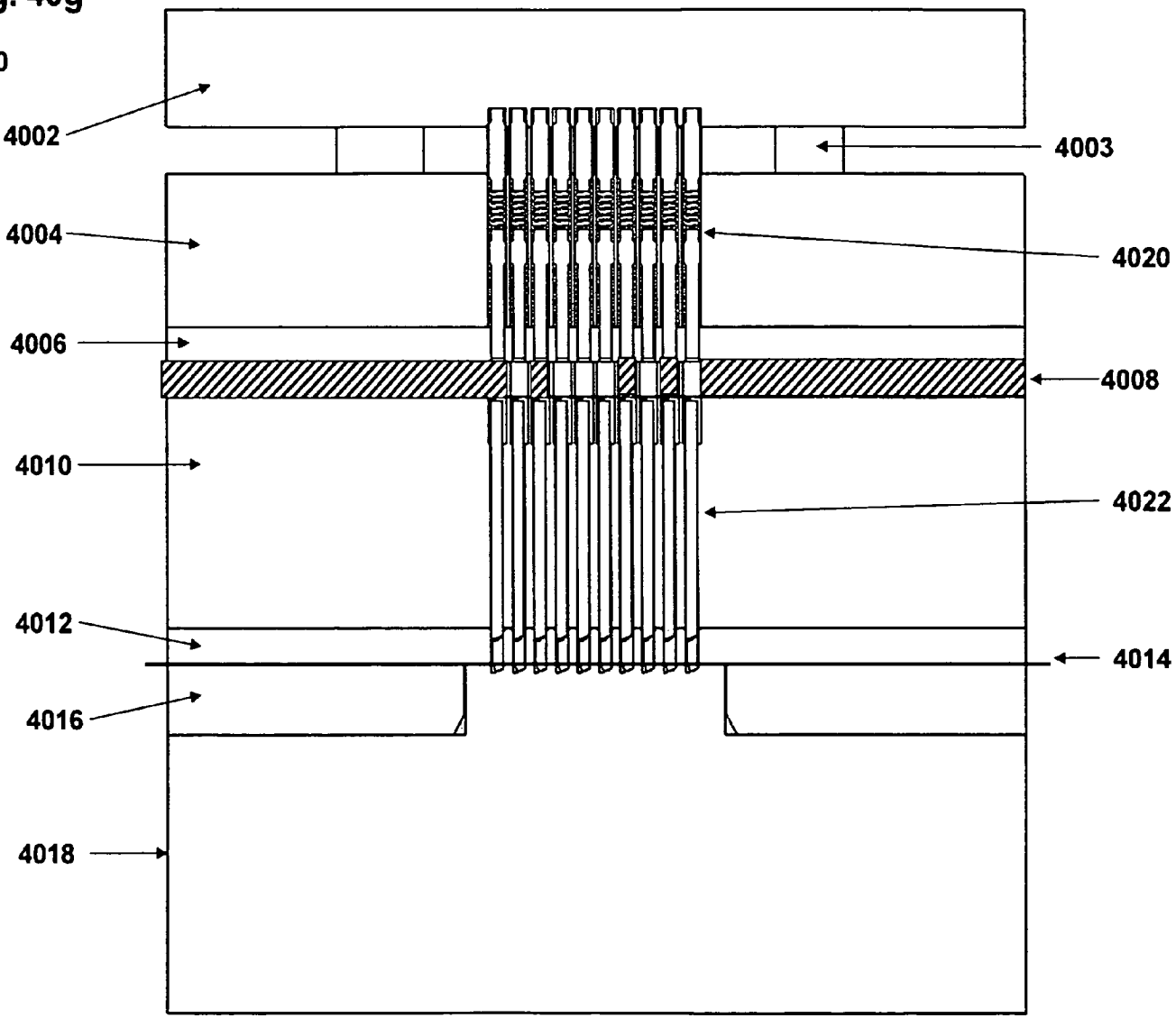

FIG. 40*g* is a cross-sectional view of stack-up 4000. The pressure applied to top press plate 4002 forces the springs 4020 located in the spring pin holder 4004 through the openings in programming plate 4008. The springs 4020 which pass through programming plate 4008 make contact with die punch pins 4022 in die punch holder 4010. The engaged die punch pins then make contact with contact element sheet 4014 and selectively form three-dimensional contact elements.

Figure 41A:
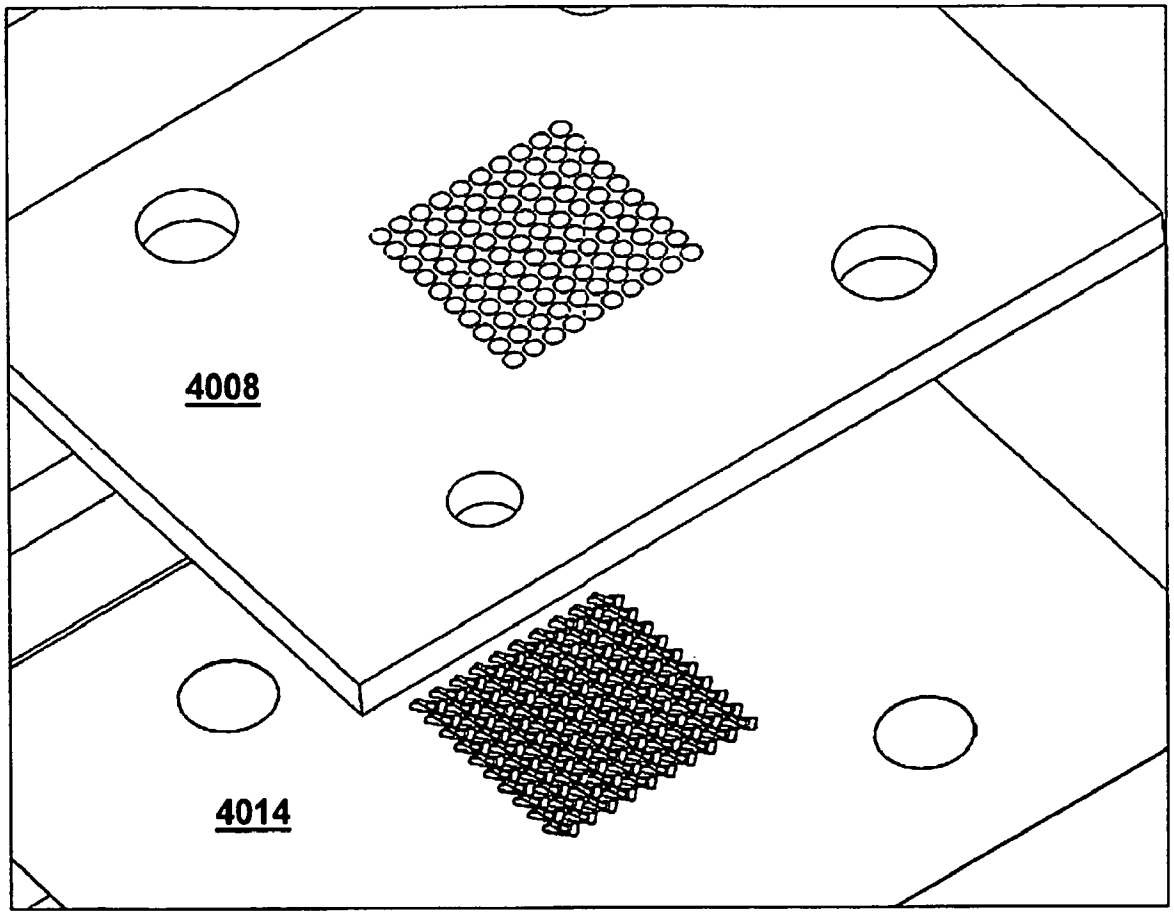
FIGS. 41*a* to 41*c* illustrate a few selective contact arrays which can be formed using the stack-up of FIGS. 40*a* to 40*g*.
Figure 41B:
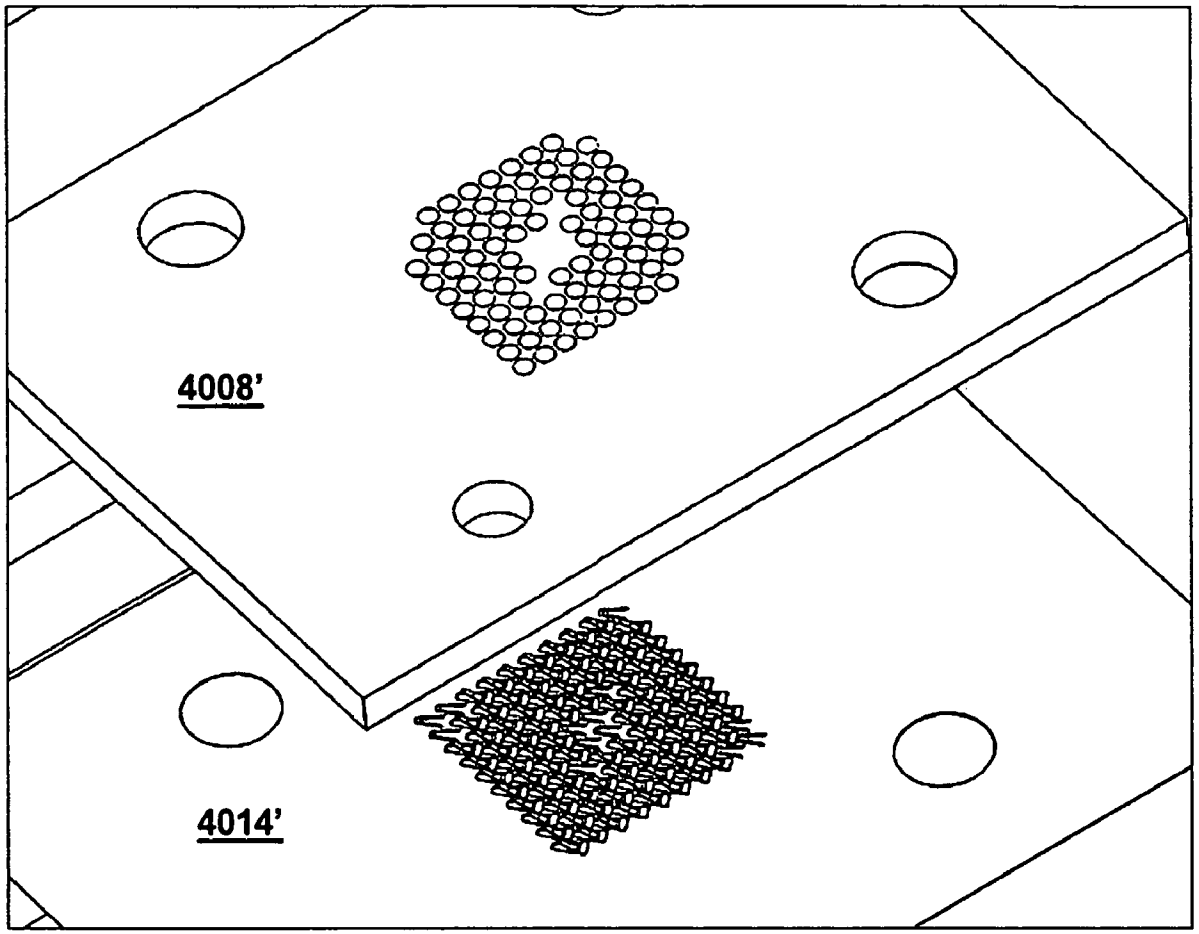
Figure 41C:
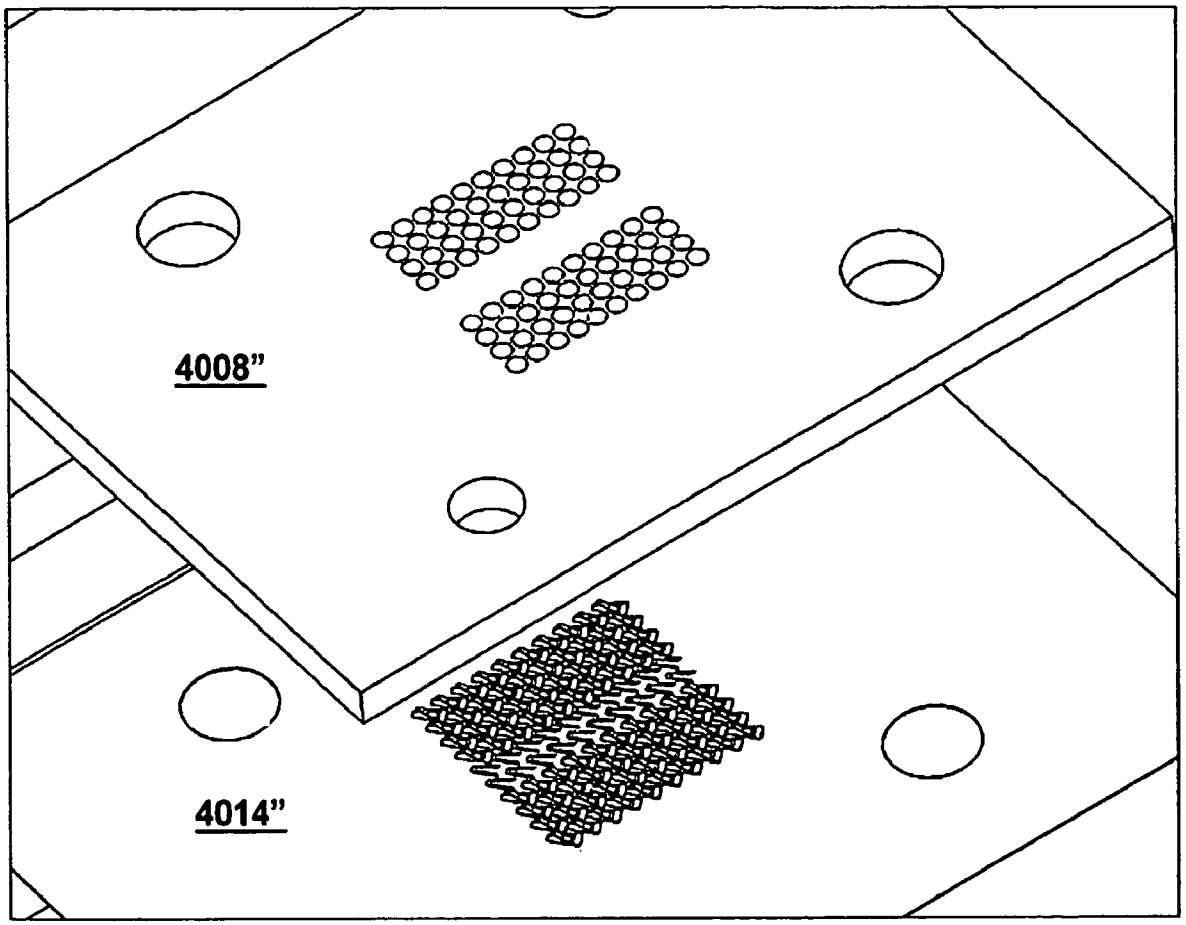

FIGS. 41*a*-41*c* illustrate a few selective contact arrays which can be formed using stack-up 4000. In FIG. 41*a*, programming plate 4008 has all holes corresponding to contact element sheet 4014 in an open position. This configuration would result in die punch pins 4022 forming all possible contacts on contact element sheet 4014. However, if only a select number of holes in programming sheet 4008 corresponding to contact element sheet 4014 are in the open position (as illustrated in FIGS. 41*b* and 41*c*), different shapes and sizes of contact arrays can be formed.

Figure 42A:
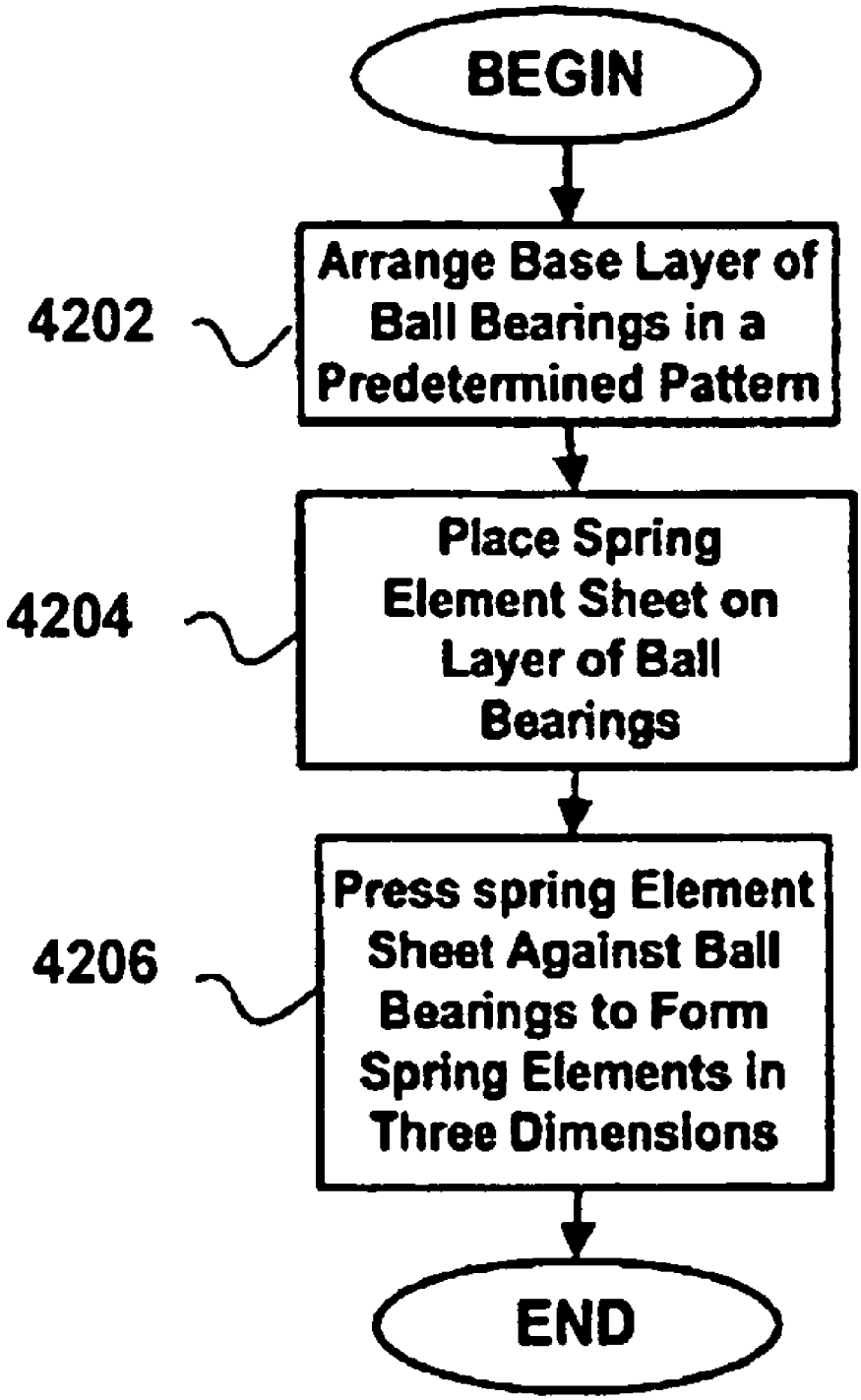
FIG. 42*a* is a flowchart of an exemplary method for batch forming spring elements using a die based on ball-bearings.

In accordance with the principles of the present invention, a method 4200 for forming spring elements in three dimensions can also be derived, as shown in FIG. 42*a*. First, a base layer of ball bearings or other configurable die, is provided, with the ball bearings, for example, being arranged in a predetermined pattern corresponding to the location of the spring elements to be formed (step 4202). Next, a spring element sheet is placed on top of the ball bearings, the spring elements being defined in two dimensions and positioned over ball bearings on the base layer (step 4204). The spring element sheet is then pressed against the ball bearings, with the ball bearings contacting the underside of the sheet, thereby pressing the spring elements above the plane of the sheet and forming the spring elements in three dimensions (step 4206).

Figure 42B:
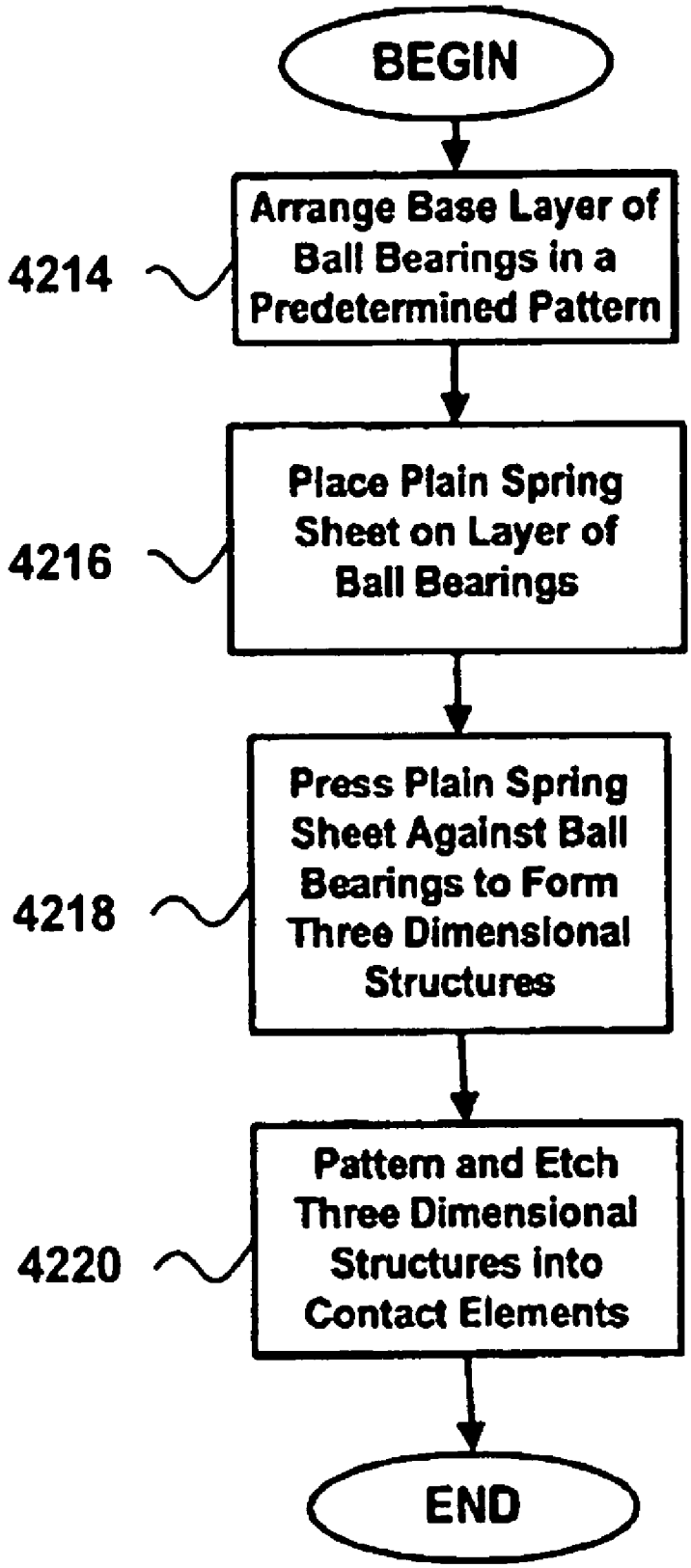
FIG. 42*b* is another flowchart of an exemplary method for batch forming spring elements using a die based on ball-bearings.

FIG. 42*b* illustrates an alternate method 4210 for forming spring elements from three dimensional domes (such as shown in FIG. 36*a*). First, a configurable die, for example, a base layer of ball bearings is provided, with the ball bearings being arranged in a predetermined pattern corresponding to the location of the three dimensional domes to be formed (step 4214). Next, a plain spring sheet is placed on top of the configurable die (step 4216). The term "plain" refers to the fact that a plain spring sheet does not contain pre-patterned two dimensional spring elements before being pressed onto configurable die. Subsequently, the spring sheet is pressed against the configurable die, with the configurable die contacting the underside of the sheet, thereby pressing portions of the spring sheet above the plane of the sheet and forming surface three dimensional relief features (also termed "three dimensional spring precursors"), for example, domes formed over ball bearings (step 4218). In step 4220, the surface relief features are then patterned and etched into three dimensional spring contact elements.

Figure 43:
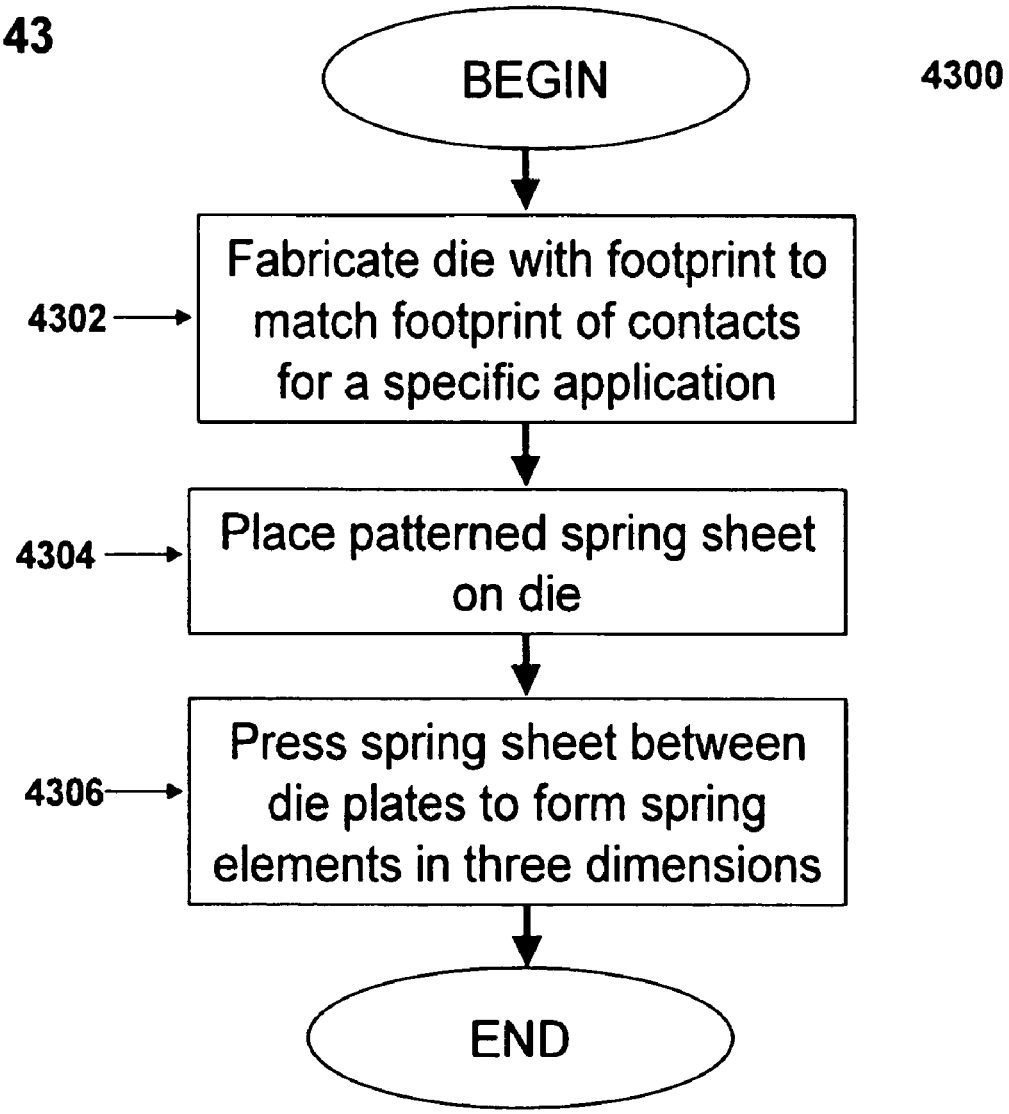
FIG. 43 is a flowchart of an exemplary method for batch forming spring elements using complementary die plates.

FIG. 43 illustrates a method 4300 for forming spring elements using the stack-up of FIGS. 37*a*-*e*. First, male and female die press plates are formed such that the footprint on the die press plates matches the footprint on the spring element sheet to be formed (step 4302). Next, a spring element sheet is placed on top of the female die press plate, the spring elements being defined in two dimensions (step 4304). The male die press plate is then pressed against the spring element sheet, thereby pressing the spring elements below the plane of the sheet and forming the spring elements in three dimensions (step 4306). While we have described the method 4300 with the male die press plate in the top position and the female die press plate in the bottom position, this configuration can be reversed.

Figure 44:
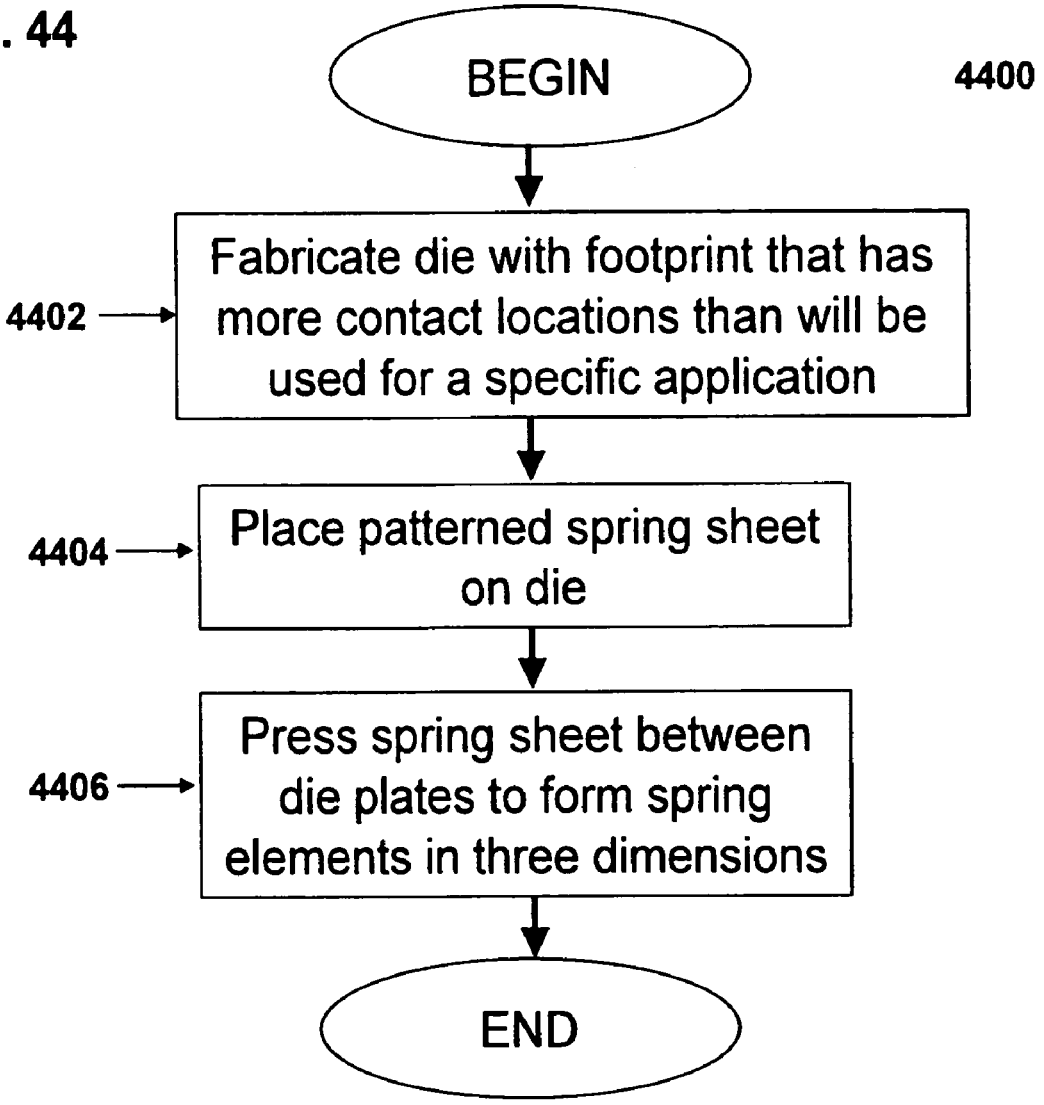
FIG. 44 is a flowchart of an exemplary method for batch forming spring elements using a universal die.

FIG. 44 illustrates a method 4400 for forming spring elements using the universal die press plates of FIG. 39*a*. First, male and female die press plates are formed such that the footprint on the die press plates have more contact locations than will be used for a specific application (step 4402). Next a spring element sheet with a selective two-dimensional pattern is placed on top of the female die press plate (step 4404). The male die press plate is then pressed against the spring element sheet, thereby pressing the spring elements below the plane of the sheet and forming the spring elements in three dimensions (step 4406). This approach has the advantage that a single set of universal die press plates can be used to form several different footprints of spring elements. While we have described the method 4400 with the male die press plate in the top position and the female die press plate in the bottom position, this configuration can be reversed.

Figure 45:
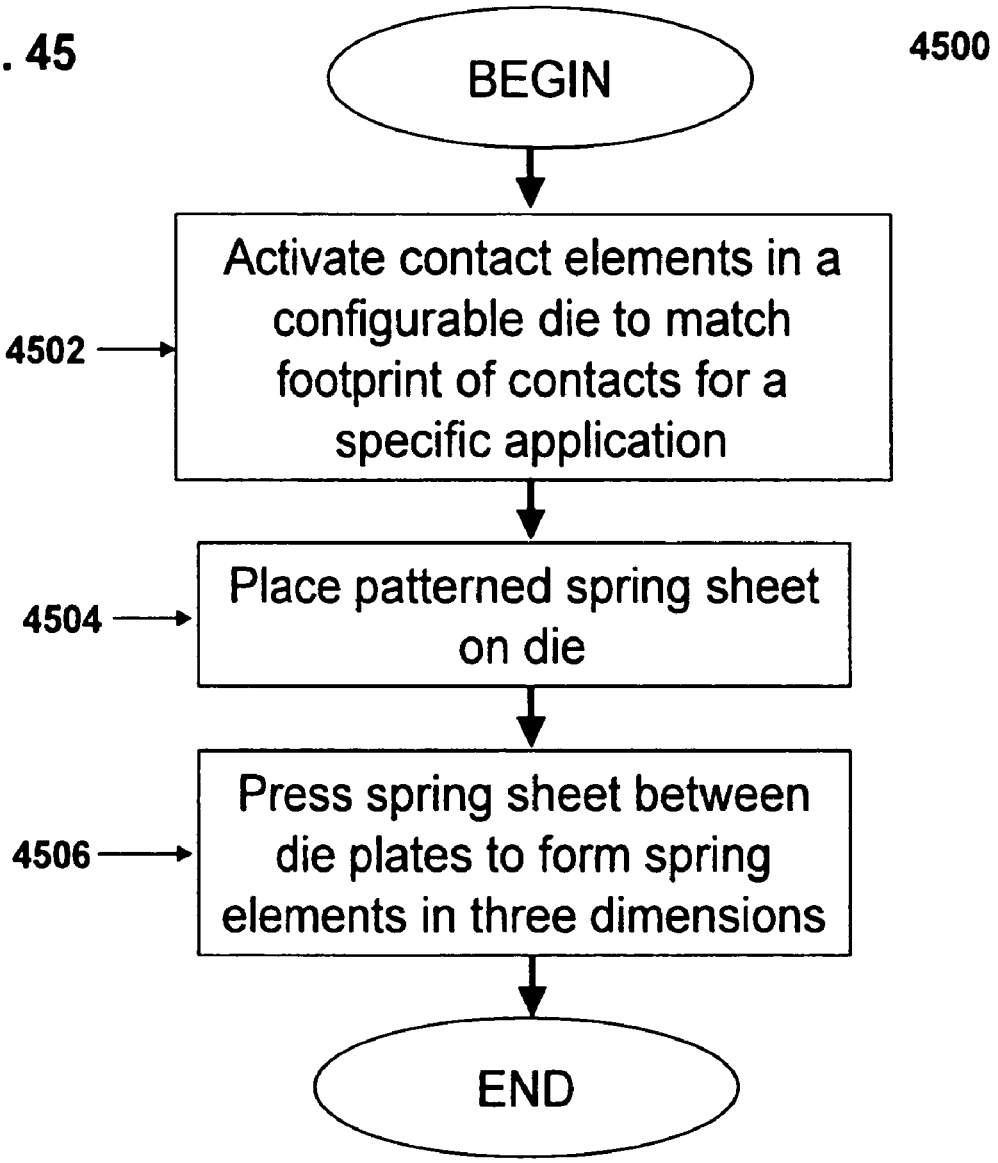
FIG. 45 is a flowchart of an exemplary method for batch forming spring elements using a configurable die.

FIG. 45 illustrates a method 4500 for forming spring elements using the configurable press of FIGS. 40*a*-*g*. First, selected contacts elements in the male die punch holder 4010 are activated to match the footprint of contacts for a specific application (step 4502). In the exemplary stack-up shown in FIGS. 40*a*-*g*, this activation of selected contacts is achieved using a programming plate 4008 that sits between a spring plate retainer 4006 and a die punch holder 4010. Next a spring element sheet with a selective two-dimensional pattern is placed on top of the female die press plate (step 4504). The selectively activated male die press plate is then pressed against the spring element sheet, thereby pressing the spring elements below the plane of the sheet and forming the spring elements in three dimensions (step 4506). In the exemplary stackup shown in FIGS. 40*a*-*g*, the spring element sheet is held in place during this pressing step 4504 between an ejector plate 4016 on the bottom which comprises the female portion of the die, and a stripper plate 4012 on the top which holds the sheet flat during pressing. In the exemplary stackup shown in FIGS. 40*a-g*, the pressing of the male die against the spring element sheet is accomplished by applying force to top press plate 4002 and bottom press plate 4018. The force is transferred to spring-loaded pins in the spring pin holder 4004 and spring pin retainer 4006 and some of these pins can to pass through holes in the programming plate 4008 to transfer the force to selected die punch pins in a die punch holder 4010. The die punch pins in the die punch holder 4010 to which the force has been transferred then transfer the force to the contact element sheet 4014 to form three-dimensional contact elements. In areas where the programming plate 4008 does not have holes, the force is not transferred to the die punch pins in the die punch holder and three-dimensional contact elements are not formed in these locations. This approach has the advantage that a single set of universal die press plates can be used to form several different footprints of spring elements. While we have described the method 4500 with the male die press plate in the top position and the female die press plate in the bottom position, this configuration can be reversed.

Another method for selectively forming contact arrays on a spring element sheet using techniques described in the present invention is to fully form all contact elements on a spring element sheet either by the process described in FIG. 43 or the process described in FIG. 45. Then, referring to FIG. 25*d*, in step 2544, resist material is selectively applied only to the contact elements which are desired to be formed. The unselected contact elements are subsequently etched away in step 2552 in FIG. 25*d*, leaving only the selected contact elements.

Figure 46:
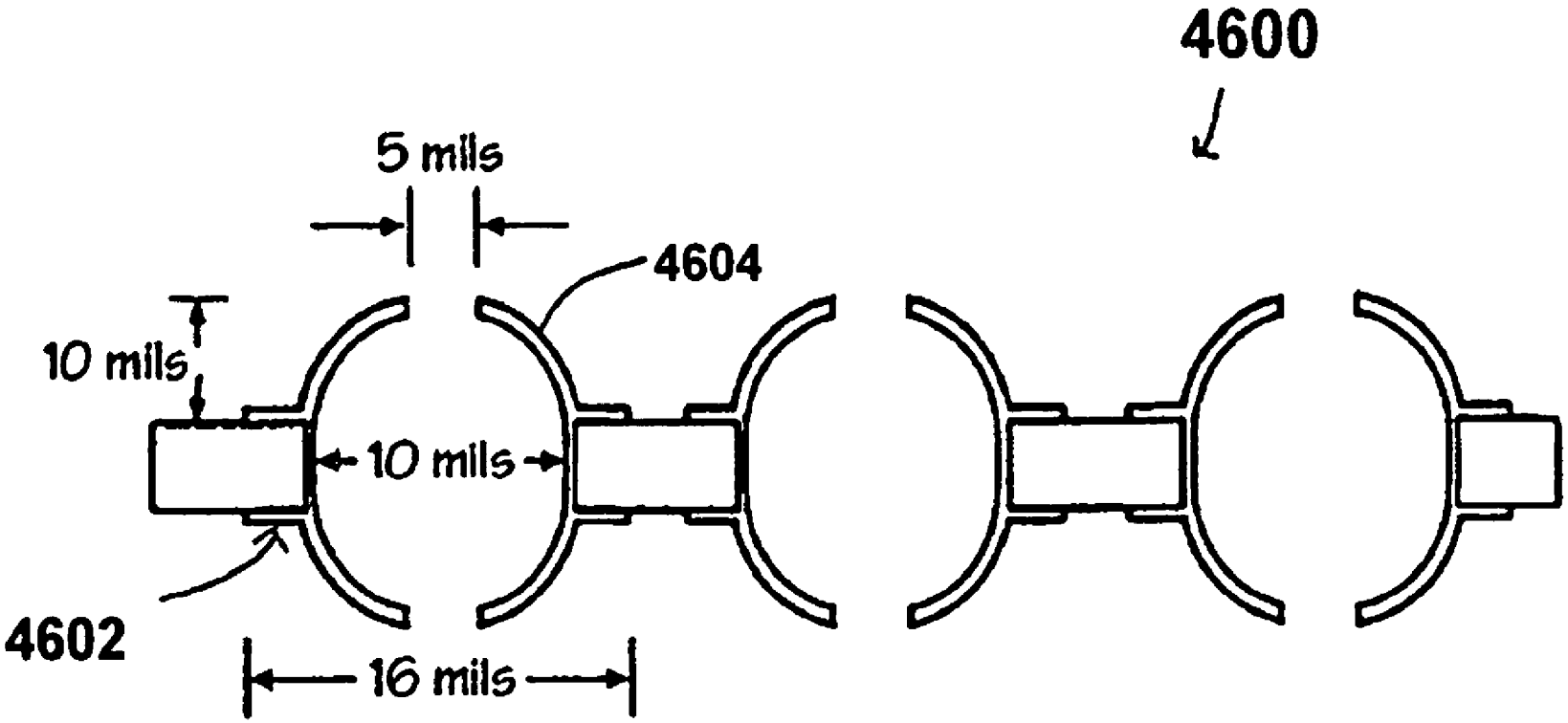
FIG. 46 is a schematic diagram of an enlarged sectional view of exemplary contact arms for a BLGA contact array.

FIG. 46 shows a cross-sectional view of a connector 4600 in accordance with the present invention, including showing some exemplary dimensions for the size of the portions of the contact element 4602. The spacing between the distal ends of the facing spring portions 4604 is 5 mils. The height of the contact element 4602 from the surface of the substrate to the top of the spring portion is 10 mils. The width of a via through the substrate can be on the order of 10 mils. The width of the contact element 4602 from the outer edge of one base portion to the outer edge of the other base portion is 16 mils. Contacts of this size can be formed in accordance with the method of the invention as described below, allowing connectors with a pitch well below 50 mils and on the order of 20 mils or less. It is noted that these dimensions are merely exemplary of what can be achieved with the present invention and one skilled in the art will understand from the present disclosure that a contact element with larger or smaller dimensions could be formed.

According to one configuration of the present invention, the following mechanical properties can be specifically engineered for a contact element or a set of contact elements, to achieve certain desired operational characteristics. First, the contact force for each contact element can be selected to ensure either a low resistance connection for some contact elements or a low overall contact force for the connector. Second, the elastic working range of each contact element can be varied. Third, the vertical height of each contact element can be varied. Fourth, the pitch or horizontal dimensions of the contact element can be varied.

Figure 47:
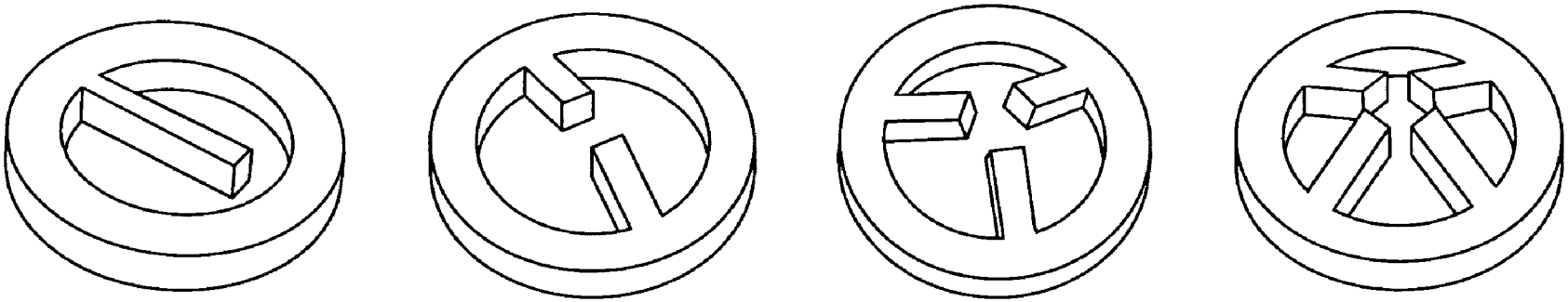
FIG. 47 is a schematic diagram of an enlarged perspective view of exemplary contact arm designs.

Referring to FIG. 47, a plurality of contact arm designs are shown for either a BBGA or a BLGA system. As aforementioned, these contacts can be either stamped or etched into a spring-like structure, and can be heat treated before or after forming.

Figure 48:
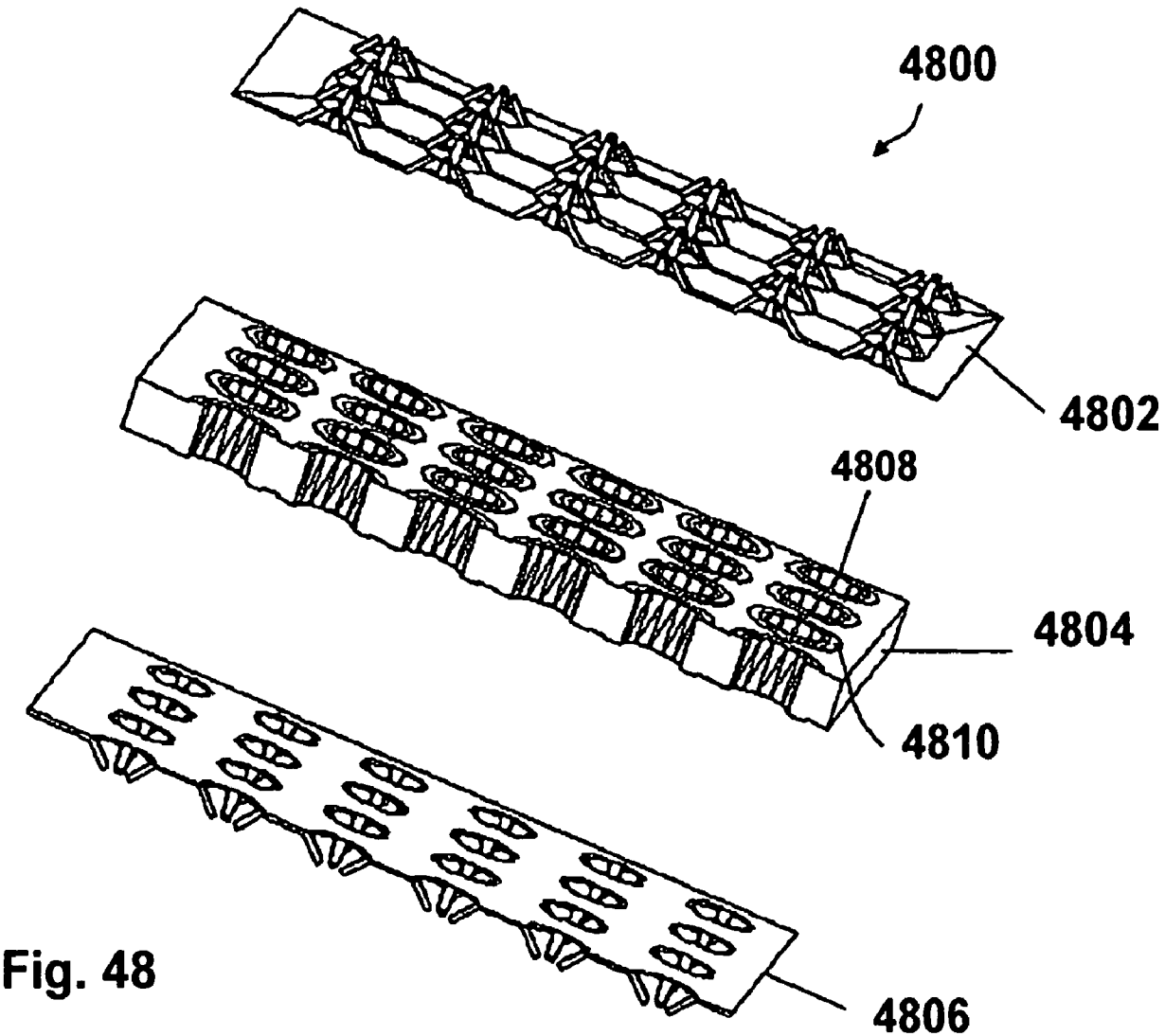
FIG. 48 is a schematic diagram of a perspective view of a connector according to one configuration of the present invention.

FIG. 48 is an exploded perspective view showing the assembly of a connector 4800 according to one configuration of the present invention. The connector 4800 includes a first set of contact elements 4802 that are located on a first major surface of a dielectric substrate 4804 and a second set of contact elements 4806 that are located on a second major surface of the substrate 4804. Each pair of contact elements 4802 and 4806 is preferably aligned with a hole 4808 formed in the substrate 4804. Metal traces are formed through the hole 4808 to connect a contact element from the first major surface to a contact element from the second major surface.

FIG. 48 shows the connector 4800 during an intermediate step in the manufacturing process for forming the connector. Therefore, the array of contact elements is shown as being connected together on a sheet of metal or metallic material from which they are formed. In the subsequent manufacturing steps, the metal sheet between the contact elements is patterned to remove unwanted portions of the metal sheet, so that the contact elements are isolated (i.e., singulated) as needed. For example, the metal sheet can be masked and etched to singulate some or all of the contact elements.

In one configuration, the connector of the present invention is formed as follows. First, the dielectric substrate 4804 including conductive paths between the top surface and the bottom surface is provided. The conductive paths can be in the form of vias or an aperture 4808. In one configuration, the dielectric substrate 4804 is a piece of any suitable dielectric material with plated through holes. A conductive metal sheet or a multilayer metal sheet is then patterned to form an array of contact elements including a base portion and one or more elastic portions. The contact elements, including the spring portions, can be formed by etching, stamping, or other means. The metal sheet is attached to the first major surface of the dielectric substrate 4804. When a second set of contact elements is to be included, a second conductive metal sheet or multilayer metal sheet is similarly patterned and attached to the second major surface of the dielectric substrate 4804. The metal sheets can then be patterned to remove unwanted metal from the sheets, so that the contact elements are isolated from each other (i.e., singulated) as needed. The metal sheets can be patterned by etching, scribing, stamping, or other means.

In an alternate configuration, the protrusion of the elastic portions can be formed after the metal sheet, including patterned contact elements, has been attached to the dielectric substrate. In another alternate configuration, the unwanted portions of the metal sheets can be removed before the contact elements are formed. Also, the unwanted portions of the metal sheets can be removed before the metal sheets are attached to the dielectric substrate.

Furthermore, in the configuration shown in FIG. 48, conductive traces are formed in the plated through holes 4808 and also on the surface of the dielectric substrate 4804 in a ring-shaped pattern 4810 encircling each plated through hole. While the conductive ring 4810 can be provided to enhance the electrical connection between the contact elements on the metal sheet and the conductive traces formed in the dielectric layer 4804, the conductive ring 4810 is not a required component of the connector 4800. In one configuration, the connector 4800 can be formed by using a dielectric substrate including through holes that are not plated. A metal sheet including an array of contact elements can be attached to the dielectric substrate. After the metal sheet is patterned to form individual contact elements, the entire structure can then be plated to form conductive traces in the through holes, connecting the contact elements through the holes to the respective terminals on the other side of the dielectric substrate.

Figure 49:
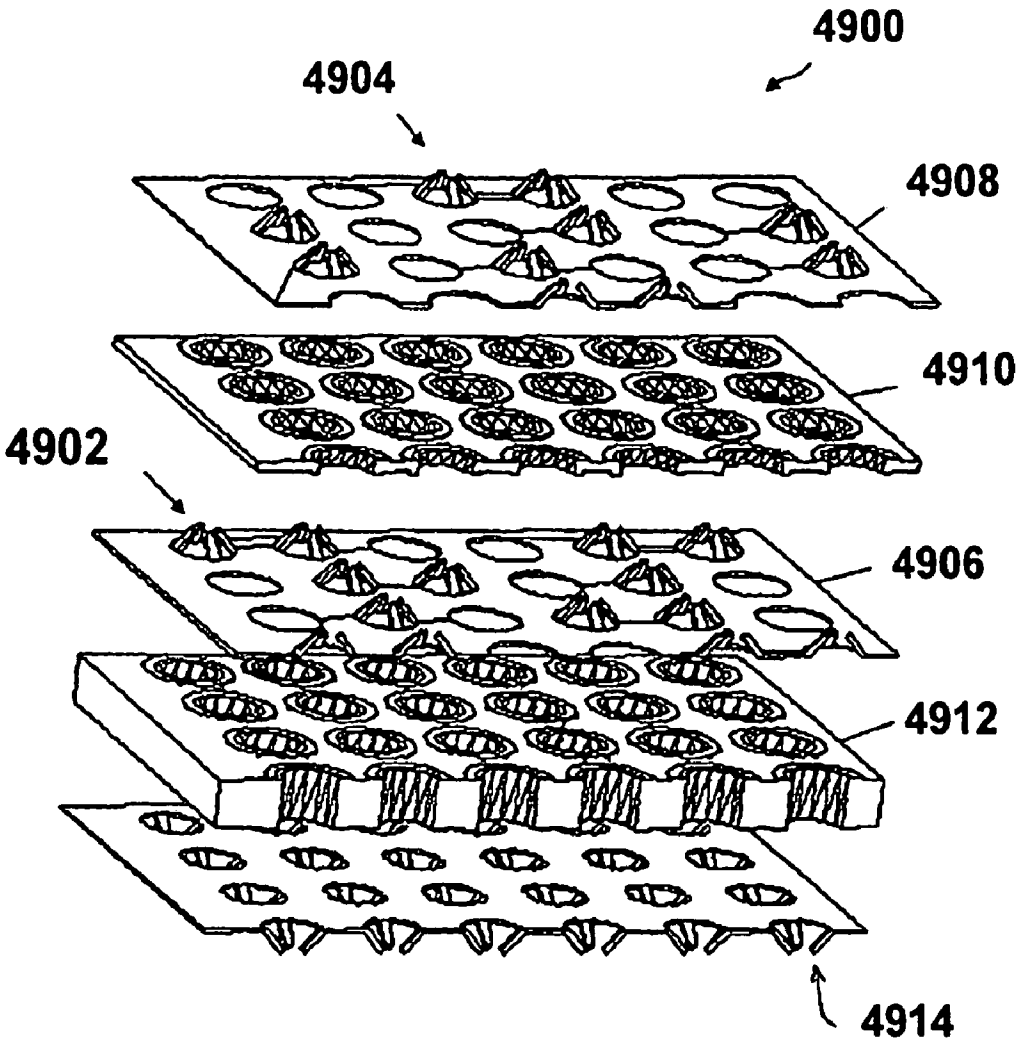
FIG. 49 is a schematic diagram of an exemplary connector including contact elements formed using multiple layers of metals according to another configuration of the present invention.

FIG. 49 illustrates a connector 4900 including contact elements formed using multiple layers of metals according to another configuration of the present invention. Referring to FIG. 49, the connector 4900 includes a multilayer structure for forming a first group of contact elements 4902 and a second group of contact elements 804. In this configuration, the first group of contact elements 4902 is formed using a first metal layer 4906 and the second group of contact elements 4904 is formed using a second metal layer 4908. The first metal layer 4906 and the second metal layer 4908 are isolated by a dielectric layer 4910. Each metal layer is patterned so that a group of contact elements is formed at desired locations on the specific metal layer. For instance, the contact elements 4902 are formed in the metal layer 4906 at predefined locations, while the contact elements 4904 are formed in the metal layer 4908 at locations not occupied by the contact elements 4902. The different metal layers may include metal layers with different thicknesses or different metallurgies, so that the operating properties of the contact elements can be specifically tailored. Thus, by forming a selected contact element or a selected group of contact elements in a different metal layer, the contact elements of the connector 4900 can be made to exhibit different electrical and mechanical properties.

In one configuration, the connector 4900 can be formed using the following process sequence. The first metal layer 4906 is processed to form the first group of contact elements 4902. The metal layer 4906 can then be attached to a dielectric substrate 4912. Subsequently, an insulating layer, such as the dielectric layer 4910, is located over the first metal layer 4906. The second metal layer 4908 can be processed to form the contact elements and attached to the dielectric layer 4910. Via holes and conductive traces are formed in the dielectric substrate 4912 and in the dielectric layer 4910 as needed to provide a conductive path between each contact element to a respective terminal 4914 on the opposing side of the substrate 4912.

Figure 50A:
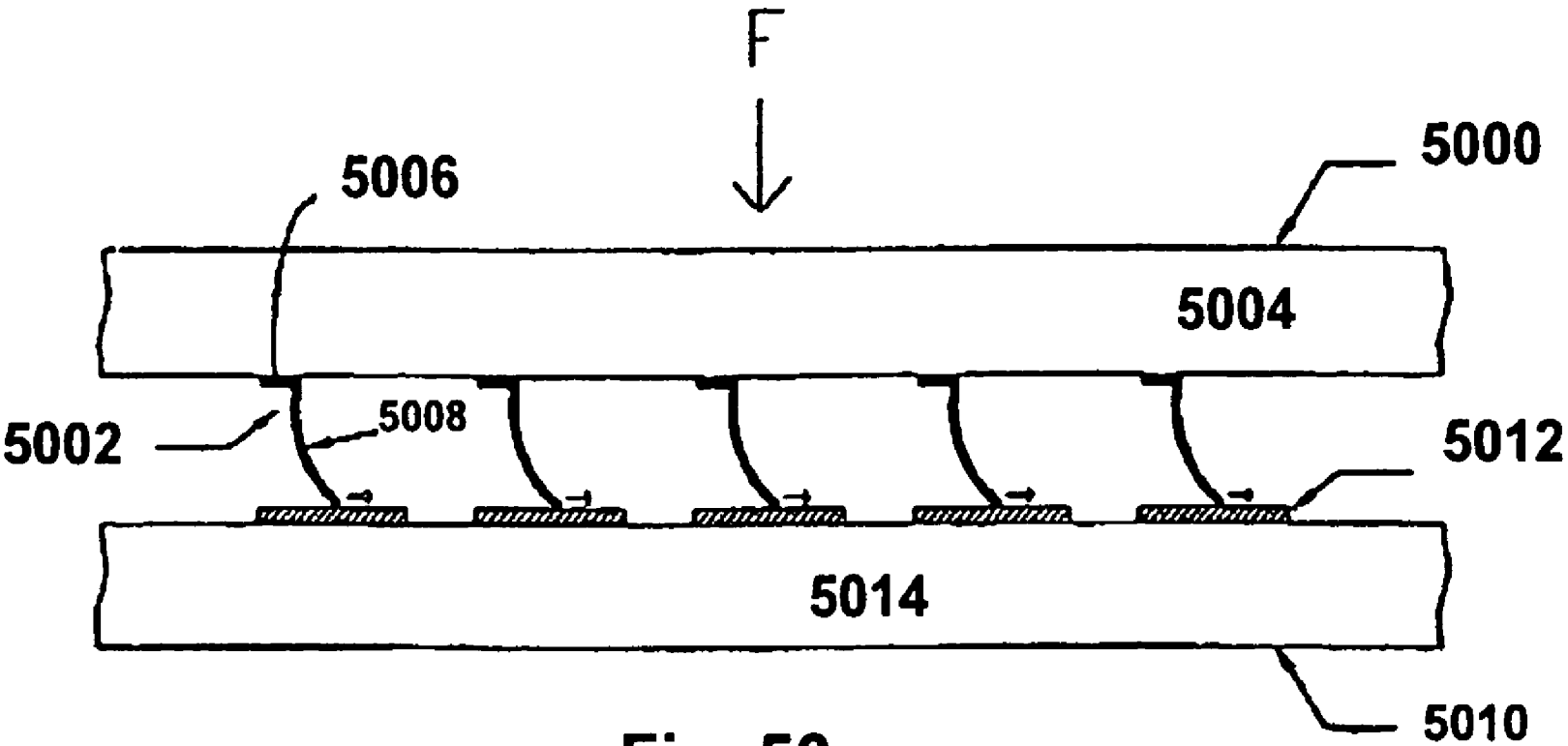
FIGS. 50*a* and 50*b* are schematic diagrams of cross-sectional views of an exemplary connector according to one configuration of the present invention.
Figure 50B:
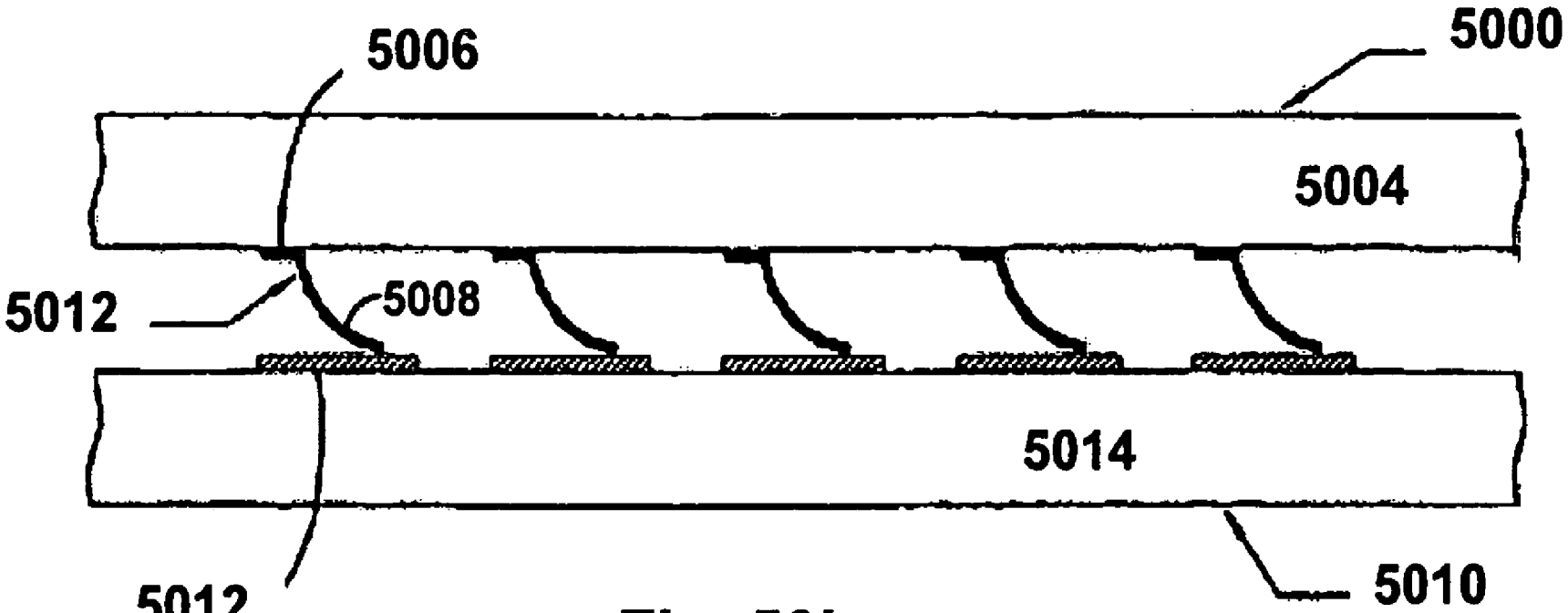

FIGS. 50*a* and 50*b* are cross-sectional views of a connector according to one configuration of the present invention. FIGS. 50*a* and 50*b* illustrate a connector 5000 connected to a semiconductor device 5010 including metal pads 5012 formed on a substrate 5014 as contact points. The semiconductor device 5010 can be a silicon wafer where the metal pads 5012 are the metal bonding pads formed on the wafer. The semiconductor device 5010 can also be a LGA package where the metal pads 5012 represent the "lands" or metal connection pads formed on the LGA package. The coupling of the connector 5000 to semiconductor device 5010 in FIGS. 50*a* and 50*b* is illustrative only and is not intended to limit the application of the connector 5000 to connecting with wafers or LGA packages only. FIGS. 50*a* and 50*b* illustrate the connector 5000 turned upside down to engage the semiconductor device 5010. The use of directional terms such as "above" and "top surface" in the present description is intended to describe the relative positional relationship of the elements of the connector as if the connector is positioned with the contact elements facing upward.

Referring to FIG. 50*a*, the connector 5000 includes an array of contact elements 5002 located on a substrate 5004. Each contact element 5002 includes a base portion 5006 attached to the top surface of the substrate 5004 and a curved or linear spring portion 5008 extending from the base portion 5006. The spring portion 5008 has a proximal end contiguous with the base portion 5006 and a distal end projecting above the substrate 5004.

The spring portion 5008 is formed to curve away or angle away from a plane of contact, which is the surface of the contact point to which the contact element 5002 is to be contacted, the surface of the metal pad 5012. The spring portion 5008 is formed to have a concave curvature with respect to the surface of the substrate 5004, or is formed to be angled away from the surface of the substrate 5004. Thus, the spring portion 5008 curves or angles away from the surface of the metal pad 5012, which provides a controlled wiping action when engaging the metal pad 5012.

In operation, an external biasing force, denoted F in FIG. 50*a*, is applied to the connector 5000 to compress the connector 5000 against the metal pads 5012. The spring portion 5008 of the contact element 5002 engages the respective metal pad 5012 in a controlled wiping action, so that each contact element 5002 makes an effective electrical connection to the respective pad 5012. The curvature or angle of the contact elements 5002 ensures that the optimal contact force is achieved concurrently with the optimal wiping distance. The wiping distance is the amount of travel the distal end of the spring portion 5008 makes on the surface of the metal pad 5012 when contacting the metal pad 5012. In general, the contact force is on the order of five to 100 grams depending on the application, and the wiping distance is on the order of five to 400 microns.

Another feature of the contact element 5002 is that the spring portion 5008 enables a large elastic working range. Specifically, because the spring portion 5008 can move in both the vertical and the horizontal directions, an elastic working range on the order of the electrical path length of the contact element 5002 can be achieved. The "electrical path length" of the contact element 5002 is defined as the distance the electrical current has to travel from the distal end of the spring portion 5008 to the base portion 5006 of the contact element 5002. The contact elements 5002 have an elastic working range that spans the entire length of the contact elements, which enables the connector to accommodate normal coplanarity variations and positional misalignments in the semiconductor or electronic devices to be connected.

The contact elements 5002 are formed using a conductive metal that can also provide the desired elasticity. In one configuration, the contact elements 5002 are formed using titanium (Ti) as a support structure that can later be plated to obtain a desired electrical and/or elastic behavior. In other configurations, the contact elements 5002 are formed using a copper alloy (Cu-alloy) or a multilayer metal sheet such as stainless steel coated with a copper-nickel-gold (Cu/Ni/Au) multilayer metal sheet. In a preferred configuration, the contact elements 5002 are formed using a small-grained copper beryllium (CuBe) alloy and then plated with electroless nickel-gold (Ni/Au) to provide a non-oxidizing surface. In an alternate configuration, the contact elements 5002 are formed using different metals for the base portions and the spring portions.

In the configuration shown in FIG. 50*a*, the contact element 5002 is shown as having a rectangular shaped base portion 5006 with one spring portion 5008. The contact element of the present invention can be formed in a variety of configurations and each contact element only needs to have a base portion sufficient for attaching the spring portion to the substrate. The base portion can assume any shape and can be formed as a circle or other useful shape for attaching the contact element to the substrate. A contact element can include multiple spring portions extending from the base portion.

Figure 51A:
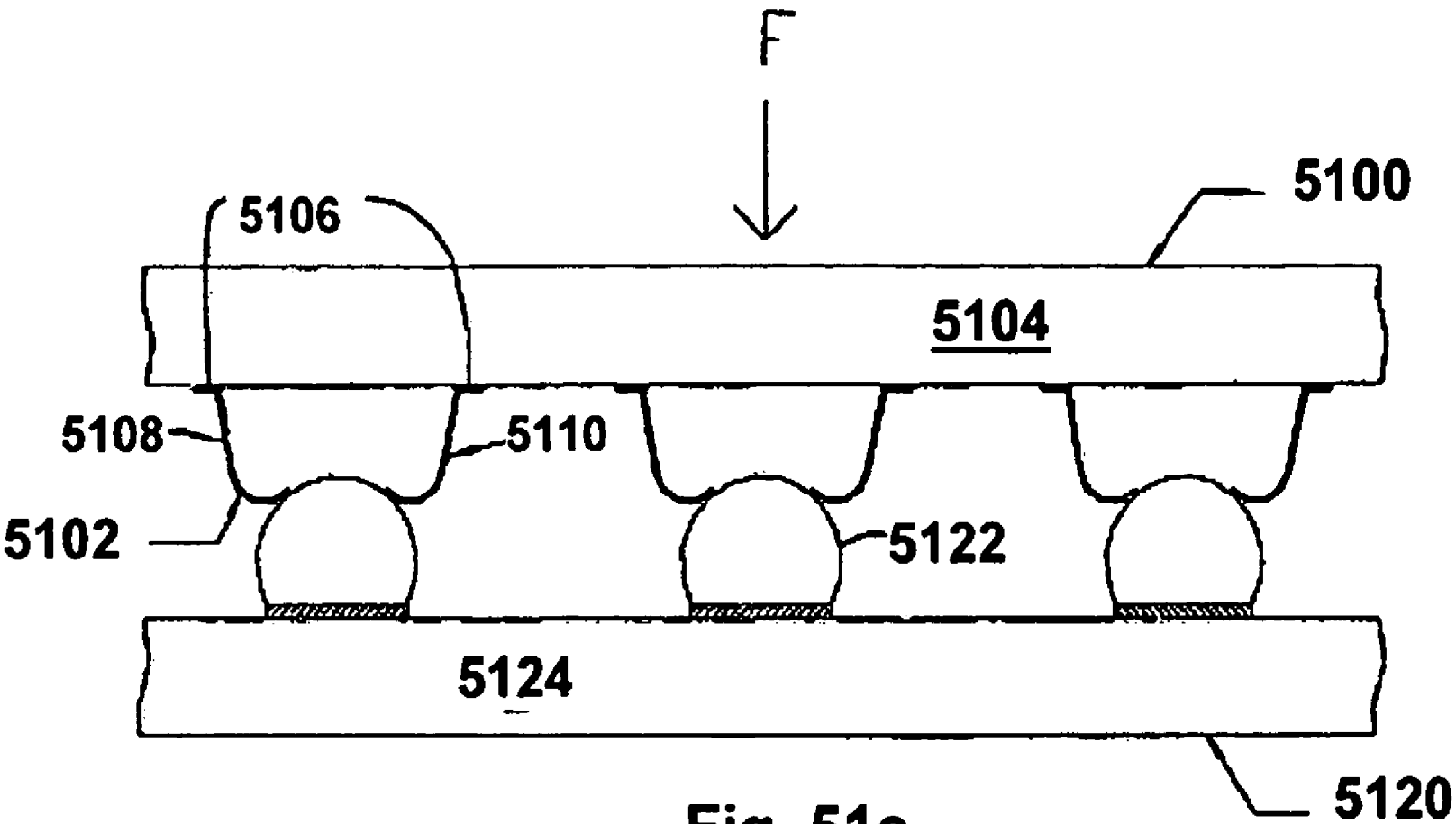
FIGS. 51*a* and 51*b* are schematic diagrams of cross-sectional views of an exemplary connector according to an alternate configuration of the present invention.
Figure 51B:
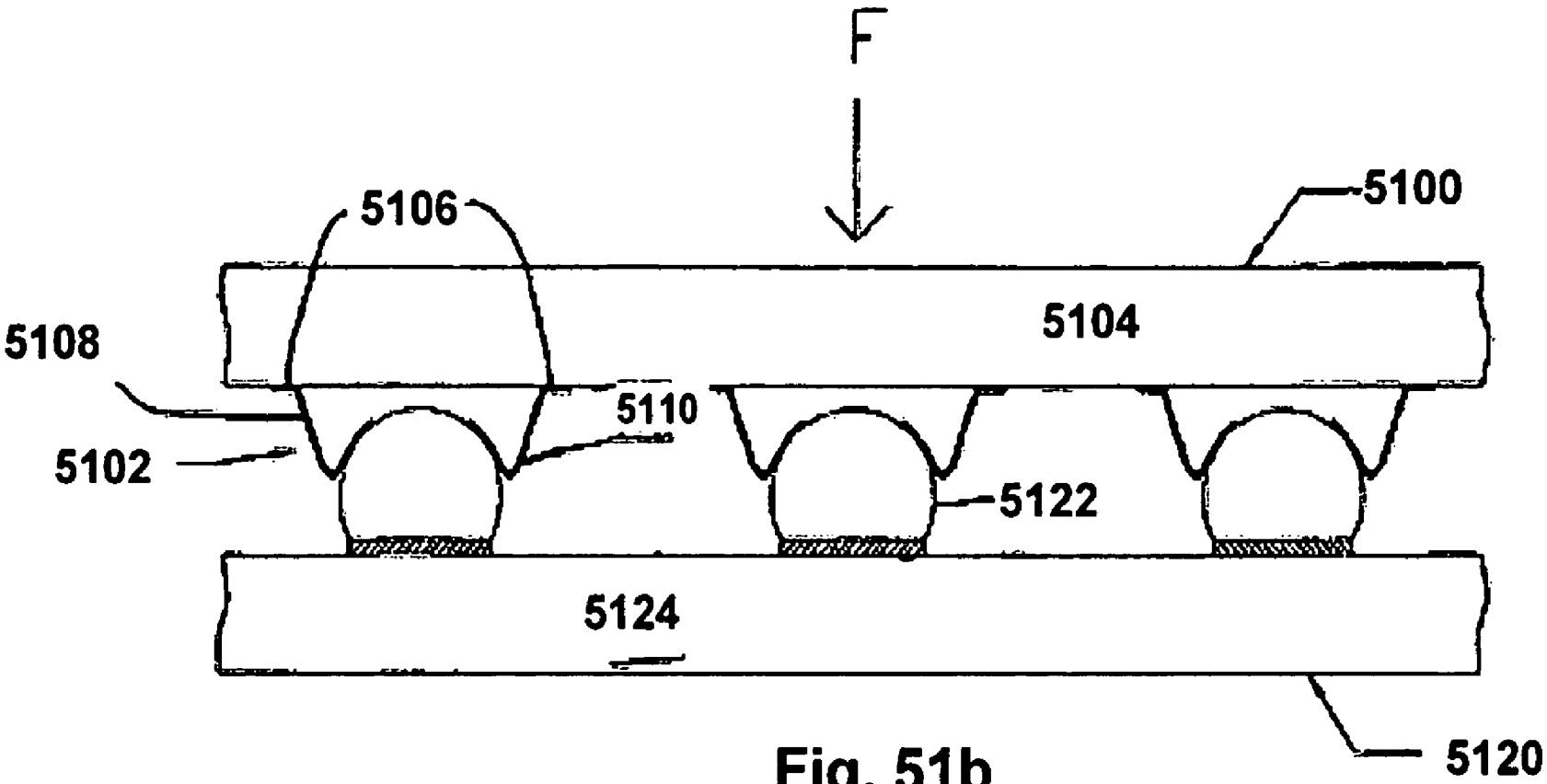

FIGS. 51*a* and 51*b* illustrate a connector 5100 according to an alternate configuration of the present invention. The connector 5100 includes an array of contact elements 5102 formed on a substrate 5104. Each contact element 5102 includes a base portion 5106 and two curved spring portions 5108 and 5110 extending from the base portion 5106. The spring portions 5108 and 5110 have distal ends projecting above the substrate 5104 and facing towards each other. Other characteristics of the spring portions 5108 and 5110 are the same as spring portion 5008. That is, the spring portions 5108 and 5110 curve away from a plane of contact and each has a curvature disposed to provide a controlled wiping action when engaging a contact point of a semiconductor device to be contacted.

The connector 5100 can be used to contact a semiconductor device 5120, such as a BGA package, including an array of solder balls 5122 mounted on a substrate 5124 as contact points. FIG. 51*b* illustrates the connector 5100 being fully engaged with the semiconductor device 5120. The connector 5100 can also be used to contact metal pads, such as pads on a land grid array package. However, using the connector 5100 to contact solder balls provides particular advantages.

First, the contact elements 5102 contact the respective solder balls 5122 along the side of the solder balls. No contact to the base surface of the solder ball 5122 is made. Thus, the contact elements 5102 do not damage the base surface of the solder balls 5122 during contact, and effectively eliminate the possibility of void formation when the solder balls 5122 are subsequently reflowed for permanent attachment.

Second, because the spring portions 5108 and 5110 of the contact elements 5102 are formed to curve away from the plane of contact, which in the present case is a plane tangent to the side surface of the solder ball 5122 being contacted, the contact elements 5102 provide a controlled wiping action when contacting the respective solder balls 5122. In this manner, an effective electrical connection can be made without damaging the surface of the solder balls 5122.

Third, the connector 5100 is scalable and can be used to contact solder balls having a pitch of 250 microns or less.

Lastly, because each contact element 5102 has a large elastic working range on the order of the electrical path length, the contact elements 5102 can accommodate a large range of compression. Therefore, the connector of the present invention can be used effectively to contact conventional devices having normal coplanarity variations or positional misalignments.

Figure 52:
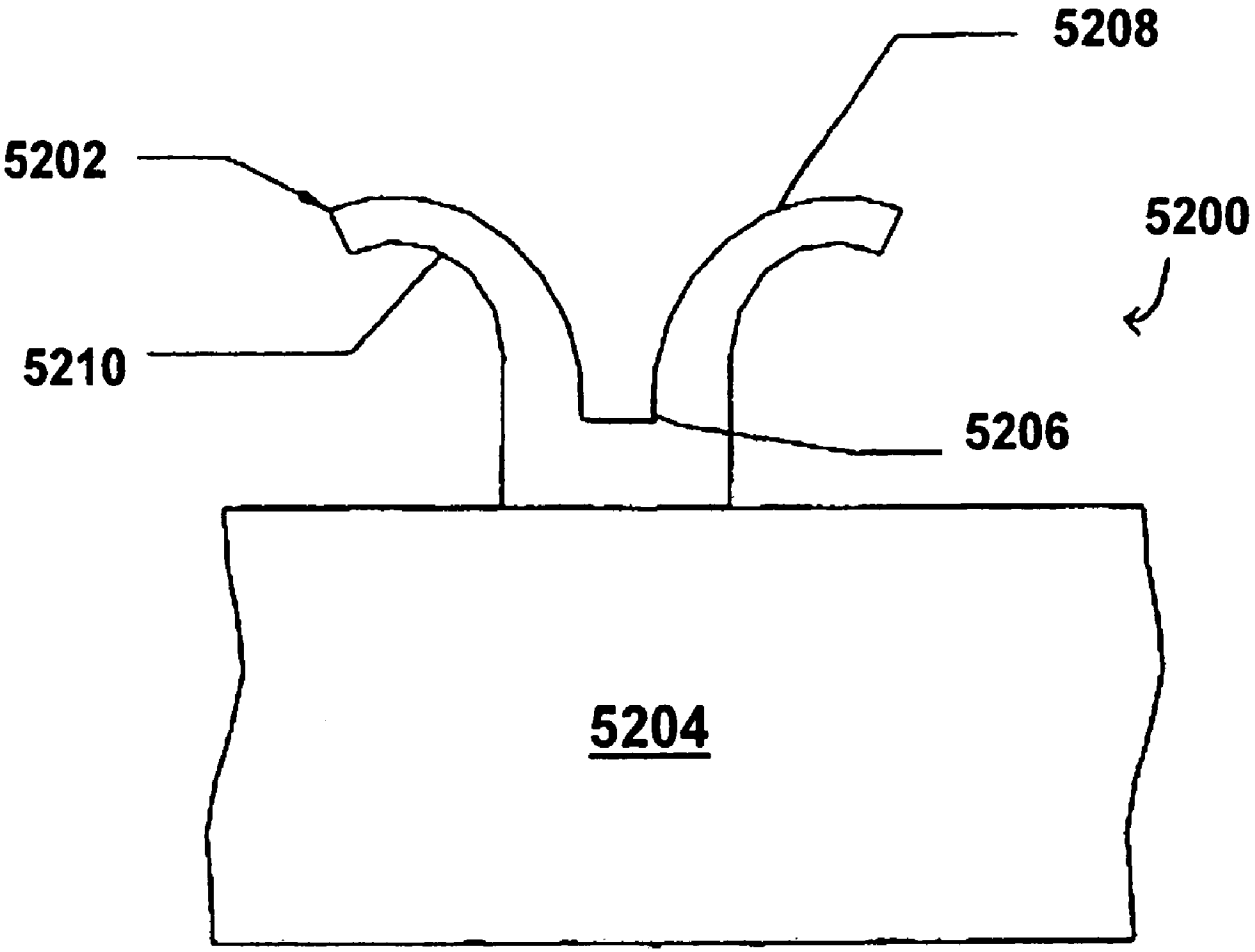
FIG. 52 is a schematic diagram of a cross-sectional view of an exemplary connector according to an alternate configuration of the present invention.
Figure 53:
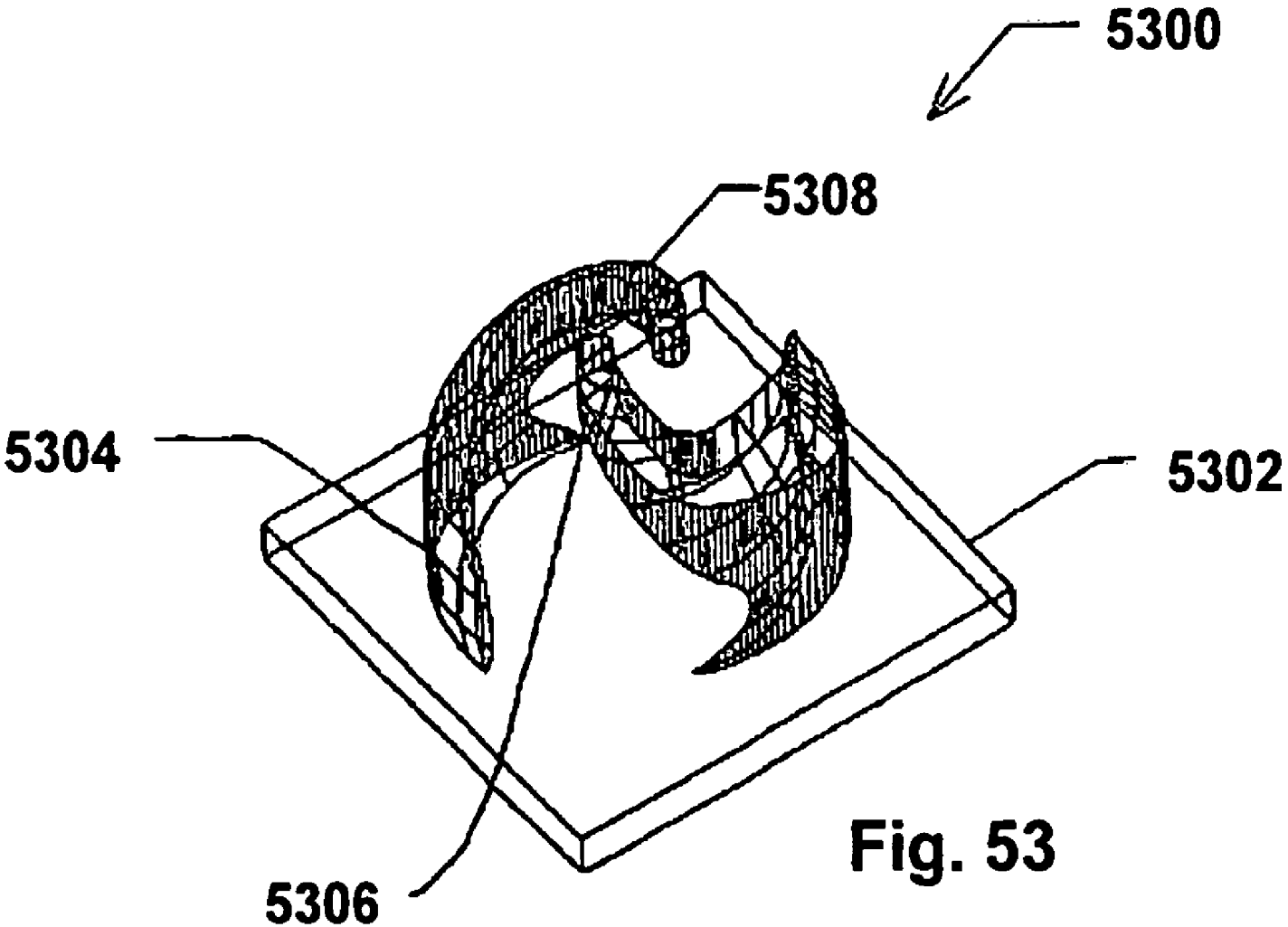
FIG. 53 is a schematic diagram of a perspective view of an exemplary connector according to an alternate configuration of the present invention.

FIGS. 52 and 53 illustrate connectors according to alternate configurations of the present invention. Referring to FIG. 52, a connector 5200 includes a contact element 5202 formed on a substrate 5204. Contact element 5202 includes a base portion 5206, a first curved spring portion 5208, and a second curved spring portion 5210. The first spring portion 5208 and the second spring portion 5210 have distal ends that point away from each other. The contact element 5202 can be used to engage a contact point including a metal pad or a solder ball. When used to engage a solder ball, contact element 5202 cradles the solder ball between the first and second spring portions 5208 and 5210. Thus, the first and second spring portions 5208 and 5210 contact the side surface of the solder ball in a controlled wiping motion in a direction that curves away from the plane of contact of the solder ball.

FIG. 53 illustrates a contact element 5300 located on a substrate 5302. The contact element 5300 includes a base portion 5304, a first curved spring portion 5306 extending from the base portion 5304, and a second curved spring portion 5308 extending from the base portion 5304. The first spring portion 5306 and the second spring portion 5308 project above the substrate 5302 in a spiral configuration. The contact element 5300 can be used to contact a metal pad or a solder ball. In both cases, the first and second spring portions 5306 and 5308 curve away from the plane of contact and provide a controlled wiping action.

Figure 54A:
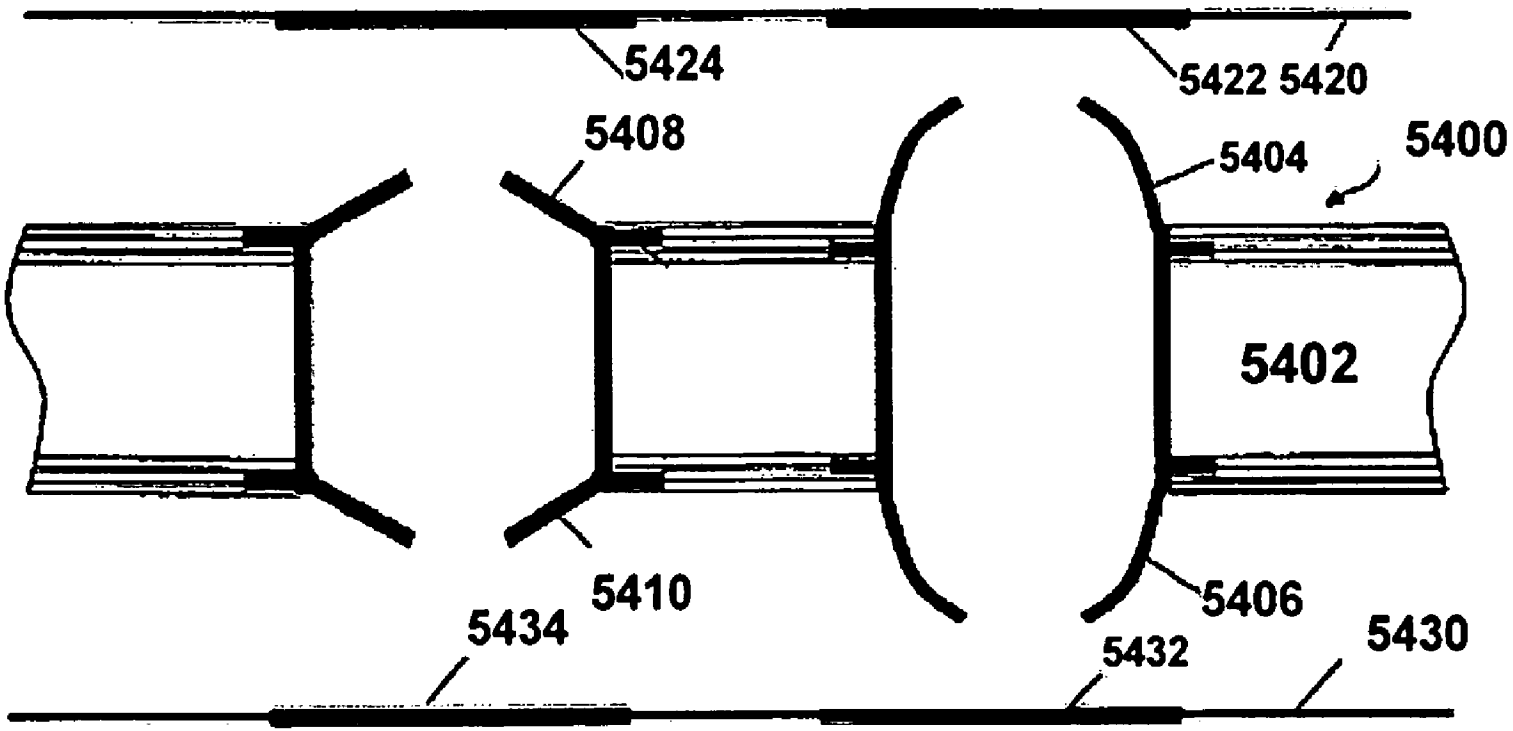
FIGS. 54*a* to 54*c* are schematic diagrams of cross-sectional views of one configuration of a connector being applied in a hot-swapping operation.
Figure 54B:
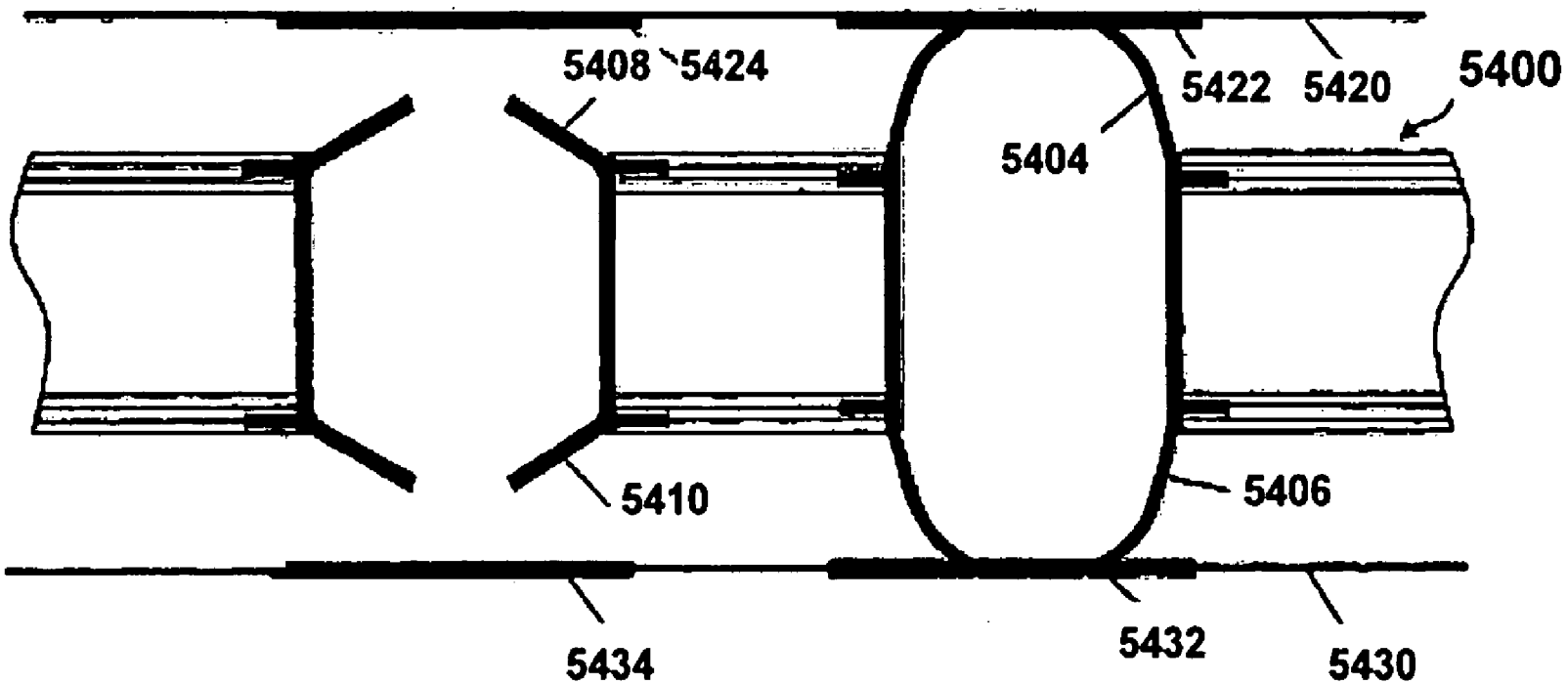
Figure 54C:
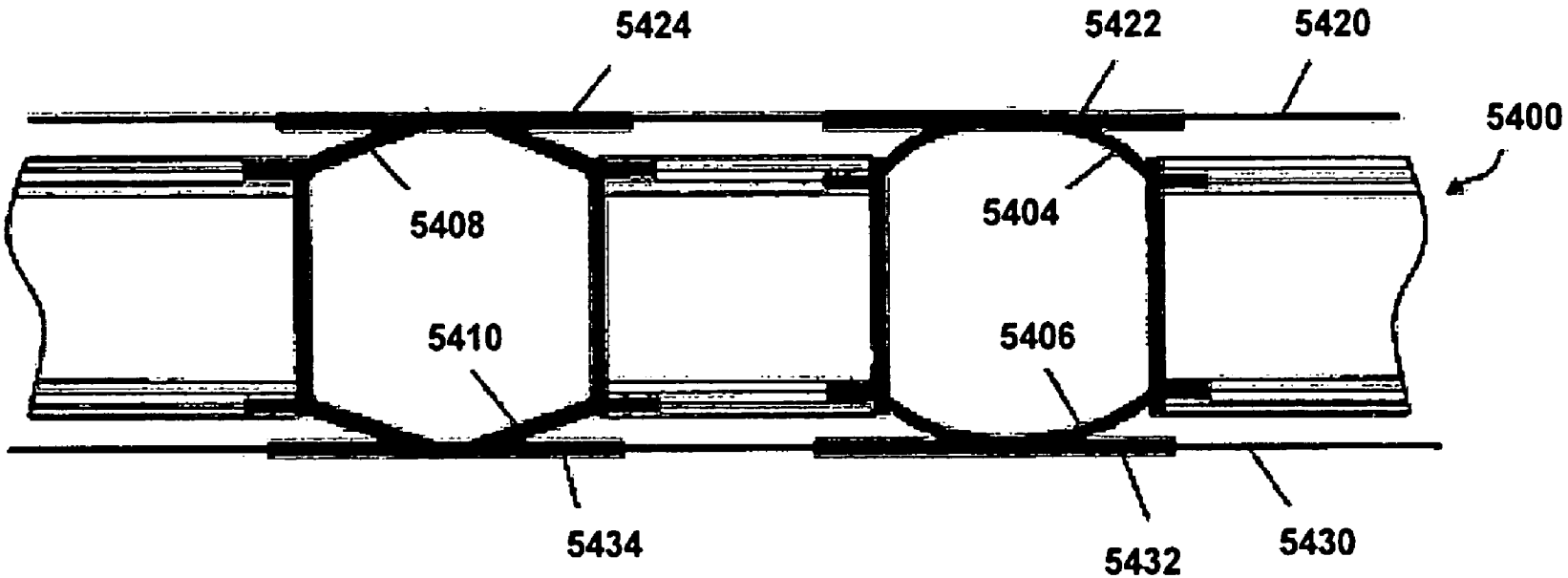

FIGS. 54*a* to 54*c* are cross-sectional views of a connector 5400 which can, for example, be applied in a hot-swapping operation. Referring to FIG. 54*a*, the connector 5400 is shown in an unloaded condition. The connector 5400 is to be connected to a land grid array (LGA) package 5420 and a printed circuit board (PC board) 5430. A pad 5422 on the LGA package 5420 represents a power connection (that is, either the positive power supply voltage or the ground voltage) of the integrated circuit in the LGA package 5420 which is to be connected to a pad 5432 on the PC board 5430. The pad 5432 is electrically active or "powered-up". A pad 5424 on the LGA package 5420 represents a signal pin of the integrated circuit which is to be connected to a pad 5434 on the PC board 5430. To enable a hot-swapping operation, the power pad 5422 should be connected to pad 5432 prior to the signal pad 5424 being connected to pad 5434. The connector 5400 includes contact elements 5404 and 5406 in a substrate 5402 which have an extended height and a larger elastic working range than contact elements 5408 and 5410, such that a hot-swapping operation between the LGA package 5420 and the PC board 5430 is realized using the connector 5400. The height of the contact elements 5404 and 5406 is selected to obtain the desired contact force and desired spacing to achieve a reliable hot-swapping operation.

FIG. 54*b* illustrates an intermediate step during the mounting process of the LGA package 5420 to the PC board 5430 using the connector 5400. When the LGA package 5420 and the PC board 5430 are compressed together against the connector 5400, pad 5422 and pad 5432 will make electrical connections to respective contact elements 5404 and 5406 prior to the pads 5424 and 5434 making connection to contact elements 5408 and 5410. In this manner, the power connection between the LGA package 5420 and the PC board 5430 is established before the signal pads are connected.

FIG. 54*c* illustrates the mounting of the LGA package 5420 to the PC board 5430 in a fully loaded condition. By applying further compression force, the LGA package 5420 is compressed against the connector 5400 so that contact element 5408 engages the signal pad 5424. Similarly, the PC board 5430 is compressed against the connector 5400 so that contact element 5410 engages the pad 5434. The LGA package 5420 is thus mounted onto the PC board 5430. In the connector 5400, as the taller contact elements 5404, 5406 are compressed more to allow the shorter contact elements 5408, 5410 to engage, the contact force required for the connector will increase. In order to minimize the overall contact force required for the connector, the taller contact elements 5404, 5406 can be designed with a lower spring constant than the shorter contact elements 5408, 5410 such that all contact elements are at the optimal contact force in the fully loaded condition.

Figure 55A:
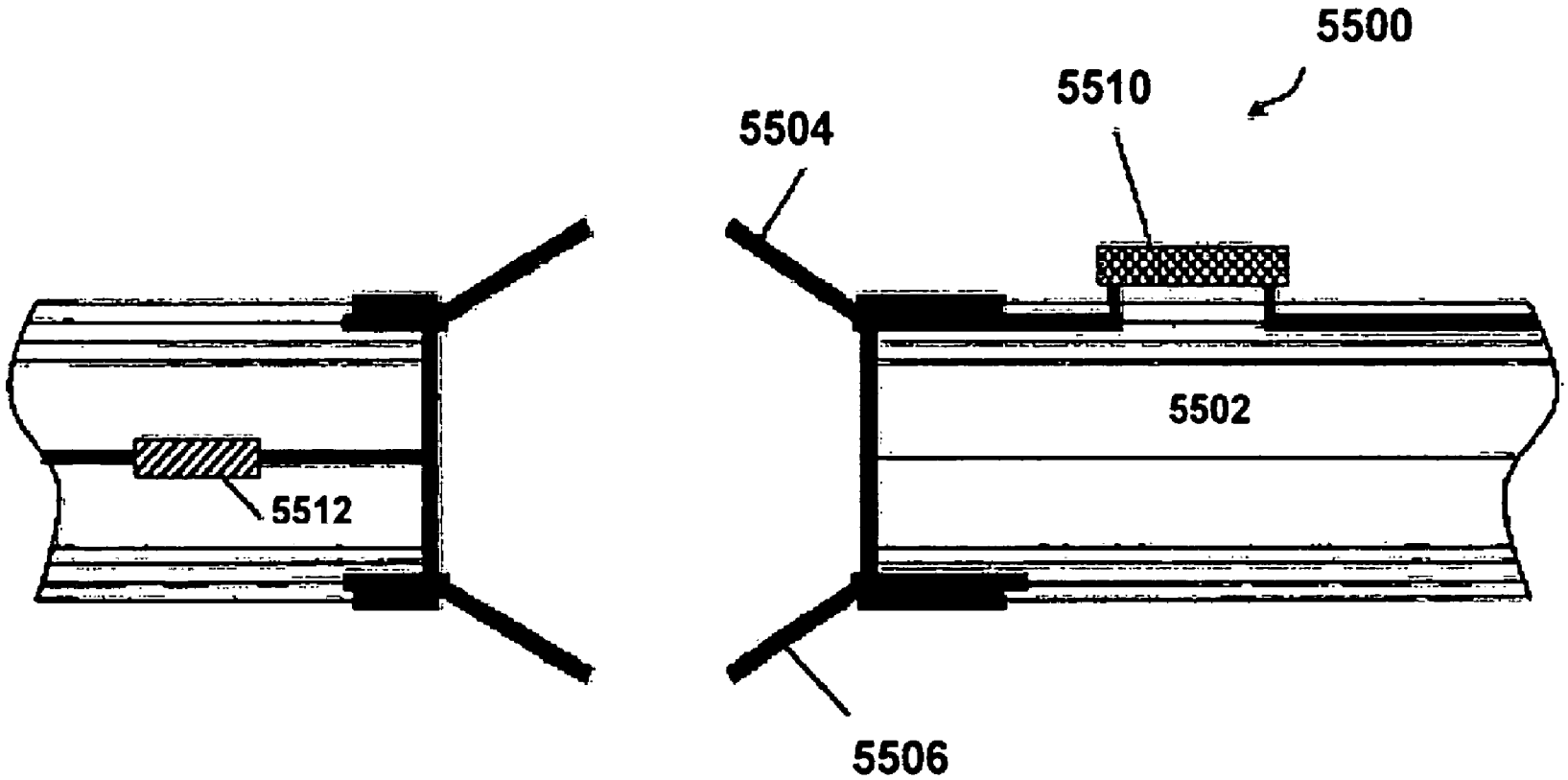
FIGS. 55*a* and 55*b* are two schematic diagrams that show configurations of a circuitized connector in accordance with the present invention.

FIG. 55*a* illustrates one configuration of a circuitized connector 5500 in accordance with the present invention. The connector 5500 includes a contact element 5504 on the top surface of a dielectric substrate 5502 connected to a contact element 5506 on the bottom surface of dielectric substrate 5502. The contact element 5504 is connected to a surface mounted electrical component 5510 and an embedded electrical component 5512. The electrical components 5510 and 5512 may be decoupling capacitors, for example, which are positioned on the connector 5500 so that the capacitors can be placed as close to the electronic component as possible. In conventional integrated circuit assembly, such decoupling capacitors are usually placed on the printed circuit board distant from the electronic component. Thus, a large distance exists between the electronic component to be compensated and the actual decoupling capacitor, thereby diminishing the effect of the decoupling capacitor. By using the circuitized connector 1400, the decoupling capacitors can be placed as close to the electronic component as possible to enhance the effectiveness of the decoupling capacitors. Other electrical components that may be used to circuitize the connector include a resistor, an inductor, and other passive or active electrical components.

Figure 55B:
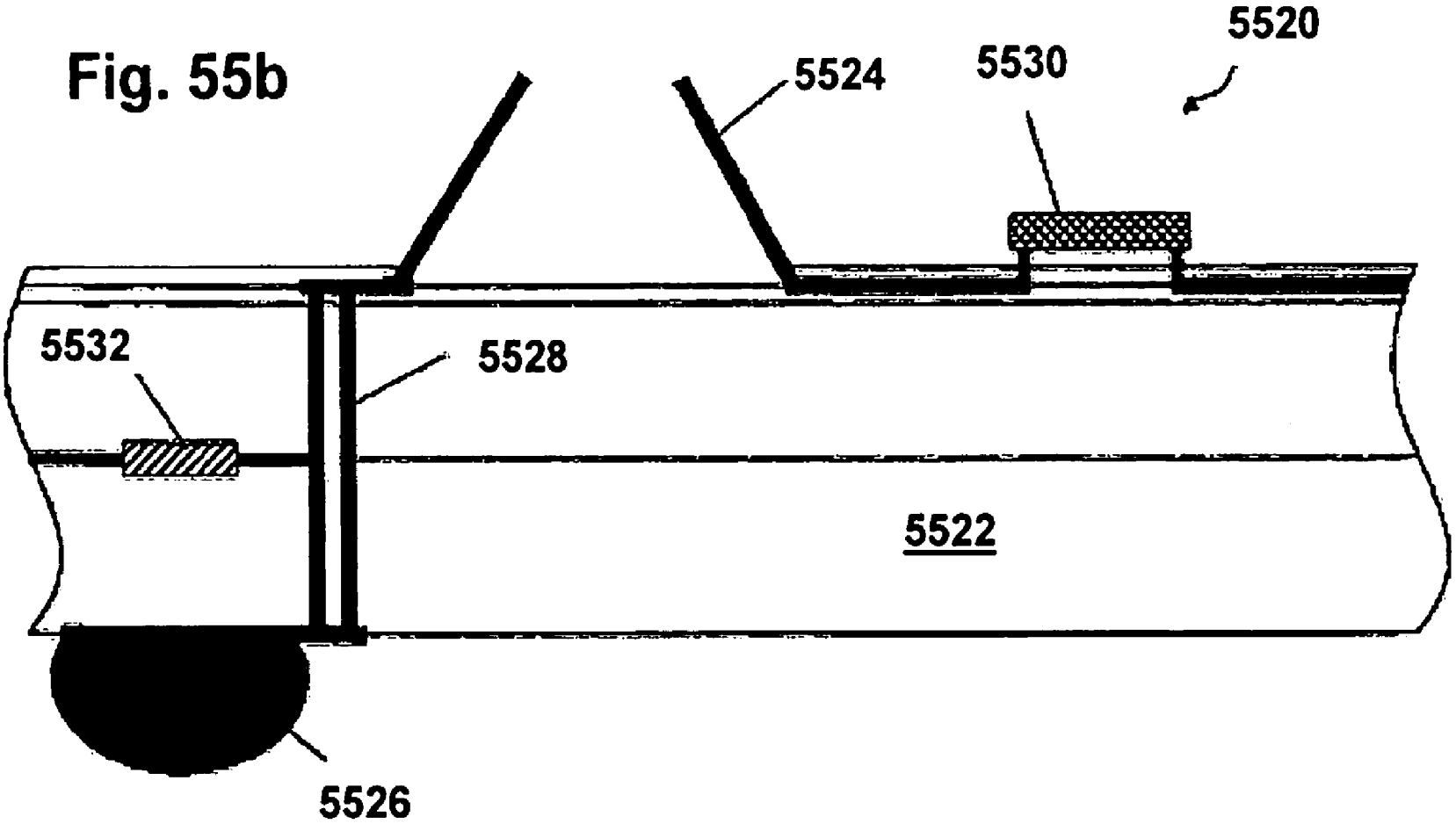

FIG. 55*b* illustrates another configuration of a circuitized connector according to the present invention. Connector 5520 includes a contact element 5524 on a dielectric substrate 5522 coupled to a solder ball terminal 5526 through a via 5528. The contact element 5524 is connected to a surface mounted electrical component 5530 and to an embedded electrical component 5532. The connector 5520 further illustrates that the placement of the terminal 5526 does not have to be aligned with the contact element 5524 as long as the contact element is electrically coupled to the terminal, such as through the via 5528. It is noted that a connector in accordance with the present invention can be constructed without a relief hole in the substrate. The electrical contact or via can be defined in an offset hole or in any suitable manner to provide electrical connections internally or to opposite sides of the substrate.

Figure 56A:
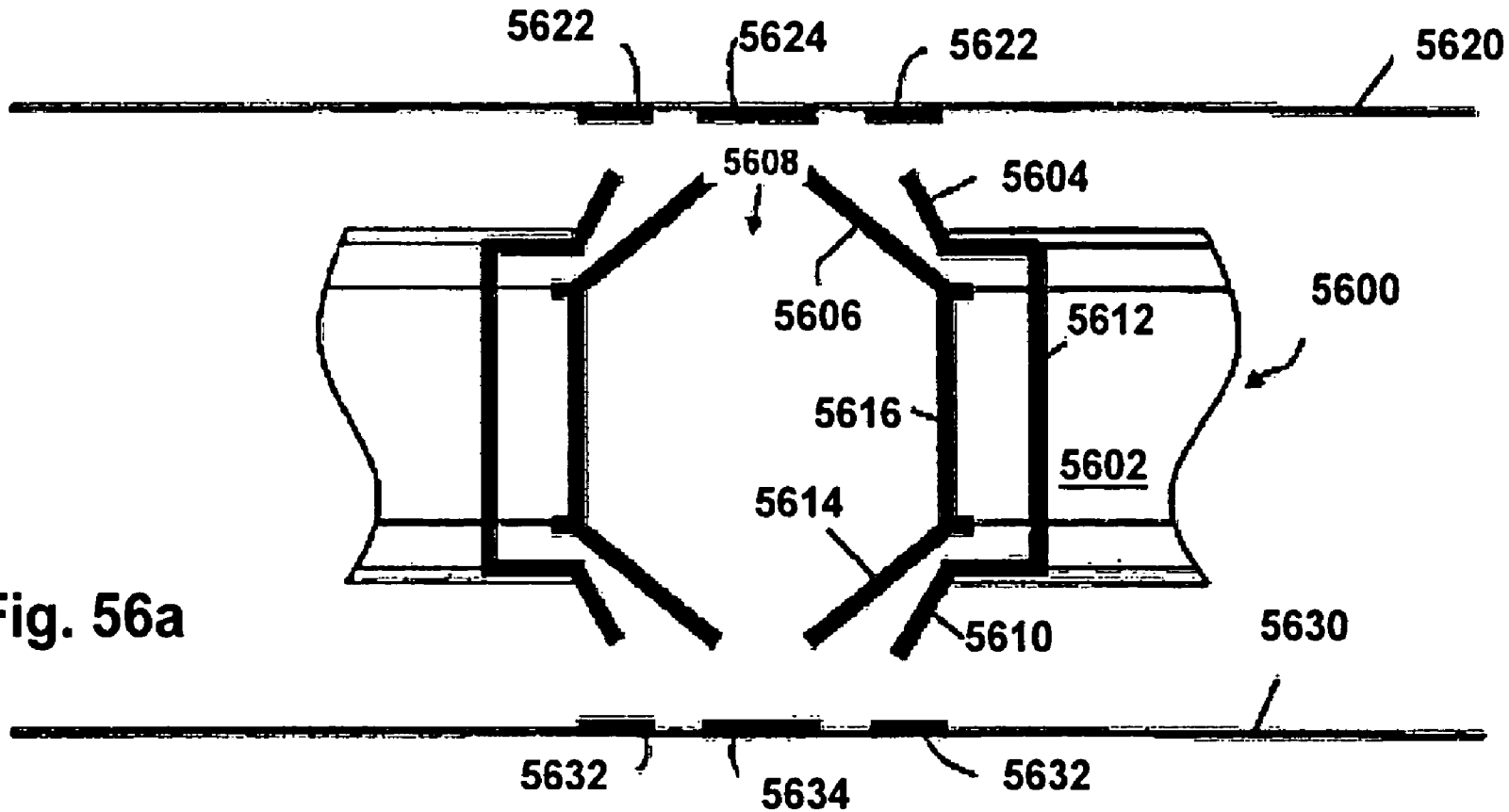
FIG. 56*a* is a schematic diagram of a cross-sectional view of an exemplary connector including a coaxial contact element according to an alternate configuration of the present invention.
Figure 56B:
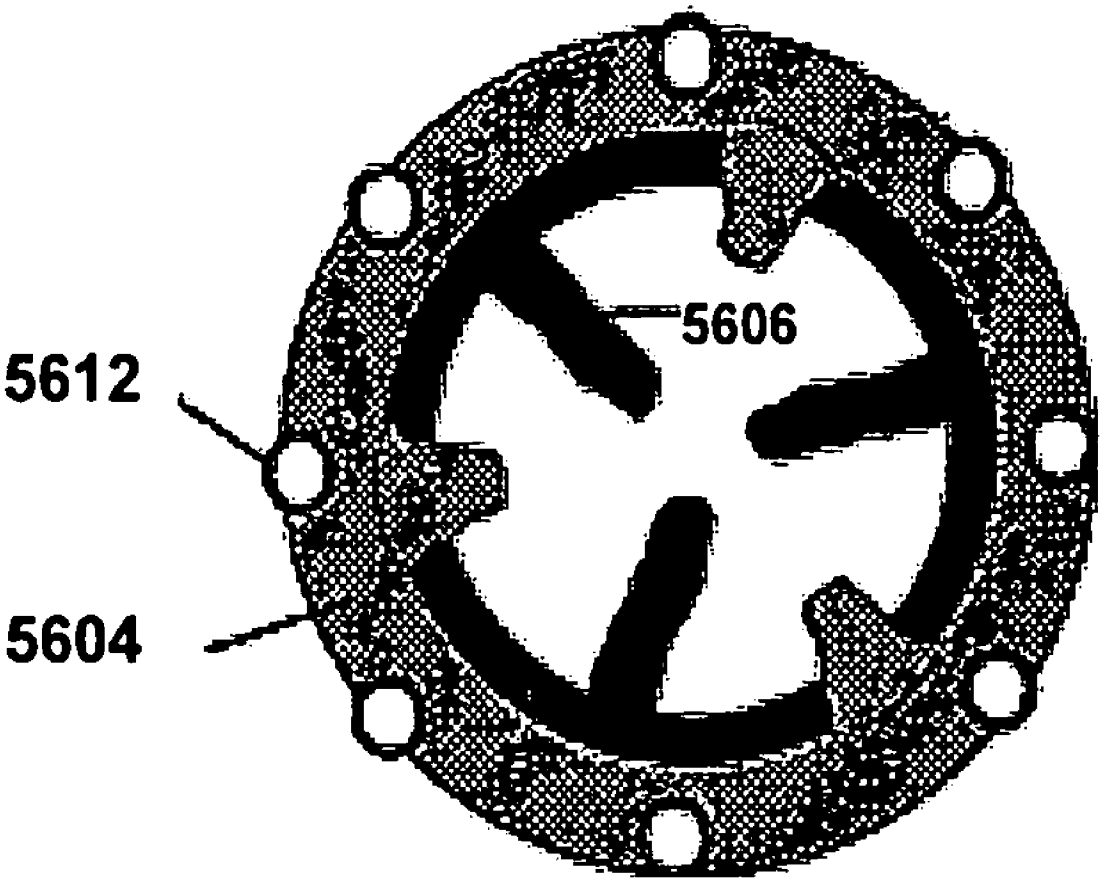
FIG. 56*b* is a schematic diagrams of a top view of the coaxial contact element of FIG. 56*a*.

According to another aspect of the present invention, a connector can include one or more coaxial contact elements. FIGS. 56*a* and 56*b* show a connector 5600 including a coaxial contact element according to one configuration of the present invention. Referring to FIG. 56*a*, the connector 5600 includes a first contact element 5604 and a second contact element 5606 formed on the top surface of a dielectric substrate 5602. The contact elements 5604 and 5606 are formed in proximity to, but electrically isolated from, each other. The contact element 5604 includes a base portion formed as an outer ring of an aperture 5608 while the contact element 5606 includes a base portion formed as an inner ring of the aperture 5608. Each of the contact elements 5604, 5606 includes three elastic portions (FIG. 56*b*). The elastic portions of the contact element 5604 do not overlap with the elastic portions of the contact element 5606. The contact element 5604 is connected to a contact element 5610 on the bottom surface of the dielectric substrate 5602 through at least one via 5612. The contact elements 5604 and 5610 form a first current path, referred to as the outer current path of the connector 5600. The contact element 5606 is connected to a contact element 5614 on the bottom surface of the dielectric substrate 5602 through a metal trace 5616 formed in the aperture 5608. The contact elements 5606 and 5614 form a second current path, referred to as the inner current path of the connector 5600.

Figure 57:
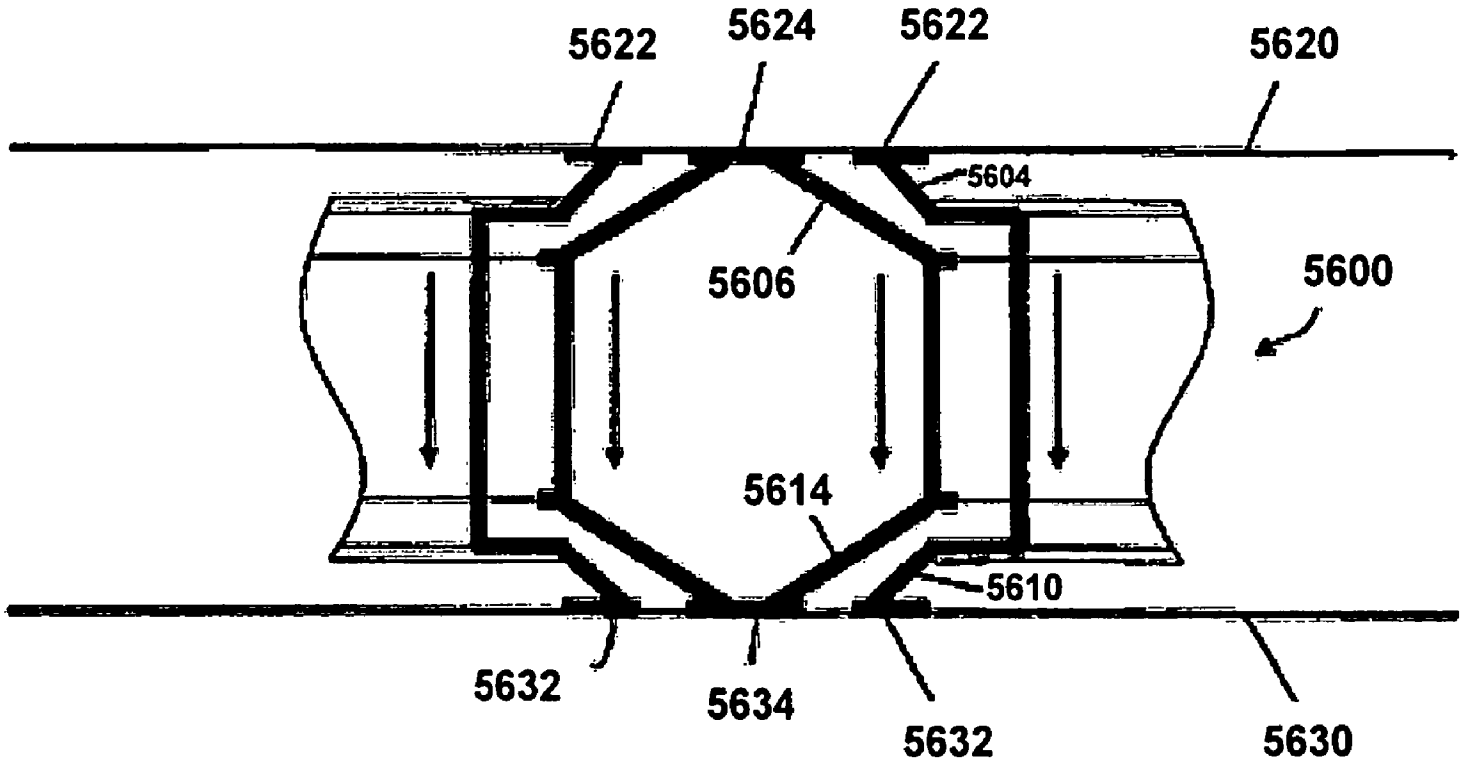
FIG. 57 is a schematic diagram that shows the mating of an LGA package to a PC board through the connector of FIG. 56*a*.

As thus constructed, the connector 5600 can be used to interconnect a coaxial connection on a LGA package 5620 to a coaxial connection on a PC board 5630. FIG. 57 illustrates the mating of the LGA package 5620 to the PC board 5630 through the connector 5600. When the LGA package 5620 is mounted to the connector 5600, the contact element 5604 engages a pad 5622 on the LGA package 5620. Similarly, when the PC board 5630 is mounted to the connector 5600, the contact element 5610 engages a pad 5632 on the PC board 5630. As a result, the outer current path between pad 5622 and pad 5632 is formed. Typically, the outer current path constitutes a ground potential connection. The contact element 5606 engages a pad 5624 on the LGA package 5620 while the contact element 5614 engages a pad 5634 on the PC board 5630. As a result, the inner current path between pad 5624 and pad 5634 is formed. Typically, the inner current path constitutes a high frequency signal.

A particular advantage of the connector 5600 is that the coaxial contact elements can be scaled to dimensions of one millimeter or less. Thus, the connector 5600 can be used to provide a coaxial connection even for small geometry electronic components.

Figure 58:
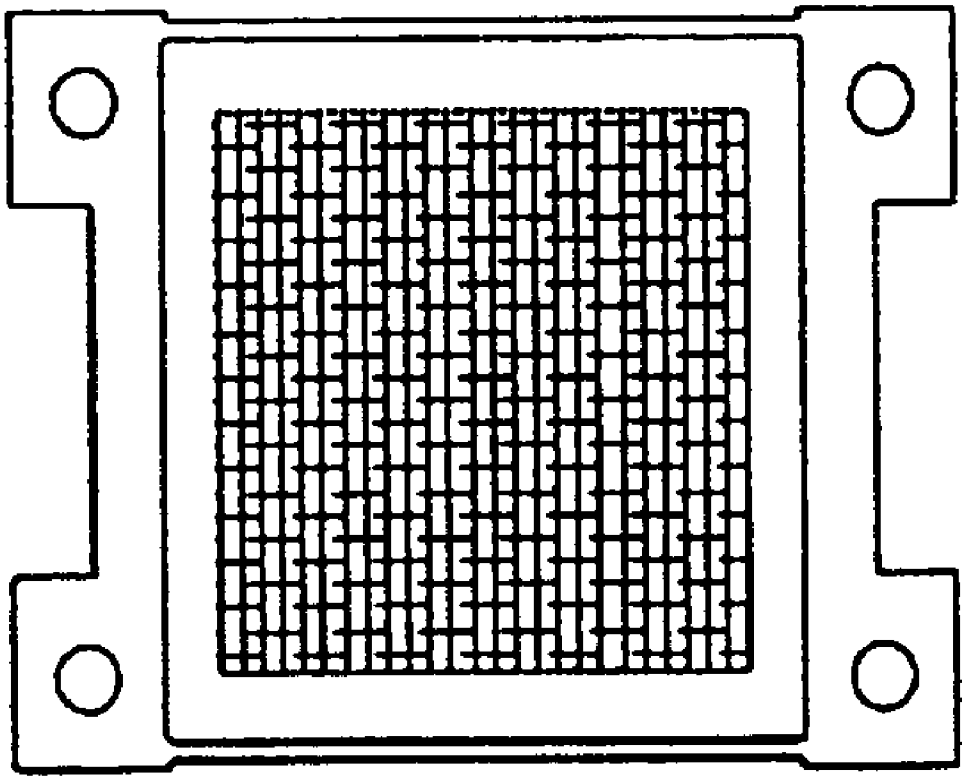
FIGS. 58 and 59 are schematic diagrams that illustrate a top view and sectional view, respectively, of an exemplary clamping system for the contact systems of this invention.
Figure 59:
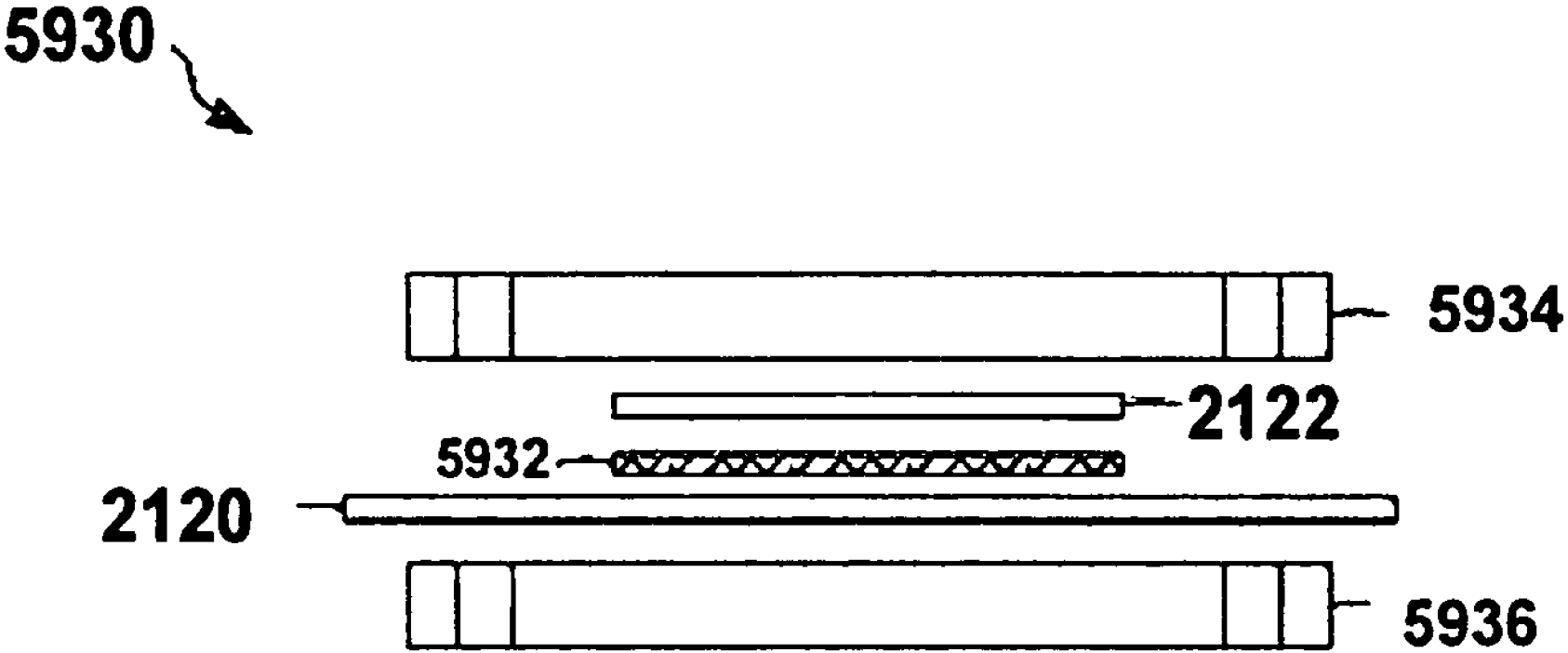

Referring to FIGS. 58 and 59, a clamping mechanism 5930 is shown in sectional and top views, respectively. The contact system arranged in accordance with configurations of this invention is depicted as an interposer 5932, which is clamped between a PCB 2120 and a package 2122 that is to be attached by placing the assembly between a top plate 5934 and a backing plate 5936, which are screwed together or otherwise compressed together.

The contact systems arranged according to different configurations of this invention can be used with high frequency semiconductor devices or almost any type of electrical interface including, but not limited to: BGA, CSP, QFP, QFN, and TSOP packages.

Compared to stamped, formed, or coiled springs, a contact system of the present invention provides greater elasticity, without limiting electrical properties. The system is readily scalable to small pitch and small inductance, whereas pogo pins, and nano-springs are very limited in this regard.

Compared with polymer-based and dense metal systems, a contact system of the present invention is not limited in its mechanical properties, durability, contact force, and working range, while providing good electrical properties.

The contact system of this invention is characterized by its elastic functionality across the entire gap between the electrical devices to be connected, i.e., from device contact to device contact. Thus, in accordance with one configuration of this invention, a double sided connector arranged has an array of elastic contacts disposed on each side of the connector substrate. Both contact arrays, when engaging respective external components on the respective opposite sides of the connector substrate, can be displaced elastically over an entire range of movement available to the elastic contact arms of the contacts.

Figure 60:
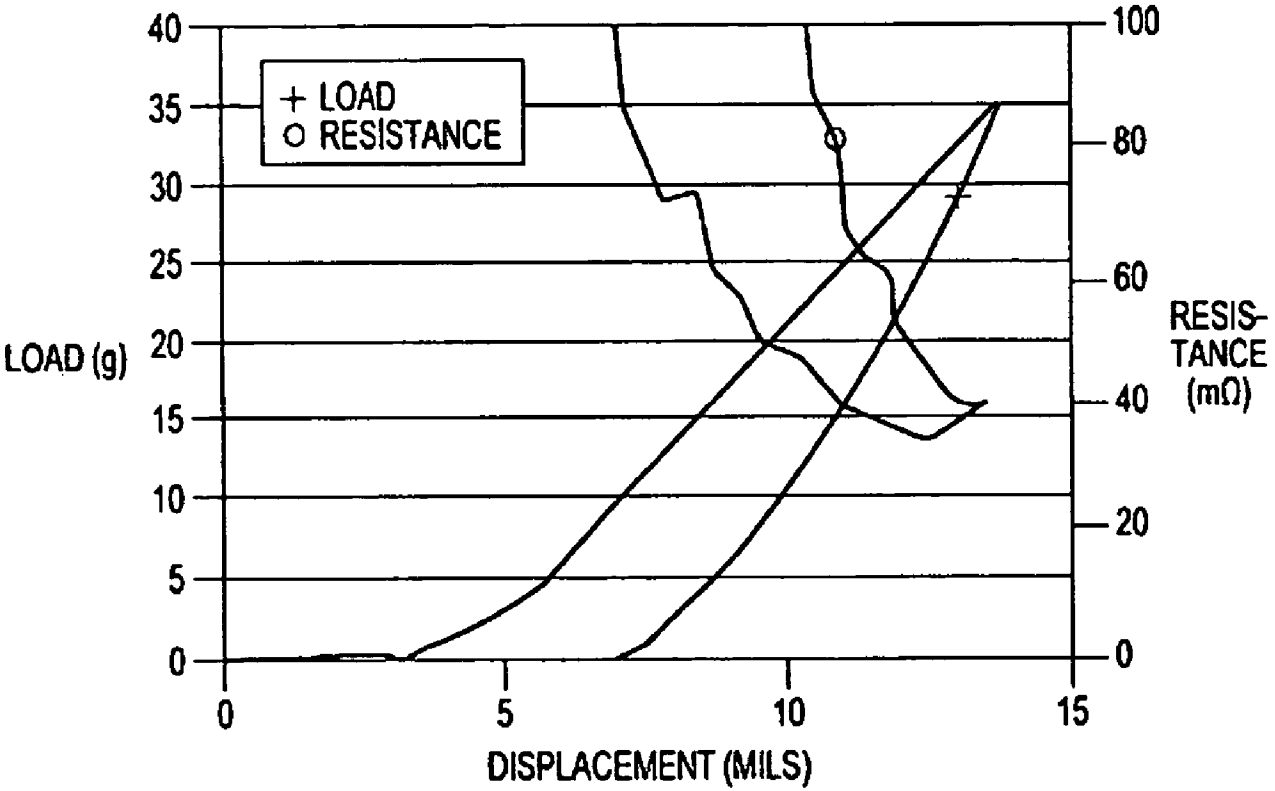
FIG. 60 is a graph of the load versus displacement for an exemplary BLGA system of this invention.

Referring to FIG. 60, a graph of load versus displacement for BLGA attachment systems of this invention is illustrated. FIG. 60 illustrates the concept of working range. The load versus displacement curve (lower hysteresis curve) illustrates that the contact has elastic behavior during insertion (the displacing downwardly of a contact arm by an external component) over a range from about 6.5 to 14 mils. The resistance versus displacement curve indicates that the insertion resistance is below about 60 mOhm between about 7 and 14 mils displacement. For purposes of this example, if the acceptable electrical resistance for the contact is determined to be 60 mOhm or lower, then a working range, defined for this example as a displacement range during contact insertion in which the contact behaves elastically and exhibits resistance of 60 mOhm or less, is about 7 mils (the range between 7 and 14 mils over which the contact is both elastic and has resistance below the defined acceptable limit).

Typical mechanical and electrical characteristics for the contacts of this invention include a large working range greater than 5 mils, a low contact force less than 30 g, wiping action having both horizontal and vertical components for reliability, high durability greater than two hundred thousand cycles, high temperature operability greater than 125° C., good elasticity, low inductance less than 0.5 nH, high current capacity greater than 1.5 A, a small scalable pitch less than 20 mils, and a functional elasticity across the entire gap separating the two devices, boards, or substrates to be electrically connected.

In one configuration of this invention, the elasticity range for a contact is approximately between 0.12 mm and 0.4 mm for a size range for the flange springs of between approximately 0.12 mm and 0.8 mm. Thus, the elasticity to size ratio is in the approximate range of between 0.5 and 1.0. This ratio is a measure of the relative distance in which a contact arm can be elastically displaced as compared to the length of the elastic contact arm (flange spring).

In accordance with other configurations of this invention, the contact structures 1015 shown generally in FIGS. 10*a-c* can be formed by the processes outlined in FIGS. 19*a* and 19*b*. The contacts include one or more arrays of elastically deformable contacts, wherein the elastically deformable contacts are integrally formed from a metallic sheet, for example, a Cu alloy sheet. The alloy material of the metallic sheet is configured to provide high elasticity, such that highly elastic contact arms can be fabricated therefrom. The term "highly elastic," as used herein with respect to contacts, refers to contacts that can be repeatedly displaced without significant plastic flow (that is, without surpassing a mechanical yield stress (or strain)) over the range of mechanical displacement that takes place during connection to external components. Accordingly, an interposer formed from the array of deformable elastic contacts can be connected and disconnected multiple times to a substrate without degradation in mechanical or electrical performance.

For example, an interposer fabricated according to one configuration of this invention, and substantially similar to that shown in FIG. 10*c*, may have an array of elastic contacts with a working range of 15 mil on one or both sides of the interposer. When connecting to a substrate, such as a PCB board, the array of contacts can accommodate a variation in relative height of up to about 15 mil for points of contact where each contact of the array of contacts comes into contact with a corresponding conductive features of the PCB. In other words, a first contact (or contact element) at a point P1 in an array can contact a conductive feature of a PCB board having a relative height H1, while a second contact at point P2 of the array can contact a conductive feature of the PCB board having a relative height H1-12 mil.

Figure 61:
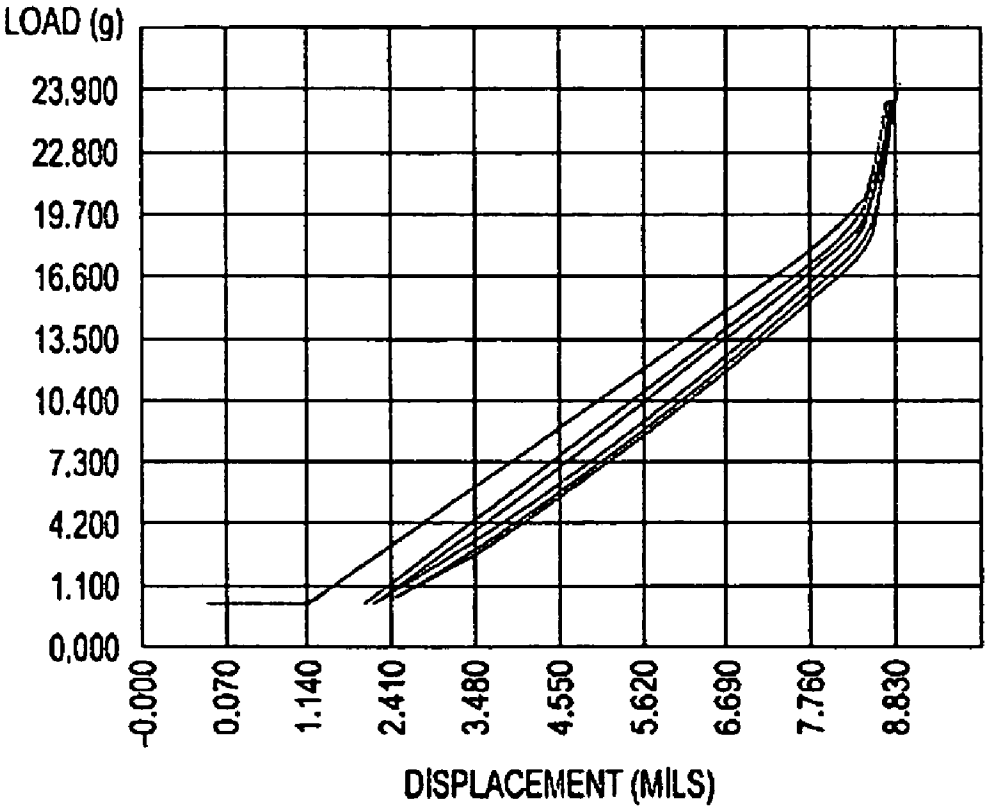
FIG. 61 is a graph of the load versus displacement for an exemplary BLGA system of this invention.

Thus, by the time electrical contact is established at point P2, the contact at point P1 may be elastically displaced by about 12 mils, that is, one or more of the contact arms displaced downwardly toward the plane of the interposer by about 12 mils. However, because the contacts are fabricated from a highly elastic sheet, upon removal from contacting the PCB, the contact arm at point P1 can return to the same relative height with respect to the interposer surface as compared to before initial contact with the PCB board. The interposer can thus be disconnected from the PCB board and reconnected without a substantial reduction in working range, thus extending the usefulness of the interposer to applications in which disconnection and reconnection may be performed multiple times. FIG. 61 illustrates a load-displacement behavior for an exemplary contact fabricated in accordance with the present invention, illustrating a highly elastic response over repeated measurements.

Figure 62A:
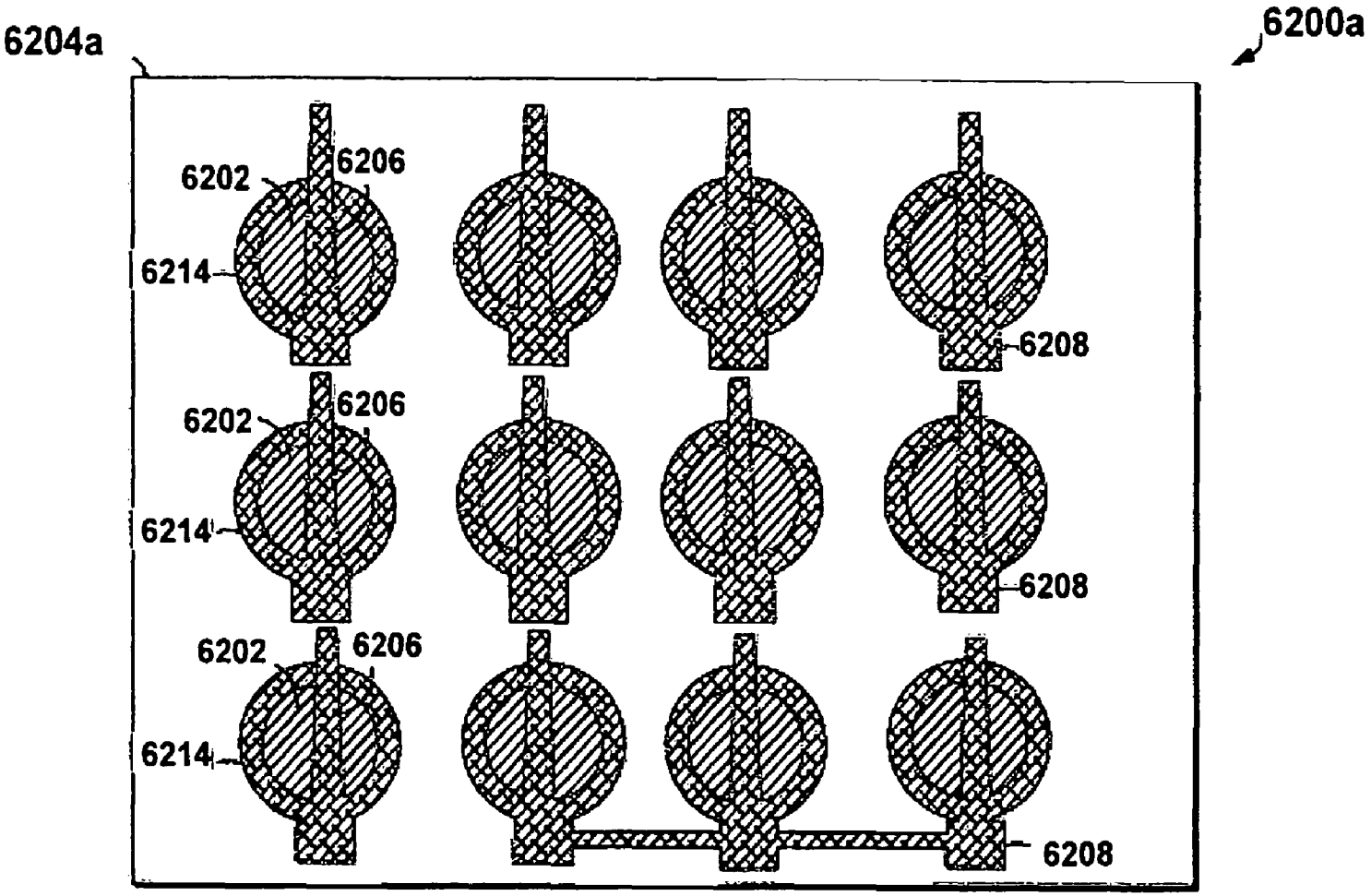
FIGS. 62*a* to 62*d* are schematic diagrams that illustrate in plan view alternative interposers according to further configurations of this invention.

FIGS. 62*a* to 62*d* illustrate alternative configurations of interposers in plan view that can be formed according to the steps outlined in FIGS. 3, 5*a*, and 5*b*. Interposers 6200*a-d* include conductive vias 6202 that extend through respective insulating substrates 6204*a-d*. Contact arms 6206 project above the plane of respective substrates 6204*a-d*, in a fashion similar to that shown in FIG. 11 for contacts 1114. An annular shaped conductive path 6214 surrounds each conductive via 6202 on the surface of the substrate, similar to conductive path 1112 of FIG. 11. Contact base portions 6208, in turn, make electrical contact with conductive paths (horizontal traces) 6214. The paths 6214 can be, for example, portions of a pre-existing metal cladding that are not covered with an adhesive layer in the regions surrounding the via (see FIG. 11). Conductive paths 6214 can be formed by selective plating the regions immediately surrounding vias. In FIG. 62*a*, contact arms 6206 extend over the corresponding conductive vias 6202 to which they are connected by conductive paths 6214. As compared to contacts illustrated in FIGS. 20*a*-23 and 10*a-c*, which generally are centered over vias, the arrangements of contacts illustrated in FIGS. 62*a-d* afford the ability to make much longer contact arms for a given array pitch. This is because, as illustrated in FIGS. 20*a*-23 and 10*a-c*, the length of contact arms centered over a via is generally comparable to or smaller than the via diameter, whereas the contact arms illustrated in FIGS. 62*a-d* have portions that extend over planar portions of their respective substrates (that is, not over the vias) so that their length can be much larger than the via diameter, often comparable to the via separation (pitch).

Figure 62B:
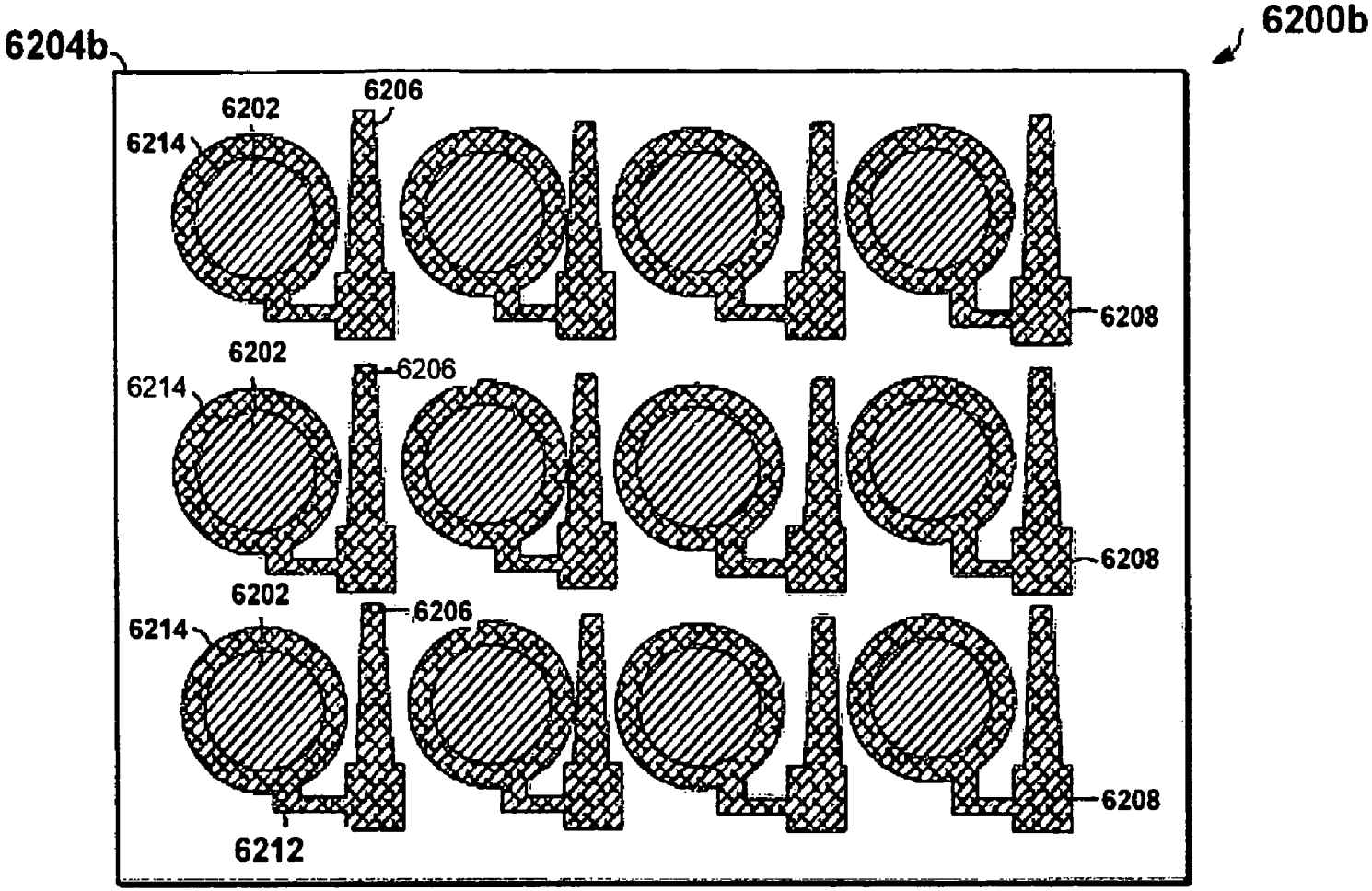

FIG. 62*b* illustrates a configuration in which contact arms 6206 do not extend over conductive vias 6202. Conductive paths 6214 include an L-shaped portion extending from the annular portion that serves to electrically connect contact bases 6208 and respective conductive vias 6202.

Figure 62C:
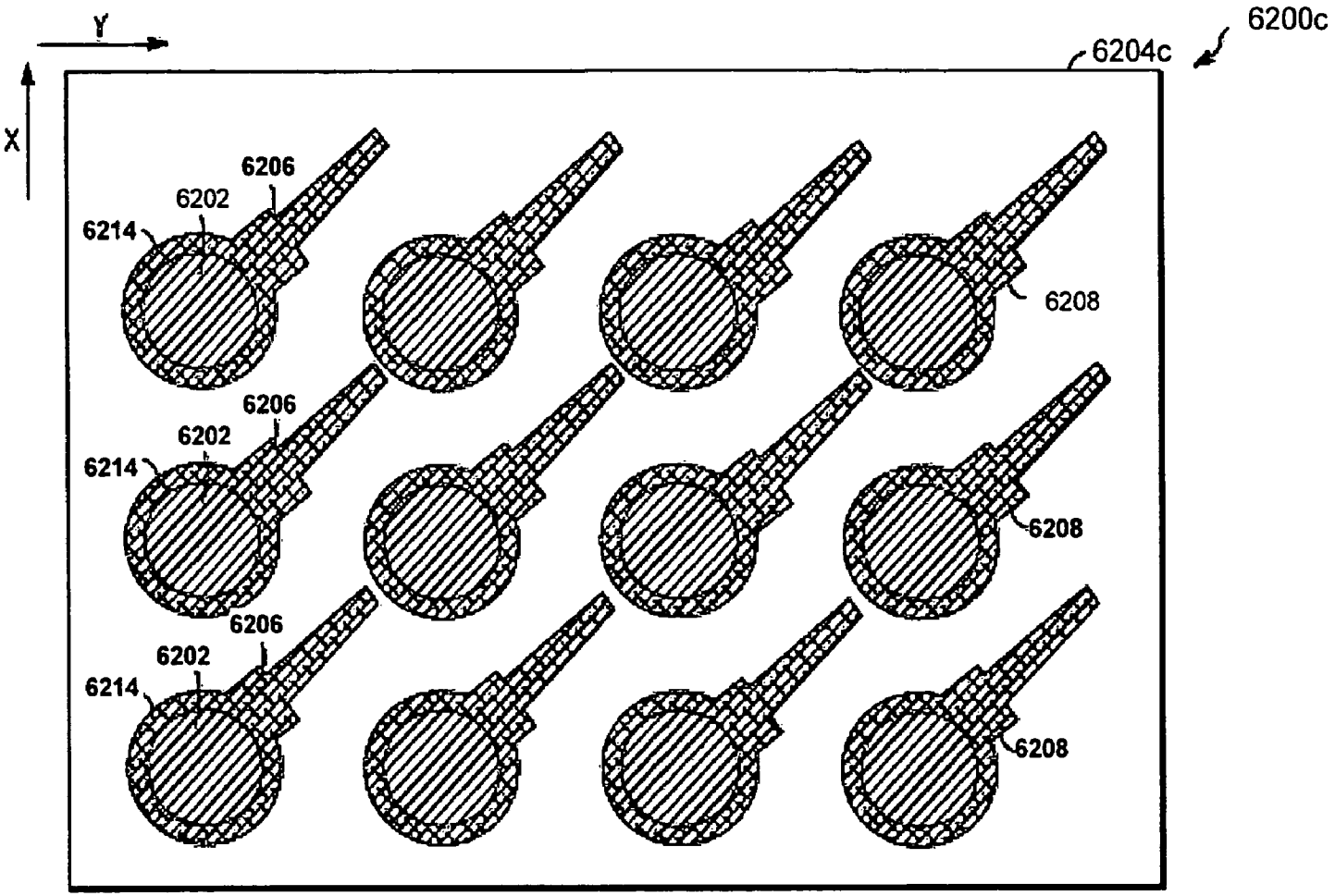

FIG. 62*c* illustrates a configuration in which contact arms 6206 extend from their respective base portions away from conductive vias 6202 to which they are electrically connected. In addition, the longitudinal direction of contact arms 6206 extends at about a 45 degree angle (from a plan-view perspective) with respect to "X" and "Y" directions of the conductive via array. This allows contact arms 6206 to extend a further distance without extending over conductive vias 6202, than if the contacts were oriented between vias along an X- or Y-direction. Thus, if the array pitch is defined as the distance along the X- or Y-directions between nearest neighbors (the array pitch in this case is the same for either contacts or vias), the contact length can actually exceed the array pitch, since the diagonal distance along a square array is a factor of 1.41 times the array pitch. For other orthogonal arrays (rectangular arrays), having two different pitches corresponding to mutually orthogonal directions, the length of the diagonal also exceeds the length of the longer of the two array pitches. Thus, in configurations of this invention, a contact arm length can be increased by orienting the arm at an angle with respect to X- or Y-axes of an array.

Thus, referring again to FIG. 62*b*, in one variation of the method of FIG. 3, conductive paths 6214 that comprise annular conductive portions surrounding conductive vias are formed in step 302. In the bonding step 308, a spring sheet containing non-singulated contacts is placed on substrate 6204*b*, such that continuous portions of the spring sheet extend from each contact to a conductive path 6214 of a via 6202. After contact singulation in step 312, conductive paths 6212 that extend between contact bases 6208 and vias 6202, are formed by etching the spring sheet in the shape of the conductive path 6212 and base 6208. As noted above, the blanket spring sheet containing unsingulated contacts can be previously electrically connected to the via by electroplating regions surrounding the via to join the via and spring sheet across the insulating adhesive layer.

Contact arm 6206 and conductive path 6212 normally comprise the same spring sheet material. Thus, during patterning of a resist layer used to define singulated contacts, contact arms 6206, base portions 6208, and conductive paths 6212 would be covered with resist after exposure and development, and remain unetched during the etch process that removes spring sheet material between each contact. Conductive path 6212 accordingly constitutes a narrow portion of the etched spring sheet.

Figure 62D:
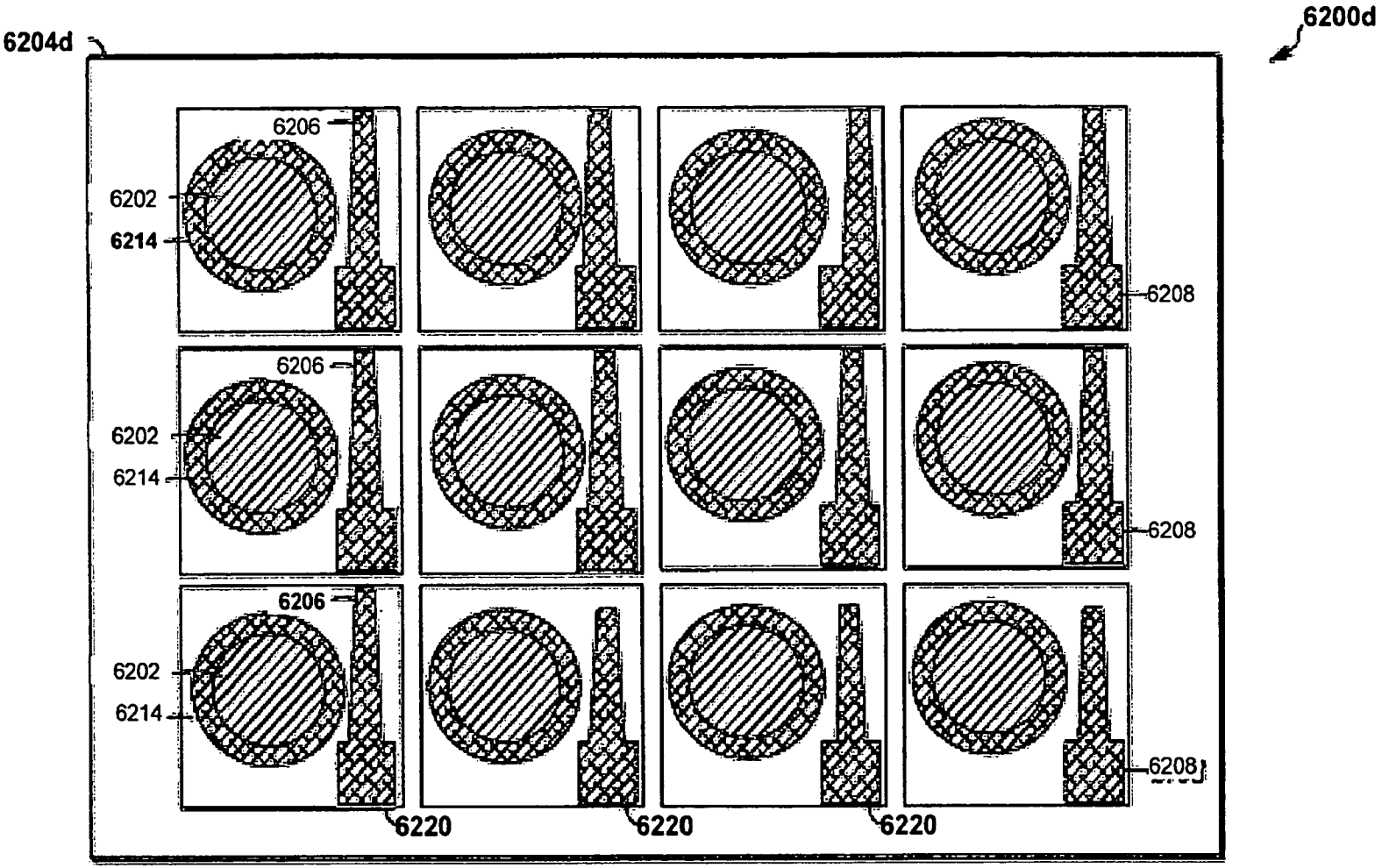

FIG. 62*d* illustrates another contact arrangement 6200*d*, according to an additional configuration of the present invention. Conductive capture pads 6220 that surround vias 6202 may be separated from base portions 6208 by an adhesive layer (see, e.g., layer 1120 of FIG. 11). In this configuration, electrical connection between contact base portions 6208 and vias 6202 can be made by removing a small portion of the adhesive layer (not shown) to expose pad 6220 in the region of base 6208 and forming a connection between the base and pad during an plating step.

Figure 63:
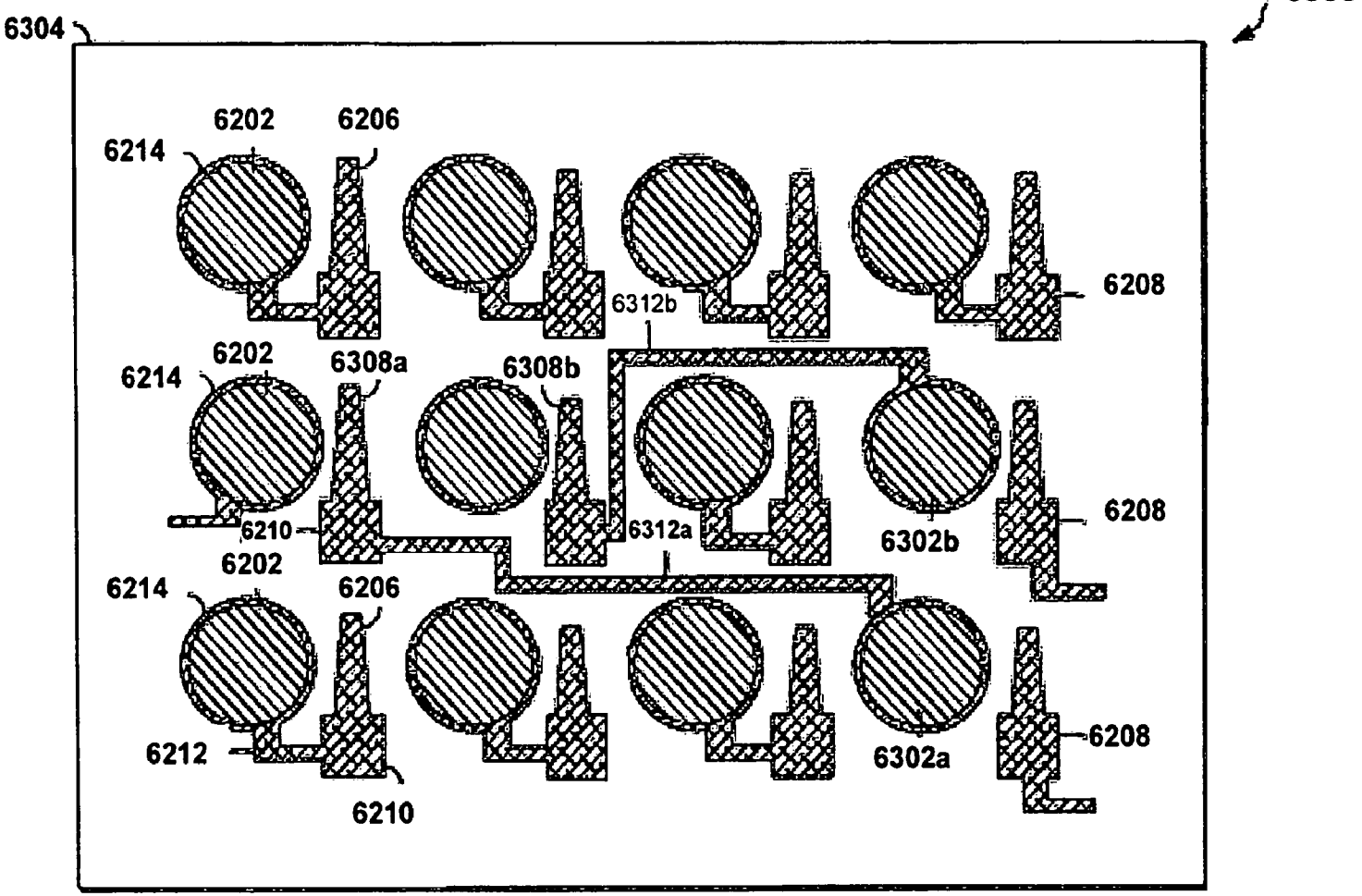
FIG. 63 is a schematic diagram that illustrates an interposer having two contacts each remotely connected to a conductive via, according to another configuration of this invention.

In other configurations of this invention, selected elastic contact arms from an array of contacts can be more remotely coupled to contact vias, wherein a conductive path extends over a further distance on an interposer substrate surface. For example, a "circuit" pattern of conductive paths can be formed in which a plurality of conductive paths each terminates at a conductive via on one end and a base of an elastic contact at the other end. However, the contact base need not be adjacent or even near the conductive via to which it is electrically coupled using the conductive path. FIG. 63 illustrates interposer 6304 having two contacts 6308*a*, 6308*b* each remotely connected to a respective conductive via 6302*a*, 6302*b* through conductive paths 6312*a*, 6312*b*, respectively, according to another configuration of this invention.

Figure 64A:
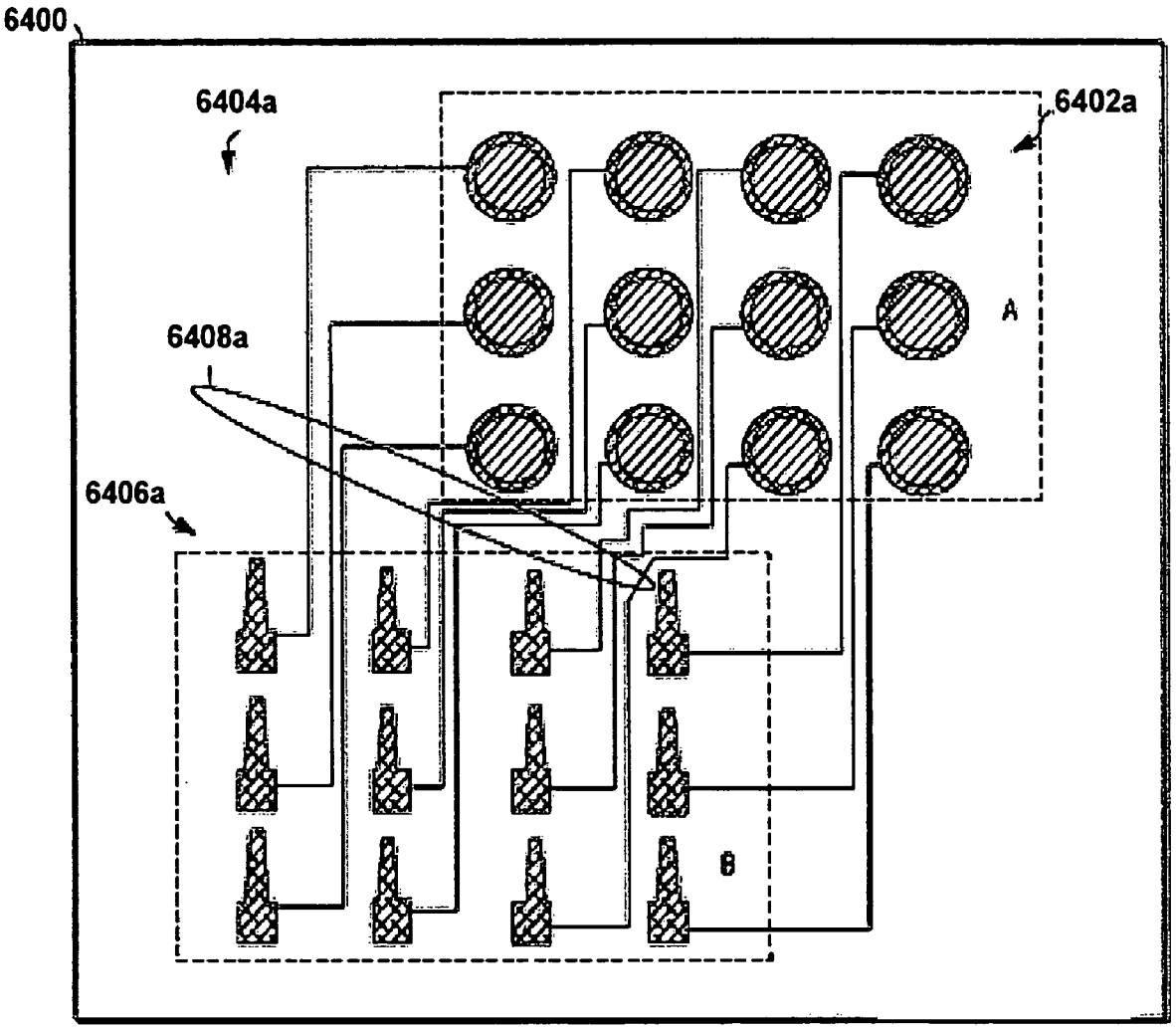
FIG. 64*a* is a schematic diagram that illustrates an interposer that includes a conductive via array arranged in a first region of insulating substrate and a contact array arranged in a second region of substrate.

In other configurations of this invention, a plurality of contacts can be arranged as a group in a first portion of a substrate surface, while a plurality of conductive vias is arranged in a second portion of a substrate. FIG. 64*a* illustrates an interposer 6400 that includes a conductive via array 6402*a* arranged in a first region of insulating substrate 6404*a*, and a contact array 6406*a* arranged in a second region of substrate 6404*a*. Contact array 6406*a* is electrically connected to conductive via array 6402*a* through conductive paths that form a circuit 6408*a*, which includes a plurality of conductive lines. Each conductive line terminates at a conductive via on one end and an elastic contact on the other end. In other configurations of this invention, the circuitry of conductive paths can be arranged so that multiple elastic contacts can be electrically connected to a common conductive via, and, alternatively, multiple conductive vias can be electrically connected to a common elastic contact.

The process illustrated in FIGS. 3, 5*a*, and 5*b* provides for flexibility in establishing the positional relationship between elastic contacts and respective conductive vias. Such flexibility provides the ability to tailor an interposer to the structure of components to be connected by the interposer. For example, for components having a similar planar dimension to the interposer, a first component to be connected to one side of an interposer may have all the active electrical devices (with respective electrical leads) arranged in one region of the component surface. The first component may be designed to be reversibly connected through a spring connection, so that it can be contacted by an array of elastic contacts in a first region of an interposer (see region A of FIG. 64*a*). A second component to be connected to the opposite side of the interposer may have devices grouped in a different region with respect to the first region. The second group can be designed to couple to the interposer through a solder connection at vias, such that a via array of the interposer can be arranged over the second region (see region B of FIG. 64*b*).

Because elastic contact portions of contacts are independently spatially configurable in their position and direction with respect to the array of conductive vias to which the contacts are electrically coupled, interposers with superior properties can be fabricated in accordance with aspects of this invention. For example, the pitch of contacts in a contact array affixed to an interposer surface can be different than the pitch of a conductive via array. In such case, where an interposer is used to interconnect a first component having the pitch of the contact array with a second component having the pitch of the conductive via array, it may be convenient to arrange the contact array in a separate portion of the substrate from the conductive via array (see FIG. 64*b*).

In addition, for any given pitch of an external component to be connected to the interposer, the direction that contact arms extend from a contact base can be arranged to maximize the contact arm length (and therefore the working distance) for the given pitch. Thus, contact arms can be arranged in an elastic sheet, such that the arms extend in a diagonal direction with respect to a square or rectangular array.

By providing a highly elastic contact arm, a contact array with a larger working distance can be fabricated. In applications in which reversible contact of the interposer to external components is desired, the additional ability to provide a relatively longer contact arm for a given array pitch affords a greater "reversible working range." The term "reversible working range" refers to a range (such as a distance range) through which an interposer contact (or contact array) can be reversibly displaced while meeting specified criteria for performance, such as electrical conductivity, inductance, high frequency performance, and mechanical performance (such as a requirement that external applied force be below a certain value). Reversibility denotes that the working range of the contact (array) is preserved when the contact arms of the contact array are brought into contact with an external device, compressed, released from contact, and subsequently brought back into contact with an external device. Thus, a contact having a reversible working range of about 20 mil would maintain acceptable properties, such as conductivity and inductance, throughout a distance of 20 mil while being compressed and released repeatedly.

The working range or reversible working range of elastic contacts arranged in an array can be further expressed in terms of the pitch of the array. Configurations of the present invention provide interposers whose array pitch and contact size are generally scalable from an array pitch of about 50 mils down to an array pitch of microns or less. In other words, the processes for making the contact arrays and via arrays can be scaled down from current technology (~1-2 mm pitch) at least by a factor of 10-100. Accordingly, as the contact array pitch decreases, contact size and working range may decrease. For a given array pitch, the normalized working range is defined as the working range divided by the pitch. The normalized working range is similar to the elasticity to size ratio mentioned above. However, the former parameter refers to a ratio of an elastic displacement range of a contact arm as compared to the length (size) of the elastic contact arm, whereas the normalized working range is a measure of the relative displacement range of elastic contacts (in which properties of interest are acceptable) as compared to the space between contacts (pitch). Because configurations of this invention provide elastic contacts whose length can exceed the array pitch (see discussion with respect to FIG. 62*c*), the vertical range of displacement of a contact arm (equal to the working range at the limit) can attain a large fraction of the size of the array pitch. For example, if a contact arm at rest above the interposer substrate forms an approximate 45 degree angle viewed in cross section, the height of the distal end of the contact above the substrate is about 0.7 times its length. Accordingly, when the contact arm is brought into contact with an external component, its range of travel can approximate the value of 0.7 times the contact length before the contact arm encounters the substrate surface. In this case, if the contact arm length is designed to lie along an array diagonal (and has a length about a factor of 1.2-1.4 times the array pitch), the normalized displacement achievable (equivalent to an upper limit on the normalized working range) would be in the range of 0.8-1.0. In practical implementations of this invention, normalized working ranges between about 0.25 and at about 1.0 are possible.

In configurations of this invention employing BeCu, spring steel, or another highly elastic conductive material, the yield stress is designed to exceed the displacement force applied to a contact arm when the contact arm is displaced through its maximum displacement. Accordingly, after an interposer whose contacts are displaced to the maximum extent is released from contact with an external component, the height of the distal end of the contact arms above the interposer substrate surface can be maintained through repeated contact with external electrical components. This is because the contact arms have a relatively larger elastic range, and are therefore subject to little or no plastic deformation (yield) during repeated loading of an external component. In other words, the contacts exhibit an elastic response over the entire working range, such that the contacts do not exhibit plastic yielding up to the point at which the contacts cannot be displaced further. Accordingly, the normalized reversible working range (defined as the normalized working range divided by the array pitch) of elastic contacts can be in the range of 0.25 to 0.75 for configurations of this invention. For 1.12 mm array pitch, a reversible working range of about 0.3 mm to 1.0 mm is possible for contacts arranged according to configurations of the present invention.

In other configurations of this invention, a contact array having N number of contacts can be aligned on top of a substrate surface having a M number of vias. In such an arrangement, not every via would uniquely couple to contact, if M>N, or not every contact would uniquely couple to a via if M<N. In some configurations of this invention, elastic contacts are aligned to vias such that a contact extends over a via, as illustrated in FIG. 9. However, in other configurations of this invention, the contacts may be arranged so that elastic arm portions do not extend over conductive vias. For example, referring again to FIG. 11, elastic portions 1116 can be arranged to extend to the right so that portions 1116 lie over substrate 1104 rather than over conductive vias 1102. In other configurations of this invention, elastic contact arms, such as portions 1116 can be arranged such that, when considered in plan view, no portions of the contact arms overlap conductive vias.

In some configurations of this invention, elastic contacts such as those illustrated in FIGS. 4 and 62*a*-64*b* can be arranged on both sides of an interposer, while in other configurations the contact arrays are only arranged on one side of a connector. In addition, different configurations of contact arrays can be arranged on opposite sides of an interposer. For example, in one configuration of this invention, a first side of an interposer contains a "local coupling" of contacts and conductive vias, such as illustrated in FIG. 62*a*, while an opposite side of the interposer contains a "remote coupling" of contacts and conductive vias, as illustrated in FIG. 64*a*. It will be understood that this invention includes configurations in which other combinations of single contacts, irregularly spaced contacts, and multiple arrays of contacts can be arranged on one side of an interposer, and connected in combinations of remote and local coupling to respective conductive vias.

Figure 64B:
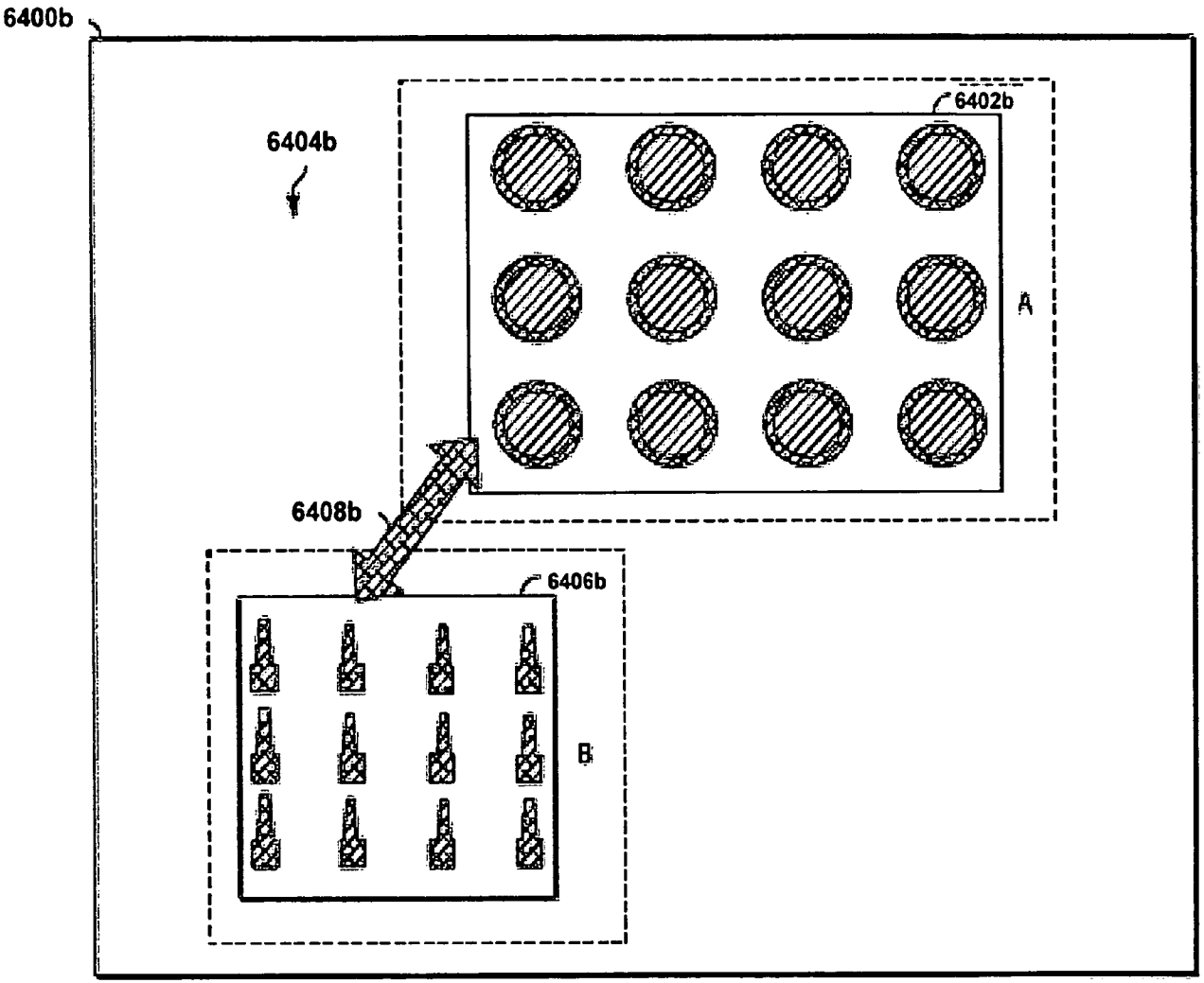
FIG. 64*b* is a schematic diagram that illustrates another interposer that includes an elastic contact array and an array of conductive vias having a second pitch, according to another configuration of this invention.

In another configuration of the present invention, as illustrated in FIG. 64*b*, an interposer 6400*b* for connecting two components includes an elastic contact array 6406*b* arranged in a first region of insulating substrate 6404*b* and having a first pitch, wherein the contact array is electrically coupled (via conductive paths 6408*b*) to an array of conductive vias 6402*b* arranged in a second region of insulating substrate 6404*b* and having a second pitch different from the first pitch. Accordingly, the interposer can be used to electrically interconnect a first electrical component having electrical contact points spaced according to the first pitch and a second electrical component having electrical contact points spaced according to the second pitch. For example, the conductive via array might couple to a pin array in a second component having the second pitch, while the elastic contacts couple to a ball array of the first component having the first pitch.

In FIGS. 62*b*, 63, 64*a*, and 64*b*, conductive paths that connect respective elastic contacts to conductive vias may reside on the top surface of an interposer. However, in some configurations of the present invention, the conductive paths, for example paths 6408*a* depicted in FIG. 64*a*, can be formed and embedded within an interposer below the surface, such that the ends of each conductive path still form an electrical connection to respective vias or elastic contacts. For example, a conductive line 6408*a* can be embedded below the surface of substrate 6404*a* and rise to the substrate surface at one end to connect to an elastic contact base in array 6406*a*. At the opposite end of the same conductive line 6408*a*, the conductive line can connect to a conductive via of array 6402*a* at, for example, a conductively plated vertical wall at a region below the substrate surface or on the surface.

Additionally, because lithographic patterning of contact arrays is performed independent of the interposer substrate structure, the contact arrays can be arranged in any desirable configuration with respect to interposer substrate conductive vias. Thus, an array of contacts where each contact is electrically connected to a given via in an array of vias, need not be located adjacent to that array of vias. This affords flexibility in design of the contact size and shape, since the contacts arms can in principle be designed to be much larger than a via diameter, for example. This affords a larger vertical working distance in comparison to arrangements where contact arms are located over vias.

In further configurations of the present invention, heterogeneous contacts are provided on a same side of a substrate, such as an interposer. One example of a heterogeneous contact arrangement is an array of contacts whose contact arm length varies between contacts. For example, a contact array can comprise two mutually interspersed contact sub arrays in which every other contact have mutually the same contact arm length and adjacent contacts have differing contact arm length.

Figure 65A:
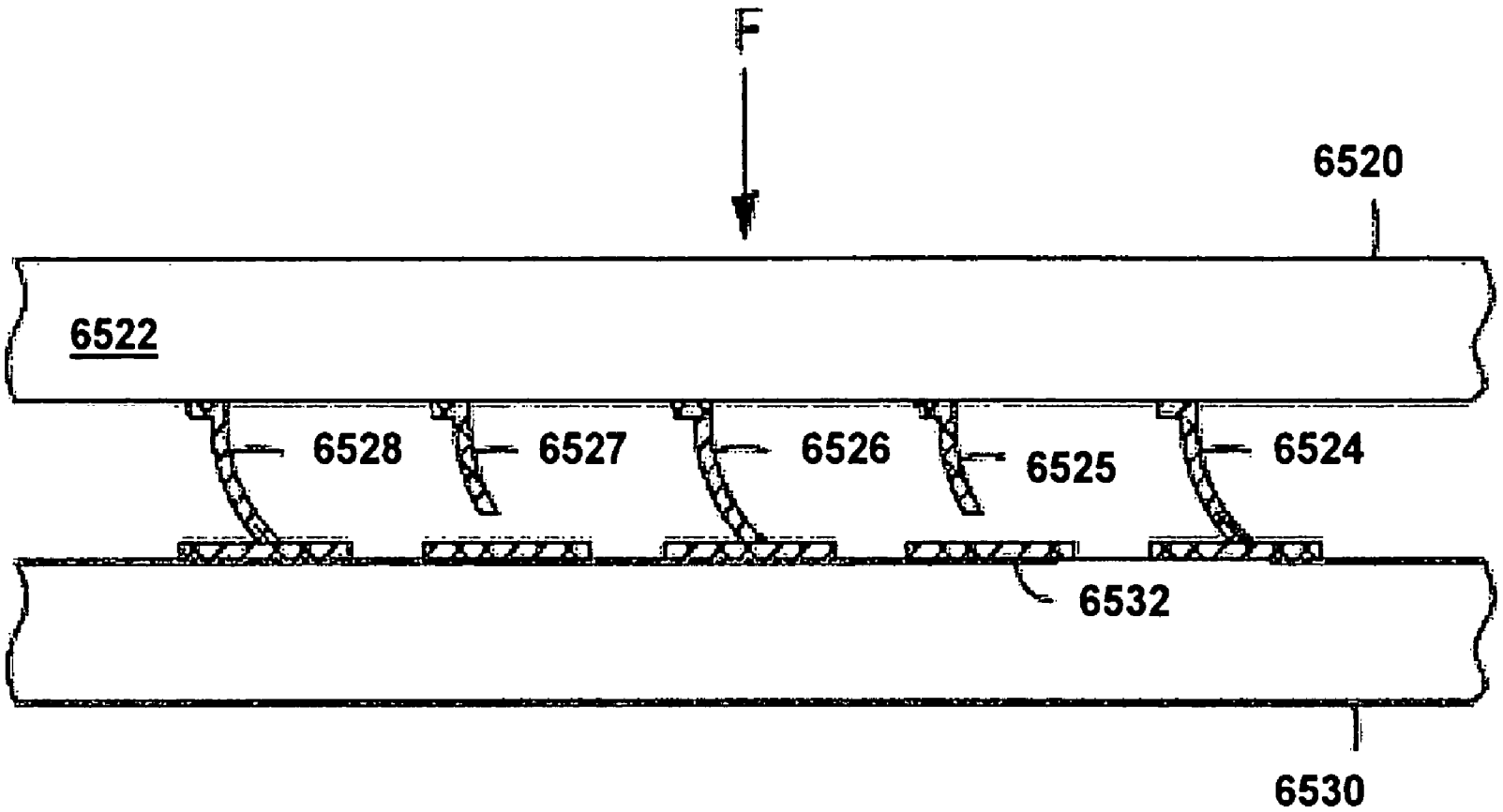
FIGS. 65*a* and 65*b* are schematic diagrams that cross-sectional views of a connector, according to an alternate embodiment of the present invention.
Figure 65B:
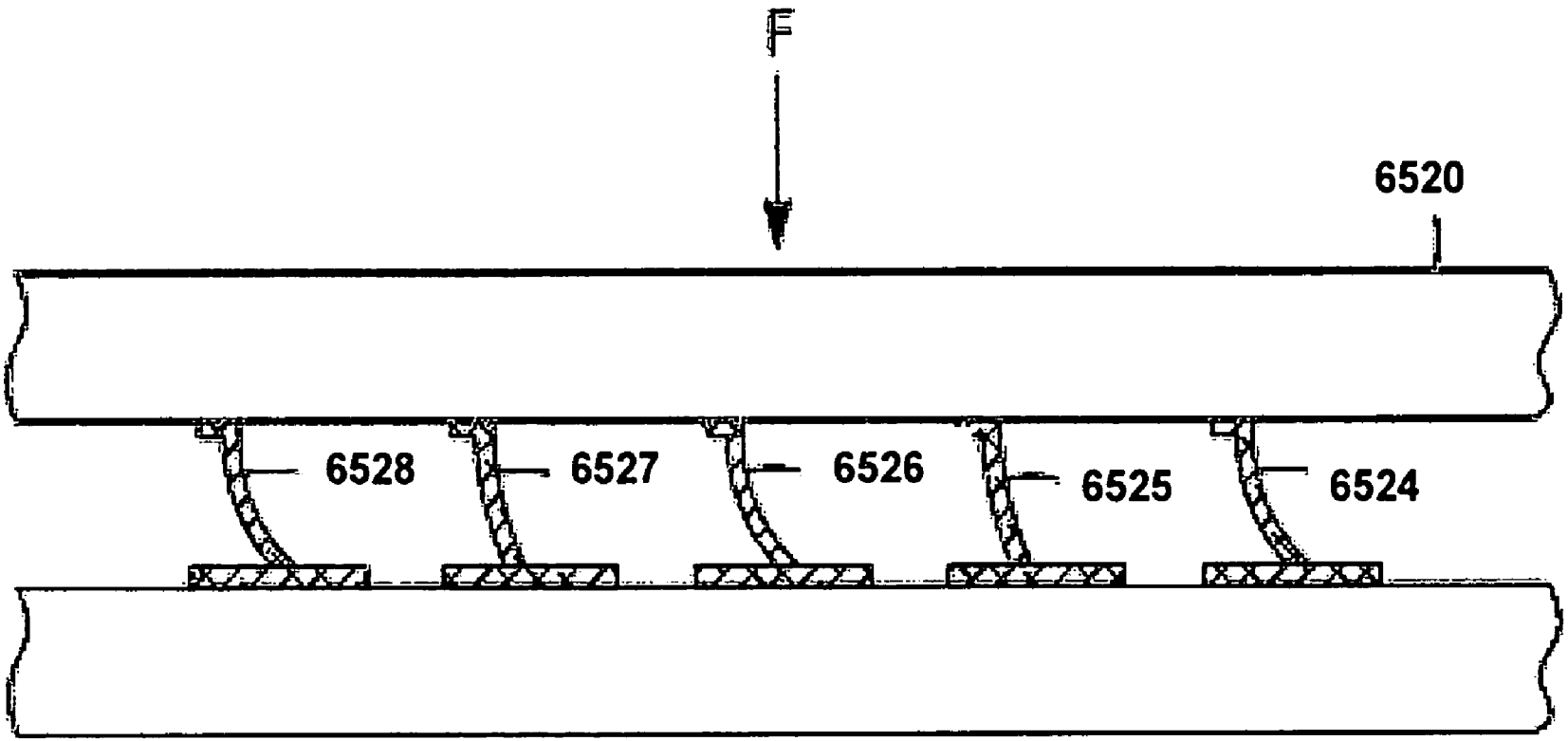

FIGS. 65*a* and 65*b* are cross-sectional views of a connector according to an alternate configuration of the present invention. Referring to FIG. 65*a*, a connector 6520 includes a first set of contact elements 6524, 6526 and 6528 and a second set of contact elements 6525 and 6527, all formed on a substrate 6522. The first set of contact elements 6524, 6526 and 6528 has a curved spring portion longer than the curved spring portion of the second set of contact elements 6525 and 6527. In other words, the height of the curved spring portion of contact elements 6524, 6526 and 6528 is greater than the height of the curved spring portion of contact elements 6525 and 6527.

By providing contact elements having different height, connector 6520 of the present invention can be advantageously applied in "hot-swapping" applications. Hot-swapping refers to mounting or demounting a semiconductor device while the system to which the device is to be connected is electrically active without damaging to the semiconductor device or the system. In a hot-swapping operation, various power and ground pins and signal pins must be connected and disconnected in sequence and not at the same time in order to avoid damages to the device or the system. By using a connector including contact elements with different heights, taller contact elements can be use to make electrical connection before shorter contact elements. In this manner, a desired sequence of electrical connection can be made to enable hot-swapping operation.

As shown in FIG. 65*a*, connector 6520 is to be connected to a semiconductor device 6530 including metal pads 6532 formed thereon. When an external biasing force F is applied to engage connector 6520 with semiconductor device 6530, the tall contact elements 6524, 6526 and 6528 make contact with respective metal pads 6532 first while shorter contact elements 6525 and 6527 remain unconnected. Contact elements 6524, 6526 and 6528 can be used to make electrical connection to power and ground pins of semiconductor device 6530. With further application of the external biasing force F (FIG. 65*b*), shorter contact elements 6525 and 6527, making connection to signal pins, can then make connection with respective metal pads 6532 on device 6530. Because the contact elements of the present invention have a large elastic working range, the first set of contact elements can be further compressed than the second set of contact elements without compromising the integrity of the contact elements. In this manner, connector 6520 enables hot-swapping operation with semiconductor device 6530.

As described above, when the contact elements of the connector of the present invention are formed using semiconductor fabrication processes, contact elements having a variety of mechanical and electrical properties can be formed. In particular, the use of semiconductor fabrication processing steps allows a connector to be built to include contact elements having different mechanical and/or electrical properties. Such "semiconductor" fabrication processes nevertheless can be employed in conjunction with substrates, such as PCB substrates, to form elastic contact arrays having contact sizes larger than the typical micron or sub-micron sizes typical of present day semiconductor devices. For example, the processes illustrated, for example, in FIGS. 16*a*-19*h*, can be used to form contact arrays on PCB-type substrates having array pitches in the range of about 10-100 microns.

Thus, according to another aspect of the present invention, a connector of the present invention is provided with contact elements having different operating properties. That is, the connector includes heterogeneous contact elements where the operating properties of the contact elements can be selected to meet requirements in the desired application. In the present description, the operating properties of a contact element refer to the electrical, mechanical and reliability properties of the contact element. By incorporating contact elements with different electrical and/or mechanical properties, the connector of the present invention can be made to meet all of the stringent electrical, mechanical and reliability requirements for high-performance interconnect applications.

According to one aspect of the present invention, the following mechanical properties can be specifically engineered for a contact element or a set of contact elements to achieve certain desired operational characteristics. First, the contact force for each contact element can be selected to ensure either a low resistance connection for some contact elements or a low overall contact force for the connector. Second, the elastic working range of each contact element over which the contact element operates as required electrically can be varied between contact elements. Third, the vertical height of each contact element can be varied. Fourth, the pitch or horizontal dimensions of the contact element can be varied.

According to alternate aspects of the present invention, the electrical properties can be specifically engineered for a contact element or a set of contact elements to achieve certain desired operational characteristics. For instance, the DC resistance, the impedance, the inductance and the current carrying capacity of each contact element can be varied between contact elements. Thus, a group of contact elements can be engineered to have lower resistance or a group of contact elements can be engineered to have low inductance.

In most applications, the contact elements can be engineered to obtain the desired reliability properties for a contact element or a set of contact elements to achieve certain desired operational characteristics. For instance, the contact elements can be engineered to display no or minimal performance degradation after environmental stresses such as thermal cycling, thermal shock and vibration, corrosion testing, and humidity testing. The contact elements can also be engineered to meet other reliability requirements defined by industry standards, such as those defined by the Electronics Industry Alliance (EIA).

When the contact elements in the connectors of the present invention are fabricated as a MEMS grid array, the mechanical and electrical properties of the contact elements can be modified by changing, for example, the following design parameters. First, the thickness of the curved spring portion of the contact element can be selected to give a desired contact force. For example, a thickness of about 30 microns typically gives low contact force on the order of 10 grams or less while a flange thickness of 40 microns gives a higher contact force of 20 grams for the same displacement. The width, length and shape of the curved sprint portion can also be selected to give the desired contact force.

Second, the number of curved spring portions to include in a contact element can be selected to achieve the desired contact force, the desired current carrying capacity and the desired contact resistance. For example, doubling the number of curved spring portions roughly doubles the contact force and current carrying capacity while roughly decreasing the contact resistance by a factor of two.

Third, specific metal composition and treatment can be selected to obtain the desired elastic and conductivity characteristics. For example, Cu-alloys, such as copper-beryllium, can be used to provide a good tradeoff between mechanical elasticity and electrical conductivity. Alternately, metal multi-layers can be used to provide both excellent mechanical and electrical properties. In one configuration, a contact element is formed using titanium (Ti) coated with copper (Cu) and then with nickel (Ni) and finally with gold (Au) to form a Ti/Cu/Ni/Au multilayer. The Ti can provide rigidity and high mechanical durability while the Cu can provide excellent conductivity as well as elasticity and the Ni and Au layers can provide excellent corrosion resistance. Finally, different metal deposition techniques, such as plating or sputtering, and different metal treatment techniques, such as alloying, annealing, and other metallurgical techniques can be used to engineer specific desired properties for the contact elements.

Fourth, the curvature of the curved spring portion can be designed to give certain electrical and mechanical properties. The height of the curved spring portion, or the amount of projection from the base portion, can also be varied to give the desired electrical and mechanical properties.

One feature of the above processes illustrated in particular in FIGS. 1 and 3A-3B is that the need for expensive tools to form contact structures is avoided. A great deal of contact design flexibility is afforded by the fact that two dimensional contact design is accomplished by well established computer-aided design. In other words, a mask or patterning process to form a desired contact structure can be designed using Gerber or other systems. Custom design can be performed or contact shapes can be selected from design libraries. Similarly, forming tools can be easily fabricated using designs that are matched to the contact array design of the spring sheet array to be formed. The lithographic techniques used for patterning spring sheets and/or forming tools are robust and inexpensive.

In the specific examples illustrated in FIGS. 4, 9*a*, 9*b*, 9*c*, 9*d*, 11 and 14 contact arms have the shape of rolling beams. By proper choice of material, contact shape design, and processing conditions, discussed further below, the performance of such contacts can be extended beyond that achievable by conventional contacts made for interposers. The contacts illustrated in FIG. 11, for example, can be engineered to be highly elastic, such that little or no fatigue occurs with repeated up and down displacement of the contacts during coupling and decoupling to an external device. Additionally, the length of the contacts can be designed independent of the via size or via spacing, so that larger working ranges (related to the vertical displacement range of the contacts) can be achieved in comparison to contacts formed directly over vias. Moreover, by proper choice of composition of a conductive sheet for forming the contact arms, and proper heat treatment of the contacts, as well as proper interposer design, the mechanical properties of the contact arms can be tuned to fit the desired application. For example, as discussed further below, the effective elastic modulus of the contacts as well as the elastic range can be varied by heat treatment of Cu alloys used to form the contact, as well as design of the region near the contact base.

The mechanical properties of the elastic contacts can be further tailored by engineering of the adhesive layer during the bonding process. Adhesive layers suitable for configurations of the present invention typically contain a polymer inner layer surrounded by epoxy layers on top and bottom. It has been experimentally determined that proper choice of adhesive layer can increase working range by about 0.5-1 mil for contacts having a working range on the order of 6-8 mils. In addition, by providing adhesive reservoirs acting as flow restrictors, in the substrate or spring sheet (see elements 910, 932, and 942 of FIGS. 9*a*, 9*c*, and 9*d*, respectively) superior contact properties are obtained after bonding. By proper design of such flow restrictors, the adhesive flow can be minimized. By preventing adhesive from flowing to the underside of a contact arm during bonding of a spring sheet, the flow restrictors facilitate fabrication of contact arms having a longer effective length. In other words, the point about which the contact arm rotates during downward displacement is effectively shorter when adhesive is located on the underside of the contact arms near the contact base (compare contacts 902 of FIGS. 9*a* and 9*b*). By ensuring no adhesive is located under the contact arm, thus extending the effective contact arm length, a greater displacement of a contact arm for a given load (stress) occurs, thereby reducing the possibility that the contact arm is subject to a yield stress before it reaches its maximum displacement.

The effect of tailoring the adhesive layer and flow restrictors adjacent to the adhesive layer is shown in FIGS. 66 and 67, which illustrate for contacts bonded with FR0111 and LF0111 adhesive materials, respectively, the measured working range for substrates having partially etched flow restrictors and fully etched flow restrictors. Changing adhesive material results in a change in working range of about 0.6-0.7 mil, while changing from a partially to fully etched flow restrictor induces a similar change in working range (See FIGS. 9*c* and 9*d* for a comparison of substrates having partially etched as opposed to fully etched flow restrictors).

Figure 68A:
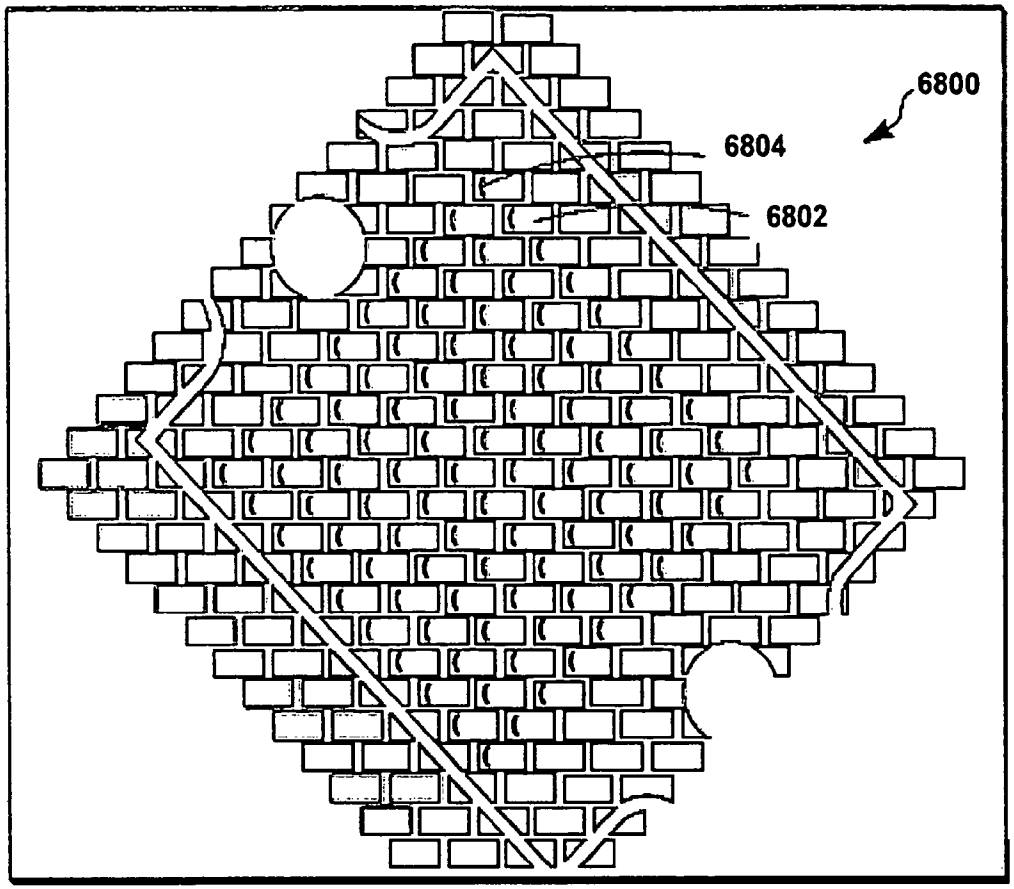
FIG. 68*a* is an image that illustrates, in accordance with a further configuration of this invention, a capture pad layout that includes pads having an arc-shaped slot configured to capture adhesive during a bonding process.

FIG. 68*a* illustrates, in accordance with a further configuration of this invention, a capture pad layout 6800 that includes pads 6802, each provided with an arc-shaped slot 6804 configured to capture adhesive during a bonding process. The slots are designed to form a concentric arc around a via (not shown). For example, a substrate provided with a metal cladding having the pattern of pads 6802 can have vias drilled through the substrate and located on each pad to be concentric with a given slot 6804. Contacts in a spring sheet to be bonded to the substrate can be arranged such that the contact arms extend from base portions located above the slots 6804. During bonding, adhesive that is forced toward the open via can be collected in a slot 6804 provided near the edge of the via.

Figure 68B:
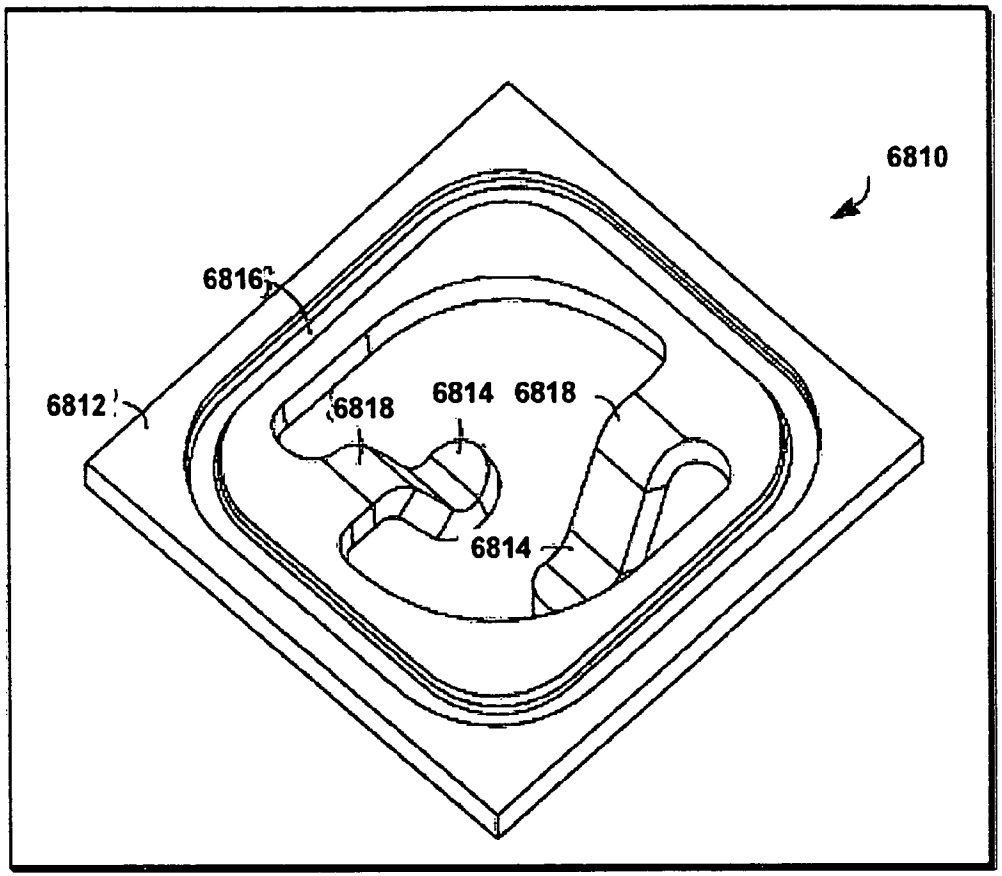
FIGS. 68*b* to 68*e* are schematic diagrams that illustrate, in perspective view, flow restrictor variations provided in exemplary contact structures, according to further configurations of the present invention.

FIGS. 68*b*-68*e* illustrate, in perspective view, flow restrictor variations provided in exemplary contact structures, according to further configurations of the present invention. In each figure, the upper contact surface shown represents the contact surface that is configured for bonding to a connector substrate. FIG. 68*b* illustrates a dual contact arm contact 6810 having a partially etched region 6816 forming a square-like depression within base portion 6812 and surrounding the region where contact arms 6814 join base 6812. When contact 6810 is bonded to a substrate, excess adhesive is accommodated within square depression 6816 that acts as a flow restrictor, preventing adhesive from flowing under regions 6818.

Figure 68C:
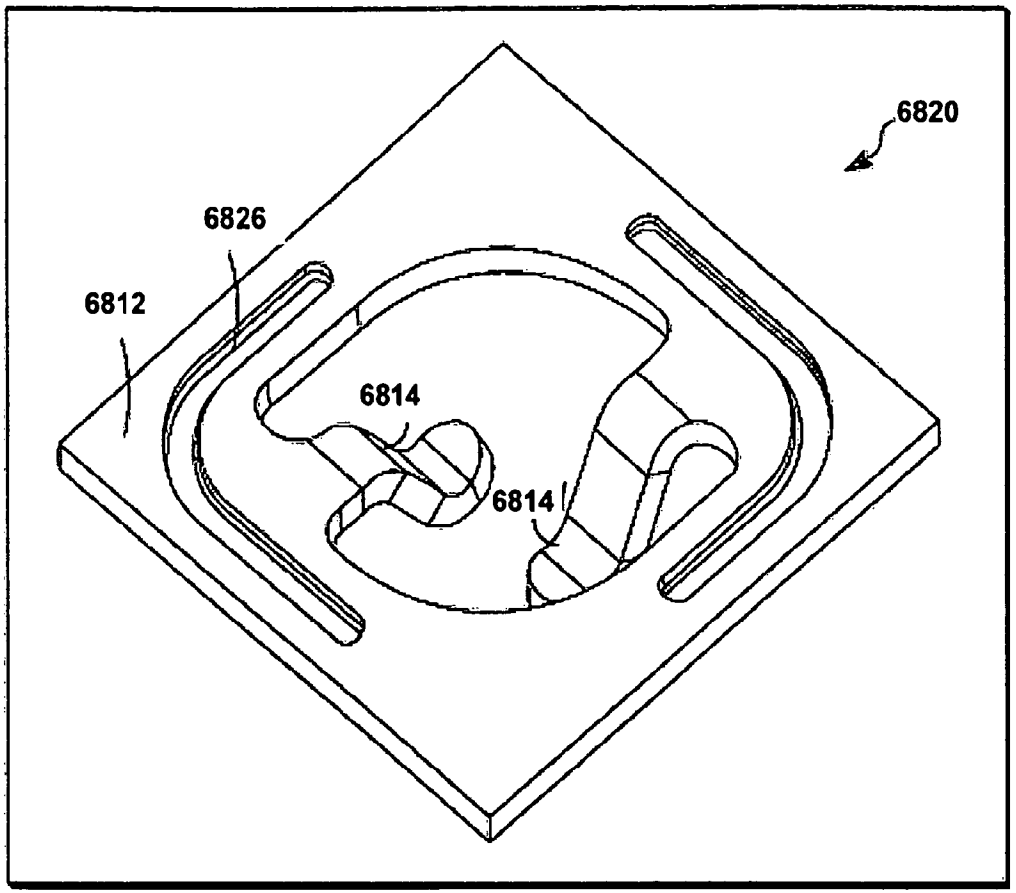

FIG. 68*c* illustrates a further contact structure 6820, in which flow restrictors 6826 are provided as two portions covering approximately one half of the square depression of regions 6816 and located adjacent to where contact arms 6814 join base 6812.

Figure 68D:
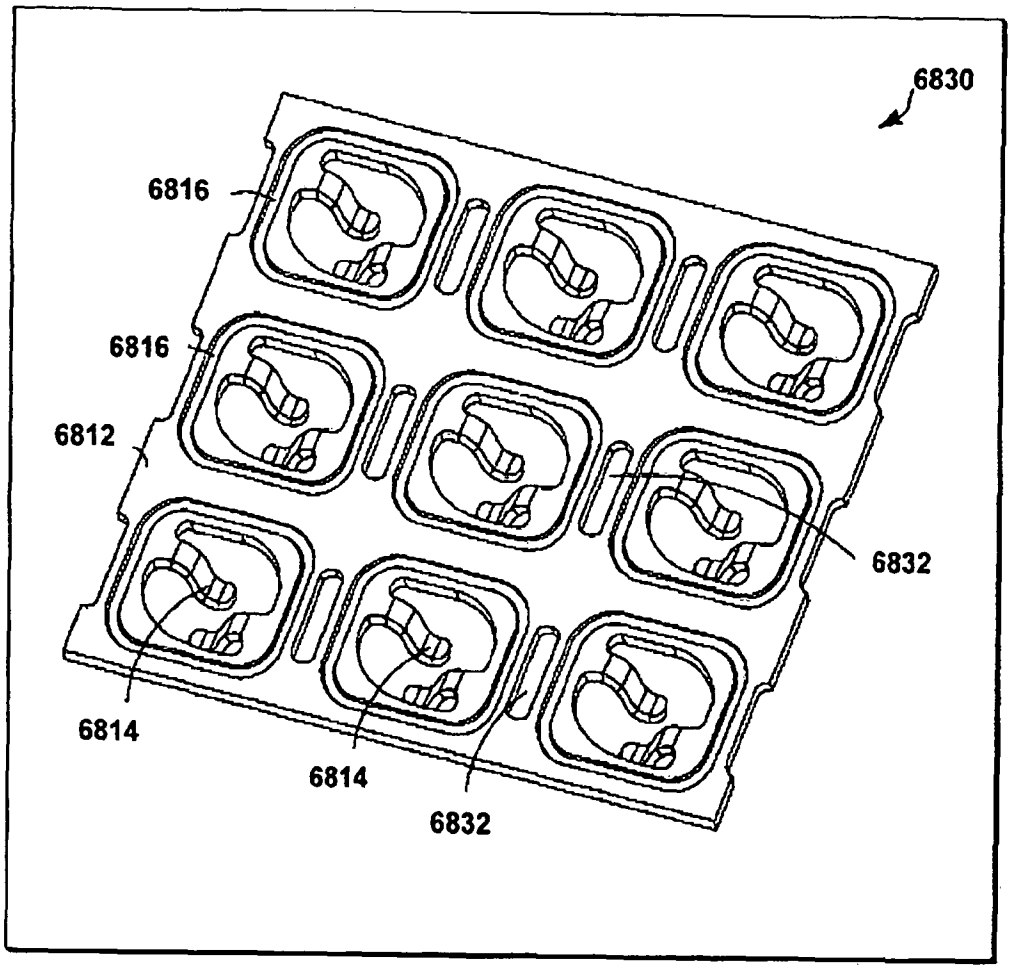

FIG. 68*d* illustrates a further contact structure 6830, illustrating an array of contacts that each include, in addition to partially etched flow restrictors 6816, fully etched oval regions 6832. Regions 6832 are each located adjacent to a portion of regions 6816 and near to regions in which contact arms 6814 join base portions 6812.

Figure 68E:
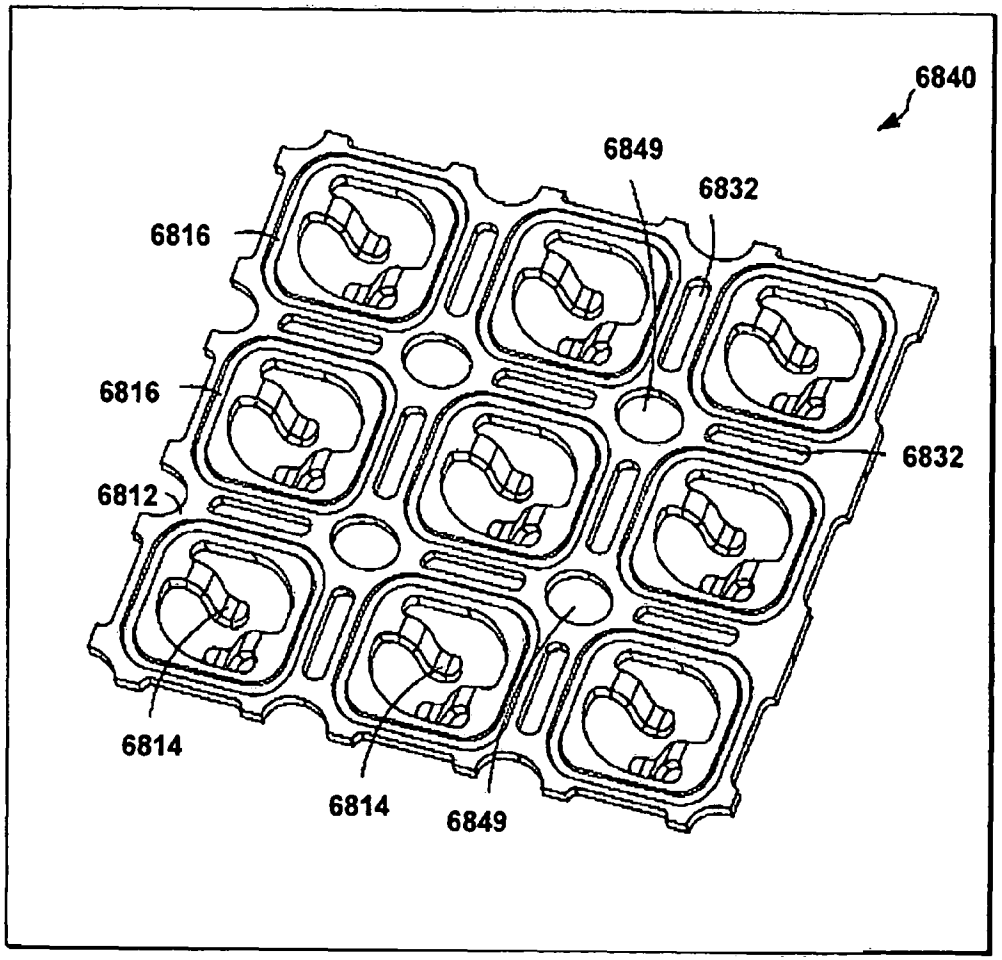

FIG. 68*e* illustrates another contact structure 6840, having features similar to those of contact structure 6830, with the addition of circular fully etched flow restrictors 6849 that are located in corner regions between contacts of the contact array.

Figure 69A:
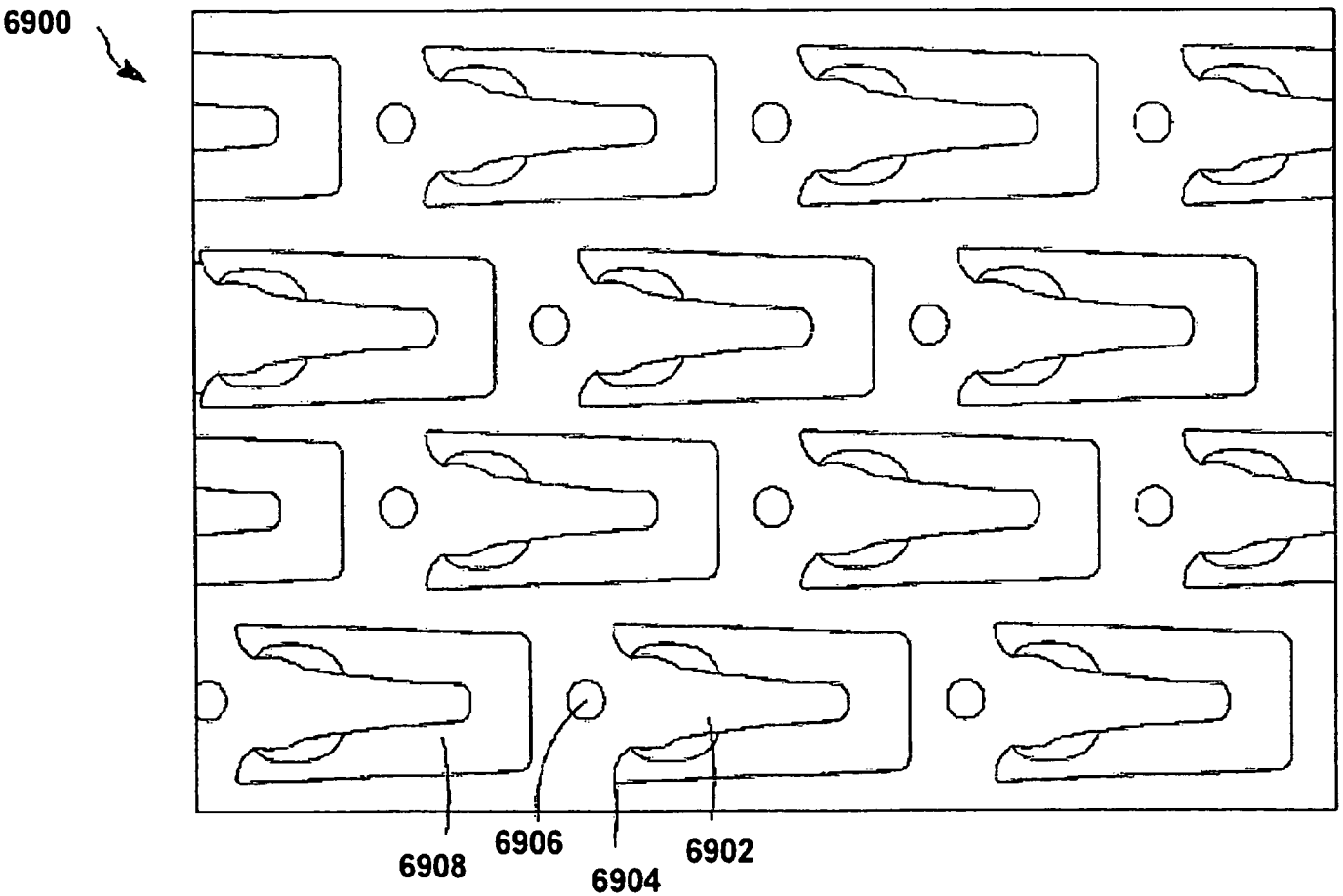
FIG. 69*a* is an image that illustrates a plan view of an exemplary contact arrangement according to a further configuration of this invention.

In addition, open through holes in the spring sheet can be provided to allow adhesive to flow up and over the top of the spring sheet. In one example, a contact structure includes a base portion provided with a hole within and around which adhesive material is disposed. In one configuration of this invention, the adhesive material has a rivet-like structure that forms by extrusion of adhesive through an aperture, such as a circular hole in the spring sheet, during bonding of the spring sheet to the substrate. The head of the rivet forms around the hole and acts to restrain the contact during mechanical deflection of the contact arm. FIG. 69*a* illustrates a plan view of an exemplary contact arrangement according to a further configuration of this invention. Arrangement 6900 includes an array of contacts 6902 whose base portions 6904 contain through holes 6906 that are configured to accommodate adhesive flow from an underlying adhesive layer 6908. Adhesive flowing through a circular hole 6906 can form a mound that extends (out of the page of FIG. 69*a*) above the plane of the base 6904 and extends beyond the outer diameter of the hole. When viewed in cross-section, as illustrated in FIG. 69*b*, the adhesive forms a mushroom, or rivet-like structure that serves to affix the base portion 6904 to the substrate 6910.

Figure 69B:
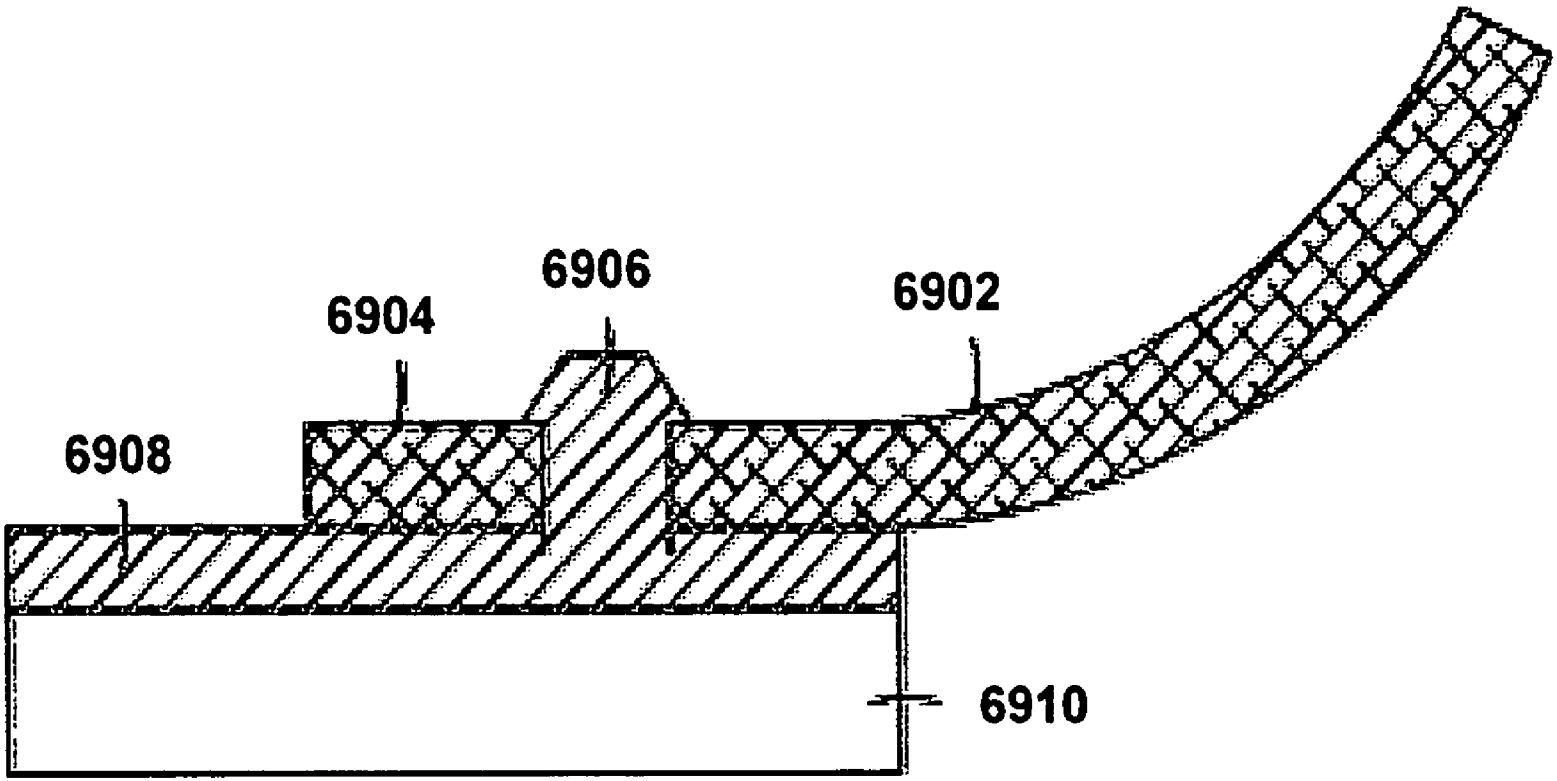
FIG. 69*b* is a schematic diagram that illustrates a cross-section view of a portion of the exemplary contact arrangement of FIG. 34*a*.
Figure 69C:
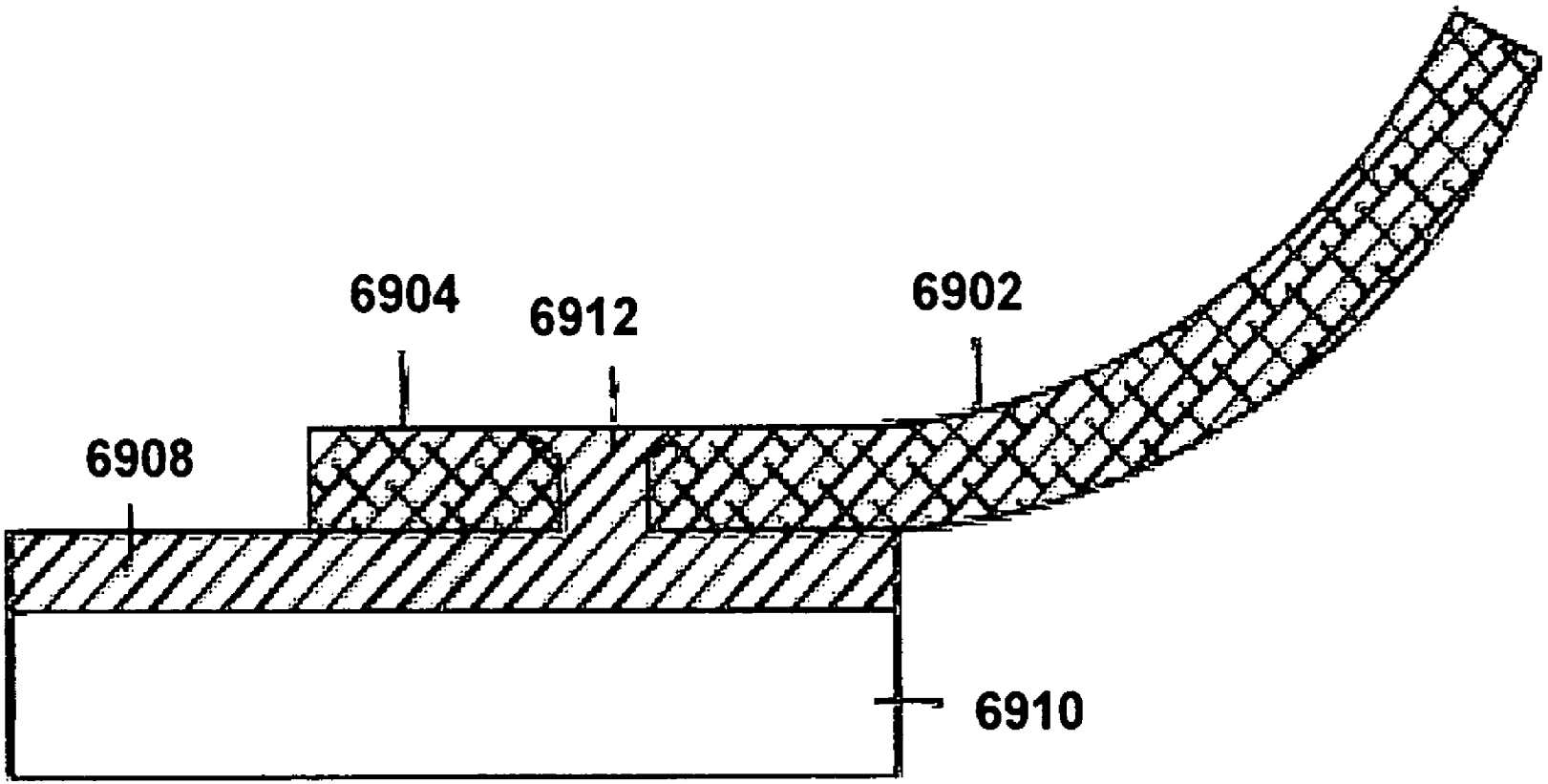
FIG. 69*c* is a schematic diagram that illustrates a variant of the contact structure of FIGS. 69*a* and 69*b*.

FIG. 69*c* illustrates a variant of the contact structure of FIGS. 69*a* and 69*b*, in which the top surface of the adhesive extruded within through hole 6912 does not substantially extend above the surface of the base. Because the through hole has a tapered cross section that increases in diameter towards the surface, the extruded adhesive portion 6910 forms a mechanical restraint to movement of the base without extending above the top surface of the base portion 6904. Such a cross-sectional shape can be imparted to a through hole etched in a spring sheet by use of isotropic etchants.

The adhesive rivet portion 6906 can also act as a hard stop that prevents an external component from hitting other portions of a substrate, such as substrate 6910. As contact arm 6902 is displaced downwardly by a feature in an external device toward substrate 6910, other portions of the external device may approach substrate 6910 in other locations. An array of rivets 6906 can act to prevent the other portions of the external component from approaching too closely to substrate 6910, and thereby prevent damage during coupling to the external component.

In other configurations of the present invention, portions of the adhesive layer displaced upwardly to form rises or bumps near the edge of vias can also act as hard stops, in this case for adjacent contact arms (see adhesive layer portion 934 in FIG. 9*c*). The top of the adhesive layer thus prevents the contact arm from extending too far in a downward direction and can thereby reduce the tendency of the contact arm to reach a yield strain (displacement) point.

Figure 70:
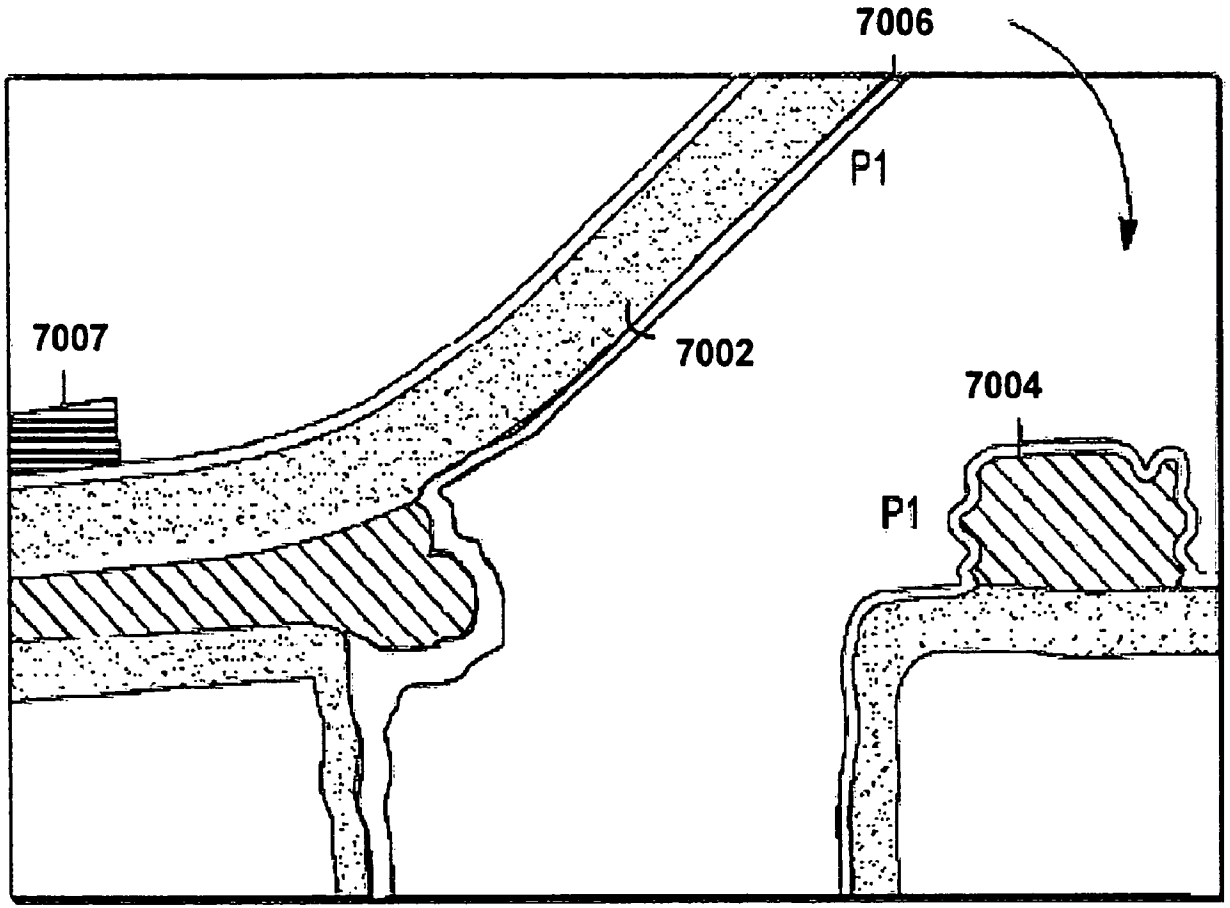
FIG. 70 is an image that illustrates a contact structure after forming conductive portions on top of an adhesive layer, according to one aspect of this invention.

In addition, the ability to raise the local surface level of the adhesive in given locations in the substrate provides a means to electrically shunt contacts during displacement of the contacts towards the substrate. After the formation stage illustrated in FIG. 9*c*, for example, an electroplating step takes place that coats exposed portions of the adhesive layer, with a conductive layer 7004 that can engage contact 7002, as illustrated in FIG. 70, leading to a smaller electrical path length and lower resistance. After the point P1 where the electrical shunting takes place, the distal end of contact arm 7006 can still be displaced downwardly.

Finally, the mechanical response of the contacts can be tailored by engineering a coverlay structure 7007 that is placed on top of portions of the contacts proximate to the contact arms.

Another advantage of using a formed sheet of springs to manufacture electrical connectors is that it facilitates geometries in which the contact element springs extend beyond the contact pitch as described in more detail below.

According to another aspect of the present invention, a connector is provided with contact elements having different operating properties. That is, the connector can include heterogeneous contact elements where the operating properties of the contact elements can be selected to meet requirements in the desired application. The operating properties of a contact element refer to the electrical, mechanical, and reliability properties of the contact element. By incorporating contact elements with different electrical and/or mechanical properties, a connector can be made to meet all of the stringent electrical, mechanical, and reliability requirements for high-performance interconnect applications.

According to alternate configurations of the present invention, the electrical properties can be specifically engineered for a contact element or a set of contact elements to achieve certain desired operational characteristics. For instance, the DC resistance, the impedance, the inductance, and the current carrying capacity of each contact element can be varied. Thus, a group of contact elements can be engineered to have lower resistance or to have low inductance. The contact elements can also be engineered to display no or minimal performance degradation after environmental stresses such as thermal cycling, thermal shock and vibration, corrosion testing, and humidity testing. The contact elements can also be engineered to meet other reliability requirements defined by industry standards, such as those defined by the Electronics Industry Alliance (EIA).

The mechanical and electrical properties of the contact elements can be modified by changing the following design parameters. First, the thickness of the spring portion of the contact element can be selected to give a desired contact force. For example, a thickness of about 30 microns typically gives a low contact force on the order of 10 grams or less, while a flange thickness of 40 microns gives a higher contact force of 20 grams for the same displacement. The width, length, and shape of the spring portion can also be selected to give the desired contact force.

Second, the number of spring portions included in a contact element can be selected to achieve the desired contact force, the desired current carrying capacity, and the desired contact resistance. For example, doubling the number of spring portions roughly doubles the contact force and current carrying capacity, while roughly decreasing the contact resistance by a factor of two.

Third, specific metal composition and treatment can be selected to obtain the desired elasticity and conductivity characteristics. For example, copper alloys, such as beryllium copper, can be used to provide a good tradeoff between mechanical elasticity and electrical conductivity. Alternately, metal multilayers can be used to provide both excellent mechanical and electrical properties. In one configuration, a contact element is formed using titanium (Ti) coated with copper (Cu), then with nickel (Ni), and finally with gold (Au) to form a Ti/Cu/Ni/Au multilayer. The Ti provides elasticity and high mechanical durability, the Cu provides conductivity, and the Ni and Au layers provide corrosion resistance. Finally, different metal deposition techniques, such as plating or sputtering, and different metal treatment techniques, such as alloying, annealing, and other metallurgical techniques can be used to engineer specific desired properties for the contact elements.

Fourth, the shape of the spring portion can be designed to give certain electrical and mechanical properties. The height of the spring portion, or the amount of projection from the base portion, can also be varied to give the desired electrical and mechanical properties. In other variations, the contact arms may be tapered along their length as viewed from the top or as viewed from the side.

Those skilled in the art will recognize that a connector according to the present invention could be used as an interposer, a PCB connector, or could be formed as a PCB. The scalability of the present invention is not limited, and can be easily customized for production due to the lithographic techniques used and the simple tooling die used for forming the connector elements in three dimensions.

The foregoing disclosure of configurations of the present invention has been presented for purposes of illustration and description. It is not intended to be exhaustive or to limit the invention to the precise forms disclosed. Many variations and modifications of the configurations described herein will be apparent to one of ordinary skill in the art in light of the above disclosure. For example, the use of the terms "top" and "bottom" in referring to elements of stack up 3000 is for the purposes of clarity. Configurations in which top and bottom elements are reversed are within the scope of the invention.

Additionally, configurations in which the layers of stack up 3000 are arranged as a horizontal stack are contemplated. The scope of the invention is to be defined only by the claims appended hereto, and by their equivalents.

Further, in describing representative configurations of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention. Amend

What is claimed is:

1. A system for batch forming three dimensional spring elements, comprising:

a two sided planar spring element sheet including two dimensional spring elements;

a female die press plate with indentations disposed on a first side of the spring element sheet; and a male die press plate with three dimensional protrusions disposed to engage a first side of the spring element sheet opposite the second side, the three dimensional protrusions contacting and forming the two dimensional spring elements into the three dimensional spring elements when the male die press plate and female die press plate are pressed against the spring element sheet.

2. The system of claim 1, the three dimensional protrusions forming in the spring element spring element sheet finished spring elements extending away from a first side of the spring element sheet.

3. The system of claim 1, the three dimensional protrusions forming in the spring element spring element sheet finished spring elements extending away from the second side of the spring element sheet.

4. The system of claim 1, further comprising an alignment system including at least one dowel pin located on the female die press plate and at least one alignment hole in the male die press plate and the spring element sheet.

5. The system of claim 1, further comprising an alignment system including at least one dowel pin located on the male die press plate and at least one alignment hole in the female die press plate and the spring element sheet.

6. The system of claim 1, the male die press plate comprising an elastic material having a predetermined thickness and being substantially conformable to the three dimensional indentations of the female die press plate.

7. The system of claim 6, the predetermined thickness being greater than a predetermined depth of the three dimensional indentations of the female die press plate.

8. The system of claim 1, the female die press plate comprising an elastic material having a predetermined thickness and being substantially conformable to the three dimensional protrusions on the male die press plate.

9. The system of claim 8, the predetermined thickness being lesser than a predetermined height of the three dimensional protrusions on the male die press plate.

10. The system of claim 1, further comprising a spring element sheet with less than all possible two-dimensional spring elements patterned on the spring element sheet.

11. A system for batch forming three dimensional spring elements, comprising:

a spring element sheet including two dimensional spring elements;

a female die press plate with indentations disposed on a first side of the spring element sheet; and a means for providing a male die press plate with three dimensional protrusions disposed on a second side of the spring element sheet opposite the first side, the three dimensional protrusions contacting and forming the two dimensional spring elements into the three dimensional spring elements when the male die press plate and female die press plate are pressed against the spring element sheet.

12. A manufacturing system for batch forming three dimensional spring elements, comprising:

a spring element sheet including two dimensional spring elements;

a top press plate;

a bottom die base; and three dimensional protrusions for contacting and forming the two dimensional spring elements into the three dimensional spring elements when selectively engaged by applying pressure to the top press plate.

13. The system of claim 12, further comprising a programming plate with holes selectively formed therein.

14. The system of claim 12, further comprising a spring pin holder with spring pins disposed within the holder and a spring pin retainer.

15. The system of claim 12, further comprising a die punch holder.

16. The system of claim 12, further comprising a stripper plate.

17. The system of claim 12, further comprising an ejector plate.

18. The system of claim 12, the three dimensional protrusions forming in the spring element spring element sheet finished spring elements extending below the planar surface portion of the spring element sheet.

19. The system of claim 12, the three dimensional protrusions forming in the spring element spring element sheet finished spring elements extending above a surface of the spring element sheet.

20. The system of claim 12, further comprising an alignment system including at least one dowel pin located on the die base and at least one alignment hole in the spring element sheet.

21. The system of claim 12, further comprising a programming plate with less than all possible holes drilled into the programming plate.

22. An apparatus for manufacturing a plurality of three dimensional spring contacts from a flat sheet, the apparatus comprising:

a first forming die having indentations a second forming die having protrusions, said first and second forming dies being positioned to define a aperture into which the flat planar sheet is inserted for forming and removed after three dimensional contacts are formed; and a member providing pressing of the dies against the flat sheet to provide the three dimensional shape of the plurality of spring contacts.

23. A manufacturing apparatus of the type described in claim 22 wherein the first forming die includes a set of projections and the second forming die includes a set of indentations which are positioned complimentary to the projections of the first forming die.

24. A system for batch forming three dimensional protrusions in spring elements, comprising:

a spring element sheet including two dimensional spring elements;

a top press plate;

a bottom die base; and die punch pins for contacting and forming the two dimensional spring elements into the three dimensional spring elements with three dimensional protrusions when selectively engaged by applying pressure to the top press plate, the protrusions forming finished spring elements including a portion extending below a planar surface of the spring element sheet.

25. A system for batch forming three dimensional protrusions in spring elements, comprising:

a spring element sheet including two dimensional spring elements;

a top press plate;

a bottom die base; and die punch pins for contacting and forming the two dimensional spring elements into the three dimensional spring elements with three dimensional protrusions when selectively engaged by applying pressure to the top press plate, the protrusions forming finished spring elements including a portion extending above a surface portion of the spring element sheet.

26. A system for batch forming three dimensional protrusions in spring elements, comprising:

a spring element sheet including two dimensional spring elements;

a top press plate and a bottom die base;

die punch pins for contacting and forming the two dimensional spring elements into the three dimensional spring elements with three dimensional protrusions when selectively engaged by applying pressure to the top press plate; and an alignment system including at least one pin located on the die base and at least one alignment hole in the spring element sheet positioned to receive the at least one pin located in the die base to positioning the die base with respect to the spring sheet.

* * * * *